US012426642B2

(12) United States Patent
Thomas et al.

(10) Patent No.: US 12,426,642 B2
(45) Date of Patent: Sep. 30, 2025

(54) SMOKING SUBSTITUTE DEVICES AND ASSOCIATED METHODS, SYSTEMS AND APPARATUSES

(71) Applicant: Imperial Tobacco Limited

(72) Inventors: David Thomas, Liverpool (GB); Oliver Talbot, Liverpool (GB); Daniel Fard, Liverpool (GB); Daniel Harden, San Jose, CA (US); Cole Derby, San Jose, CA (US); KaiKai Liu, Liverpool (GB)

(73) Assignee: Imperial Tobacco Limited, Bristol (GB)

( * ) Notice: Subject to any disclaimer, the term of this patent is extended or adjusted under 35 U.S.C. 154(b) by 743 days.

(21) Appl. No.: 17/733,582

(22) Filed: Apr. 29, 2022

(65) Prior Publication Data

US 2022/0256930 A1 Aug. 18, 2022

Related U.S. Application Data

(63) Continuation of application No. PCT/EP2020/081355, filed on Nov. 6, 2020.
(Continued)

(30) Foreign Application Priority Data

Dec. 20, 2019 (EP) ..... 19218476
Dec. 20, 2019 (EP) ..... 19218482
(Continued)

(51) Int. Cl.
*A24F 47/00* (2020.01)
*A24F 40/53* (2020.01)
*A24F 40/65* (2020.01)

(52) U.S. Cl.
CPC ..... *A24F 40/53* (2020.01); *A24F 40/65* (2020.01)

(58) Field of Classification Search
CPC ..... A24F 40/53; A24F 40/65; A24F 40/50
See application file for complete search history.

(56) References Cited

U.S. PATENT DOCUMENTS

2013/0319439 A1 12/2013 Gorelick et al.
2015/0181945 A1 7/2015 Tremblay
(Continued)

FOREIGN PATENT DOCUMENTS

CN 110 169 607 A 8/2019
EP 3 485 747 A1 5/2019
(Continued)

OTHER PUBLICATIONS

International Search Report and Written Opinion (PCT/EP2020/081355), dated Feb. 1, 2021, 17 pages.
(Continued)

*Primary Examiner* — Abdullah A Riyami
*Assistant Examiner* — Nelson R. Burgos-Guntin
(74) *Attorney, Agent, or Firm* — DUNLAP CODDING, P.C.

(57) ABSTRACT

A smoking substitute device is configured to record and store user data that is generated during operation of the device. Analyzing the user data can provide the user with useful information regarding their use of the smoking substitute device as well as useful information regarding the operational performance of the device. Typically, the analysis of the data would be conducted by a remote device and the smoking substitute device therefore includes a communication interface to connect and communicate with the remote device. The smoking substitute device and method of managing the smoking substitute device allows user data to be deleted from the device upon identification of a reset operation wherein the reset operation is able to be triggered from the connected remote device and/or the smoking
(Continued)

substitute device. Providing a function to delete user data upon identification of a reset operation provides the user with some control over their information.

13 Claims, 50 Drawing Sheets

Related U.S. Application Data

(60) Provisional application No. 62/932,810, filed on Nov. 8, 2019, provisional application No. 62/932,819, filed on Nov. 8, 2019, provisional application No. 62/932,800, filed on Nov. 8, 2019, provisional application No. 62/932,792, filed on Nov. 8, 2019, provisional application No. 62/932,869, filed on Nov. 8, 2019, provisional application No. 62/932,822, filed on Nov. 8, 2019, provisional application No. 62/932,863, filed on Nov. 8, 2019, provisional application No. 62/932,876, filed on Nov. 8, 2019, provisional application No. 62/932,815, filed on Nov. 8, 2019.

(30) Foreign Application Priority Data

| | | |
|---|---|---|
| Dec. 20, 2019 | (EP) | 19218494 |
| Dec. 20, 2019 | (EP) | 19218498 |
| Dec. 20, 2019 | (EP) | 19218507 |
| Dec. 20, 2019 | (EP) | 19218512 |
| Dec. 20, 2019 | (EP) | 19218521 |
| Dec. 20, 2019 | (EP) | 19218580 |
| Dec. 20, 2019 | (EP) | 19218589 |
| Dec. 20, 2019 | (EP) | 19218601 |

(56) References Cited

U.S. PATENT DOCUMENTS

| | | | | |
|---|---|---|---|---|
| 2015/0366268 | A1 | 12/2015 | Shabat | |
| 2016/0158782 | A1* | 6/2016 | Henry, Jr. | A24F 40/53 700/275 |
| 2016/0331034 | A1* | 11/2016 | Cameron | A61M 15/0003 |
| 2016/0331035 | A1* | 11/2016 | Cameron | H04M 1/21 |
| 2016/0346489 | A1 | 12/2016 | Finke et al. | |
| 2017/0231273 | A1 | 8/2017 | Xiang | |
| 2018/0020720 | A1 | 1/2018 | Matischek et al. | |
| 2018/0043114 | A1 | 2/2018 | Bowen et al. | |
| 2018/0160733 | A1* | 6/2018 | Leadley | A24F 40/50 |
| 2018/0181945 | A1* | 6/2018 | Patel | G06Q 20/327 |
| 2018/0263288 | A1* | 9/2018 | Goldstein | A61M 11/042 |
| 2018/0292846 | A1 | 10/2018 | Henry et al. | |
| 2019/0200677 | A1 | 7/2019 | Chong et al. | |
| 2019/0208822 | A1 | 7/2019 | Mullin | |
| 2019/0247606 | A1* | 8/2019 | Williams | A24F 40/485 |
| 2019/0261692 | A1 | 8/2019 | Henry, Jr. et al. | |
| 2019/0272359 | A1* | 9/2019 | Popplewell | G06F 21/32 |

FOREIGN PATENT DOCUMENTS

| | | | |
|---|---|---|---|
| WO | WO 2014/195805 | A2 | 12/2014 |
| WO | WO 2016/009202 | A1 | 1/2016 |
| WO | WO 2017/011419 | A1 | 1/2017 |
| WO | WO 2017/055795 | A1 | 4/2017 |
| WO | WO 2017/055799 | A1 | 4/2017 |
| WO | WO 2017/055801 | A1 | 4/2017 |
| WO | WO 2017/055803 | A1 | 4/2017 |
| WO | WO 2017/205838 | A1 | 11/2017 |
| WO | WO 2018/202651 | A1 | 11/2018 |
| WO | WO 2019/020151 | A1 | 1/2019 |
| WO | WO 2019/121778 | A1 | 6/2019 |
| WO | WO 2019/129866 | A1 | 7/2019 |
| WO | WO 2019/162153 | A1 | 8/2019 |
| WO | WO 2019/162157 | A1 | 8/2019 |
| WO | WO 2019/162159 | A1 | 8/2019 |
| WO | WO 2019/162160 | A1 | 8/2019 |
| WO | WO 2019/162161 | A1 | 8/2019 |

OTHER PUBLICATIONS

European Search Report, dated Jun. 26, 2020, 11 pages.
European Search Report, dated Jun. 15, 2020, 9 pages.
European Search Report, dated Jun. 4, 2020, 10 pages.
European Search Report, dated May 19, 2020, 7 pages.
European Search Report, dated Jun. 19, 2020, 9 pages.
European Search Report, dated Jun. 26, 2020, 10 pages.
European Search Report, dated Jun. 23, 2020, 8 pages.
European Search Report, dated May 26, 2020, 8 pages.
European Search Report, dated Jun. 15, 2020, 8 pages.
European Search Report, dated Jul. 16, 2020, 10 pages.

* cited by examiner

SMOKING SUBSTITUTE DEVICES AND ASSOCIATED METHODS, SYSTEMS AND APPARATUSES

This application is a non-provisional application claiming benefit to the international application no. PCT/EP2020/081355 filed on Nov. 6, 2020, which claims priority to U.S. Provisional No. 62/932,792 filed on Nov. 8, 2019, U.S. Provisional No. 62/932,800 filed on Nov. 8, 2019, U.S. Provisional No. 62/932,810 filed on Nov. 8, 2019, U.S. Provisional No. 62/932,815 filed on Nov. 8, 2019, U.S. Provisional No. 62/932,819 filed on Nov. 8, 2019, U.S. Provisional No. 62/932,863 filed on Nov. 8, 2019, U.S. Provisional No. 62/932,869 filed on Nov. 8, 2019, U.S. Provisional No. 62/932,821 filed on Nov. 8, 2019, U.S. Provisional No. 62/932,822 filed on Nov. 8, 2019, U.S. Provisional No. 62/932,876 filed on Nov. 8, 2019, EP 19218476.0 filed on Dec. 20, 2019, EP 19218482.8 filed on Dec. 20, 2019, EP 19218494.3 filed on Dec. 20, 2019, EP 19218498.4 filed on Dec. 20, 2019, EP 19218507.2 filed on Dec. 20, 2019, EP 19218512.2 filed on Dec. 20, 2019, EP 19218521.3 filed on Dec. 20, 2019, EP 19218580.9 filed on Dec. 20, 2019, EP 19218589.0 filed on Dec. 20, 2019, and EP 19218601.3 filed on Dec. 20, 2019. The entire contents of each of the above-referenced applications are hereby incorporated herein by reference in their entirety.

TECHNICAL FIELD

The present disclosure relates to a smoking substitute device and particularly, although not exclusively, to the management of user generated data when the smoking substitute device is connected to an external device.

The present disclosure also relates to a smoking substitute device and particularly, although not exclusively, to the management of firmware updates when the smoking substitute device is connected to an external device.

The present disclosure also relates to a smoking substitute device and particularly, although not exclusively, to the management of functionality on the smoking substitute device.

The present disclosure also relates to a smoking substitute device and particularly, although not exclusively, to connectivity of a smoking substitute device to an external device.

The present disclosure further relates to a smoking substitute device and particularly, although not exclusively, to the management of the smoking substitute device to assist a user in locating the device.

The present disclosure further relates to a smoking substitute device and particularly, although not exclusively, to the management of the smoking substitute device when wirelessly connected to an external device.

The present disclosure further relates to a smoking substitute device and particularly, although not exclusively, to providing notifications on a smoking substitute device and a connected mobile device.

The present disclosure further relates to a smoking substitute device and particularly, although not exclusively, to a smoking substitute device and a method of communicating usage of a smoking substitute device to a user.

The present disclosure further relates to a smoking substitute device and particularly, although not exclusively, to a smoking substitute device, a smoking substitute system and a method of syncing at least two smoking substitute devices.

The present disclosure further relates to a smoking substitute device and particularly, although not exclusively, to a smoking substitute device, system and method of communicating.

BACKGROUND

The smoking of tobacco is generally considered to expose a smoker to potentially harmful substances. It is generally thought that a significant amount of the potentially harmful substances are generated through the heat caused by the burning and/or combustion of the tobacco and the constituents of the burnt tobacco in the tobacco smoke itself.

Conventional combustible smoking articles, such as cigarettes, typically comprise a cylindrical rod of tobacco comprising shreds of tobacco which is surrounded by a wrapper, and usually also a cylindrical filter axially aligned in an abutting relationship with the wrapped tobacco rod. The filter typically comprises a filtration material which is circumscribed by a plug wrap. The wrapped tobacco rod and the filter are joined together by a wrapped band of tipping paper that circumscribes the entire length of the filter and an adjacent portion of the wrapped tobacco rod. A conventional cigarette of this type is used by lighting the end opposite to the filter, and burning the tobacco rod. The smoker receives mainstream smoke into their mouth by drawing on the mouth end or filter end of the cigarette.

Combustion of organic material such as tobacco is known to produce tar and other potentially harmful by-products. There have been proposed various smoking substitute devices in order to avoid the smoking of tobacco.

Such smoking substitute devices can form part of nicotine replacement therapies aimed at people who wish to stop smoking and overcome a dependence on nicotine.

Smoking substitute devices may comprise electronic systems that permit a user to simulate the act of smoking by producing an aerosol (also referred to as a "vapor") that is drawn into the lungs through the mouth (inhaled) and then exhaled. The inhaled aerosol typically bears nicotine and/or flavorings without, or with fewer of, the odor and health risks associated with traditional smoking.

In general, smoking substitute devices are intended to provide a substitute for the rituals of smoking, whilst providing the user with a similar experience and satisfaction to those experienced with traditional smoking and tobacco products. Some smoking substitute systems use smoking substitute articles (also referred to as a "consumables") that are designed to resemble a traditional cigarette and are cylindrical in form with a mouthpiece at one end.

The popularity and use of smoking substitute devices has grown rapidly in the past few years. Although originally marketed as an aid to assist habitual smokers wishing to quit tobacco smoking, consumers are increasingly viewing smoking substitute devices as desirable lifestyle accessories. Some smoking substitute devices are designed to resemble a traditional cigarette and are cylindrical in form with a mouthpiece at one end. Other smoking substitute devices do not generally resemble a cigarette (for example, the smoking substitute device may have a generally box-like form).

There are a number of different categories of smoking substitute devices, each utilizing a different smoking substitute approach. A smoking substitute approach corresponds to the manner in which the substitute system operates for a user.

One approach for a smoking substitute device is the so-called "vaping" approach, in which a vaporizable liquid, typically referred to (and referred to herein) as "e-liquid", is heated by a heating device to produce an aerosol vapor which is inhaled by a user. An e-liquid typically includes a base liquid as well as nicotine and/or flavorings. The resulting vapor therefore typically contains nicotine and/or flavorings. The base liquid may include propylene glycol and/or vegetable glycerin.

A typical vaping smoking substitute device includes a mouthpiece, a power source (typically a battery), a tank for containing e-liquid, as well as a heating device. In use, electrical energy is supplied from the power source to the heating device, which heats the e-liquid to produce an aerosol (or "vapor") which is inhaled by a user through the mouthpiece.

Vaping smoking substitute devices can be configured in a variety of ways. For example, there are "closed system" vaping smoking substitute devices which typically have a sealed tank and heating element which is pre-filled with e-liquid and is not intended to be refilled by an end user. One subset of closed system vaping smoking substitute devices include a main body which includes the power source, wherein the main body is configured to be physically and electrically coupled to a consumable including the tank and the heating element. In this way, when the tank of a consumable has been emptied, the main body can be reused by connecting it to a new consumable. Another subset of closed system vaping smoking substitute devices are completely disposable, and intended for one-use only.

There are also "open system" vaping smoking substitute devices which typically have a tank that is configured to be refilled by a user, so the device can be used multiple times.

An example vaping smoking substitute device is the Myblu™ e-cigarette. The Myblu™ e-cigarette is a closed system device which includes a main body and a consumable. The main body and consumable are physically and electrically coupled together by pushing the consumable into the main body. The main body includes a rechargeable battery. The consumable includes a mouthpiece, a sealed tank which contains e-liquid, as well as a heating device, which for this device is a heating filament coiled around a portion of a wick which is partially immersed in the e-liquid. The device is activated when a microprocessor on board the main body detects a user inhaling through the mouthpiece. When the device is activated, electrical energy is supplied from the power source to the heating device, which heats e-liquid from the tank to produce a vapor which is inhaled by a user through the mouthpiece.

Another example vaping smoking substitute device is the blu PRO™ e-cigarette. The blu PRO™ e-cigarette is an open system device which includes a main body, a (refillable) tank, and a mouthpiece. The main body and tank are physically and electrically coupled together by screwing one to the other. The mouthpiece and refillable tank are physically coupled together by screwing one of the other, and detaching the mouthpiece from the refillable tank allows the tank to be refilled with e-liquid. The device is activated by a button on the main body. When the device is activated, electrical energy is supplied from the power source to a heating device, which heats e-liquid from the tank to produce a vapor which is inhaled by a user through the mouthpiece.

Another approach for a smoking substitute system is the so-called Heated Tobacco ("HT") approach in which tobacco (rather than an "e-liquid") is heated or warmed to release vapor. HT is also known as "heat not burn" ("HNB"). The tobacco may be leaf tobacco or reconstituted tobacco. The vapor may contain nicotine and/or flavorings. In the HT approach the intention is that the tobacco is heated but not burned, i.e., the tobacco does not undergo combustion.

A typical HT smoking substitute system may include a device and a consumable. The consumable may include the tobacco material. The device and consumable may be configured to be physically coupled together. In use, heat may be imparted to the tobacco material by a heating element of the device, wherein airflow through the tobacco material causes components in the tobacco material to be released as vapor. A vapor may also be formed from a carrier in the tobacco material (this carrier may for example include propylene glycol and/or vegetable glycerin) and additionally volatile compounds released from the tobacco. The released vapor may be entrained in the airflow drawn through the tobacco.

As the vapor passes through the consumable (entrained in the airflow) from the location of vaporization to an outlet of the consumable (e.g., a mouthpiece), the vapor cools and condenses to form an aerosol for inhalation by the user. The aerosol will normally contain the volatile compounds.

In HT smoking substitute systems, heating as opposed to burning the tobacco material is believed to cause fewer, or smaller quantities, of the more harmful compounds ordinarily produced during smoking. Consequently, the HT approach may reduce the odor and/or health risks that can arise through the burning, combustion and pyrolytic degradation of tobacco.

There may be a need for improved design of smoking substitute systems, in particular HT smoking substitute systems, to enhance the user experience and improve the function of the HT smoking substitute system.

An example of the HT approach is the IQOS™ smoking substitute device from Philip Morris Ltd. The IQOS™ smoking substitute device uses a consumable, including reconstituted tobacco located in a wrapper. The consumable includes a holder incorporating a mouthpiece. The consumable may be inserted into a main body that includes a heating device. The heating device has a thermally conductive heating knife which penetrates the reconstituted tobacco of the consumable, when the consumable is inserted into the heating device. Activation of the heating device heats the heating element (in this case a heating knife), which, in turn, heats the tobacco in the consumable. The heating of the tobacco causes it to release nicotine vapor and flavorings which may be drawn through the mouthpiece by the user through inhalation.

A second example of the HT approach is the device known as "Glo"™ from British American Tobacco p.l.c. Glo™ comprises a relatively thin consumable. The consumable includes leaf tobacco which is heated by a heating device located in a main body. When the consumable is placed in the main body, the tobacco is surrounded by a heating element of the heating device. Activation of the heating device heats the heating element, which, in turn, heats the tobacco in the consumable. The heating of the tobacco causes it to release nicotine vapor and flavorings which may be drawn through the consumable by the user through inhalation. The tobacco, when heated by the heating device, is configured to produce vapor when heated rather than when burned (as in a smoking apparatus, e.g., a cigarette). The tobacco may contain high levels of aerosol formers (carrier), such as vegetable glycerin ("VG") or propylene glycol ("PG").

The present inventor(s) have observed that most smoking substitute devices currently on the market are configured to operate in isolation of other devices, which limits the functions the smoking substitute devices can perform.

If the smoking substitute device does not operate in isolation to other devices, it would be advantageous to provide the user with control over user generated data whilst maintaining the advantageous features associated with recording and logging the user generated data.

If the smoking substitute device does not operate in isolation to other devices, it would be advantageous to allow the device's firmware to be optionally updated to ensure safety or otherwise critical firmware updates are completed.

If the smoking substitute device does not operate in isolation to other devices, it would be advantageous to provide a manufacturer of the device the ability to produce a single device that is useable in multiple locations that may have different regulations, rules or preferences for the operating functionality of the smoking substitute device.

If the smoking substitute device does not operate in isolation to other devices, it may be possible to link the other device to the smoking substitute device by a wireless communication and use the other device to trigger an alert signal to assist a user in locating the smoking substitute device. Here, it would be advantageous to provide an effective user convenience when deactivating the alert signal.

If the smoking substitute device does not operate in isolation to other devices, it would be advantageous to provide the user with the ability to manage the smoking substitute device's wireless connection with effective user convenience.

The present inventor(s) have observed that smoking substitute devices currently on the market are not adapted to signal the extent of the use of the smoking substitute device to a user. In particular, current smoking substitute devices may not signal the time of non-use to a user.

Additionally, the present inventor(s) have observed that when most smoking substitute devices currently on the market are configured to operate in isolation of other devices, a plurality of smoking substitute devices arranged in the vicinity of one another, e.g., used by a plurality of users in the vicinity of one another act independently. Such independent operation while arranged in the vicinity of one another may make it difficult to properly operate one's own device, due to conflicting information being received from the plurality of devices.

The present inventor(s) have also observed that when operating in conjunction with a mobile device, a transmission of data between the smoking substitute device and the mobile device for processing by the mobile device and/or a backend application server may consider the type of data to determine a suitable type of data transmission and may adapt the transmission of data appropriately.

The present disclosure has been devised in light of the above considerations.

SUMMARY OF THE DISCLOSURE

The following description is divided into multiple modes. A person having ordinary skill in the art would appreciate that the statements and features described in each of these modes may be combined together in any combination, except where such a combination is clearly impermissible or expressly avoided.

First Mode: A Smoking Substitute Device and Management of User Generated Data when the Smoking Substitute Device is Connected to an External Device.

According to exemplary aspects of the first mode, a smoking substitute device is configured to record and store user data that is generated during operation of the device. Advantageously, analyzing the user data can provide the user with useful information regarding their use of the smoking substitute device as well as useful information regarding the operational performance of the device. Typically, the analysis of the data would be conducted by a remote device and the smoking substitute device therefore includes a communication interface to connect and communicate with the remote device.

At their most general, the exemplary aspects of the first mode provide a smoking substitute device and method of managing the smoking substitute device wherein user data can be deleted from the device upon identification of a reset operation wherein the reset operation is able to be triggered from the connected remote device and/or the smoking substitute device. Advantageously, providing a function to delete user data upon identification of a reset operation allows a user to delete information from the device and provides the user with some control over their information.

There is therefore provided, according to a first exemplary aspect of the first mode, a smoking substitute device having; a memory, a communication interface, a control unit, and at least one additional component. In the exemplary aspects, the memory, control unit, and additional component are suitably housed in a body.

The memory stores firmware data. Firmware data is stored in the memory and used by the control unit to operate the smoking substitute device. Typically, the firmware data is permanently stored in the memory or semi permanently stored in the memory to allow firmware updates. However, upon identification of the reset operation, the control unit may not be caused to delete all the firmware data. Thus, the smoking substitute device is reset to an operating condition.

The memory may also store user data. The user data is generated during operation of the smoking substitute device. For instance, the user data may log and or record details of the battery voltage, inhale count, inhale duration, coil resistance, pressure, temperature, charging source and status, error count number of charges or any other information useful to the operation or performance of the smoking substitute device. Here the body may house a battery and the additional component may include circuitry for controlling and managing the battery and battery recharging. Further, the body may include a coupling portion arranged to receive a consumable. Here the consumable may include a heating device such as a coil and may include machine readable information regarding the type or other details of the consumable. Further, the body may house an airflow sensor for detecting airflow through the body, wherein the airflow sensor can be monitored to determine an inhale or puff occurrence as well as data concerning the inhale duration and inhale pressure and additional or alternative inhale parameters.

The communication interface is configured to transmit user data stored in the memory to an external device. Typically, the transmission is completed under the control of the control unit. Suitably, the external device may be a smartphone, tablet, smartwatch or other suitable device. The control unit may complete a pairing operation to pair the smoking substitute device and external device or to otherwise verify the external device as a trusted external device that is able to receive user data from the smoking substitute device. In exemplary embodiments, data relating to the paired or verified external device is stored as user data that is deleted upon identification of a reset operation The control unit controls the operation of the smoking substitute device using the firmware. The control unit also controls the storage of user data in the memory and the communication interface to communicate said data with the external device. Furthermore, the control unit is configured to delete user data from the memory upon identification of a reset operation. Deletion of the user data may be triggered by the control unit identifying a reset operation as a manipulation of the additional component. Additionally of alternatively, deletion of the user data may be triggered by the control unit identifying receipt by the communication interface of a reset command transmitted from the external device.

Suitably, the additional component may be an actuator that the user may activate from the exterior of the housing. Here, the reset operation is a manipulation of the actuator, for instance, in one exemplary embodiment, the actuator is a button and the manipulation is a press of the button. Additionally, or alternatively, the additional component maybe a motion sensor such as an accelerometer and the reset operation is a manipulation of the smoking substitute device to replicate a predetermined signal pattern from the accelerometer. For instance, the reset operation may be a set number and frequency of taps of the smoking substitute device. Advantageously, the additional component may be a component with a further operational purpose to the smoking substitute device and the reset operation therefore utilizes a specific manipulation of the additional component in order to differentiate the reset command from the other operational command. For instance, a short push of the button may be used to identify one operational command and a long push of the button may be predetermined as the manipulation required to trigger the control unit to identify the reset operation.

The external device suitably operates an application to control the communication with the smoking substitute device and to display the information to the user. The application suitably provides an input means through the application's graphic user interface to initiate the sending of a reset command to the connected smoking substitute device.

In one exemplary embodiment of the first mode, the control unit identifies and stores user data as either user specific data or global device data and upon identification of the reset operation, the control unit deletes user specific data only. Thus, some user data remains permanently stored in the memory.

Here, the retained global device data may be data on the operation of the smoking substitute device restricted to the lifetime operation of the smoking substitute device, e.g., data on (i.e., pertaining to) the operation of the smoking substitute device collected over the lifetime of the smoking substitute device. Global device data may therefore include data collected before a most recent reset operation as well as data collected since a most recent reset event. In contrast, the user specific data is limited to data on the operation of the device since the last reset operation or alternative event.

An example of global device data may be a "puff count" (which may alternatively be expressed as "activation count") which indicates the number of times the smoking substitute device has been activated to produce vapor over the lifetime of the device. Such data may be retained, even if a reset operation is performed.

Preferably, the global device data is non-user specific, i.e., does not (on its own) indicate the identity of the user.

The smoking device may be configured to enable/disable the ability of the smoking substitute device to produce vapor, based on the global device data. For example, the smoking substitute device may be configured to disable the smoking substitute device if the puff count exceeds a predetermined number, unless/until an age verification test has been passed by a user of the smoking substitute device (to indicate the user's age meets an age requirement necessary for the user to be permitted to use the smoking substitute device). In this way, a user cannot bypass a disabling of the device based on the global device data merely by performing a reset operation, but the user still has the ability to remove user-specific data from the device. The age verification test may be performed using the smoking substitute device, or using another device (e.g., a mobile device) in communication with the smoking substitute device.

An example of user specific data may be user-specific configuration preferences for the device, or data identifying the user of the device. Such data may be deleted if a reset operation is performed.

There is provided, according to a further exemplary aspect of the first mode, a method of managing a smoking substitute device wherein the method comprises the step of storing user data generated during operation of the smoking substitute device in a memory that also stores firmware. The method includes a step, subsequent to storing the user data, of causing a communication interface to transmit user data stored in the memory to an external device. The method step includes a step, subsequent to storing the user data, of deleting user data from the memory upon identification by a control unit of a reset operation. Here, the method comprises a user manipulating an additional component housed in a body of the smoking substitute device to trigger the reset operation. Additionally, or alternatively, the method comprises a user inputting a reset command into the external device and causing the communication interface to receive the reset command from the external device to trigger the reset operation.

In one exemplary embodiment, the method comprises identifying user data as either user specific data or global device data and upon identification of the reset operation the control unit deletes user specific data only. Thus, some user data remains permanently stored in the memory. Here the retained global device data may be data on the operation of the smoking substitute device restricted to the lifetime operation of the smoking substitute device, e.g., data on (i.e., pertaining to) the operation of the smoking substitute device collected over the lifetime of the smoking substitute device. Global device data may therefore include data collected before a most recent reset operation as well as data collected since a most recent reset event. In contrast, the user specific data is limited to data on the operation of the device since the last reset operation or alternative event.

According to further exemplary aspects of the first mode there is provided a system including a smoking substitute device according to previous aspects and an external device connectable to the smoking substitute device. Yet further, according to another exemplary aspect, there is provided a computer implement method for managing a smoking substitute device to execute the previous method aspect or a computer-readable medium containing computer-readable instructions which, when executed by a processor, cause the processor to perform the precious method aspect.

The disclosure includes the combination of the aspects and preferred features of the first mode described except where such a combination is clearly impermissible or expressly avoided.

The skilled person will appreciate that except where mutually exclusive, a feature or parameter described in relation to any one of the above aspects of the first mode may be applied to any other aspect of the first mode. Furthermore, except where mutually exclusive, any feature or parameter described herein may be applied to any aspect and/or combined with any other feature or parameter described herein.

Second Mode: A Smoking Substitute Device and Management of Firmware Updates when the Smoking Substitute Device is Connected to an External Device.

According to exemplary aspects of the second mode, a smoking substitute device is configured to be disabled until an updated firmware is installed on the device. Advantageously, by disabling the smoking substitute device, it can be ensured that the device is not used without a safety or otherwise critical firmware update being installed.

At their most general, the exemplary aspects of the second mode provide a smoking substitute device, a system including the smoking substitute device and a method of managing the smoking substitute device wherein once a disable command is received by the device, an aerosol component assembly is disabled and the aerosol component assembly remains disabled until an updated firmware is installed on the device. In the exemplary aspects of the system, the smoking substitute device is connected to an external device that receives the updated firmware and upon receiving the updated firmware, the external device transmits to the smoking substitute device the disable command before transmitting the updated firmware. Thus, the smoking substitute device receives the updated firmware. Typically, the process will be controlled via an application running on the external device and the application may provide the user control over when the firmware update is installed. Advantageously, by first transmitting a disable command, the smoking substitute device can be prevented from being used to produce an aerosol until the safety or otherwise critical firmware update is complete.

There is, therefore, provided according to a first exemplary aspect of the second mode, a smoking substitute device comprising a memory component, a communication interface component, a control unit component, and an aerosol assembly component.

In exemplary embodiments, the memory component, communication component, control unit component and aerosol assembly component are suitably housed in a body. Yet further, in exemplary embodiments, typically a power source is provided to power the components. Suitably, the power source may be a battery and preferably a rechargeable battery. Moreover, preferably the power source is housed in the body.

In the exemplary embodiments, the memory component stores firmware. Firmware is data that is used to control operation of the smoking substitute device. For instance, the control unit component uses the firmware to dictate how the components are controlled. Firmware updates can be installed by storing updated firmware data in the memory or by overwriting all or parts of previously installed firmware. Once installed, the controller uses the updated firmware to guide control of the components. It will be appreciated that a developer can release updated firmware to fix operational bugs or errors or to provide new or enhanced operational features through the software changes. Here, a receiving device receives the updated firmware from a remote server. In one exemplary embodiment, the receiving device is configured to automatically transmit a disable command on receiving the firmware update. Alternatively, the receiving device may be configured to read a header or the like of the updated firmware for the presence or absence of a critical tag identifier, wherein the disable command is not sent if the updated firmware is identified as non-critical. Advantageously, by providing the developer the choice to assign a critical tag to the updated firmware such that critical updates are forced on the smoking substitute device, for non-critical updates the firmware developer can opt to assign a non-critical tag to the update such that the external device is not controlled to send the disable command such that the smoking substitute device remains operational even if the updated firmware is not installed.

The communication interface component is configured to receive data and commands from an external device. Suitably, the external device may be a smartphone, tablet, smartwatch or other suitable device. The control unit may complete a pairing operation to pair the smoking substitute device and external device or to otherwise verify the external device as a trusted external device that the smoking substitute device is authorized to receive transmissions from. In exemplary embodiments, the external device receives firmware updates from a remote server. Upon receiving a firmware update the external device is configured to transmit a disable command to the communication interface component of the smoking substitute device. Here, after transmitting the disable command, the external device transmits the updated firmware to the communication interface component of the smoking substitute device. In some exemplary embodiments, after transmitting the disable command, the external device may require a user input before transmitting the updated firmware. Typically, the external device suitably operates an application to control the communication with the smoking substitute device and to display the information to the user.

The control unit component executes the firmware stored in the memory to control the memory and communication interface. For instance, the control unit component controls the storage of the updated firmware data in the memory and the receipt by the communication interface component of transmissions from the external device. Upon receiving a disable command via the communication interface component, the control unit is configured to disable operation of the aerosol assembly component such that the smoking substitute device does not produce an aerosol even when manipulated to do so by a user.

The power source, for instance a battery, provides power to the components of the smoking substitute device. Suitably the battery and components are housed in a body of the smoking substitute device.

In the exemplary embodiments of the second mode, the aerosol assembly component is operable to produce an aerosol. Suitably, the control unit may prevent power from being supplied to the aerosol assembly component to disable the operation thereof. For instance, by preventing or controlling the power source from supplying power to the aerosol assembly component. In one exemplary embodiment, the aerosol assembly component includes a heating unit and the assembly is disabled by preventing power from being supplied to the heating unit. In an alternative or complimentary exemplary embodiment, the aerosol assembly component includes a heating unit and a heating unit activator, wherein the heating unit is activated to heat a consumable via the heating unit activator. Here the control unit can disable the aerosol assembly component by preventing power from being supplied to the heating unit activator. A suitable heating unit activator may be a switch that is manually activated or alternatively an airflow sensor that detects airflow through the body and is activated by inhaling from the smoking substitute device.

In a further exemplary embodiment of the second mode, the aerosol assembly component comprises a coupling portion arranged to receive a consumable and an electrical interface for electrically coupling the consumable to the coupling portion. Suitably, the coupling portion may be a portion of a body housing the components. Here, the control unit component disables the aerosol assembly component by preventing power from being supplied to the electrical interface.

Preferably, in the exemplary embodiments of the second mode, the communication interface component is a wireless communication interface. Here the connection between the smoking substitute device and the external device is a wireless connection and the updated firmware is an Over-the-Air update. Typically, the updated firmware is transmitted from a remote server to the smoking substitute device via an intermediary external device. However, it will be appreciated that the smoking substitute device could be adapted to receive the updated firmware directly from the remote server. Here, the remote server would act as the remote device and first transmit the disable command. Alternatively, the smoking substitute device may receive the updated firmware direct from the remote network. Here the smoking substitute device generates the disable command on receiving the updated firmware and the control unit disables the aerosol assembly component as part of generating the disable command. Where an intermediary device is used, the exemplary embodiments include re-attempting to send the disable command should the wireless communication with the smoking substitute device not be connected. For instance, upon reconnection of the wireless communication, the disable command is re-transmitted to the wireless interface of the smoking substitute device.

There is therefore provided, according to a further exemplary aspect of the second mode, a system including the smoking substitute device of the above exemplary embodiments and an external device. Typically, the external device runs an application to control the interface between the user and the smoking substitute device. The external device receives updated firmware from a remote server. After receiving the updated firmware, the external device transmits a disable signal to the smoking substitute device. After transmitting the disable signal, the external device transmits the updated firmware to the smoking substitute device. In one exemplary embodiment, after transmitting the disable signal, a user input is required before the external device transmits the updated firmware. In a further exemplary embodiment, the external device reads a critical tag from an updated firmware and does not transmit the disable command if the critical tag is not present. This allows a developer to issue non critical firmware updates that a user can opt to install without the smoking substitute device being disabled prior to the updated firmware installation.

According to a further exemplary aspect of the second mode there is therefore provided a method of managing a smoking substitute device according to the above aspects. The method comprises the step of receiving a disable command via a communication interface component of the smoking substitute device. After receiving the disable command, the method comprises the step of disabling the aerosol assembly component. The method further comprises the step of re-enabling the aerosol assembly component only after the updated firmware has been installed on the smoking substitute device. Here, suitably, the control unit running the updated firmware from the memory is configured to re-enable the aerosol assembly component. According to exemplary embodiments the method includes managing a system further including an external device. Here the method includes the steps of receiving an updated firmware from a remote server. On receiving the updated firmware, the method comprises the step of transmitting a disable command to a communication interface component of the smoking substitute device.

In one exemplary embodiment the updated firmware may include a critical tag and the external device may read the critical tag and send a disable command upon determining that the updated firmware includes a critical tag.

According to further exemplary aspects of the second mode there is provided a computer implemented method for managing a smoking substitute device to execute the previous method aspect or a computer-readable medium containing computer-readable instructions which, when executed by a processor, cause the processor to perform the precious method aspect.

The disclosure includes the combination of the aspects and preferred features of the second mode described except where such a combination is clearly impermissible or expressly avoided.

The skilled person will appreciate that except where mutually exclusive, a feature or parameter described in relation to any one of the above aspects of the second mode may be applied to any other aspect. Furthermore, except where mutually exclusive, any feature or parameter described herein may be applied to any aspect and/or combined with any other feature or parameter described herein.

Third Mode: A Smoking Substitute Device and Management of Firmware Updates when the Smoking Substitute Device is Connected to an External Device.

According to exemplary aspects of the third mode, a smoking substitute device is configured to switch between a first operating mode and a second operating mode based on a location of the smoking substitute device. Here, a first function of the smoking substitute device is enabled and disabled when switching between the first mode and the second mode. Advantageously, by enabling and disabling a function of the smoking substitute device based on a location of the smoking substitute device, the same device can be controlled to operate according to varying rules or regulations in both a first location and a second location.

At their most general, the exemplary aspects of the third mode provide a smoking substitute device wherein a locator device determines a location of the smoking substitute device and a control unit is configured to operate the smoking substitute device in the first mode or the second mode based on an identified location. For instance, if the location is determined to be a first jurisdiction, the smoking substitute device is controlled to be operable in a first mode according to the requirements of the first jurisdiction. If the smoking substitute device subsequently moves to a second location and the second location is determined to be a second jurisdiction, the smoking substitute device is configured to automatically switch to the second mode to comply with a change in the requirements between the first jurisdiction and the second jurisdiction. That is, at least a first function is enabled or disabled as the smoking substitute device moves between a first location and a second location. Consequently, the same smoking substitute device can be automatically configured to operate with a functionality complying with the specific jurisdiction. For instance, in the second jurisdiction use of the smoking substitute device to create an aerosol may not be allowed, or the lower age limit for using the smoking substitute device in the second jurisdiction may be higher than the first jurisdiction, or the second jurisdiction may not authorise the use of a certain type of consumable, or the second jurisdiction may prevent the collection of user data, or the second jurisdiction may not authorise another functionality of the smoking substitute device.

There is therefore provided, according to a first exemplary aspect of the third mode, a smoking substitute device including a control unit and a locator device.

In the exemplary embodiments, the control unit controls the smoking substitute device to operate in a first mode and a second mode. In the first mode, the control unit controls the smoking substitute device to be operable with a first function enabled. In the second mode, the control unit controls the smoking substitute device to be operable with the first function disabled.

In the exemplary embodiments, the locator device determines the location of the smoking substitute device. Suitably the locator device includes a locator. The locator is configured to determine a location of the locator as is known in the art. The locator device may comprise a lookup unit. Here, the lookup unit queries a database to determine which mode the determined location supports. For instance, based on the location of the smoking substitute device whether the device should be controlled to operate in the first mode or the second mode. Advantageously, by looking up the functionality in a database allows the database to be updated to reflect changes in rules or regulations. The locator device's function may be entirely completed by components of the smoking substitute device. Alternatively, some or all of the locator device's function may be completed by components which are not part of the smoking substitute device, for instance by components of a connected external device. In the example wherein the locator and lookup unit are comprised externally to the smoking substitute device, the locator device of the smoking substitute device may comprise the control unit using information received from the external device to determine which mode to operate in. Thus in its most general form, the locator device has a function of determining whether the control unit should operate in a first mode or a second mode based on a determined location of the smoking substitute device.

In one exemplary embodiment, the smoking substitute device includes a wireless communication interface configured to transmit and receive data and commands from an external device. Suitably, the external device may be a smartphone, tablet, smartwatch or other suitable device. The control unit may complete a pairing operation to pair the smoking substitute device and external device or to otherwise verify the external device as a trusted external device that the smoking substitute device is authorised to receive transmissions from. Typically, the external device suitably operates an application to control the communication with the smoking substitute device and to display the information to the user.

It will be appreciated that in the exemplary embodiments, the wireless communication interface is configured to wirelessly communicate with an external device. Specifically, the wireless communication interface is arranged to establish a wireless communication link with the external device. In one exemplary embodiment, the locator device comprises a part of the external device. Here, the locator device determines the location of the external device as is known in the art, and the location of the smoking substitute device is determined to be the location of the external device. Suitably, the wireless communication link is therefore a short distance wireless link such that the smoking substitute device is constrained to be nearby to share a location with the external device. In exemplary embodiments, the external device includes a lookup unit and the lookup unit determines whether the determined location supports the first mode of operation or the second mode of operation. For instance, the lookup unit queries a database based on the determined location and reads a mode associated with the location. Here, suitably, the lookup unit is configured to send a mode command over the wireless link. On receiving the mode command at the wireless communication interface the control unit determines a mode to operate in based on the mode command and, where necessary, switches the smoking substitute device to operate in the respective mode.

In the exemplary embodiment, the smoking substitute device may periodically poll the external device for a mode command. Alternatively, the application may cause the lookup unit to query the database each time a location changes and pushes a mode command to the smoking substitute device when it is determined the location has moved to a jurisdiction supporting a different mode.

In one exemplary embodiment, the smoking substitute device is configured to enable and disable operation of the smoking substitute device to create an aerosol. Thus, the manufacturer of a smoking substitute device can control the device to automatically switch to a disabled mode when it is detected that the user has moved within a second jurisdiction where producing or inhaling an aerosol is not permitted, for instance to comply with a regulation of the second jurisdiction such as a state or country or to enforce a ban in a certain location, for instance around a specific geographical location such as a specific building (such as a school) or the like. In the exemplary embodiments wherein the first function that is enabled and disabled is an operating function of the smoking substitute device, suitably the smoking substitute device comprises an aerosol assembly for producing an aerosol and the function is an operating function of the aerosol assembly. Here, in the first mode, the aerosol assembly is enabled such that when a user completes a puff operation, the aerosol assembly produces an aerosol. When in the second mode, the aerosol assembly is disabled such that it is prevented from creating an aerosol, for instance, even if a user completes a puff operation.

In a further exemplary embodiment, the smoking substitute device is configured to enable and disable the use of a specific type of consumable. For instance, the first jurisdiction may allow the use of the smoking substitute device with both a first type and a second type of consumable whereas the second jurisdiction may only allow use of the smoking substitute device with the first type of consumable. For instance, the second consumable may be a flavored consumable or may comprise a consumable with a higher nicotine level. Here, the substitute device includes a coupling portion and a consumable. For instance, the smoking substitute device comprises a body having the coupling portion and the consumable is able to be coupled thereto. The body further houses a reading device to read a detail of the consumable and to determine whether the consumable is a first type or a second type and to enable or disable an aerosol assembly according to an operation mode determined from the location of the smoking substitute device.

Preferably, the smoking substitute device includes a power source. The power source, for instance a battery, provides power to the components of the smoking substitute device. Suitably the battery and components are housed in a body of the smoking substitute device.

In the exemplary embodiments, the aerosol assembly is operable to produce an aerosol. Suitably, the control unit may prevent power from being supplied to the aerosol assembly component to disable the operation thereof. For instance, by preventing or controlling the power source from supplying power to the aerosol assembly. In one exemplary embodiment, the aerosol assembly includes a heating unit and the assembly is disabled by preventing power from being supplied to the heating unit. In an alternative or complimentary exemplary embodiment, the aerosol assembly includes a heating unit and a heating unit activator, wherein the heating unit is activated to heat a consumable via the heating unit activator. Here the control unit can disable the aerosol assembly component by preventing power from being supplied to the heating unit activator. A suitable heating unit activator may be a switch that is manually activated or alternatively an airflow sensor that detects airflow through the body and is activated by inhaling from the smoking substitute device. In a further exemplary embodiment wherein the aerosol assembly comprises a coupling portion, there may be provided an electrical interface for electrically coupling the consumable to the coupling portion. Here, the control unit disables the aerosol assembly by preventing power from being supplied to the electrical interface.

In a further exemplary embodiment, the smoking substitute device is configured to enable and disable operation of the smoking substitute device to create an aerosol and in accordance with other embodiments, wherein the first mode and second mode enable and disable the aerosol assembly also based on an age verification process. For instance, where a second region has a lower age at which a user can use the smoking substitute device as compared to the first region, the smoking substitute device is configured to be operable in the first region if the user is verified as being older than the age limit but to automatically disable operation when the smoking device is moved to the second region and the user is not also older than the second, higher age limit.

In a further exemplary embodiment, the smoking substitute device is configured to enable and disable the storage of user data. For instance, in a first mode, during operation of the smoking substitute device, the control unit is configured to store user data in a memory. The user data is generated during operation of the smoking substitute device. For instance, the user data may log and or record details of the battery voltage, inhale count, inhale duration, coil resistance, pressure, temperature, charging source and status, error count number of charges or any other information useful to the operation or performance of the smoking substitute device. Here a body may house a battery and an additional component may include circuitry for controlling and managing the battery and battery recharging. Further, the body may include a coupling portion arranged to receive a consumable. Here the consumable may include a heating device such as a coil and may include machine readable information regarding the type or other details of the consumable. Further, the body may house an airflow sensor for detecting airflow through the body, wherein the airflow sensor can be monitored to determine an inhale or puff occurrence as well as data concerning the inhale duration and inhale pressure and additional or alternative inhale parameters. Where it might be useful to control the storage of user data differently in a second jurisdiction, the second mode may comprise disabling the functionality of storing some or all of the user data, or for instance, storing the user data differently.

It will be appreciated that the exemplary embodiments may include third or subsequent operating modes. Here, for instance, the third operating mode may include a further operating function, for instance a third age limit and/or the operating modes may comprise a combination of the functionality, for instance an age limit on a type of consumable.

There is therefore provided, according to a further exemplary aspect of the third mode, a method of managing a smoking substitute device wherein the method comprises the step of determining a location of the smoking substitute device, determining an operating mode of the smoking substitute device according to the determined location, and enabling and disabling a function of the smoking substitute device according to the determined operating mode.

In exemplary embodiments, the method may comprise using a locator to determine the location of the smoking substitute device.

In exemplary embodiments, the method may comprise using a lookup device to query a database to determine the operating mode based on a determined location.

In the exemplary embodiments, the method may comprise managing a system comprising a smoking substitute device and an external device wherein the method comprises forming a wireless link between the devices. Suitably, the external device includes a locator and the method comprises using the location of the external device as the location of the smoking substitute device. Suitably, the external device includes a lookup unit and the lookup unit determines the operating mode and causes a mode command to be transmitted over the wireless link to the smoking substitute device. Here, the control unit is configured to operate the smoking substitute device in the first mode or the second mode based on the received mode command.

According to further exemplary aspects of the third mode there is provided a system including a smoking substitute device according to previous aspects of the third mode and an external device connectable to the smoking substitute device. Yet further, according to another exemplary aspect of the third mode, there is provided a computer implement method for managing a smoking substitute device to execute the previous method aspect or a computer-readable medium containing computer-readable instructions which, when executed by a processor, cause the processor to perform the precious method aspect.

The disclosure includes the combination of the aspects and preferred features of the third mode described except where such a combination is clearly impermissible or expressly avoided.

The skilled person will appreciate that except where mutually exclusive, a feature or parameter described in relation to any one of the above aspects of the third mode may be applied to any other aspect. Furthermore, except where mutually exclusive, any feature or parameter described herein may be applied to any aspect and/or combined with any other feature or parameter described herein.

Fourth Mode: A Smoking Substitute Device and Connectivity of a Smoking Substitute Device to an External Device.

In a first aspect of the fourth mode, the disclosure provides a smoking substitute device comprising: a wireless interface, a charging port, and a connection port for electrical connection to an external device.

The inclusion of the connection port in addition to the wireless interface and the charging port allows electrical (e.g., wired) connection of the smoking substitute device to an external device. This external device can be used for data exchange that is not practicable via the wireless interface or may be used to test the wireless interface.

The connection port may be a serial port. The connection port may be a UART interface.

The connection port may comprise one or more electrical contacts accessible outside of the smoking substitute device. The electrical contact(s) may be exposed outside of the smoking substitute device. The electrical contact(s) may be positioned beneath a removable cap, such that when the cap is removed, the electrical contact(s) are exposed outside of the smoking substitute device.

The smoking substitute device may be configured to receive age verification data via the connection port and switch between a locked and unlocked status based on the data received. The smoking substitute device may be configured to lock the device when an age verification success signal has not been received via the connection port for the duration of a time window. Locking the device may comprise preventing a heater in the device from activating. Locking the device prevents the device from producing vapor or prevents the user from inhaling the vapor.

The time window may be a predetermined time since the device received an age verification success signal and/or a predetermined time since the device was turned on, and/or a time over which a predetermined number of inhales is taken, and/or a time for a predetermined number of charge cycles to be initiated. When the device is turned on for the first time, the time window may be the shortest of (a) a predetermined time since the device was turned on, (b) a time over which a predetermined number of inhales is taken, and (c) a time for a predetermined number of charge cycles to be initiated.

The wireless interface may comprise a Bluetooth™ antenna and the smoking substitute device may be configured to receive Bluetooth™ test commands via the connection port and to control the Bluetooth™ antenna based on the Bluetooth™ test commands.

The smoking substitute device may be a vaping smoking substitute device or a heat not burn (HNB) smoking substitute device.

The smoking substitute device may include a main body and a consumable 150. The main body and the consumable may be configured to be physically coupled together.

The consumable may be for containing an aerosol precursor (e.g., the consumable may include a tank for containing a liquid aerosol precursor as in a typical vaping smoking substitute device). In some embodiments, the consumable may include the aerosol precursor (e.g., liquid aerosol precursor as in a typical vaping smoking substitute device, e.g., a solid aerosol precursor as in a typical HNB smoking substitute device).

In a second aspect of the fourth mode, the disclosure provides a system for managing a smoking substitute device comprising the smoking substitute device of any preceding claim and an external device connectable to the connection port of the smoking substitute device. The external device may be an age verification device. The external device may be a Bluetooth™ certification device.

The disclosure includes the combination of the aspects and preferred features of the fourth mode described except where such a combination is clearly impermissible or expressly avoided.

The skilled person will appreciate that except where mutually exclusive, a feature or parameter of the fourth mode described in relation to any one of the above aspects may be applied to any other aspect. Furthermore, except where mutually exclusive, any feature or parameter described herein may be applied to any aspect and/or combined with any other feature or parameter described herein.

Fifth Mode: A Smoking Substitute Device and Management of the Smoking Substitute Device to Assist a User in Locating the Device.

According to exemplary aspects of the fifth mode, a smoking substitute device is configured to be wirelessly triggered to issue an alert to enable a user to locate the device. The alert can be deactivated automatically by moving the smoking substitute device in a predetermined movement. Advantageously, the user does not have to input a user command into a remote device from which an alert command is sent in order to deactivate the alert.

At their most general, the exemplary aspects of the fifth mode provide a smoking substitute device, a system including the smoking substitute device and the method of managing the smoking substitute device wherein the smoking substitute device includes an alert device that is triggered to issue an alert between a first event trigger and a second event trigger. Suitably, the first event trigger is the receiving of an alert command by a wireless interface of the smoking substitute device. The smoking substitute device includes a motion sensor, for instance an accelerometer for detecting motion of the smoking substitute device. Advantageously, the second event trigger is the detection by the motion sensor that the smoking substitute device has been moved in a predetermined movement.

There is therefore provided, according to a first exemplary embodiment, a smoking substitute device having a wireless communication interface, an alert device, a motion sensor, and a control unit. Suitably, according to exemplary embodiments, the wireless communication interface, alert device, motion sensor and control unit are housed in a body.

The wireless communication interface is configured to wirelessly communicate with an external device. Specifically, the wireless communication interface is arranged to establish a wireless communication link with the external device. Here, the wireless communication interface is configured to receive an alert command. That is, the wireless communication interface is configured to receive an alert command from the external device. Here, the wireless communication interface receives the alert command over the established wireless communication link. Typically, receiving the alert command is completed under the control of the control unit. Suitably, the external device may be a smartphone, tablet, smartwatch or other suitable device. The control unit may complete a pairing operation to pair the smoking substitute device and external device or to otherwise verify the external device as a trusted external device that is able to transmit commands to the smoking substitute device. In exemplary embodiments, the wireless communication interface and wireless communication link are short distance communication links such as a wireless personal area network.

In the exemplary embodiments, the smoking substitute device comprises an alert device. The alert device is arranged so that when activated, the alert device issues an alert. Suitably, the alert is an audible alert. Additionally or alternatively, the alert is a visual alert. Thus, the alert is able to assist guide a user to the device's location by providing the user with a visual and/or audible location identifier.

In the exemplary embodiments including an audible alert, the alert device may suitably comprise a speaker. Here, the speaker may be arranged to emit a sound periodically between the first and second event triggers. For instance the emission of a repeated beep or buzzer or other audible noise to a user. Or the speaker may be arranged to make a substantially continuous noise between the first and second events. For instance, to play music. In the exemplary embodiments, the audible sound is issued as an alert to guide the user to the smoking substitute device.

In the exemplary embodiments including an audible alert, the alert device may additionally or alternatively include a haptic generator. Here, the haptic generator creates a vibratory force that causes the smoking substitute device to vibrate. The vibrating device typically causes an audible sound to emanate. Thus an audible signal to the device's location is issued. In addition to the audible alert, the haptic generator also creates a haptic alert that a user may sense. For instance by sensing the vibrations should the smoking substitute device be in connected contact, for instance by being in a user's pocket or the like. Suitably, the haptic generator is a vibrating element such as a haptic motor. In some embodiments, the haptic motor is an electric motor and a weight mounted eccentrically on a shaft of the electric motor. The haptic generator may be arranged to emit a constant vibration or a periodic vibration between the first and second events.

In the exemplary embodiments including a visual alert, the alert device suitably comprises a light emitter. For instance the light emitter may be a light emitting device. Suitably, the light emitter may be controllable to emit light of varying wavelengths. Thus the light emitted can be controlled to change colour. In the exemplary embodiments, the alert device is configured to emit a visual alert, for instance a light between the first event and the second event. The emitted light may be a constant light emission or a periodic flash.

In the exemplary embodiments, the smoking substitute device comprises a motion sensor. The motion sensor is arranged to detect motion of the smoking substitute device. For instance, the motion sensor is suitably an accelerometer. The motion sensor is arranged to produce signals in response to a movement of the smoking substitute device. Suitably, the control unit monitors the response signals from the motion sensor and determines a movement of the smoking substitute device by analysing the signals. Here, the control unit can determine when predetermined movement of the smoking substitute device is replicated. In doing so, the control unit can determine the second event as the occurrence of a predetermined movement of the smoking substitute device. Suitably, the second event is configured to be a movement of lifting or picking up the smoking substitute device. Here, the movement may be determined to be a specific distance of movement. For instance, by monitoring the movement time and/or movement velocity and/or movement direction. In exemplary embodiments, the control unit determines a predetermined movement has occurred when predetermined values are met or exceeded.

The control unit controls the operation of the smoking substitute device. Thus the control unit controls the receipt of the alert command by the wireless communication interface, and the activation and deactivation of the alert device upon recognition of the first and second event triggers respectively. In one exemplary embodiment, the control unit is configured to deactivate the alert device on the second event trigger and to also control the wireless interface to issue a found command to the external device.

According to a further exemplary embodiment, there is provided a system for managing the smoking substitute device comprising an external device and the smoking substitute device. The external device suitably operates an application to control the communication with the smoking substitute device and to display the information to the user. The application suitably provides an input means through the application's graphic user interface to initiate the sending of an alert command to the connected smoking substitute device. In one exemplary embodiment, the application is configured to verify the smoking substitute device is connected to the external device by a short distance wireless communication prior to sending the alert command. If the short distance wireless communication link is not established an error message is suitably provided to the user.

According to a further exemplary embodiment, there is provided a method of managing a smoking substitute device. The method comprises the steps of activating an alert device to issue an alert upon identifying a first event trigger and deactivating the alert device to stop issuing the alert upon identifying a second event trigger, wherein the second event trigger is a motion sensor detecting a predetermined movement of the smoking substitute device. In the exemplary embodiments, the method comprises receiving an alert command. Here the alert command is received by the wireless interface of the smoking substitute device and the control unit identifies the first event trigger as the receipt of the alert command.

In exemplary embodiments, the method comprises causing the alert device to issue an audible alert and/or a visual alert and/or a haptic alert.

According to exemplary embodiments of the management method, the method comprises the step of the user inputting an alert input into the external device. Suitably, the external device verifies a short distance wireless communication link is established between the external device and the smoking substitute device and if a link is established the alert command is issued or if a link is not established the external device issues an error message to the user.

According to another exemplary aspect of the fifth mode, there is provided a computer implemented method for managing a smoking substitute device to execute the previous method aspect or a computer-readable medium containing computer-readable instructions which, when executed by a processor, cause the processor to perform the precious method aspect.

The disclosure includes the combination of the aspects and preferred features of the fifth mode described except where such a combination is clearly impermissible or expressly avoided.

The skilled person will appreciate that except where mutually exclusive, a feature or parameter of the fifth mode described in relation to any one of the above aspects may be applied to any other aspect of the fifth mode. Furthermore, except where mutually exclusive, any feature or parameter described herein may be applied to any aspect and/or combined with any other feature or parameter described herein.

Sixth Mode: A Smoking Substitute Device and Management of the Smoking Substitute Device when Wirelessly Connected to an External Device.

According to exemplary aspects of the sixth mode, a smoking substitute device is configured to automatically reactivate a wireless communication mode upon sensing a puff operation. Advantageously, by automatically reactivating the wireless communication mode, the user is provided with a more effective user convenience as the user does not have to initiate a separate manipulation or command input to reactivate the wireless communication mode and corresponding device functionality. Furthermore, by arranging a puff sensor to detect the puff operation of a user, the automatic reactivation command is a command that is unlikely to occur accidentally.

At their most general, the exemplary aspects of the sixth mode provide a smoking substitute device and a method of managing the smoking substitute device wherein a wireless communication interface of the smoking substitute device is deactivated upon a deactivate communication action. The smoking substitute device may be deactivated via a connected external device and/or directly by a user input to the device. For instance, the external device may transmit a deactivate communication command. Here, the deactivate communication action is the smoking substitute device receiving the deactivate communication command. Additionally, or alternatively, the smoking substitute device may include a motion sensor or an input actuator and the user may input commands directly to the smoking substitute device by replicating a specific motion or by actuating the actuator. Thus, here the deactivate communication action is recognizing the user input at the device as a predetermined user input to deactivate wireless transmission.

After deactivation of the wireless communication interface, the wireless communication interface is configured to remain deactivated until a reactivation command. In the exemplary aspects of the sixth mode, the reactivation command is a user puff operation. Here a puff sensor is arranged to detect a puff operation, that is, the puff sensor detects a user manipulation of the smoking substitute device replicating a user operation to produce and inhale an aerosol. A control unit monitors the puff sensor and automatically reactivates the wireless communication interface to an active mode when the puff sensor detects a puff operation. Advantageously, the user is provided with a more user-convenient operation as the functionality of the smoking substitute device when connected to an external device is automatically reactivated when the user initiates a puff operation without the user first having to recognize the smoking substitute device is in a deactivated mode and without the user having to undertake a separate input command to enter the active mode.

Once deactivated, the wireless communication interface is configured to be in a deactivated mode wherein the wireless communication interface is prevented from sending data to an external device. Here, typically the smoking substitute device is configured to send data over a wireless communication link established between the wireless communication interface and an external device. Thus, in an active mode, the wireless communication interface is configured and controlled by the control unit to send data over the wireless communication link. Here, the data sending maybe a push operation, wherein the control unit pushes data to the external device. Additionally, or alternatively, the data sending may be polled from the remote device. In either event, in the deactivated mode, the wireless communication interface is configured to be deactivated such that the smoking substitute device does not transmit wireless signals, for instance it does not transmit any signals over a wireless frequency. In contrast, in the active mode, the control unit is configured to transmit data over the wireless communication link to an external device to provide connected functionality to the smoking substitute device. Advantageously, the deactivated mode may be entered when it is not desired or allowed to have devices transmitting wireless signals, for instance in 'flight mode' when on an airplane.

In the active mode, the wireless communication interface is configured to send and receive data and commands to and from an external device. Suitably, the external device may be a smartphone, tablet, smartwatch or other suitable device. The control unit may complete a pairing operation to pair the smoking substitute device and external device or to otherwise verify the external device as a trusted external device that the smoking substitute device is authorized to receive and send transmissions from/to the external device. In exemplary embodiments, the external device sends a deactivate communication command to the smoking substitute device. Upon receiving the deactivate communication command at the wireless communication interface, the control unit controls the smoking substitute device to enter the deactivated mode. Typically, the external device suitably operates an application to control the communication with the smoking substitute device and to display the information to the user. The application suitably provides an input means through the application's graphic user interface to initiate the sending of a deactivate communication command.

It will be appreciated that in the exemplary embodiments, the wireless communication interface is configured to wirelessly communicate with an external device. Specifically, the wireless communication interface is arranged to establish a wireless communication link with the external device. Here, the wireless communication interface is configured to receive the deactivate command. That is, the wireless communication interface is configured to receive the deactivate communication command from the external device. Here, the wireless communication interface receives the deactivate communication command over the established wireless communication link. Typically, receiving the deactivate communication command is completed under the control of the control unit.

Suitably, the control unit executes firmware stored in the memory to control the wireless communication interface. For instance, the control unit controls storage of data in a memory and the receipt by the wireless communication interface of transmissions from the external device. The control unit suitably also controls the sending of data to the external device, for instance the sending of data stored in the memory. Upon receiving a deactivate communication command via the wireless communication interface, the control unit is configured to deactivate operation of the wireless communication interface such that the smoking substitute device does not transmit a wireless signal even if requested to do so by a user operation or a poll request from an external device. That is, the control unit switches the wireless communication interface from the active mode to the deactivated mode. In other embodiments, the control unit may be configured to send poll requests periodically to the external device. Here, as will be appreciated, in the deactivated mode, the wireless communication link is blocked from or controlled not to poll the external device.

In some exemplary embodiments, as will be appreciated, the smoking substitute device comprises a power source to power the wireless communication interface and/or the control unit and/or the puff sensor arrangement. The power source, for instance a battery, and the other components of the smoking substitute device are suitably housed in a body of the smoking substitute device.

In an exemplary aspect of the sixth mode there is therefore provided a smoking substitute device comprising the wireless communication interface and a control unit for switching the operation of the wireless communication interface between an active mode and a deactivated mode, wherein the smoking substitute device further includes a puff sensor.

Suitably, the puff sensor is arranged to sense a puff operation of the smoking substitute device. That is, the puff sensor is configured to detect a user manipulation of the smoking substitute device predetermined to trigger the production and subsequent inhalation of an aerosol. In some embodiments, the puff sensor comprises an airflow sensor. Here, the airflow sensor is arranged to detect air flow through the smoking substitute device. In use, the user inhales on the smoking substitute device and the airflow sensor detects the increase in airflow and determines a puff operation has been initiated. As will be appreciated, as well as activating a heating device as part of the puff operation, the control unit determines the increase in airflow as a puff operation and, if the wireless communication is in a deactivated mode, automatically switches the wireless communication interface to the active mode. Additionally, or alternatively, the puff sensor may comprise an actuator. For instance, the smoking substitute device may be configured to require the actuator to be activated to initiate a heating device to create the aerosol. Here, in addition to activating the heating coil as part of the puff operation, the actuator may be configured to signal the control unit. The signal to the control unit suitably initiates the control unit to switch the wireless communication interface to the active mode. It will be appreciated that the puff sensor may be triggered by other events of the puff operation, for instance when it is detected that the heating unit is activated, or where applicable a consumable is inserted or the like.

In one exemplary embodiment, the control unit may additionally be configured to switch the wireless communication interface from a deactivated mode to an active mode by receipt of a reactivate command. For instance, the external device may provide a reactivate communication command input through the application and, in addition to the wireless communication interface being automatically woken up on a user puff operation, the smoking substitute device can have the wireless communication interface reactivated via the external device.

According to further exemplary aspects of the sixth mode there is provided a system including a smoking substitute device according to previous aspects and an external device connectable to the smoking substitute device.

According to a further exemplary embodiment, there is provided a method of managing a smoking substitute device. The method comprises the steps of receiving at a wireless communication interface a command to switch the wireless communication interface to a deactivated mode. In the deactivated mode, the wireless communication interface is configured not to transmit a wireless transmission. The method further comprises automatically reactivating the wireless communication interface upon a puff sensor sensing a puff operation. For instance, the puff sensor senses a user manipulation to inhale through the smoking substitute device or to activate a heating unit.

As will be appreciated, in the exemplary embodiments, the method may initially or subsequently comprise using the smoking substitute device with the wireless communication module in an active mode wherein the wireless communication interface transmits a wireless signal. For instance, the wireless communication interface transmits data over an established wireless link with an external device.

According to a further exemplary aspect of the sixth mode, there is provided a method of managing a system comprising the method steps of managing the smoking substitute device and including the step of a user inputting a deactivate communication command into an external device and subsequently transmitting a deactivated command to the smoking substitute device, wherein on receiving the deactivate communication command the wireless communication interface enters a deactivated mode.

According to another exemplary aspect of the sixth mode, there is provided a computer implemented method for managing a smoking substitute device to execute the previous method aspect or a computer-readable medium containing computer-readable instructions which, when executed by a processor, cause the processor to perform the precious method aspect.

The disclosure includes the combination of the aspects and preferred features of the sixth mode described except where such a combination is clearly impermissible or expressly avoided.

The skilled person will appreciate that except where mutually exclusive, a feature or parameter described in relation to any one of the above aspects of the sixth mode may be applied to any other aspect. Furthermore, except where mutually exclusive, any feature or parameter described herein may be applied to any aspect and/or combined with any other feature or parameter described herein.

Seventh Mode: A Smoking Substitute Device and Providing Notifications on a Smoking Substitute Device and a Connected Mobile Device.

In a first aspect of the seventh mode, the disclosure provides a system comprising a smoking substitute device and a mobile device, the smoking substitute device being connected to a mobile device, and the system being configured to perform a first notification on the smoking substitute device and simultaneously perform a second notification on the mobile device, wherein the second notification corresponds the first notification.

In a second aspect of the seventh mode, the disclosure provides a method of managing a smoking substitute device, the smoking substitute device being connected to a mobile device, the method comprising: providing a first notification on the smoking substitute device and simultaneously providing a second notification corresponding to the first notification on the mobile device.

In this way, as the corresponding notifications are given by the mobile device and the smoking substitute device, the user can be sure that the mobile device and smoking substitute device are working correctly and are connected (e.g., wirelessly, for example paired by Bluetooth™ or WIFI) properly. The mobile device and smoking substitute perform mirrored notifications so that the user can quickly and easily see that the devices are connected correctly. Providing the notification via the mobile device as well as the smoking substitute device may also allow the user to better understand the notification as further contextual information may be provided on the mobile device.

Simultaneous is intended to mean that the notifications happen at the same time within a user-perception tolerance. It may include notifications being up to 0.5 seconds apart, or up to one second apart.

In a third aspect of the seventh mode, the disclosure provides a smoking substitute device configured to, when connected with a mobile device, to either: (i) perform a first notification and send a signal to the mobile device configured to cause a corresponding second notification to occur on the mobile device simultaneously to the first notification, or (ii) receive a signal from the mobile device indicative of the mobile device performing the second notification and perform the corresponding first notification simultaneously to the second notification.

In a fourth aspect of the seventh mode, the disclosure provides a mobile device configured to, when connected with a smoking substitute device, to either: (i) receive a signal from the smoking substitute device indicative of the smoking substitute device performing a first notification and perform a corresponding second notification, or (ii) perform the second notification and send a signal to the smoking substitute device configured to cause the corresponding first notification to occur on the smoking substitute device; such that the first and second notifications occur simultaneously.

The signals described above may also have other purposes. For example, a signal from the smoking substitute device to the mobile device which indicates a connection has been achieved may cause the mobile device to perform a corresponding second notification and may be considered to be a signal indicative of the smoking substitute device performing a first notification. The same is true of a signal from the mobile device to the smoking substitute device indicating a connection has been achieved.

The first and second notifications may be performed when a connecting process between the smoking substitute device and the mobile device has completed successfully. The mobile device may be connected with the smoking substitute device by a Bluetooth™ connection. The mobile device may be connected with the smoking substitute device by a WIFI connection. The connecting process may be a pairing of the devices, for example using Bluetooth™. The smoking substitute device may comprise a wireless interface configured to communicate wirelessly with a mobile device, for example, via an application installed on the device.

The first and second notifications may be performed to indicate a battery level of the smoking substitute device, for example, below 20%, over 20%, between 50 and 100% inclusive, between 49% and 20% inclusive and/or between 19% and 0% inclusive. The first and second notifications may be performed to indicate that the mobile device and smoking substitute device are within Bluetooth™ range, and/or to indicate the smoking substitute device will shut down, and/or the user inhales.

The first notification may comprise a visual notification. The second notification may comprise a visual notification. The first notification may comprise activation of a light on the smoking substitute device. Activation of the light may comprise flashing the light in a pattern. For example, flashing the light three times.

Preferably, the mobile device may be configured to display an image representing the smoking substitute device and the second notification may comprise a representation of the first notification on the image.

The first notification may comprise a haptic notification. The first notification may comprise a haptic notification and a visual notification.

The second notification may comprise a visual notification indicative of vibration. The second notification may comprise a haptic notification.

The second notification may have the same pattern as the first notification. For example, when the first notification comprises activation of a light on the smoking substitute device, the representation of the light on the mobile device may show the same color and/or with the same pattern as the light on the smoking substitute device to perform the second notification. For example, where a first notification comprises three vibrations, the second notification may also comprise three vibrations or three visual notifications indicative of vibration.

The first notification comprises one or more of: activation of a light on the smoking substitute device which illuminates in a pattern, activation of a haptic on the smoking substitute device which vibrates in a pattern; wherein the second notification comprises the same pattern as the first notification.

The front and/or rear surface of the device body may include visual user feedback means, for example one or more lights, e.g., one or more LEDs. In some embodiments, the device body may include an illumination region configured to allow light provided by a light source (e.g., one or more LEDs) within the device body to shine through. The device may be configured to operate the light to display a variety of colors, flash, or illuminate different sections of the light in turn so as to cause a certain visual effect. This visual effect may form the first notification.

The device may comprise a movement detection unit (e.g., an accelerometer) for detecting a movement of the device, and a haptic feedback generation unit (e.g., an electric motor and a weight mounted eccentrically on a shaft of the electric motor). The haptic generation unit may be used to perform a haptic notification.

The disclosure includes the combination of the aspects and preferred features of the seventh mode described except where such a combination is clearly impermissible or expressly avoided.

The skilled person will appreciate that except where mutually exclusive, a feature or parameter described in relation to any one of the above aspects may be applied to any other aspect. Furthermore, except where mutually exclusive, any feature or parameter described herein may be applied to any aspect and/or combined with any other feature or parameter described herein.

Eighth Mode: A Smoking Substitute Device and a Method of Communicating Usage of a Smoking Substitute Device to a User.

According to a first aspect of the eighth mode of the present disclosure, there is provided a smoking substitute device, comprising a sensor element adapted to detect usage of the smoking substitute device by the user, and at least one signaling element adapted to provide a signal to a user, wherein the signaling element is adapted to provide the signal to the user after a defined non-use time period of the smoking substitute device.

According to a second aspect of the eighth mode of the present disclosure, there is provided smoking substitute system, comprising a smoking substitute device according to the present disclosure, and a mobile device.

According to a third aspect of the eighth mode of the present disclosure, there is provided a method of communicating usage of a smoking substitute device to a user, comprising detecting usage of the smoking substitute device by the user, and providing a signal after a defined non-use time period of the smoking substitute device to the user.

As describes above, smoking substitute devices are intended to provide a substitute for the rituals of smoking, whilst providing the user with a similar experience and satisfaction to those experienced with traditional smoking and tobacco products. Traditional smoking of cigarettes however, provides a rather simple and direct feedback regarding the amount of cigarettes, i.e., nicotine consumed. A user may simply count cigarettes smoked, and knows how many cigarettes are in a pack. Thus, consumption is easily traceable by "counting stubs". Some smoking substitute devices however, provide a substance reservoir for nicotine delivery, that may be used a plurality of times before the need to replace it occurs, e.g., in the case of an e-liquid, the aerosol generating substance forms a depot that is comparable to, e.g., the amount of nicotine delivered by multiple cigarettes, e.g., even a full pack of cigarettes, before the consumable has to be replaced. Thus, a user may lose track about his consumption, without precise feedback.

The present disclosure is devised to provide a signal to the user, in particular after a defined non-use time period of the smoking substitute device. Such an indication may further be seen as a signal to the user to switch off the smoking substitute device, e.g., to save battery power by switching the device in a low- or non-power consumption mode (i.e., switching off the device). Alternatively, such a signal may provide an indication that the smoking substitute device now requires a certain heat-up time due to the non-use, and thus may result in the user triggering said heat-up. Further, a certain non-use may make it necessary that a user cleans the smoking substitute device, e.g., because due to the non-use that power has been reduces and a consumable may have been cooled and is not unfavorably attached to a heating element. Further, the signal may be an indication or reminder that a user shall use or shall not forget the device, e.g., when leaving home. In particular the latter may assure that the user does not forget their device, e.g., at home when leaving home. This assures that the user carries along with them the smoking substitute device for their immediate and continued personal use. Thus, the signal keeps the user from smoking real cigarettes/consuming a conventional tobacco product, since they have their smoking substitute device readily available.

A possible scenario may be a signal to a user after a prolonged period of non-use, e.g., in the morning, after not using the smoking substitute device throughout the night. Thus, when a user first picks up the smoking substitute device in the morning, the signal may be a defined glow, e.g., of a defined color. The color or the glow may indicate a certain non-use period of time. The glow or color may be initiated after a certain non-use period of time in combination with a certain current time of the day, e.g., in the morning, is may be assumed that a comparably long non-use period has preceded the "first use of the day", so the device may require a longer than usual period of time until operational, e.g., due to the requirement to extensively pre-heat the smoking substitute device or because first a dedicated boot or start-up sequence has to be initiated. Depending on the time of the day, the signal may change, e.g., a different signal may be presented to the user after a certain non-use period, e.g., after lunch, which may be longer than a usual non-use period during the day between uses, but shorter that a non-use period through the night. The glow color may in particular be blue, yellow or green, but any other color may be suitably chosen. The signal may further be a reminder to a user to not forget the smoking substitute device when leaving a certain place.

According to a preferred embodiment of the present disclosure, the signaling element may be at least one of a visual signaling element, a haptic signaling element and an acoustic signaling element.

In addition to a visual signaling element, a haptic signal may be presented to the user when picking up the smoking substitute device, e.g., a defined vibration, which may be dependent on the current time of the day and/or the length of the non-use time period as well, e.g., a number count may indicate the time elapsed since a last use, e.g., a certain number of strong vibration for hours lapsed, followed by a number of lighter vibrations indicting increments of, e.g., 15 minutes. The lack of a vibration may indicate a time elapsed that is less than a certain amount of time, e.g., less than 15 minutes. The same may be realized with an acoustic element and tones of different frequency and/or amplitude, or differentiable sounds. In summary, a signal type may be based on any one of a glow, color intensity, color, rightness, vibration, sound, or tone.

According to a further preferred embodiment of the present disclosure, the signaling element may be an illumination element adapted to provide a visual signal to the user.

Providing a visual signal may be seen as providing a prominent signal type to a user, in particular without further interfering with bystanders.

According to a further preferred embodiment of the present disclosure, the sensor element may be an element out of the group consisting of an accelerator sensor element, a puff sensor element, a consumable detection sensor element, and an input sensor element, in particular a user input sensor element.

In other words, the sensor may be a dedicated sensor element, or may be another element of the smoking substitute device that can detect a use or non-use merely by its operation.

According to a further preferred embodiment of the present disclosure, the signal may be provided to the user dependent on the defined non-use time period and a current time.

For example, a different signal may be presented to the user in the morning than midday after lunch or evenings after dinner. Different signals may comprise different colors, different glowing patters, different frequencies of tones, different sounds, and different vibrations.

According to a further preferred embodiment of the present disclosure, the provided signal may be dependent on the current time and/or the length of the non-use time period.

For example, in case of a visual signal the brightness of the signal provided may increase with an increase in non-use time. Alternatively, a color may change with an increase in non-use time. This may reward the user dependent on the time of non-use, e.g., the longer the non-use the more pleasant the visual signal presented to the user. Likewise, an acoustic or haptic signal may change dependent on the non-use time period.

Exemplarily, a signal may be provided to a user when it is determined that a non-use time period of at least 1 hour has been achieved and a time of day is a time after 6 am, or in particular the time of day in a certain time window, e.g., the time window is between 6 am and 9 am, or between 11:30 am and 2 pm, possibly with a shorter non-use time period of 30 in or 45 min. The time window may be dependent on the day of the week, e.g., may be between 6 am and 9 am on Mondays to Fridays, but 8 am to 10 am on Saturdays and between 9:30 am and 11:30 am on Sundays. The time window may be dependent on national holidays, which may compare to a time window of a Saturday or Sunday.

According to a further preferred embodiment of the present disclosure, a mobile device may be communicatively connectable to the smoking substitute device to detect usage of the smoking substitute device and/or to control the smoking substitute device to provide the signal to the user, and/or to provide a signal to the user.

Thus, the use/non-use of the smoking substitute device may be determined by a mobile device associated with the smoking substitute device, in particular communicatively connected to the smoking substitute device. This may allow a simpler construction of the smoking substitute device, since the smoking substitute device, e.g., may not need to be capable to determine a period of non-use or a current time of the day by itself. Such information may be provided by the mobile device, which in turn may trigger and/or control the signal presented to the user.

According to a further preferred embodiment of the present disclosure, the detecting the usage may comprise detecting an accelerator, a puff, a consumable status change and a user input.

According to a further preferred embodiment of the present disclosure, providing the signal to the user may comprise providing a visual signal.

According to a further preferred embodiment of the present disclosure, providing the signal to the user may be dependent on the defined non-use time period and a current time.

According to a further preferred embodiment of the present disclosure, providing the signal may be dependent on the current time and/or the length of the non-use time period.

The disclosure includes the combination of the aspects and preferred features of the eighth mode described except where such a combination is clearly impermissible or expressly avoided.

The skilled person will appreciate that except where mutually exclusive, a feature or parameter described in relation to any one of the above aspects of the eighth mode may be applied to any other aspect. Furthermore, except where mutually exclusive, any feature or parameter described herein may be applied to any aspect and/or combined with any other feature or parameter described herein.

Nineth Mode: A Smoking Substitute Device, a Smoking Substitute System and a Method of Syncing at Least Two Smoking Substitute Devices.

According to a first aspect of the ninth mode of the present disclosure, there is provided there is provided a smoking substitute system, comprising a smoking substitute device, and a processing unit in communicative connection with the smoking substitute device and adapted to detect a presence of at least one further smoking substitute device, wherein, when the presence of the at least one further smoking substitute device is detected, a dedicated function of each smoking substitute device is syncable.

According to a second aspect of the ninth mode of the present disclosure, there is provided a method of syncing at least two smoking substitute devices, comprising detecting, by a processing unit in communicative connection with a smoking substitute device, a presence of at least one further smoking substitute device, and syncing a dedicated function of each smoking substitute device, when the presence of the at least one further smoking substitute device is detected.

When using a smoking substitute device, a user is usually receiving feedback from the device, e.g., to a current operational status. The feedback may of a visual, acoustic or haptic type. Providing such as a feedback may be seen as one type of dedicated function. Another type of function may be an operational function or in other words may relate to an operational parameter used to set a certain function of the device, e.g., a puff function, a puff intensity function, a puff duration function, an activation function, a lock function and a deactivation function. In other words, is may be conceivable that the dedicated function sets an intensity of nicotine, or a nicotine dose provided to a user of the smoking substitute device during use.

When a plurality of users, each with their own smoking substitute device are near each other, a synced operation of the smoking substitute devices may be beneficial, e.g., when in a confined space, like a dedicated smoking area, it may be beneficial to synchronize the operation of the smoking substitute devices like limiting the number of (total) puffs the users may take jointly, so to avoid surpassing a certain exhale fume concentration, possibly resulting in an overexposure to exhales of bystanders. To achieve this limitation, present (i.e., close by) smoking substitute devices may agree on a defined maximum exposure situation, in other words their operation may be synced, and subsequently the operation of the so synced devices may be limited to avoid the aforementioned overexposure situation, by, e.g., limiting the number of puffs an individual smoking substitute device user may take, e.g., in a certain time period. At the end of a use, an automatic (synced) locking of a smoking substitute device may be initiated, thereby avoiding the immediate continued or repeated use of the smoking substitute device by a user.

Likewise, in a multi device scenario, e.g., again in a confined space, like a dedicated smoking area, a visual indication given to a user by their own device, may result in overexpose of users or bystanders to visual stimuli, possibly resulting in a serious medical condition like triggering a seizure. To avoid such a situation, present smoking substitute devices may sync a visual indicator, like an illumination function, to limit maximum brightness, or sync a repeating signal, like a glow to a similar frequency or similar color.

To avoid such negative impact that in itself potentially has nothing or little to do with the act of using the smoking substitute device per se, it may thus be beneficial to sync the operational behaviors of a plurality of devices in close proximity.

In order to allow such a synchronization, a smoking substitute device, either by itself or via a processing unit connected thereto, like a processor, mobile communication device, a smartphone or an application server, may detect the presence of at least one further smoking substitute device. When in the context of the following and preceding description it is mentioned that a smoking substitute device may perform a certain action, like detecting the presence of another smoking substitute device or sending or receiving a signal for detecting the presence or communicating with another device, is should be understood that this functionality may either be implemented in the smoking substitute device itself, or may be realized by a processing unit connected thereto, like a processor, mobile communication device, a smartphone or an application server, in other words, may be realized by an associated element.

In order to achieve this detection, the smoking substitute device may send out a signal or may be adapted to receive a signal sent out by another smoking substitute device. Such a signal may be implemented as a beacon, like a Bluetooth beacon signal or a Bluetooth low energy beacon. Consequently, there may not be the need to establish an actual communication between (a plurality of) (smoking substitute) devices, but each device may receive and send such a beacon signal, possibly adapting the beacon, e.g., by at least one synchronization parameter, such that a defined synchronization may be established. In order to achieve this, a beacon may comprise information about what function to be synchronized, and how and when such a sync should be established, like, e.g., setting a defined frequency for an increasing and decreasing glowing operation and an associated glow color. Alternatively, information about an absolute or relative position may suffice as well.

A synchronization behavior may be switched on and off for the smoking substitute device, either directly on the smoking substitute device or via an application running on the mobile device. The synchronization behavior may be adapted via synchronization settings, e.g., specifying a type of operation to by synchronized, like a color or glow, and parameters of the synchronization, like setting a similar color, but a different maximum glow intensity and a dedicated frequency curve.

Such a synchronization may thus influence the behavior of the devices, which in turn may influence a group dynamic of a group of users that are so synchronized, i.e., their smoking substitute device being synchronized. A synchronized glow, for example, may provide a feeling of togetherness any may make using a smoking substitute device feel less separated and lonely.

Syncing two devices may also be seen as one device following the behavior or adapting its behavior to that of another device, so no coordinated syncing of both devices is required. One device may sync its behavior to the other device According to a preferred embodiment of the smoking substitute system, detecting a presence may comprise communicating with the least one further smoking substitute device.

According to another preferred embodiment of the smoking substitute system, the presence of the at least one further smoking substitute device may be detected either directly or via at least one further processing unit in communicative connection with the at least one further smoking substitute device.

According to a further preferred embodiment of the smoking substitute system, the dedicated function may be at least one function out of the group consisting of a visual function, an illumination function, an audible function, an acoustic function, a haptic function, a puff function, a puff intensity function, a puff duration function, an activation function, a lock function and a deactivation function.

According to a further preferred embodiment of the smoking substitute system, the smoking substitute device may further comprise at least one illumination element, wherein the illumination element of the smoking substitute device may be synced with a respective illumination element of the at least one further smoking substitute device when the presence of the least one further smoking substitute device has been detected.

According to a further preferred embodiment of the smoking substitute system, the illumination element of the smoking substitute device and the illumination element of the at least one further smoking substitute device may be synced such that the illumination elements illuminate is a similar color and/or pulse with a similar frequency, in particular have synced minima and maxima of pulsation.

A similar color may be understood as a color that is identical or at least the same color to an extent so that no significant difference is discernible. Such a definition may apply to further embodiments of dedicated functions, e.g., a haptic function may be similar if no significant difference is experienced by a user, or an acoustic function may be similar if a tone is received by a user with no significantly different experience.

According to a further preferred embodiment of the smoking substitute system, the presence of the at least one further smoking substitute device may be detected substantially without a user interaction.

In other words, the smoking substitute device or the mobile device may detect the presence of another smoking substitute device, e.g., by a signal or a beacon, and may, e.g., dependent on the sync settings in an app, automatically activate synchronization in particular including suitably adapting sync parameters. Such an automatic activation may be initiated as soon as an smoking substitute device or associated mobile device detects the presence of a further smoking substitute device or only when in a defined vicinity, e.g., within 2, 3, 4, 5 or 10 meters. Likewise, when the presence detection is based on a relative location of one smoking substitute device relative to the location of a further smoking substitute device, or based on an absolute position of a further smoking substitute device, a similar closeness like mentioned above may be determined, thus, e.g., the presence may be established within a defined set of parameters, and subsequently the sync may be initiated.

According to a further preferred embodiment of the smoking substitute system, the presence of the at least one further smoking substitute device may be detected by receiving a beacon signal sent from the at least one further smoking substitute device and/or the processing unit of the at least one further smoking substitute device, in particular by receiving a Bluetooth beacon or Bluetooth low energy beacon.

Using a beacon may allow for an easy implementation of the synchronization feature, in particular using a standardized communication platform.

According to a further preferred embodiment of the smoking substitute system, when a beacon signal is received, the receiving smoking substitute device and/or the processing unit may be sending a synced beacon signal, so that further smoking substitute devices are syncable by receiving the sent synced beacon, in particular the beacon may be adaptable for transmitting at least one synchronization parameter.

In other words, a smoking substitute device or associated mobile device may relay the sync signal, thereby extending the range or increasing the area where a synchronization between multiple devices may be realized.

According to a further preferred embodiment of the smoking substitute system, the at least one synchronization parameter comprises information about a function to be synchronized and/or information about the configuration of the synchronization.

According to a further preferred embodiment of the smoking substitute system, the presence of the at least one further smoking substitute device may be detected by determining a current location of the smoking substitute device relative to a current location of the at least one further the smoking substitute device or by receiving information about an absolute position of the at least one further smoking substitute device.

Such an absolute position may be determined by receiving a signal of a GPS, GLONASS, GALILEO or similar system. The signal may be received by a suitable element of a smoking substitute device or the processing unit, may be analyzed appropriately, so that an absolute global position, in particular with a suitable accuracy, may be determined. Based on an own (absolute) position and that (absolute) position of another smoking substitute device, a presence may be detected by determining that a suitable closeness condition to establish a sync exists.

According to a further preferred embodiment of the smoking substitute system, the processing unit may be one of a control unit of a smoking substitute device, a mobile device in communicative connection with a smoking substitute device, and an application server in communicative connection with a smoking substitute device and/or a mobile device in communicative connection with a smoking substitute device.

According to a further preferred embodiment of the method, the presence of the at least one further smoking substitute device may be detected either directly or via at least one further processing unit in communicative connection with the at least one further smoking substitute device.

According to a further preferred embodiment of the method, the presence of the at least one further smoking substitute device may be detected by receiving a beacon signal sent from the at least one further smoking substitute device and/or the processing unit of the at least one further smoking substitute device, in particular by receiving a Bluetooth beacon or Bluetooth low energy beacon, and/or may be detected by determining a current location of the smoking substitute device relative to a current location of the at least one further the smoking substitute device or by receiving information about an absolute position of the at least one further smoking substitute device.

The disclosure includes the combination of the aspects and preferred features of the ninth mode described except where such a combination is clearly impermissible or expressly avoided.

The skilled person will appreciate that except where mutually exclusive, a feature or parameter described in relation to any one of the above aspects of the ninth mode may be applied to any other aspect. Furthermore, except where mutually exclusive, any feature or parameter described herein may be applied to any aspect and/or combined with any other feature or parameter described herein.

Tenth Mode: A Smoking Substitute Device, System and Method of Communicating.

According to a first aspect of the tenth mode of the present disclosure, there is provided a smoking substitute device, comprising a wireless interface, wherein the wireless interface is adapted to be connectable to a mobile device for communicating with the mobile device; wherein the smoking substitute device is adapted to transmit first data to the mobile device; wherein the smoking substitute device is adapted to transmit second data to the mobile device; wherein the first data comprises encrypted data; and wherein the second data comprises at least one of non-encrypted data, and encrypted data that is encrypted differently than the first data.

According to a second aspect of the tenth mode of the present disclosure, there is provided a smoking substitute system, comprising a smoking substitute device according to at least one of the preceding claims, and a mobile device in communicative connection with the smoking substitute device, and in particular an application server in communicative connection with the mobile device via a network.

According to a third aspect of the tenth mode of the present disclosure, there is provided a method of communicating of a smoking substitute device and a mobile device, wherein the smoking substitute device is adapted to be connectable to the mobile device for communicating with the mobile device, comprising transmitting first data from the smoking substitute device to the mobile device; and transmitting second data to the mobile device, wherein the first data comprises encrypted data; and wherein the second data comprises at least one of non-encrypted data, and data that is encrypted differently to the first data.

Known devices may provide a proprietary functionality to a user, e.g., a smoking substitute device may provide the proprietary functionality of allowing a user of the device to simulate the act of smoking. In case a certain proprietary functionality is limited to the specific application, it is conceivable to connect such a proprietary device to a multi-purpose device, like, e.g., a mobile device, in particularly one that is flexibly programmable. By such a connection between a proprietary device and a flexible multi-purpose device, the functionality of the proprietary device may be enhanced, and the combined experience for a user may be likewise enhanced. A flexible multi-purpose device, like a mobile device, may provide the functionality to execute an application, or app, on the mobile device, to provide the enhanced functionality.

A connection between a smoking substitute device and a mobile device requires the transmission of data at least between the smoking substitute device and the mobile device. Possibly, a further application server may be involved in the communication, e.g., as a backend server, for storing user and/or usage data, and for analyzing raw data that would otherwise not be possible on either the smoking substitute device or the mobile device, be it that the processing power of either the smoking substitute device or the mobile device is insufficient for timely analysis or simply further data is required for the analysis that is not available to the smoking substitute device or the mobile device.

Different types of data may be analyzed, in particular data of a data type that must or should be available in real time, and data of a data type that need not be or may not be available in real time. The reason for the unavailability of non-real time data may, e.g., be the above mentioned required computing power or computational complexity, or data availability for analysis. Non-real-time data may also be data where a certain time sequence of data is analyzed, and thus historic data is required, which may not be available to the either the smoking substitute device or the mobile device. Such historic data may, e.g., be stored on an application server, and for analysis may thus be available exclusively to the application server.

Data from the smoking substitute device may be sent from the smoking substitute device to the application server, in particular via the mobile device, like, e.g., a mobile communicating device or smartphone. In other words, the mobile device may relay or forward data received from the smoking substitute device to the application server and vice versa. Thus, there may be a transport layer or communication channel between the smoking substitute device and the application server, via the mobile device. Such a channel may be encrypted, e.g., may be embodied as a virtual private network (VPN) connection, or the data itself may be encrypted.

First data, or encrypted data may in particular be the aforementioned non-real-time data, since for encryption and decryption, the smoking substitute device may require time to perform said encryption/decryption that simply does not allow for real-time processing and transmission. Alternatively, encrypted non-real-time data may deliberately be sent only at specific times or intervals, so to reduce power consumption and or reduce data usage required for the transmission of the data, e.g., such non-real-time data may be sent every couple of hours or on force closure of an app running on the mobile device. As such, the encrypted data may originate from the smoking substitute device, i.e., may be encrypted by the smoking substitute device, or may originate from the mobile device, i.e., may be encrypted by the mobile device.

In particular in case that the smoking substitute device provides encrypted (non-real-time) data and non-encrypted or differently encrypted (real-time) data, the mobile device may forward the encrypted data, substantially unprocessed, to the application server, but may use the non-encrypted/differently encrypted data locally.

The non-encrypted/differently encrypted data may be used on the mobile device, e.g., displayed to a user currently using the smoking substitute device. Such data may, e.g., be a (current) power supply or battery level, a puff count or a lock status of the smoking substitute device.

The encrypted data sent to the application server may be processed by the application server, and may in particularly be sent back to the mobile device (also encrypted or unencrypted) for display to the user only subsequently. Such data presented may, e.g., be a puff count graph (e.g., a weekly view or daily view of the puff count), an nicotine consumption graph (e.g., a yearly, monthly, weekly or daily view of the consummated nicotine), a weekly or monthly pod count of consumables consumed, a (current) liquid level (which may be computed by the application server using such consumption data, like (historical) puff count data and puff duration data), or general purchasing information, like where to find a store, e.g., in the vicinity of the mobile device or another defined area.

Generally, encrypted data may be sent from the smoking substitute device to the mobile device. The mobile phone may then send this data to the application server in the backend. There, the data is decrypted and processed before being sent back to the mobile phone, either encrypted or non-encrypted. To save battery life and reduce data usage, the encrypted data may not be sent in real time, but may be sent every couple of hours or on force closure of the app. However, in order to provide real time data on battery level % and puff count, these data may not be encrypted or may be differently encrypted, and will be sent from the smoking substitute device to the mobile device in real time.

According to a preferred embodiment of the smoking substitute device, the first data may be non-real time data and the second data may be real time data.

Put another way, non-real time data, since it is data that is not or cannot be used in real time may be encrypted, to enhance security and privacy when transporting and storing the data, e.g., the non-real-time data is processed or analyzed in a further entity, like an application server, and thus leaves the immediate sphere of influence of the user, e.g., the mobile device, thus the data may be encrypted for these reasons. Likewise, real-time data is or may be used substantially immediately, either because said data is required for the proper functioning of the smoking substitute system and/or the app, or because the data is usable directly, in particular without the requirement for further post-processing.

Such real-time data may thus not be encrypted or may be encrypted in a way that the mobile device is capable of decrypting, e.g., the mobile device may only be adapted to decrypt an encryption scheme that is less complex or less CPU-intensive, i.e., requires lesser computing resources than, e.g., the encryption that is decrypted on the application server. Alternatively, since the mobile device is in the sphere of influence of the user, a less complex and potentially less secure encryption may be sufficient to adequately secure the data stored (only) on the mobile device. Contrary hereto, since the application server is out of the sphere of control of the user, a more complex and potentially more secure encryption may be used as a transport encryption for data transmitted to and from the application server, or rather between mobile device and application server.

Considering the communication connection, it may be sufficient to have a transport layer encryption or the like between the smoking substitute device and the mobile device, which may be a less complex encryption than the encryption between the mobile device and the application server, in particular may not have any additional encryption. Thus, e.g., the transport layer or channel may provide the encryption between the smoking substitute device and the mobile device, while the data is additionally encrypted, by the smoking substitute device and/or the mobile device, for transmission to the application server.

In this regard, real time data may be seen as data that is transmitted substantially in real time, i.e., transmitted substantially at the time the data is obtained. Contrary hereto, non-real time data may be seen as data that is transmitted not in real time, i.e., transmitted with a time delay from the time the data is obtained and/or it is transmitted only in defined intervals, e.g., every 5 min, 10 min, 15, min 30 min, 60 min, 90 min, 120 min, 4 h, 8 h, 12 h, 24 h, or transmitted upon a trigger event, e.g., an app closure, a termination of a consumable consumption, a termination of a consumption of x consumables, with x being a number like 2 consumed consumables, 3 consumed consumables, 4 consumed consumables, 5 consumed consumables, 10 consumed consumables, 15 consumed consumables, 20 consumed consumables, 25 consumed consumables, at the end of a day, a defined time elapsed since last consumable consumption, e.g., 5 min, 10 min, 15 min, 30 min, 60 min, 90 min, 120 min, 4 h, 8 h, 12 h, 24 h, and the like.

According to a further preferred embodiment of the smoking substitute device, the mobile device may be adapted to be connectable to an application server for communicating with the application server via a network, at least part of the first data may be transmitted to the application server and may be processed by the application server, and in particular at least part of the processed data may be transmitted to the mobile device.

An application server, or a backend server, may provide either dedicated computing power and/or dedicated storage space that may not be available on either the smoking substitute device and/or the mobile device. Such computing power may be required for dedicated processing and analysis of data, and likewise the storage space may be required to make available (historical) usage data required for the processing and analysis of the data. An application server may be a backend server farm, a consumer database system, a consumer management system or the like. Processing of data may at least be a decryption of data, and in particular an analysis of the data. A processing may also comprise a subsequent encryption, to securely store the data on the application server or before transmitting analyzed data back to the mobile device.

According to a further preferred embodiment of the smoking substitute device, the smoking substitute device may be adapted to communicate with the application server via the mobile device, in particular may be adapted to directly communicate with the application server via the mobile device.

In other words, the mobile device may act as a relay between the smoking substitute device and the application server, or may provide a bridge functionality to allow a substantially directly connection between the smoking substitute device and the application server. The mobile device may receive encrypted data from the smoking substitute device to forward to the application server or may likewise receive non-encrypted data from the smoking substitute device to encrypt and the forward to the application server.

According to a further preferred embodiment of the smoking substitute device, the first data may be of a first data type; and the second data may be at least partly of a second data type different from the first data type.

According to a further preferred embodiment of the smoking substitute device, the first data and the second data may be a data type of the group consisting of status data, usage data, consumption data, error data, puff count data, nicotine consumption data, pod count data, fill level data of a consumable, power source level data, lock status data, consumable supply data, sensor data, device identification data and user identification data.

The respective data may be data from the smoking substitute device, in particular may be data from the consumable of the smoking substitute device.

According to a further preferred embodiment of the smoking substitute device, at least part of the second data may be processed by the mobile device, in particular may be at least one of status data, usage data, consumption data, error data, puff count data, pod count data, fill level data of a consumable, power source level data and lock status data, further in particular may be power source level data and puff count data.

In other words, data that may be used directly, in particular without the need to be processed or analyzed before a proper use, may be sent to the mobile device non-encrypted for immediate use by the mobile device. This sending of non-encrypted data to the mobile device and the subsequent use by the mobile device may not exclude that the same data in sent (additionally) as encrypted data or within the encrypted data to the application server so use in subsequent processing and analysis. In other words, at least a part of the data sent in non-encrypted form to the mobile device may also be sent in encrypted form to the application server.

According to a further preferred embodiment of the smoking substitute device, processing data by the mobile device may comprise decryption of encrypted data by the mobile device, and/or processing data by the application server may comprise decryption of encrypted data by the application server.

According to a further preferred embodiment of the smoking substitute system, the mobile device may be adapted to be connectable to an application server for communicating with the application server via a network, at least part of the first data may be transmitted to the application server and may be processed by the application server; and at least part of the second data may be processed by the mobile device.

According to a further preferred embodiment of the smoking substitute system, processing data by the mobile device may comprise decryption of encrypted data by the mobile device, and/or processing data by the application server may comprise decryption of encrypted data by the application server.

According to a further preferred embodiment of the smoking substitute system, the first data may be decryptable by the application server, and/or the second data may be decryptable by the mobile device.

According to a further preferred embodiment of the present disclosure, the method may comprise communicating with the application server via a network, may transmit at least part of the first data to the application server and for processing by the application server, and in particular may transmit at least part of the processed data to the mobile device.

According to a further preferred embodiment of the present disclosure, the method the first data may be decrypted by the application server, and/or the second data may be decrypted by the mobile device.

The disclosure includes the combination of the aspects and preferred features of the tenth mode described except where such a combination is clearly impermissible or expressly avoided.

The skilled person will appreciate that except where mutually exclusive, a feature or parameter described in relation to any one of the above aspects of the tenth mode may be applied to any other aspect. Furthermore, except where mutually exclusive, any feature or parameter described herein may be applied to any aspect and/or combined with any other feature or parameter described herein.

SUMMARY OF THE FIGURES

Embodiments and experiments illustrating the principles of the disclosure will now be discussed with reference to the accompanying figures in which.

DETAILED DESCRIPTION OF THE DISCLOSURE

First Mode: A Smoking Substitute Device and Management of User Generated Data when the Smoking Substitute Device is Connected to an External Device.

Aspects and embodiments of the first mode of the present disclosure will now be discussed with reference to the accompanying figures. Further aspects and embodiments will be apparent to those skilled in the art. All documents mentioned in this text are incorporated herein by reference.

Figure 1:
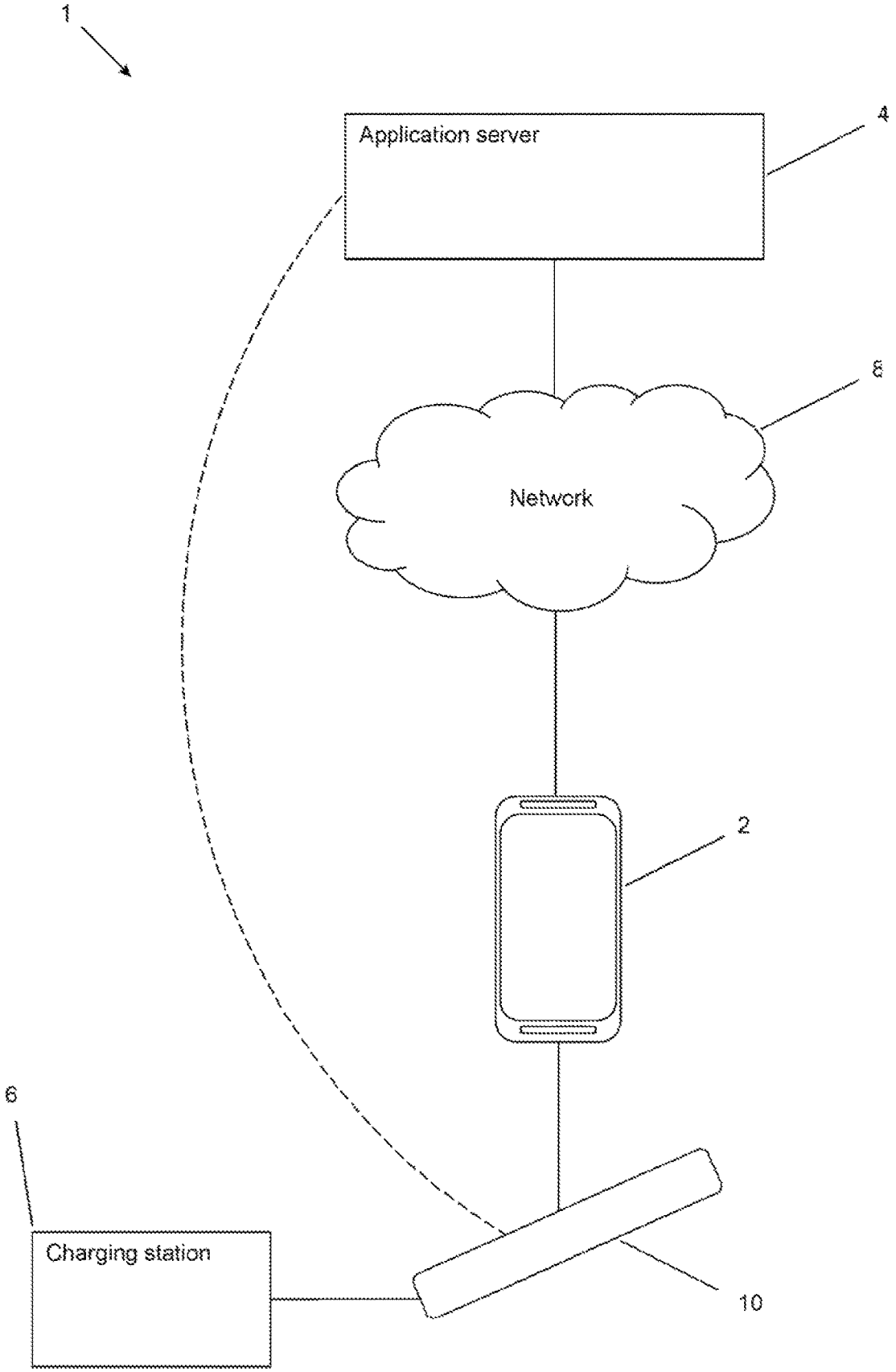
FIG. 1 shows an example system of the first mode for managing a smoking substitute device.

FIG. 1 shows an example system 1 for managing a smoking substitute device 10.

The system 1 as shown in FIG. 1 includes a mobile device 2, an application server 4, an optional charging station 6, as well as the smoking substitute device 10.

The smoking substitute device 10 is configured to communicate wirelessly, e.g., via Bluetooth™, with an application (or "app") installed on the mobile device 2, e.g., via a suitable wireless interface (not shown) on the mobile device 2. The mobile device 2 may be a mobile phone, for example. The application on the mobile phone is configured to communicate with the application server 4, via a network 8. The application server 4 may utilize cloud storage, for example.

The network 8 may include a cellular network and/or the internet.

In other examples, the smoking substitute device 10 may be configured to communicate with the application server 4 via a connection that does not involve the mobile device 2, e.g., via a narrowband internet of things ("NB-IoT") connection. In some examples, the mobile device 2 may be omitted from the system.

A skilled person would readily appreciate that the mobile device 2 may be configured to communicate via the network 8 according to various communication channels, preferably a wireless communication channel such as via a cellular network (e.g., according to a standard protocol, such as 3G or 4G) or via a WIFI network.

The app installed on the mobile device and the application server 4 may be configured to assist a user with their smoking substitute device 10, based on information communicated between the smoking substitute device 10 and the app and/or information communicated between the app and the application server 4. The app may run in the background to handle communication with the smoking substitute device.

The charging station 6 (if present) may be configured to charge (and optionally communicate with) the smoking substitute device 10, via a charging port on the smoking substitute device 10. The charging port on the smoking substitute device 10 may be a USB port, for example, which may allow the smoking substitute device to be charged by any USB-compatible device capable of delivering power to the smoking substitute device 10 via a suitable USB cable (in this case the USB-compatible device would be acting as the charging station 6). Alternatively, the charging station could be a docking station specifically configured to dock with the smoking substitute device 10 and charge the smoking substitute device 10 via the charging port on the smoking substitute device 10.

Figure 2A:
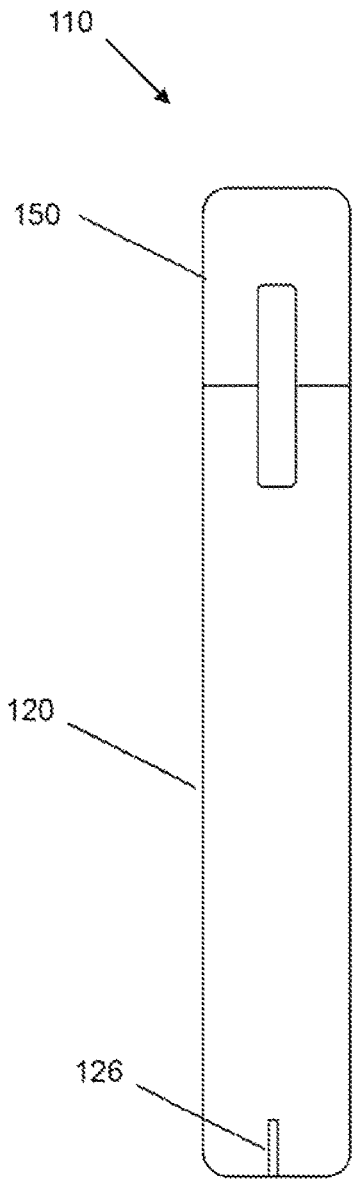
FIG. 2A shows an example smoking substitute device of the first mode for use as the smoking substitute device in the system of FIG. 1.

FIG. 2A shows an example smoking substitute device 110 for use as the smoking substitute device 10 in the system 1 of FIG. 1.

In this example, the smoking substitute device 110 includes a main body 120 and a consumable 150. The consumable 150 may alternatively be referred to as a "pod".

In this example, the smoking substitute device 110 is a closed system vaping device, wherein the consumable 150 includes a sealed tank 156 and is intended for one-use only.

FIG. 2A shows the smoking substitute device 110 with the main body 120 physically coupled to the consumable 150.

Figure 2B:
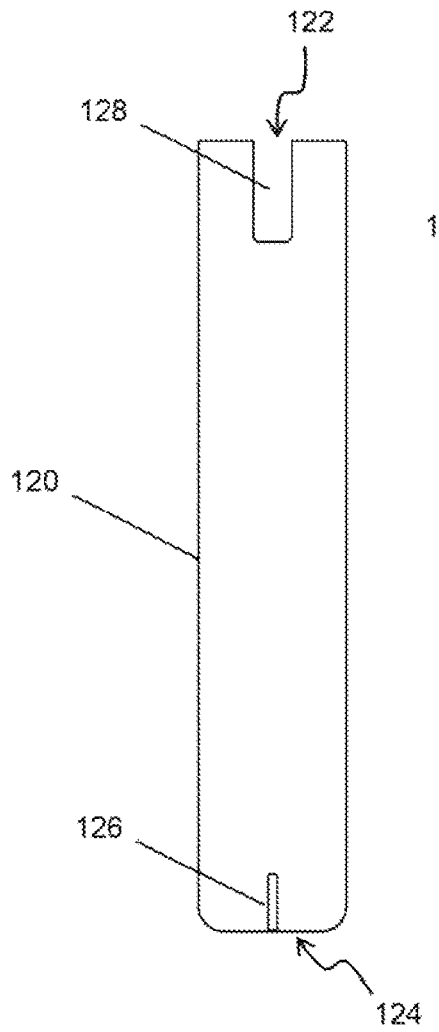
FIG. 2B shows the main body of the smoking substitute device of FIG. 2A without the consumable.

FIG. 2B shows the main body 120 of the smoking substitute device 110 without the consumable 150.

Figure 2C:
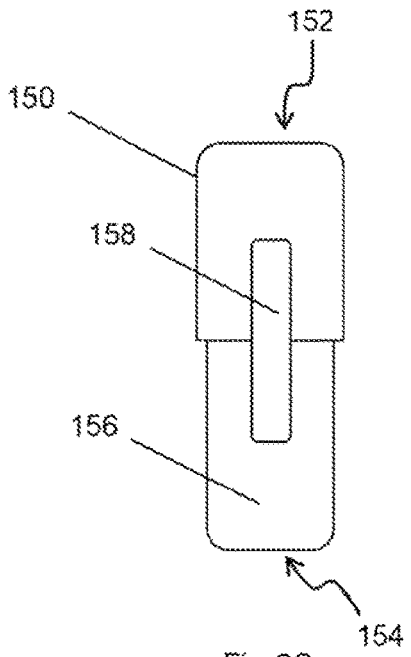
FIG. 2C shows the consumable of the smoking substitute device of FIG. 2A without the main body.

FIG. 2C shows the consumable 150 of the smoking substitute device 110 without the main body 120.

The main body 120 and the consumable 150 are configured to be physically coupled together, in this example by pushing the consumable 150 into an aperture in a top end 122 of the main body 120, e.g., with the consumable 150 being retained in the aperture via an interference fit. In other examples, the main body 120 and the consumable could be physically coupled together by screwing one onto the other, through a bayonet fitting, or through a snap engagement mechanism, for example. An optional light 126, e.g., an LED located behind a small translucent cover, is located at a bottom end 124 of the main body 120. The light 126 may be configured to illuminate when the smoking substitute device 110 is activated.

The consumable 150 includes a mouthpiece (not shown) at a top end 152 of the consumable 150, as well as one or more air inlets (not shown in FIG. 2) so that air can be drawn into the smoking substitute device 110 when a user inhales through the mouthpiece. At a bottom end 154 of the consumable 150, there is located a tank 156 that contains e-liquid. The tank 156 may be a translucent body, for example.

The tank 156 preferably includes a window 158, so that the amount of e-liquid in the tank 156 can be visually assessed. The main body 120 includes a slot 128 so that the window 158 of the consumable 150 can be seen whilst the rest of the tank 156 is obscured from view when the consumable 150 is inserted into the aperture in the top end 122 of the main body 120.

In this present embodiment, the consumable 302 is a "single-use" consumable. That is, upon exhausting the e-liquid in the tank 156, the intention is that the user disposes of the whole consumable 150. In other embodiments, the e-liquid (i.e., aerosol former) may be the only part of the system that is truly "single-use". In such embodiments, the tank 156 may be refillable with e-liquid or the e-liquid may be stored in a non-consumable component of the system. For example, the e-liquid may be stored in a tank located in the device or stored in another component that is itself not single-use (e.g., a refillable tank).

The tank 156 may be referred to as a "clearomizer" if it includes a window 158, or a "cartomizer" if it does not.

Figure 3A:
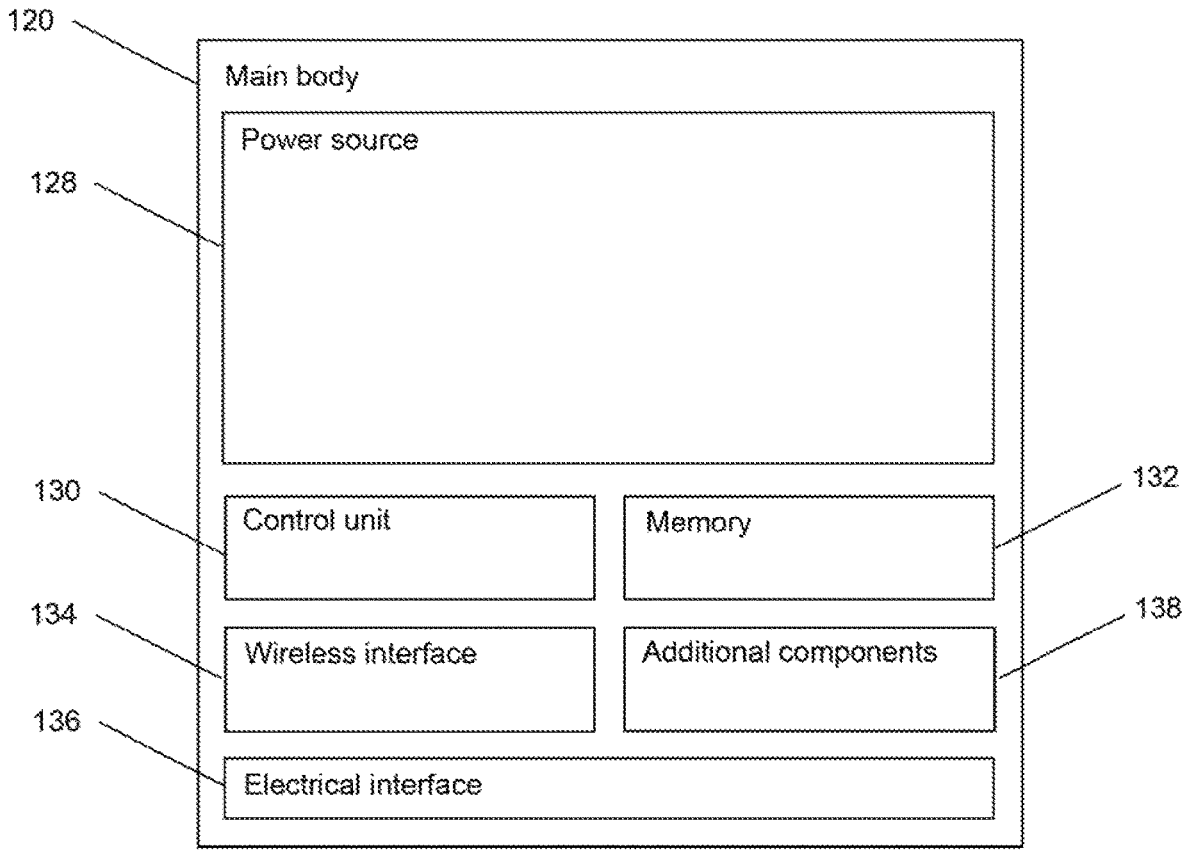
FIG. 3A is a schematic view of the main body of the smoking substitute device of FIG. 2A.

FIG. 3A is a schematic view of the main body 120 of the smoking substitute device 110.

Figure 3B:
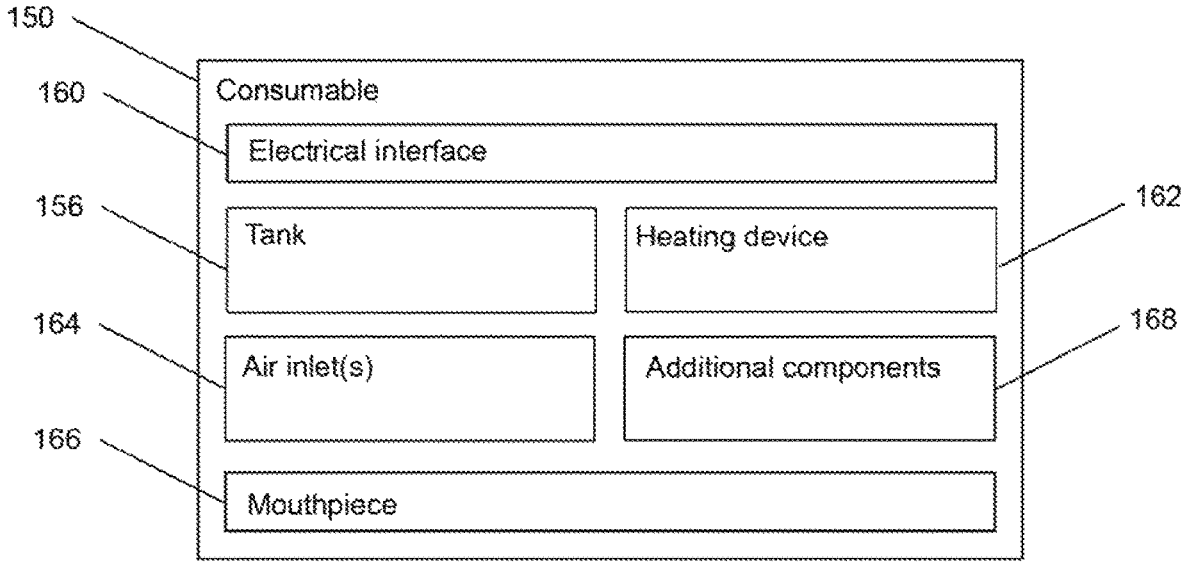
FIG. 3B is a schematic view of the consumable of the smoking substitute device of FIG. 2A.

FIG. 3B is a schematic view of the consumable 150 of the smoking substitute device 110.

As shown in FIG. 3A, the main body 120 includes a power source 128, a control unit 130, a memory 132, a wireless interface 134, an electrical interface 136, and, optionally, one or more additional components 138.

The power source 128 is preferably a battery, more preferably a rechargeable battery.

The control unit 130 may include a microprocessor, for example.

The memory 132 is preferably includes non-volatile memory.

The wireless interface establishes communication over a wireless communication channel between the smoking substitute device and communication terminal of the external device. The wireless interface may utilities any suitable wireless protocol. Suitably, the wireless interface may operate over a short range network. For example, it may comprise a wireless personal area network (WPAN), e.g., using Bluetooth™, ZigBee, a WIFI personal hotspot or the like. The smoking substitute device may pair with the portable communication terminal over the wireless communication channel. The portable communication terminal may be a master device and the smoking substitute device may be a slave device. As such, in exemplary embodiments, the wireless interface 134 is preferably configured to communicate wirelessly with the mobile device 2, e.g., via Bluetooth. To this end, the wireless interface 134 could include a Bluetooth™ antenna. Other wireless communication interfaces, e.g., WIFI, are also possible.

The electrical interface 136 of the main body 120 may include one or more electrical supply contacts. The electrical interface 136 may be located in, and preferably at the bottom of, the aperture in the top end 122 of the main body 120. When the main body 120 is physically coupled to the consumable 150, the electrical interface 136 may be configured to pass electrical power from the power source 128 to (e.g., a heating device of) the consumable 150 when the smoking substitute device 110 is activated, e.g., via the electrical interface 160 of the consumable 150 (discussed below). When the main body 120 is not physically coupled to the consumable 150, the electrical interface may be configured to receive power from the charging station 6.

The additional components 138 of the main body 120 may include the optional light 126 discussed above.

The additional components 138 of the main body 120 may, if the power source 128 is a rechargeable battery, include a charging port configured to receive power from the charging station 6. This may be located at the bottom end 124 of the main body 120. Alternatively, the electrical interface 136 discussed above is configured to act as a charging port configured to receive power from the charging station 6 such that a separate charging port is not required.

The additional components 138 of the main body 120 may, if the power source 128 is a rechargeable battery, include a battery charging control circuit, for controlling the charging of the rechargeable battery. However, a battery charging control circuit could equally be located in the charging station 6 (if present).

The additional components 138 of the main body 120 may include an airflow sensor for detecting airflow in the smoking substitute device 110, e.g., caused by a user inhaling through a mouthpiece 166 (discussed below) of the smoking substitute device 110. The smoking substitute device 110 may be configured to be activated when airflow is detected by the airflow sensor. This optional sensor could alternatively be included in the consumable 150 (though this is less preferred where the consumable 150 is intended to be disposed of after use, as in this example).

The additional components 138 of the main body 120 may include an actuator, e.g., a button. The smoking substitute device 110 may be configured to be activated when the actuator is actuated. This provides an alternative to the airflow sensor noted, as a mechanism for activating the smoking substitute device 110.

The additional components 138 of the main body 120 may include a motion sensor such as an accelerometer. The accelerometer may function as a motion sensor to receive inputs for controlling the device. An accelerometer is, as the skilled reader will know, an electromechanical device that measures acceleration forces, and provides a measure of "proper acceleration", which is the acceleration of a body or object, relative to free fall. The accelerometer comprised within the smoking substitute device, is configured to measure dynamic acceleration forces, and so can sense movement or vibrations. The accelerometer is configured to measure acceleration and its outputs may be used to determine position factors and/or orientation factors such as tilt, tilt angle, and incline, as well as being used to determine actions or events such as rotation, vibration and collision.

The accelerometer may be a piezoelectric accelerometer. However other types of accelerometer may be used in a smoking substitute device, such as a capacitance accelerometer. The accelerometer may comprise a three-axis model, to enable it to sense rotational tilt, as well as movement in a two-dimensional plane.

The accelerometer may be configured to detect movement and collisions, and to provide one or more voltage outputs to the control unit 130, as a result of what it has detected. The accelerometer can, for example, detect the action of the smoking substitute device being tapped against (i.e., relatively gently colliding with) a surface. When the user taps the device, the accelerometer transmits a corresponding voltage signal to the control unit 130. The control unit 130 can then control the memory 132 to store (at least temporarily) a measure of the voltage signal, along with an indicator of the time at which it was received. If the smoking substitute device is currently paired with, or bonded to, a mobile device, it may also submit a signal to the mobile device, via the wireless communication link that has been established between them, regarding the detection that the accelerometer has made. This can be very useful as the smoking substitute device may be preconfigured for a tap (or a plurality of taps) to form part of a sequence for the user to convey instructions to the device and/or to the connected mobile device or application.

The additional components 138 of the main body 120 may include a reading device configured to read information associated with the consumable from a machine readable data source included in (e.g., contained in the body of, or attached to) the consumable 150.

In some examples, the reading device (if present) may be configured to read information from the machine readable data source non-wirelessly, e.g., using an electrical connection between the main body 120 and consumable 150.

For example, the reading device (if present) may include a set of one or more electrical communication contacts configured to read information from the machine readable data source via an electrical connection established between the set of one or more electrical communication contacts and the machine readable data source. Conveniently, the set of one or more electrical communication contacts of the reading device may be configured to provide the electrical connection by engaging with a set of one or more electrical communication contacts of the consumable 150, when the main body 120 and the consumable 150 are physically coupled together.

In some examples, the reading device (if present) may be configured to read information from the machine readable data source wirelessly, e.g., via electromagnetic waves or optically. Thus, for example, the machine readable data source included in the consumable 150 could be an RFID tag (in which case the reading device included in the main body 120 may be an RFID reader) or a visual data source such as a barcode (in which case the reading device included in the main body may be an optical reader, e.g., a barcode scanner).

Various wireless technologies and protocols may be employed to allow the reading device to wirelessly read information from a machine readable data source included in or attached to the consumable 150, e.g., NFC, Bluetooth, Wi-Fi, as would be appreciated by a skilled person.

The reading device (if present) may be configured to write information associated with the consumable to the machine readable data source (e.g., wirelessly or non-wirelessly, via one of the mechanisms discussed above) in addition to being configured to read information associated with the consumable from the machine readable data source. In this case, the reading device may be referred to as a reading/writing device.

As shown in FIG. 3B, the consumable 150 includes the tank 156, an electrical interface 160, a heating device 162, one or more air inlets 164, a mouthpiece 166, and, optionally, one or more additional components 168.

The electrical interface 160 of the consumable 150 may include one or more electrical supply contacts. The electrical interface 136 of the main body 120 and an electrical interface 160 of the consumable 150 are preferably configured to contact each other and therefore electrically couple the main body 120 to the consumable 150 when the main body 120 is physically coupled to the consumable 150. In this way, electrical energy (e.g., in the form of an electrical current) is able to be supplied from the power source 128 in the main body 120 to the heating device 162 in the consumable 150.

The heating device 162 is preferably configured to heat e-liquid contained in the tank 156, e.g., using electrical energy supplied from the power source 128. In one example, the heating device 162 may include a heating filament and a wick, wherein a first portion of the wick extends into the tank 156 in order to draw e-liquid out from the tank 156, and wherein the heating filament coils around a second portion of the wick located outside the tank 156. In this example, the heating filament is configured to heat up e-liquid drawn out of the tank 156 by the wick to produce an aerosol vapor.

The one or more air inlets 164 are preferably configured to allow air to be drawn into the smoking substitute device 110, when a user inhales through the mouthpiece 166.

The additional components 168 of the consumable 150 may include a machine readable data source, which may, e.g., be contained in the body of, or attached to the consumable 150. The machine readable data source may store information associated with the consumable. The information associated with the consumable may include information concerning the content of the consumable (e.g., e-liquid type, batch number) and/or a unique identifier, for example.

The machine readable data source may be rewritable, e.g., a rewritable RFID chip, or read only, e.g., a visual data source such as a barcode. As indicated above, the additional components 138 of the main body 120 may include a reading device configured to read information associated with the consumable from the machine readable data source.

For example, the electrical interface 160 of the consumable 150 may include a set of one or more electrical communication contacts, which may allow a reading device of the main body to read information from a machine readable data source of the consumable, e.g., as discussed previously.

In use, a user activates the smoking substitute device 110, e.g., through actuating an actuator included in the main body 120 or by inhaling through the mouthpiece 166 as described above. Upon activation, the control unit 130 may supply electrical energy from the power source 128 to the heating device 162 (via electrical interfaces 136, 166), which may cause the heating device 162 to heat e-liquid drawn from the tank 156 to produce a vapor which is inhaled by a user through the mouthpiece 166.

Of course, a skilled reader would readily appreciate that the smoking substitute device 110 shown in FIGS. 2 and 3 shows just one example implementation of a smoking substitute device, and that other forms of smoking substitute device could be used as the smoking substitute device 10 of FIG. 1.

By way of example, a HNB smoking substitute device including a main body and a consumable could be used as the smoking substitute device 10 of FIG. 1, instead of the smoking substitute device 110. One such HNB smoking substitute device is the IQOS™ smoking substitute device discussed above.

As another example, an open system vaping device which includes a main body, a refillable tank, and a mouthpiece could be used as the smoking substitute device 10 of FIG. 1, instead of the smoking substitute device 110. One such open system vaping device is the blu PRO™ e-cigarette discussed above.

As another example, an entirely disposable (one use) smoking substitute device could be used as the smoking substitute device 10 of FIG. 1, instead of the smoking substitute device 110.

Figure 4:
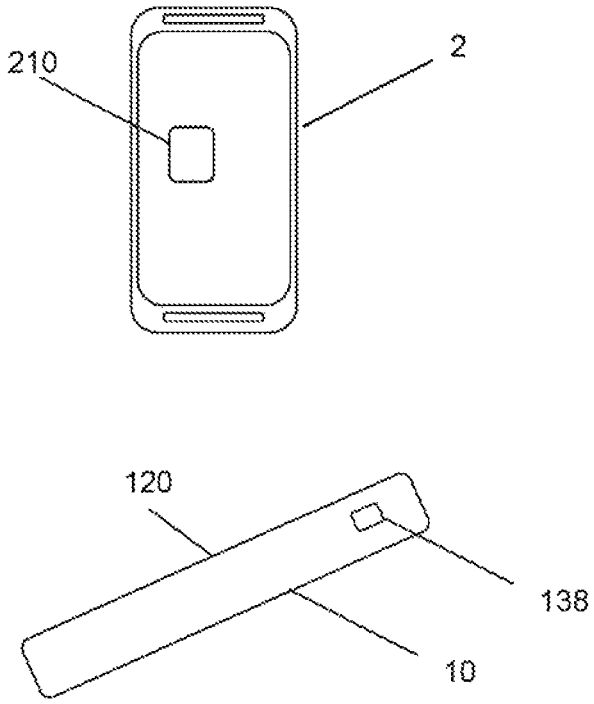
FIG. 4. is an example schematic view of a system of the first mode for managing the reset of a smoking substitute device according to an exemplary embodiment.

Referring to FIG. 4, an exemplary embodiment is shown wherein the system comprises an external device 2 and a smoking substitute device 10. The devices 2, 10 can be as explained above, but specific features relating to the deletion of user data are herein further described. The external device is shown as suitably being a smart telephone operating an application. However, it will be appreciated that other devices such as tablet computers, smart watches or the like may be equally applicable. The external device 2 runs the application that can be used as a user interface between the user and the smoking substitute device. In order to establish communication between the external device and smoking substitute device, the smoking substitute device includes a communications interface and the external device is connected thereto. Whilst a wired connection would provide a suitable connection, it is envisaged that a more preferable connection would be a wireless connection as discussed above. Therefore, upon initial set up of the system, it will be appreciated that the application may be used to pair the external device with the smoking substitute device. For instance, the application may complete a Bluetooth pairing operation or another operation to establish the external device as a trusted device. With communication between the devices established, the external device can communicate with the smoking substitute device via the application and the smoking substitute device can communicate with the application by being controlled to transmit data via the communication interface. The substitute smoking device may store details of the trusted device or Bluetooth pairing or other details of the external device as user data in a memory 132 as described above.

The smoking substitute device's body 120 houses an additional component that in one embodiment is as an actuator. Suitably, the actuator is shown as a button 138. Here, the button 138 is arranged to be activated from an exterior of the smoking substitute device. Typically, the button is activated by pressing as is known in the art. The button 138 may have another operational purpose in which case the firmware is configured to differentiate between an input to trigger said other operational purpose and a reset operation input by a variance in the press condition, frequency, press pattern or the like. For instance, a short press where the button 138 is pressed for less than a second may determine an input operation, whereas a long press may determine a reset operation. The long press may be determined as a press and hold of the button for more than two seconds or more than 3 seconds.

Where the smoking substitute device does not require a button 138, or as an alternative or additional rest operation input, an alternative additional component may be utilized. For instance, the additional component may be an accelerometer arranged to monitor taps of the smoking substitute device's body. Again, where the accelerometer is arranged to determine other operational commands the firmware is configured to differentiate between commands by identifying specific tap or tap pattern characteristics. To avoid the reset operation being inadvertently activated, the specific push or tap or other input characteristic or pattern is selected to be complex to reduce the pattern being replicated from manipulations during general use or whilst stowed. Moreover, the actuator may be arranged to be concealed or protected or difficult to access in order to reduce any unintended activations.

Although not depicted in FIG. 4, the body 120 also houses memory 132. The memory as described above is arranged to store firmware data that is used by a control unit 130 to perform the operational functions of the smoking substitute device as is known in the art. For instance, the control unit uses the firmware to control the communication unit to complete communication steps and to monitor the additional component for user inputs and to store user data in the memory. User data is typically stored as non-volatile memory and is generated during operation of the smoking substitute device. For instance, the user data may be logs of operational details such as the time at which an inhale began, the duration or pressure or flow rate of an inhale, battery characteristics such as charge status or connection status, temperature details, error events, or the like. Where a consumable is inserted, the user data may include details such as time and number of consumables inserted, coil temperature and resistance details, and where supported, details of the type or other data of the consumable. It will be appreciated that to record the one or more desired user data, further hardware of the smoking substitute device may be required and/or further additional components as described above or otherwise known in the art.

Figure 5:
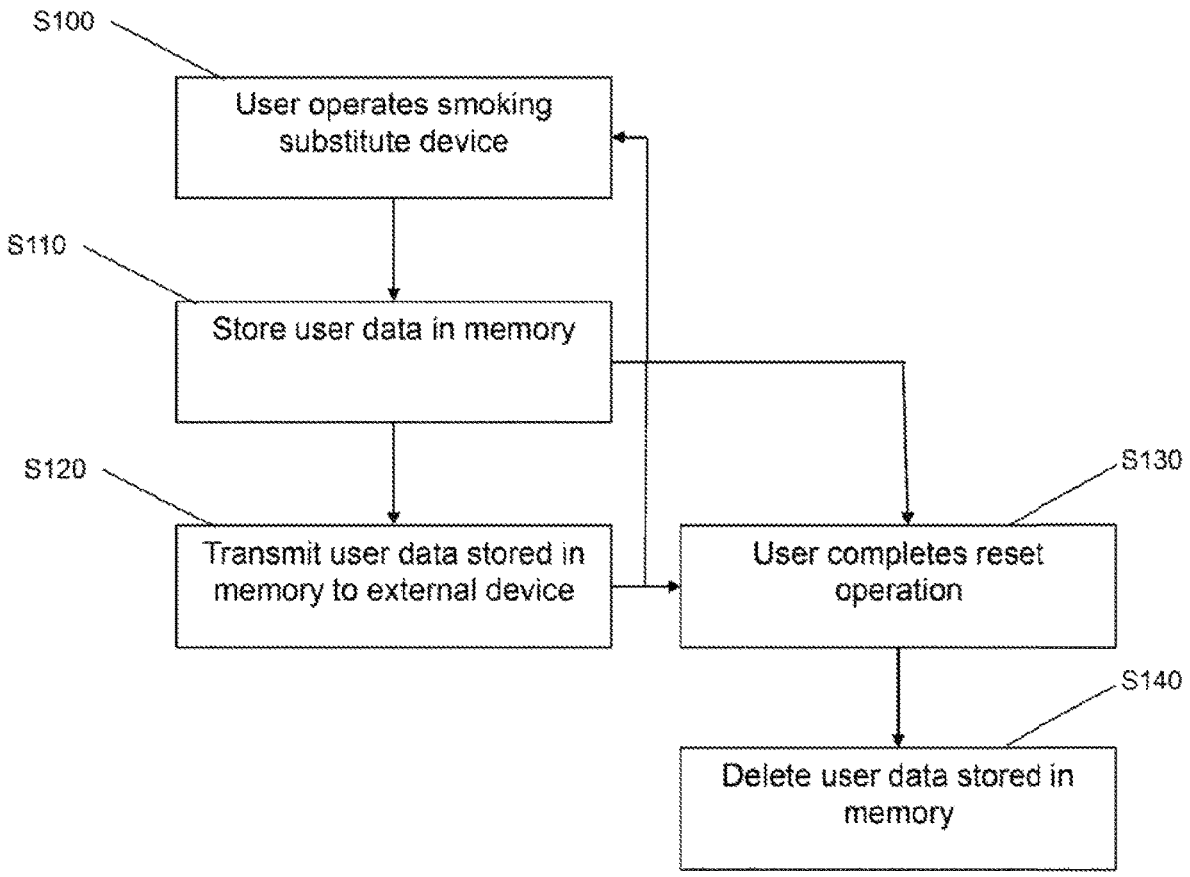
FIG. 5. is a flow chart of a reset method of the first mode to automatically delete user generated data from a smoking substitute device according to an exemplary embodiment.

FIG. 5 shows a method of managing a smoking substitute device 2. At step S100 a user operates the smoking substitute device. At step S110, the control unit stores user data in the memory of the smoking substitute device. Subsequent to step S110, at step S120, the control unit controls the communication interface to transmit user data stored in the memory to an external device. It will be appreciated that Steps S100, S110 and S120 may be repeated multiple times, periodically and/or at varying intervals as required by the use of the smoking substitute device.

Subsequent to step S110, at step S130, a user completes a reset operation. At Step S140, the control unit identifies the reset operation and deletes user data stored in the memory. Here, the control unit can recognize the reset operation as either a predetermined manipulation of the additional component or receipt by the communication interface of a reset command from the external device. That is, either through a hardware triggered reset or a software triggered reset.

It will be appreciated that the hardware triggered reset requires a specific manipulation of the smoking substitute device by the user. For instance, in the example wherein the additional component is a button 136, the management method includes the step of the user pressing the button to replicate the push time or push pattern predetermined as a reset operation input.

Further, it will be appreciated that the software triggered reset requires the user to complete a step of triggering the reset command to be transmitted to and received by the communication interface of the smoking substitute device. For instance, the user activates the reset command through the application operating on the external device. It will be appreciated that when using a wireless communication connection, prior to step S120, the user may complete a pairing or authorization step so that the external device is trusted by the smoking substitute device.

Figure 6:
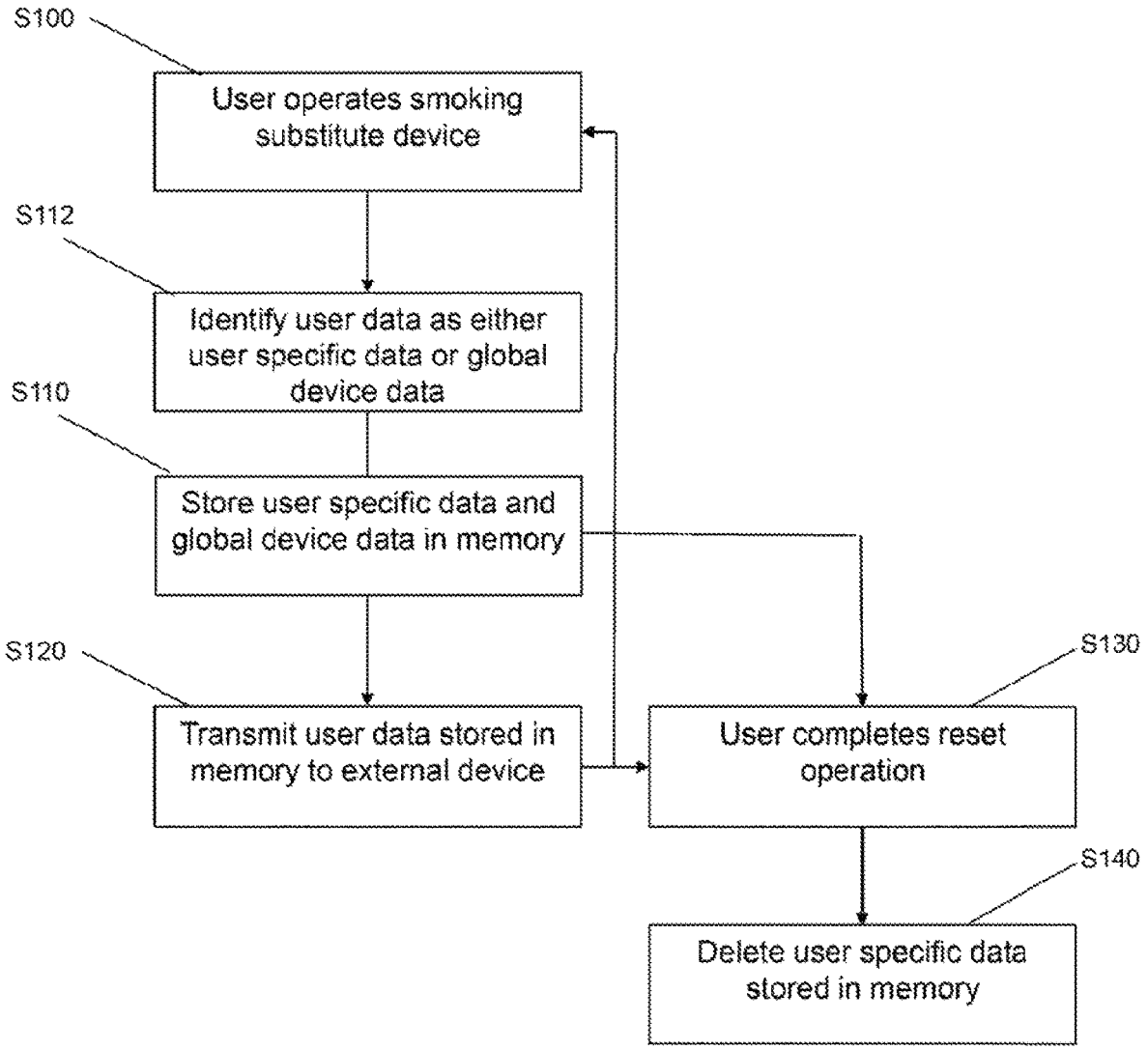
FIG. 6. is a flow chart of a reset method of the first mode to automatically delete user generated data from a smoking substitute device according to another exemplary embodiment.

FIG. 6 shows a further exemplary method embodiment, wherein the step S110 of storing user data in the memory further includes the step S112 of first identifying the user data as either user specific data or global device data. After identifying and categorizing the user data, the controller stores both categories of user data in the memory. The controller may be configured to store the user specific data in a separate area to the global device data. The memory may be organized so that the user specific data is overwritten when the memory becomes full on a first-in-first-out basis. In step S112 of identifying the category of user data, the controller may determine global device data as user data that is logged apportioned over the lifetime of operational use of the smoking substitute device. This global device data is not overwritten or deleted as part of a reset operation. The controller may identify user specific data as user data that is logged over apportioned over a period of time since the last reset operation or, if no previous reset operation has occurred, since the start of operation of the smoking substitute device.

In the exemplary embodiment, Step S140 of deleting user data from the memory comprises deleting user specific data. Here, the user data identified as global device data is not deleted. Consequently, a subsequent connected device can still access lifetime data from the memory of the smoking substitute device in order to provide useful information or feedback or predictive analysis on the device's operational performance.

The features disclosed in the foregoing description, or in the following claims, or in the accompanying drawings, expressed in their specific forms or in terms of a means for performing the disclosed function, or a method or process for obtaining the disclosed results, as appropriate, may, separately, or in any combination of such features, be utilized for realizing the disclosure in diverse forms thereof.

While the disclosure has been described in conjunction with the exemplary embodiments described above, many equivalent modifications and variations will be apparent to those skilled in the art when given this disclosure. Accordingly, the exemplary embodiments of the disclosure set forth above are considered to be illustrative and not limiting. Various changes to the described embodiments may be made without departing from the spirit and scope of the disclosure.

For the avoidance of any doubt, any theoretical explanations provided herein are provided for the purposes of improving the understanding of a reader. The inventors do not wish to be bound by any of these theoretical explanations.

Any section headings used herein are for organizational purposes only and are not to be construed as limiting the subject matter described.

Throughout this specification, including the claims which follow, unless the context requires otherwise, the word "comprise" and "include", and variations such as "comprises", "comprising", and "including" will be understood to imply the inclusion of a stated integer or step or group of integers or steps but not the exclusion of any other integer or step or group of integers or steps.

It must be noted that, as used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by the use of the antecedent "about," it will be understood that the particular value forms another embodiment. The term "about" in relation to a numerical value is optional and means for example +/−10%.

Second Mode: A Smoking Substitute Device and Management of Firmware Updates when the Smoking Substitute Device is Connected to an External Device.

Aspects and embodiments of the second mode of the present disclosure will now be discussed with reference to the accompanying figures. Further aspects and embodiments will be apparent to those skilled in the art. All documents mentioned in this text are incorporated herein by reference.

Figure 7:
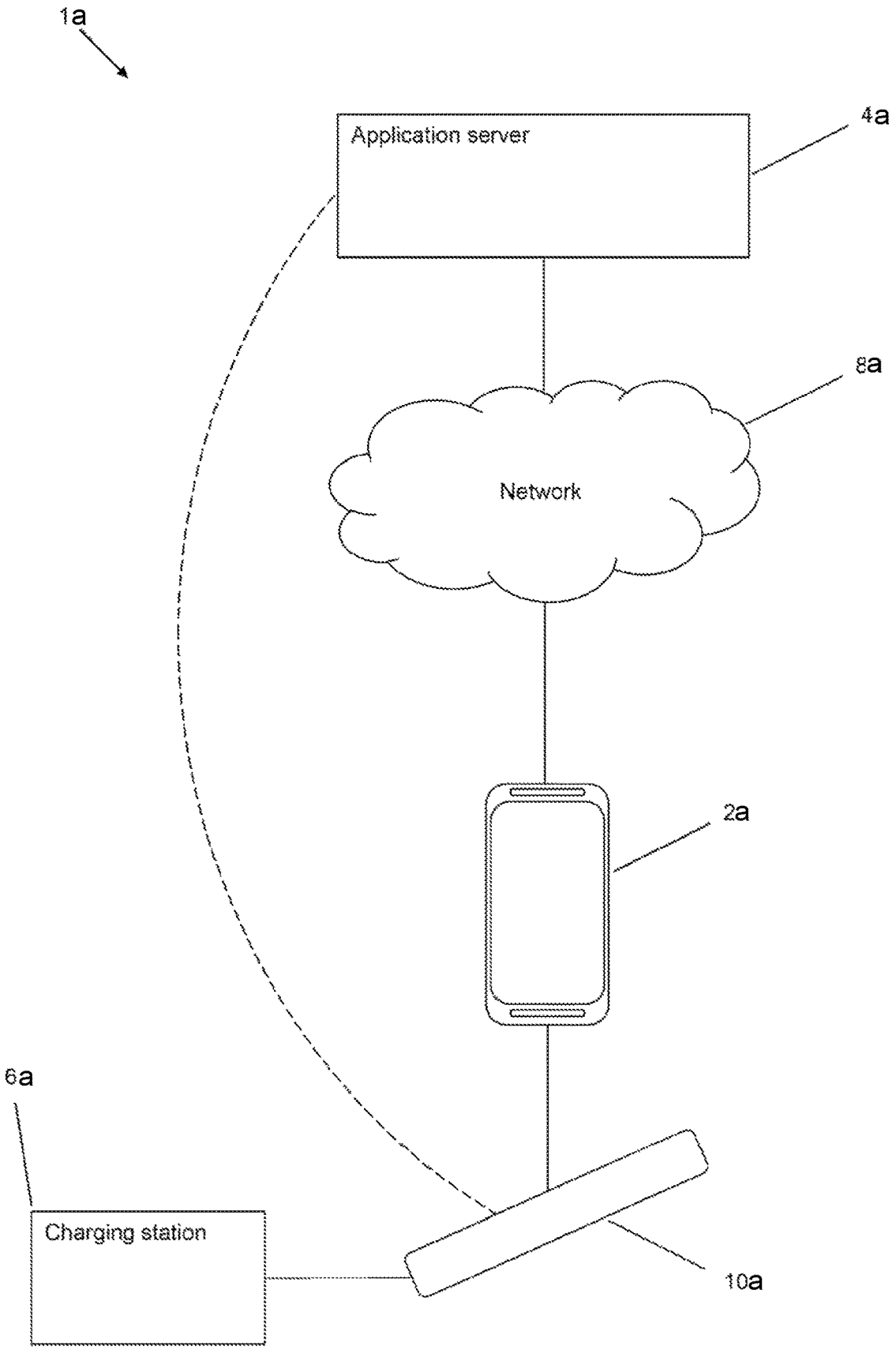
FIG. 7 shows an example system of the second mode for managing a smoking substitute device.

FIG. 7 shows an example system 1*a* for managing a smoking substitute device 10*a*.

The system 1*a* as shown in FIG. 7 includes a mobile device 2*a*, an application server 4*a*, an optional charging station 6*a*, as well as the smoking substitute device 10*a*.

The smoking substitute device 10*a* is configured to communicate wirelessly, e.g., via Bluetooth™, with an application (or "app") installed on the mobile device 2*a*, e.g., via a suitable wireless interface (not shown) on the mobile device 2*a*. The mobile device 2*a* may be a mobile phone, for example. The application on the mobile phone is configured to communicate with the application server 4*a*, via a network 8*a*. The application server 4*a* may utilize cloud storage, for example.

The network 8*a* may include a cellular network and/or the internet.

In other examples, the smoking substitute device 10*a* may be configured to communicate with the application server 4*a* via a connection that does not involve the mobile device 2*a*, e.g., via a narrowband internet of things ("NB-IoT") connection. In some examples, the mobile device 2*a* may be omitted from the system.

A skilled person would readily appreciate that the mobile device 2*a* may be configured to communicate via the network 8*a* according to various communication channels, preferably a wireless communication channel such as via a cellular network (e.g., according to a standard protocol, such as 3G or 4G) or via a WIFI network.

The app installed on the mobile device and the application server 4*a* may be configured to assist a user with their smoking substitute device 10*a*, based on information communicated between the smoking substitute device 10*a* and the app and/or information communicated between the app and the application server 4*a*. The app may run in the background to handle communication with the smoking substitute device.

The charging station 6*a* (if present) may be configured to charge (and optionally communicate with) the smoking substitute device 10*a*, via a charging port on the smoking substitute device 10*a*. The charging port on the smoking substitute device 10*a* may be a USB port, for example, which may allow the smoking substitute device to be charged by any USB-compatible device capable of delivering power to the smoking substitute device 10*a* via a suitable USB cable (in this case the USB-compatible device would be acting as the charging station 6*a*). Alternatively, the charging station could be a docking station specifically configured to dock with the smoking substitute device 10*a* and charge the smoking substitute device 10*a* via the charging port on the smoking substitute device 10*a*.

Figure 8A:
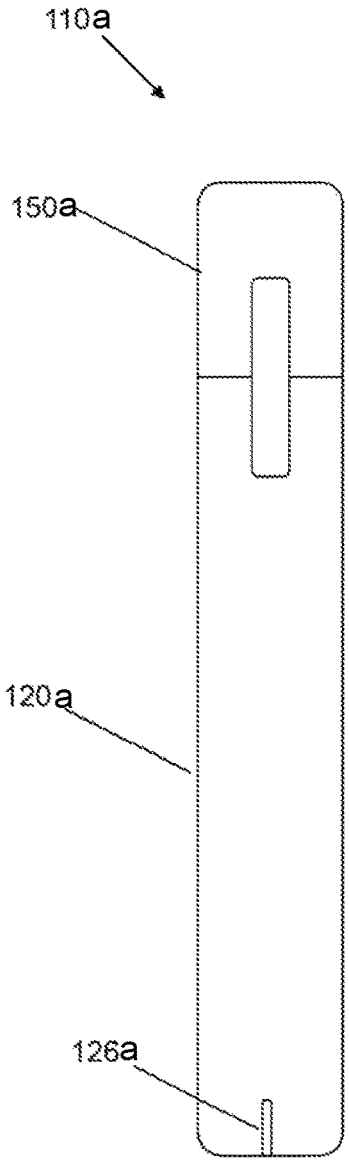
FIG. 8A shows an example smoking substitute device for use as the smoking substitute device in the system of FIG. 7.

FIG. 8A shows an example smoking substitute device 110*a* for use as the smoking substitute device 10*a* in the system 1*a* of FIG. 7.

In this example, the smoking substitute device 110*a* includes a main body 120*a* and a consumable 150*a*. The consumable 150*a* may alternatively be referred to as a "pod".

In this example, the smoking substitute device 110*a* is a closed system vaping device, wherein the consumable 150*a* includes a sealed tank 156*a* and is intended for one-use only.

FIG. 8A shows the smoking substitute device 110*a* with the main body 120*a* physically coupled to the consumable 150*a*.

Figure 8B:
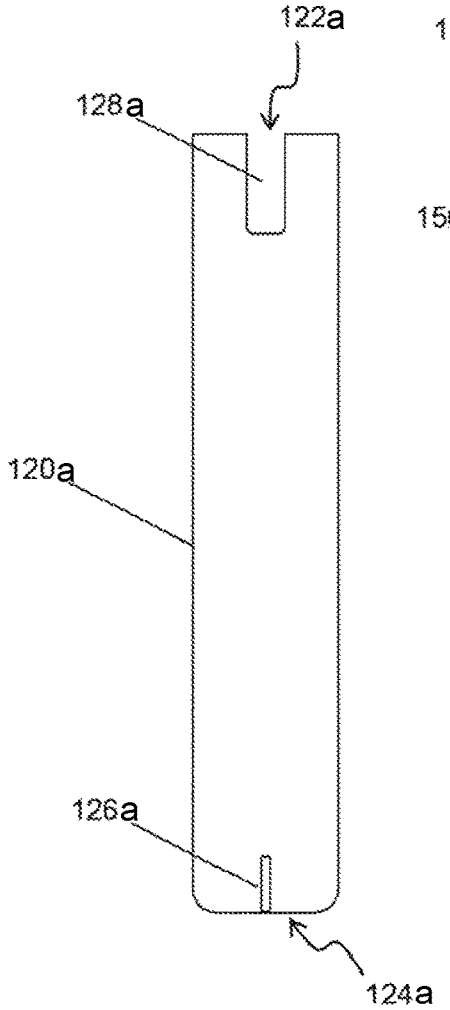
FIG. 8B shows the main body of the smoking substitute device of FIG. 8A without the consumable.

FIG. 8B shows the main body 120*a* of the smoking substitute device 110*a* without the consumable 150*a*.

Figure 8C:
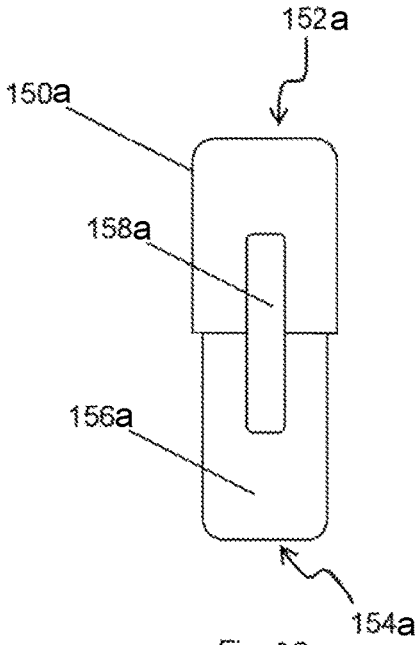
FIG. 8C shows the consumable of the smoking substitute device of FIG. 8A without the main body.

FIG. 8C shows the consumable 150*a* of the smoking substitute device 110*a* without the main body 120*a*.

The main body 120*a* and the consumable 150*a* are configured to be physically coupled together, in this example by pushing the consumable 150*a* into an aperture in a top end 122*a* of the main body 120*a*, e.g., with the consumable 150*a* being retained in the aperture via an interference fit. In other examples, the main body 120*a* and the consumable could be physically coupled together by screwing one onto the other, through a bayonet fitting, or through a snap engagement mechanism, for example. An optional light 126*a*, e.g., an LED located behind a small translucent cover, is located a bottom end 124*a* of the main body 120*a*. The light 126*a* may be configured to illuminate when the smoking substitute device 110*a* is activated.

The consumable 150*a* includes a mouthpiece (not shown) at a top end 152*a* of the consumable 150*a*, as well as one or more air inlets (not shown in FIG. 8) so that air can be drawn into the smoking substitute device 110*a* when a user inhales through the mouthpiece. At a bottom end 154*a* of the consumable 150*a*, there is located a tank 156*a* that contains e-liquid. The tank 156*a* may be a translucent body, for example.

The tank 156*a* preferably includes a window 158*a*, so that the amount of e-liquid in the tank 156*a* can be visually assessed. The main body 120*a* includes a slot 128*a* so that the window 158*a* of the consumable 150*a* can be seen whilst the rest of the tank 156*a* is obscured from view when the consumable 150*a* is inserted into the aperture in the top end 122*a* of the main body 120*a*.

In this present embodiment, the consumable 302*a* is a "single-use" consumable. That is, upon exhausting the e-liquid in the tank 156*a*, the intention is that the user disposes of the whole consumable 150*a*. In other embodiments, the e-liquid (i.e., aerosol former) may be the only part of the system that is truly "single-use". In such embodiments, the tank 156*a* may be refillable with e-liquid or the e-liquid may be stored in a non-consumable component of the system. For example, the e-liquid may be stored in a tank located in the device or stored in another component that is itself not single-use (e.g., a refillable tank).

The tank 156*a* may be referred to as a "clearomizer" if it includes a window 158*a*, or a "cartomizer" if it does not.

Figure 9A:
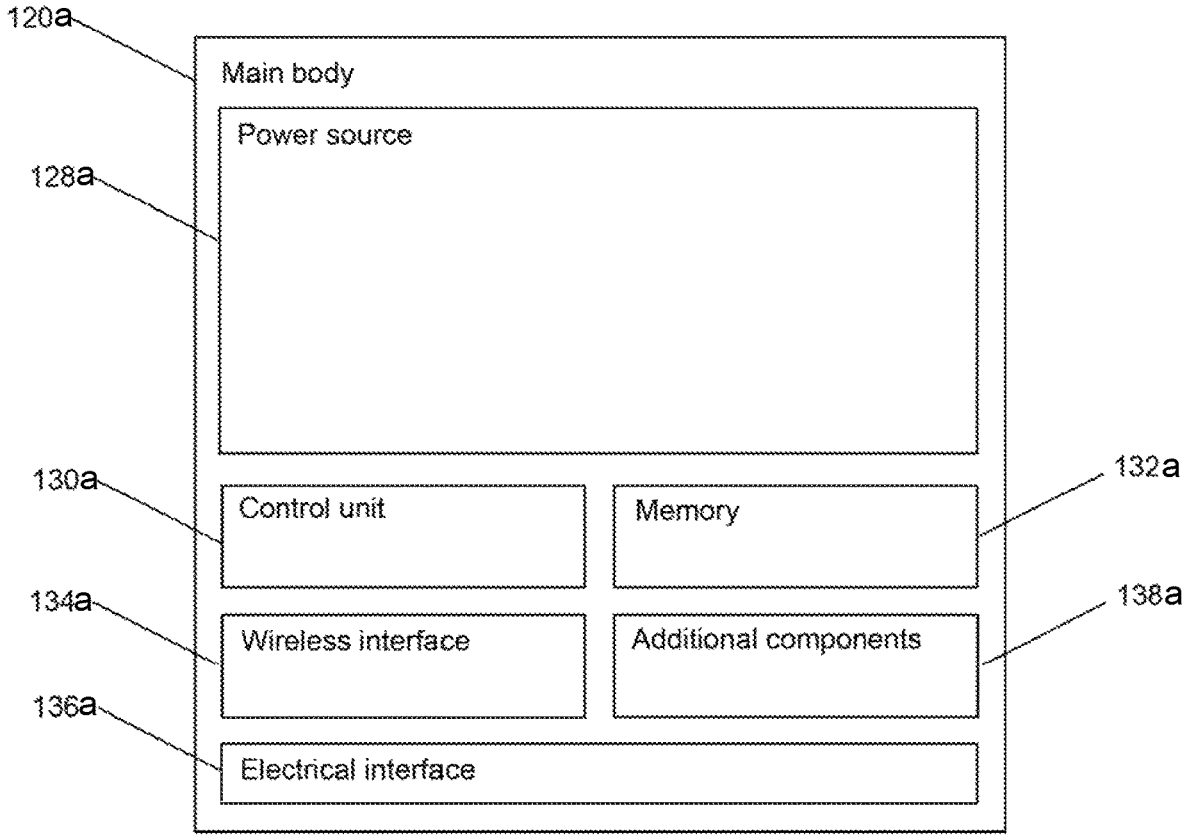
FIG. 9A is a schematic view of the main body of the smoking substitute device of FIG. 8A.

FIG. 9A is a schematic view of the main body 120*a* of the smoking substitute device 110*a*.

Figure 9B:
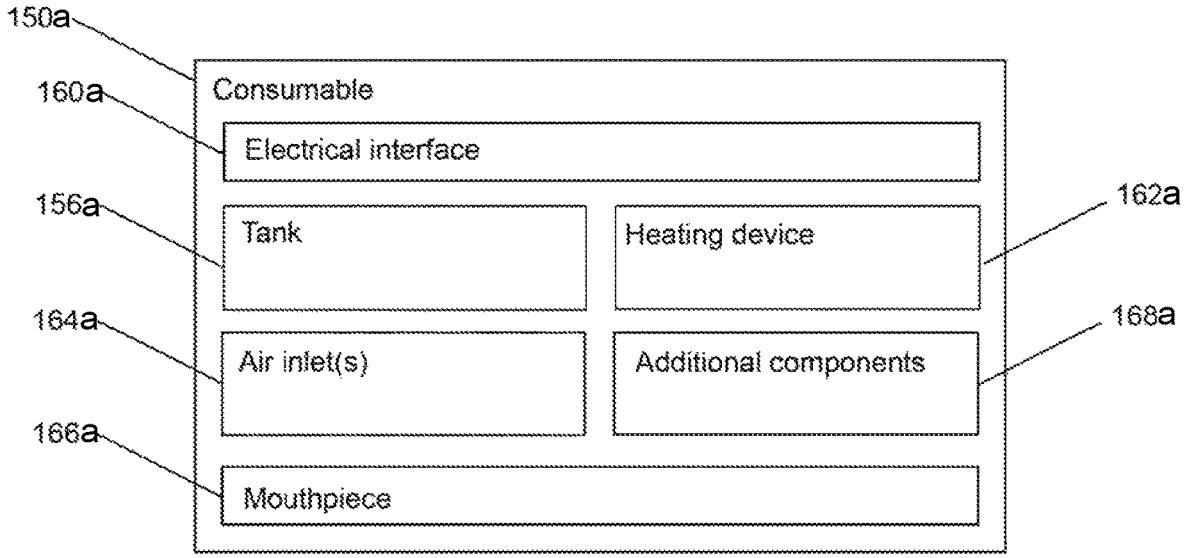
FIG. 9B is a schematic view of the consumable of the smoking substitute device of FIG. 8A.

FIG. 9B is a schematic view of the consumable 150*a* of the smoking substitute device 110*a*.

As shown in FIG. 9A, the main body 120*a* includes a power source 128*a*, a control unit 130*a*, a memory 132*a*, a wireless interface 134*a*, an electrical interface 136*a*, and, optionally, one or more additional components 138*a*.

The power source 128*a* is preferably a battery, more preferably a rechargeable battery.

The control unit 130*a* may include a microprocessor, for example.

The memory 132*a* is preferably includes non-volatile memory.

The wireless interface establishes communication over a wireless communication channel between the smoking substitute device and communication terminal of the external device. The wireless interface may utilities any suitable wireless protocol. Suitably, the wireless interface may operate over a short range network. For example, it may comprise a wireless personal area network (WPAN), e.g., using Bluetooth™, ZigBee, a WIFI personal hotspot or the like. The smoking substitute device may pair with the portable communication terminal over the wireless communication channel. The portable communication terminal may be a master device and the smoking substitute device may be a slave device. As such, in exemplary embodiments, the wireless interface 134*a* is preferably configured to communicate wirelessly with the mobile device 2*a*, e.g., via Bluetooth. To this end, the wireless interface 134*a* could include a Bluetooth™ antenna. Other wireless communication interfaces, e.g., WIFI, are also possible.

The electrical interface 136*a* of the main body 120*a* may include one or more electrical supply contacts. The electrical interface 136*a* may be located in, and preferably at the bottom of, the aperture in the top end 122*a* of the main body 120*a*. When the main body 120*a* is physically coupled to the consumable 150*a*, the electrical interface 136*a* may be configured to pass electrical power from the power source 128*a* to (e.g., a heating device of) the consumable 150*a* when the smoking substitute device 110*a* is activated, e.g., via the electrical interface 160*a* of the consumable 150*a* (discussed below). When the main body 120*a* is not physically coupled to the consumable 150*a*, the electrical interface may be configured to receive power from the charging station 6*a*.

The additional components 138*a* of the main body 120*a* may include the optional light 126*a* discussed above.

The additional components 138*a* of the main body 120*a* may, if the power source 128*a* is a rechargeable battery, include a charging port configured to receive power from the charging station 6*a*. This may be located at the bottom end 124*a* of the main body 120*a*. Alternatively, the electrical interface 136*a* discussed above is configured to act as a charging port configured to receive power from the charging station 6*a* such that a separate charging port is not required.

The additional components 138*a* of the main body 120*a* may, if the power source 128*a* is a rechargeable battery, include a battery charging control circuit, for controlling the charging of the rechargeable battery. However, a battery charging control circuit could equally be located in the charging station 6*a* (if present).

The additional components 138*a* of the main body 120*a* may include an airflow sensor for detecting airflow in the smoking substitute device 110*a*, e.g., caused by a user inhaling through a mouthpiece 166*a* (discussed below) of the smoking substitute device 110*a*. The smoking substitute device 110*a* may be configured to be activated when airflow is detected by the airflow sensor. This optional sensor could alternatively be included in the consumable 150*a* (though this is less preferred where the consumable 150*a* is intended to be disposed of after use, as in this example).

The additional components 138*a* of the main body 120*a* may include an actuator, e.g., a button. The smoking substitute device 110*a* may be configured to be activated when the actuator is actuated. This provides an alternative to the airflow sensor noted, as a mechanism for activating the smoking substitute device 110*a*.

The additional components 138*a* of the main body 120*a* may include a reading device configured to read information associated with the consumable from a machine readable data source included in (e.g., contained in the body of, or attached to) the consumable 150*a*.

In some examples, the reading device (if present) may be configured to read information from the machine readable data source non-wirelessly, e.g., using an electrical connection between the main body 120*a* and consumable 150*a*.

For example, the reading device (if present) may include a set of one or more electrical communication contacts configured to read information from the machine readable data source via an electrical connection established between the set of one or more electrical communication contacts and the machine readable data source. Conveniently, the set of one or more electrical communication contacts of the reading device may be configured to provide the electrical connection by engaging with a set of one or more electrical communication contacts of the consumable 150*a*, when the main body 120*a* and the consumable 150*a* are physically coupled together.

In some examples, the reading device (if present) may be configured to read information from the machine readable data source wirelessly, e.g., via electromagnetic waves or optically. Thus, for example, the machine readable data source included in the consumable 150*a* could be an RFID tag (in which case the reading device included in the main body 120*a* may be an RFID reader) or a visual data source such as a barcode (in which case the reading device included in the main body may be an optical reader, e.g., a barcode scanner). Various wireless technologies and protocols may be employed to allow the reading device to wirelessly read information from a machine readable data source included in or attached to the consumable 150*a*, e.g., NFC, Bluetooth, Wi-Fi, as would be appreciated by a skilled person.

The reading device (if present) may be configured to write information associated with the consumable to the machine readable data source (e.g., wirelessly or non-wirelessly, via one of the mechanisms discussed above) in addition to being configured to read information associated with the consumable from the machine readable data source. In this case, the reading device may be referred to as a reading/writing device.

As shown in FIG. 9B, the consumable 150*a* includes the tank 156*a*, an electrical interface 160*a*, a heating device 162*a*, one or more air inlets 164*a*, a mouthpiece 166*a*, and, optionally, one or more additional components 168*a*.

The electrical interface 160*a* of the consumable 150*a* may include one or more electrical supply contacts. The electrical interface 136*a* of the main body 120*a* and an electrical interface 160*a* of the consumable 150*a* are preferably configured to contact each other and therefore electrically couple the main body 120*a* to the consumable 150*a* when the main body 120*a* is physically coupled to the consumable 150*a*. In this way, electrical energy (e.g., in the form of an electrical current) is able to be supplied from the power source 128*a* in the main body 120*a* to the heating device 162*a* in the consumable 150*a*.

The heating device 162*a* is preferably configured to heat e-liquid contained in the tank 156*a*, e.g., using electrical energy supplied from the power source 128*a*. In one example, the heating device 162*a* may include a heating filament and a wick, wherein a first portion of the wick extends into the tank 156*a* in order to draw e-liquid out from the tank 156*a*, and wherein the heating filament coils around a second portion of the wick located outside the tank 156*a*. In this example, the heating filament is configured to heat up e-liquid drawn out of the tank 156*a* by the wick to produce an aerosol vapor.

The one or more air inlets 164*a* are preferably configured to allow air to be drawn into the smoking substitute device 110*a*, when a user inhales through the mouthpiece 166*a*.

The additional components 168*a* of the consumable 150*a* may include a machine readable data source, which may, e.g., be contained in the body of, or attached to the consumable 150*a*. The machine readable data source may store information associated with the consumable. The information associated with the consumable may include information concerning the content of the consumable (e.g., e-liquid type, batch number) and/or a unique identifier, for example.

The machine readable data source may be rewritable, e.g., a rewritable RFID chip, or read only, e.g., a visual data source such as a barcode. As indicated above, the additional components 138*a* of the main body 120*a* may include a reading device configured to read information associated with the consumable from the machine readable data source.

For example, the electrical interface 160*a* of the consumable 150*a* may include a set of one or more electrical communication contacts, which may allow a reading device of the main body to read information from a machine readable data source of the consumable, e.g., as discussed previously.

In use, a user activates the smoking substitute device 110*a*, e.g., through actuating an actuator included in the main body 120*a* or by inhaling through the mouthpiece 166*a* as described above. Upon activation, the control unit 130*a* may supply electrical energy from the power source 128*a* to the heating device 162*a* (via electrical interfaces 136*a*, 166*a*), which may cause the heating device 162*a* to heat e-liquid drawn from the tank 156*a* to produce a vapor which is inhaled by a user through the mouthpiece 166*a*.

Of course, a skilled reader would readily appreciate that the smoking substitute device 110*a* shown in FIGS. 8 and 9 shows just one example implementation of a smoking substitute device, and that other forms of smoking substitute device could be used as the smoking substitute device 10*a* of FIG. 7.

By way of example, a HNB smoking substitute device including a main body and a consumable could be used as the smoking substitute device 10*a* of FIG. 7, instead of the smoking substitute device 110*a*. One such HNB smoking substitute device is the IQOS™ smoking substitute device discussed above.

As another example, an open system vaping device which includes a main body, a refillable tank, and a mouthpiece could be used as the smoking substitute device 10*a* of FIG. 7, instead of the smoking substitute device 110*a*. One such open system vaping device is the blu PRO™ e-cigarette discussed above.

As another example, an entirely disposable (one use) smoking substitute device could be used as the smoking substitute device 10*a* of FIG. 7, instead of the smoking substitute device 110*a*.

Figure 10:
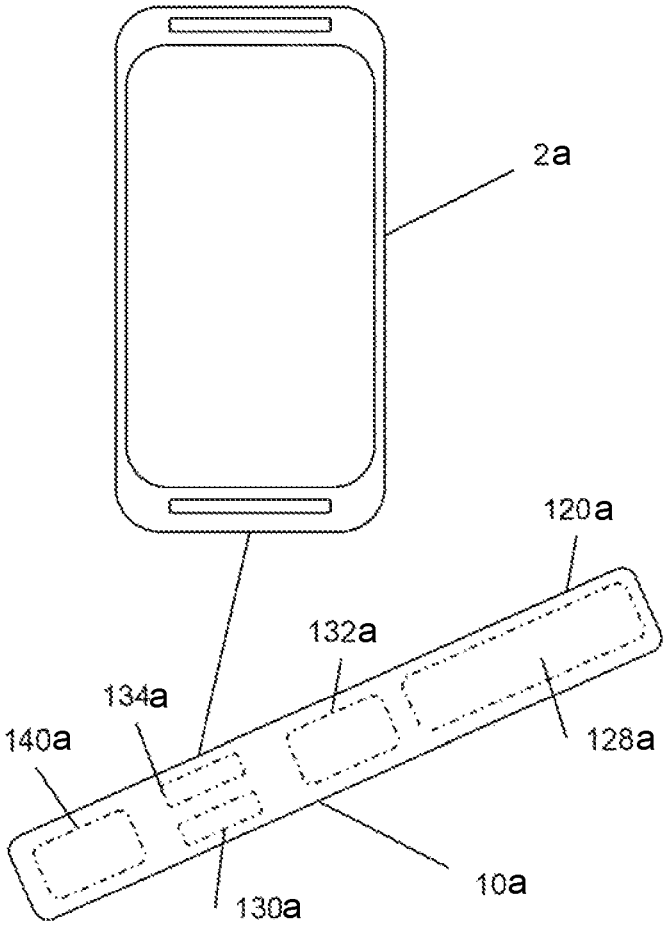
FIG. 10 is an example schematic view of a system of the second mode for disabling a smoking substitute device before an updated firmware is loaded.

Referring to FIG. 10, an exemplary embodiment is shown wherein the system comprises an external device 2*a* and a smoking substitute device 10*a*. The devices 2*a*, 10*a* can be as explained above, but specific features relating to the disablement of the smoking substitute device prior to an updated firmware being installed are herein further described.

The external device 2*a* is shown as suitably being a smart telephone operating an application. However, it will be appreciated that other devices such as tablet computers, smart watches or the like may be equally applicable. The external device 2*a* runs the application that can be used as a user interface between the user and the smoking substitute device. In order to establish communication between the external device and smoking substitute device, the smoking substitute device includes a communications interface and the external device is connected thereto. Whilst a wired connection would provide a suitable connection, it is envisaged that a more preferable connection would be a wireless connection as discussed above. Therefore, upon initial set up of the system, it will be appreciated that the application may be used to pair the external device with the smoking substitute device. For instance, the application may complete a Bluetooth pairing operation or another operation to establish the external device as a trusted device. With communication between the devices established, the external device can communicate with the smoking substitute device via the application and the smoking substitute device can communicate with the external device via the application by being controlled to transmit data via a communication interface component.

As shown in FIG. 10, the body 120*a* of the smoking substitute device 10*a* therefore preferably house a wireless communication component such as short distance wireless communication module 134*a*.

The body 120*a* also houses memory 132*a*. The memory as described above is a non-transitory computer readable medium operable to store firmware data that is used by a control unit 130*a* to perform the operational functions of the smoking substitute device as is known in the art. For instance, the control unit uses the firmware to control the communication unit to complete communication steps, to control power distribution to the components and to store updated firmware data in the memory.

A power source, such as a battery 128*a* is also housed in the body 120*a*. The power source is configured to provide power to the various components of the smoking substitute device as is known in the art.

As shown in FIG. 10, the smoking substitute device 10*a* includes an aerosol assembly component 140*a*. The aerosol assembly component typically includes the components necessary to produce an aerosol. For instance, the aerosol assembly component might include a heating device 162*a*. Suitably, the heating device might be a coil as herein described. In an additional embodiment, the heating device 162*a* is configured to be actuated by an additional component 168*a* such as a switch or an airflow sensor. Here, in use the smoking substitute device is configured to supply power to the heating device when the switch is activated or when the airflow sensor senses an inhale. In the exemplary embodiments, the control unit 130*a* controls the power source 128*a* to not supply power to the heating device 162*a* and/or the additional component 168*a*. Consequently, the aerosol assembly component is disabled because the heating device is not provided with power, either directly or through the additional component. Alternatively, the control unit is configured to ignore commands requesting the heating devices activation. With no power provided to the heating device, the smoking substitute device is disabled from being used because no aerosol is produced even if the user attempts to do so by activating the switch for instance or by inhaling.

In one embodiment, the smoking substitute device includes a consumable 150*a* as herein described. The consumable couples with a coupling portion, for instance a coupling portion of the smoking substitute device's body. Typically, the coupling portion includes an electrical interface 136*a* for electrically connecting the consumable to the components in the body 120*a*. For instance, as explained above, the electrical interface may be a pair of electrical contact pins. The power source 128*a* is configured to power the consumable through the electrical interface 136*a*. Here, the smoking substitute device can additionally or alternatively be disabled by controlling the power source to prevent power from being supplied to the electrical interface.

In use, the external device receives an updated firmware that has been developed and published on the remote server. This updated firmware may, in addition to correcting generic errors which the developers are aware of, provide new features on the smoking substitute device. The updated firmware may be pushed to the external device actively or the external device may periodically poll the remote server to see if new firmware is available. Either as a push, or in response to a poll, the remote server 4*a* sends the updated firmware to the mobile device. The mobile device then receives the updated firmware. Here the mobile device may verify that the updated firmware is compatible with the smoking substitute device to which it is connected and may prompt a user of the mobile device asking for authorization to update the firmware on the smoking substitute device.

Upon receiving the updated firmware, the external device automatically transmits a disable command to the connected smoking substitute device. Typically, as discussed above, the mobile device is configured to interact with the user, remote network and smoking substitute device via an application running in the external device. The application may trigger the disable command to be transmitted as soon as the updated firmware is received or after verifying that the updated firmware is compatible with the connected smoking substitute device. However, the disable command is forced on the smoking device as soon as a connection is established or re-established and without the application requiring an input from the user. In this way, safety critical firmware updates can be pushed on the smoking substitute device with the device remaining disabled until the updated firmware is installed. Should the application be paired with a smoking substitute device but where a wireless connection is not available, the application may reattempt to send the disable command when a wireless connection is established or re-established.

The application may cause the external device to either push the updated firmware to the smoking substitute device without further user input, or the smoking device may be manipulated to pull the updated firmware from the external device periodically or the application running on the external device may provide for the updated firmware to be pushed to the connected smoking substitute device only after a further input command, such as from a user.

In exemplary embodiments, the updated firmware is transmitted from the remote server 4*a* to the smoking substitute device 10*a* via the mobile device 2*a*. However, as described above, it is possible that the smoking substitute device 10*a* forms a connection to the remote server 4*a* without going via the mobile device 2*a*. For example, if the smoking substitute device 10*a* included a WIFI® adapter or cellular network adapter.

Figure 11:
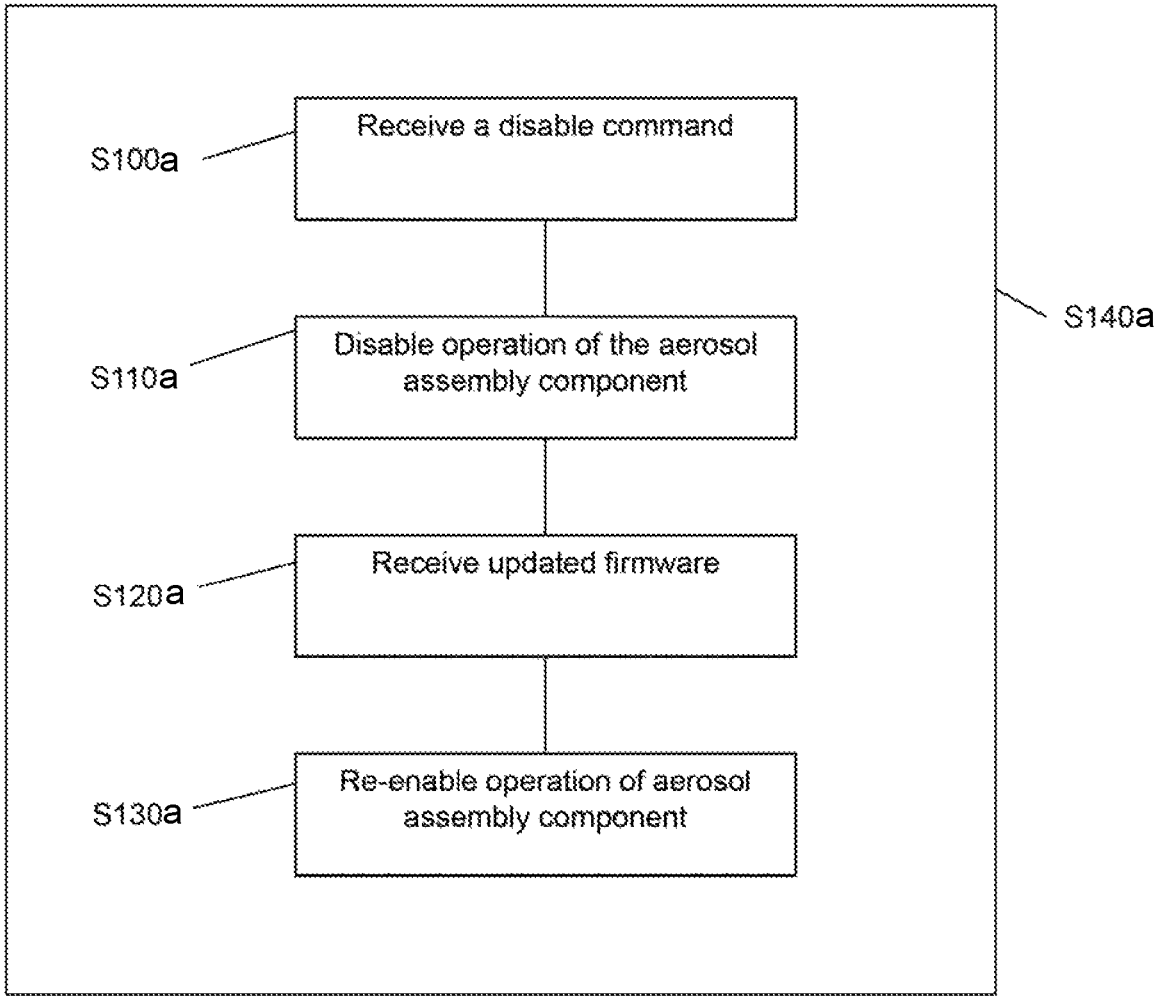
FIG. 11 is a flow chart of a method of the second mode of disabling a smoking substitute device before an updated firmware is loaded.

Referring to FIG. 11 a method of managing the smoking substitute device comprises the step S100 of receiving a disable command. After receiving the disable command the control unit component 130*a* is configured to disable operation of the aerosol assembly component 140*a* at step S110. Subsequent to step S100, the smoking substitute device is configured to receive an updated firmware and to save the updated firmware to the memory 132*a* at step S120. After saving the updated firmware to the memory, the control unit is configured by the updated firmware to re-enable the aerosol assembly component at step S130. The steps complete a firmware update step S140.

Figure 12:
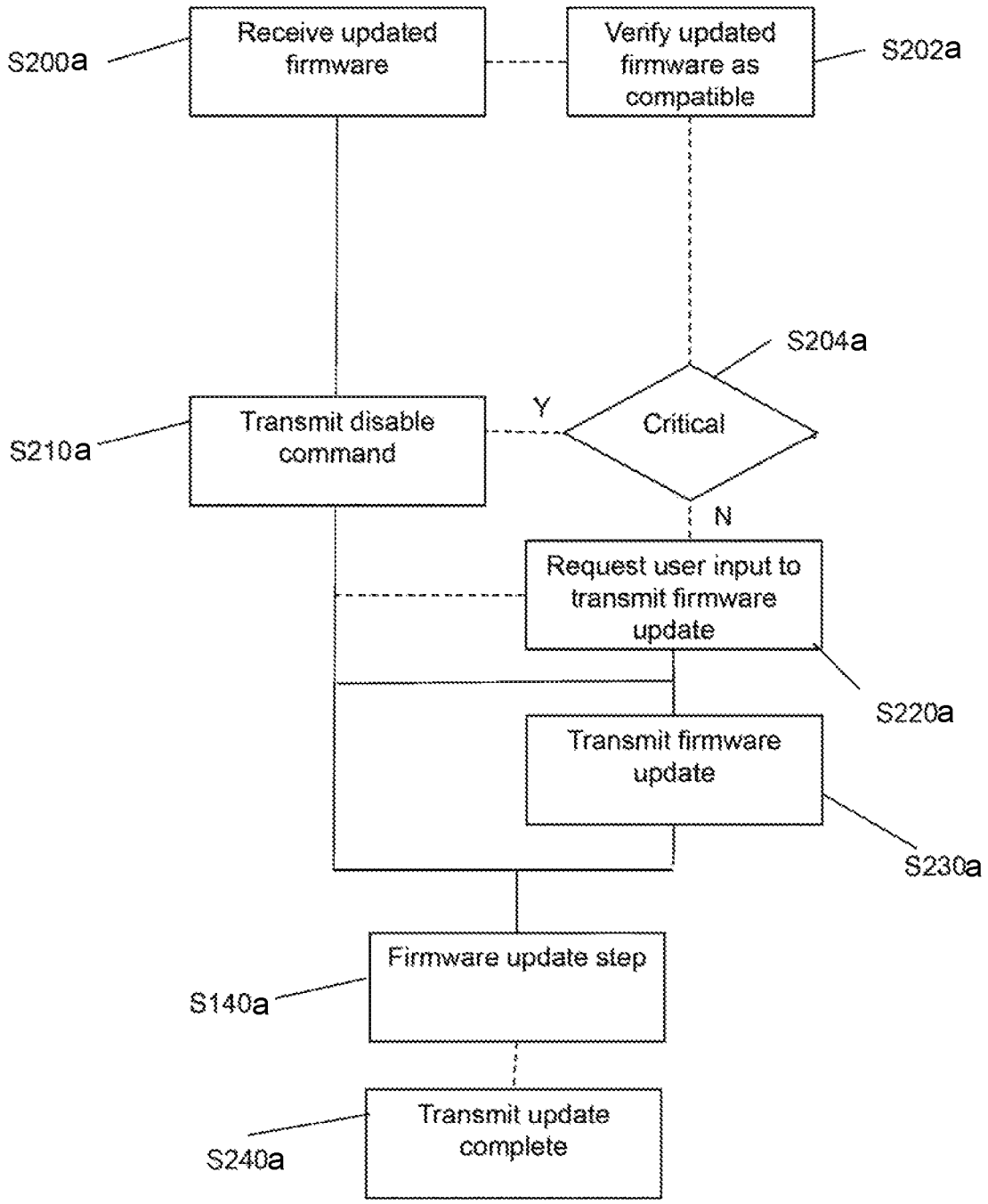
FIG. 12 is a flow chart of a method of the second mode of managing a system and disabling a smoking substitute device before an updated firmware is loaded.

FIG. 12 shows a method of managing a system including the smoking substitute device 10*a* and an external device 2*a*. Here the method comprises the step S200 of receiving at the external device an updated firmware. Typically receiving the updated firmware at the external device will be controlled by an application running on the external device. Here the application may complete an optional verification step S202 to check that the updated firmware is compatible with the smoking substitute device the external device is connected to. Automatically upon receiving the updated firmware, the external device transmits a disable signal to the connected smoking substitute device at step S210. Therein the method completes the firmware update step S140.

In one exemplary embodiment, the application includes an optional step S220 of seeking a user input before pushing the updated firmware to the smoking substitute device. However, the optional step S220 occurs after the disable command step S210 has been transmitted. In a further exemplary embodiment, wherein the updated firmware includes a critical tag, the method optionally includes the step S204 of reading the updated firmware to check for a non-critical tag. If the firmware is marked as non-critical, the step S210 can be bypassed.

In one exemplary embodiment, at step S240, the control unit component can be configured to transmit a download complete signal back to the remote device once the download is complete and the aerosol assembly component re-enabled.

The features disclosed in the foregoing description, or in the following claims, or in the accompanying drawings, expressed in their specific forms or in terms of a means for performing the disclosed function, or a method or process for obtaining the disclosed results, as appropriate, may, separately, or in any combination of such features, be utilized for realizing the disclosure in diverse forms thereof.

While the disclosure has been described in conjunction with the exemplary embodiments described above, many equivalent modifications and variations will be apparent to those skilled in the art when given this disclosure. Accordingly, the exemplary embodiments of the disclosure set forth above are considered to be illustrative and not limiting. Various changes to the described embodiments may be made without departing from the spirit and scope of the disclosure.

For the avoidance of any doubt, any theoretical explanations provided herein are provided for the purposes of improving the understanding of a reader. The inventors do not wish to be bound by any of these theoretical explanations.

Any section headings used herein are for organizational purposes only and are not to be construed as limiting the subject matter described.

Throughout this specification, including the claims which follow, unless the context requires otherwise, the word "comprise" and "include", and variations such as "comprises", "comprising", and "including" will be understood to imply the inclusion of a stated integer or step or group of integers or steps but not the exclusion of any other integer or step or group of integers or steps.

It must be noted that, as used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by the use of the antecedent "about," it will be understood that the particular value forms another embodiment. The term "about" in relation to a numerical value is optional and means for example +/−10%.

Third Mode: A Smoking Substitute Device and Management of Firmware Updates when the Smoking Substitute Device is Connected to an External Device.

Aspects and embodiments of the third mode of the present disclosure will now be discussed with reference to the accompanying figures. Further aspects and embodiments of the third mode will be apparent to those skilled in the art. All documents mentioned in this text are incorporated herein by reference.

Figure 13:
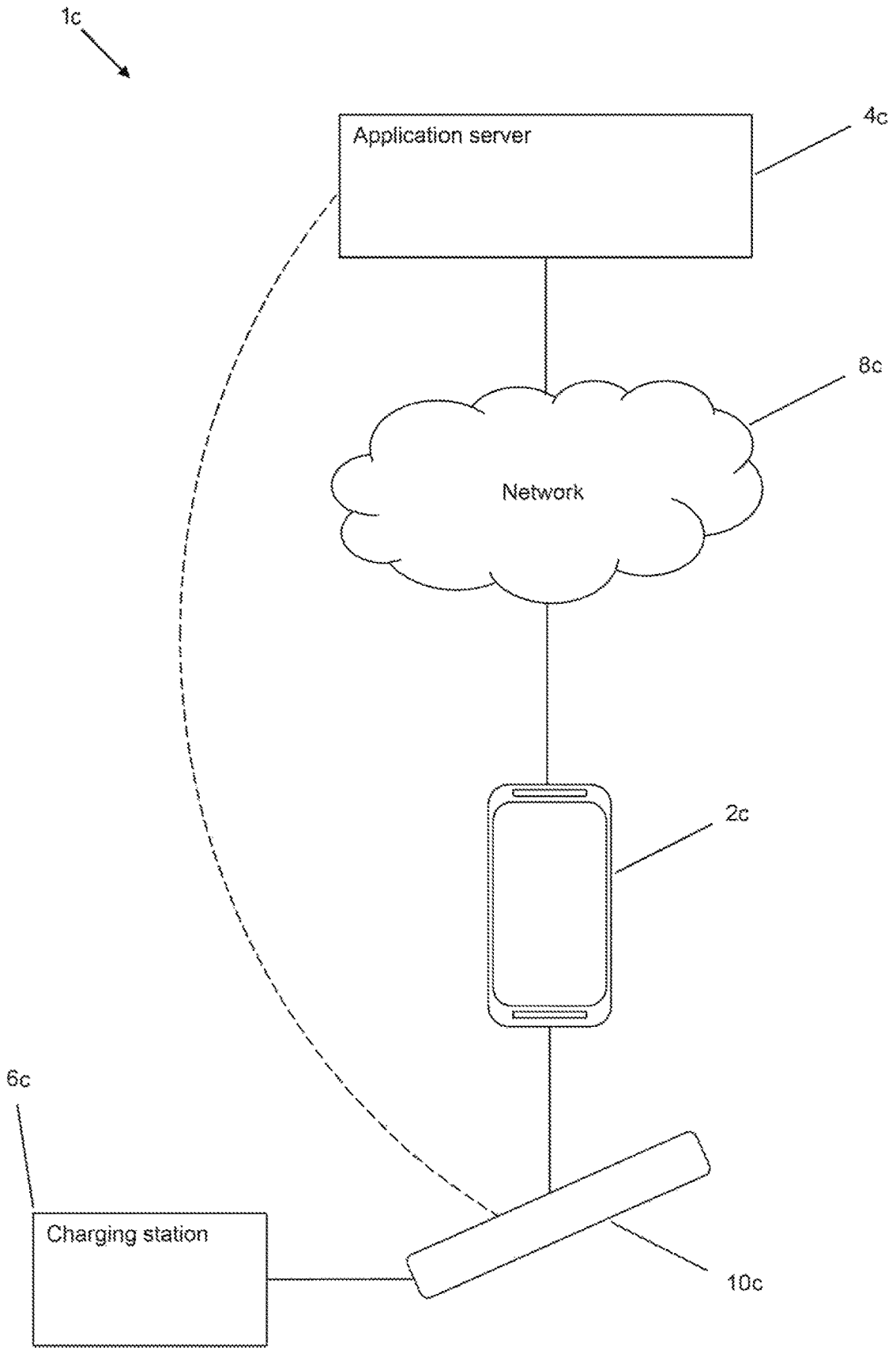
FIG. 13 shows an example system of the third mode for managing a smoking substitute device.

FIG. 13 shows an example system 1*c* for managing a smoking substitute device 10*c*.

The system 1*c* as shown in FIG. 13 includes a mobile device 2*c*, an application server 4*c*, an optional charging station 6*c*, as well as the smoking substitute device 10*c*.

The smoking substitute device 10*c* is configured to communicate wirelessly, e.g., via Bluetooth™, with an application (or "app") installed on the mobile device 2*c*, e.g., via a suitable wireless interface (not shown) on the mobile device 2*c*. The mobile device 2*c* may be a mobile phone, for example. The application on the mobile phone is configured to communicate with the application server 4*c*, via a network 8*c*. The application server 4*c* may utilize cloud storage, for example.

The network 8*c* may include a cellular network and/or the Internet.

In other examples, the smoking substitute device 10*c* may be configured to communicate with the application server 4*c* via a connection that does not involve the mobile device 2*c*, e.g., via a narrowband Internet of things ("NB-IoT") connection. In some examples, the mobile device 2*c* may be omitted from the system.

A skilled person would readily appreciate that the mobile device 2*c* may be configured to communicate via the network 8*c* according to various communication channels, preferably a wireless communication channel such as via a cellular network (e.g., according to a standard protocol, such as 3G or 4G) or via a WIFI network.

The app installed on the mobile device and the application server 4*c* may be configured to assist a user with their smoking substitute device 10*c*, based on information communicated between the smoking substitute device 10*c* and the app and/or information communicated between the app and the application server 4*c*. The app may run in the background to handle communication with the smoking substitute device.

The charging station 6*c* (if present) may be configured to charge (and optionally communicate with) the smoking substitute device 10*c*, via a charging port on the smoking substitute device 10*c*. The charging port on the smoking substitute device 10*c* may be a USB port, for example, which may allow the smoking substitute device to be charged by any USB-compatible device capable of delivering power to the smoking substitute device 10*c* via a suitable USB cable (in this case the USB-compatible device would be acting as the charging station 6*c*). Alternatively, the charging station could be a docking station specifically configured to dock with the smoking substitute device 10*c* and charge the smoking substitute device 10*c* via the charging port on the smoking substitute device 10*c*.

Figure 14A:
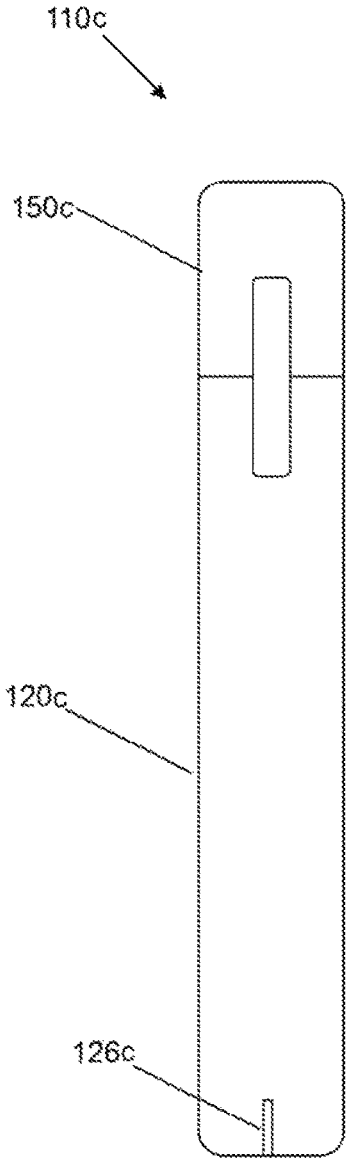
FIG. 14A shows an example smoking substitute device for use as the smoking substitute device in the system of FIG. 13.

FIG. 14A shows an example smoking substitute device 110*c* for use as the smoking substitute device 10*c* in the system 1*c* of FIG. 13.

In this example, the smoking substitute device 110*c* includes a main body 120*c* and a consumable 150*c*. The consumable 150*c* may alternatively be referred to as a "pod".

In this example, the smoking substitute device 110*c* is a closed system vaping device, wherein the consumable 150*c* includes a sealed tank 156*c* and is intended for one-use only.

FIG. 14A shows the smoking substitute device 110*c* with the main body 120*c* physically coupled to the consumable 150*c*.

Figure 14B:
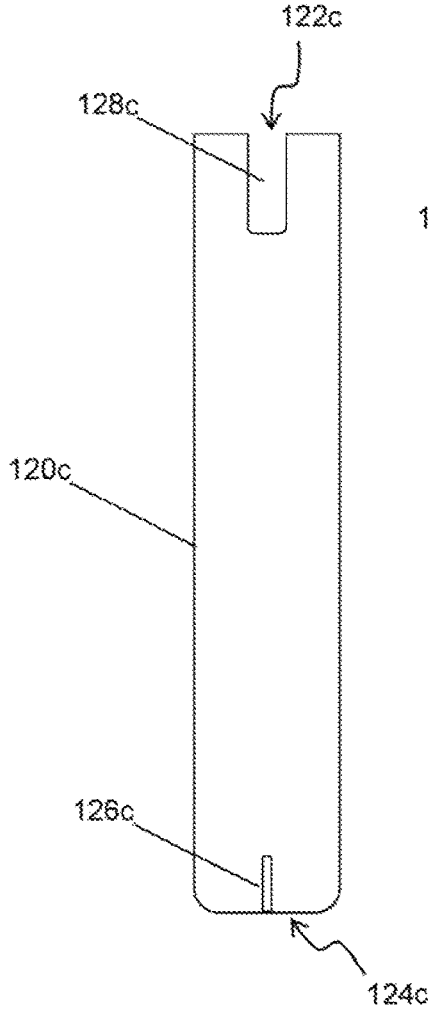
FIG. 14B shows the main body of the smoking substitute device of FIG. 14A without the consumable.

FIG. 14B shows the main body 120*c* of the smoking substitute device 110*c* without the consumable 150*c*.

Figure 14C:
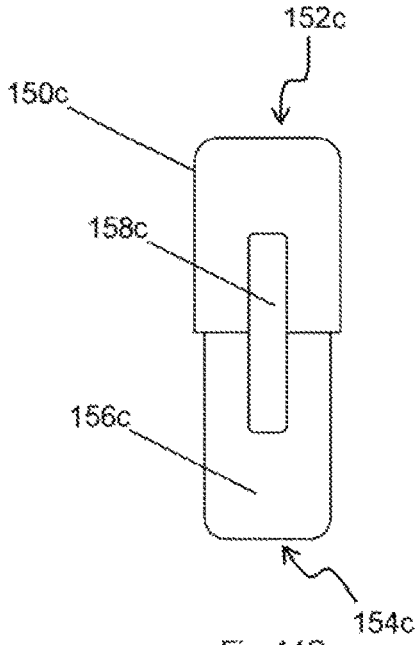
FIG. 14C shows the consumable of the smoking substitute device of FIG. 14A without the main body.

FIG. 14C shows the consumable 150*c* of the smoking substitute device 110*c* without the main body 120*c*.

The main body 120*c* and the consumable 150*c* are configured to be physically coupled together, in this example by pushing the consumable 150*c* into an aperture in a top end 122*c* of the main body 120*c*, e.g., with the consumable 150*c* being retained in the aperture via an interference fit. In other examples, the main body 120*c* and the consumable could be physically coupled together by screwing one onto the other, through a bayonet fitting, or through a snap engagement mechanism, for example. An optional light 126*c*, e.g., an LED located behind a small translucent cover, is located a bottom end 124*c* of the main body 120*c*. The light 126*c* may be configured to illuminate when the smoking substitute device 110*c* is activated.

The consumable 150*c* includes a mouthpiece (not shown) at a top end 152*c* of the consumable 150*c*, as well as one or more air inlets (not shown in FIG. 14) so that air can be drawn into the smoking substitute device 110*c* when a user inhales through the mouthpiece. At a bottom end 154*c* of the consumable 150*c*, there is located a tank 156*c* that contains e-liquid. The tank 156*c* may be a translucent body, for example.

The tank 156*c* preferably includes a window 158*c*, so that the amount of e-liquid in the tank 156*c* can be visually assessed. The main body 120*c* includes a slot 128*c* so that the window 158*c* of the consumable 150*c* can be seen whilst the rest of the tank 156*c* is obscured from view when the consumable 150*c* is inserted into the aperture in the top end 122*c* of the main body 120*c*.

In this present embodiment, the consumable 302*c* is a "single-use" consumable. That is, upon exhausting the e-liquid in the tank 156*c*, the intention is that the user disposes of the whole consumable 150*c*. In other embodiments, the e-liquid (i.e., aerosol former) may be the only part of the system that is truly "single-use". In such embodiments, the tank 156*c* may be refillable with e-liquid or the e-liquid may be stored in a non-consumable component of the system. For example, the e-liquid may be stored in a tank located in the device or stored in another component that is itself not single-use (e.g., a refillable tank).

The tank 156*c* may be referred to as a "clearomizer" if it includes a window 158*c*, or a "cartomizer" if it does not.

Figure 15A:
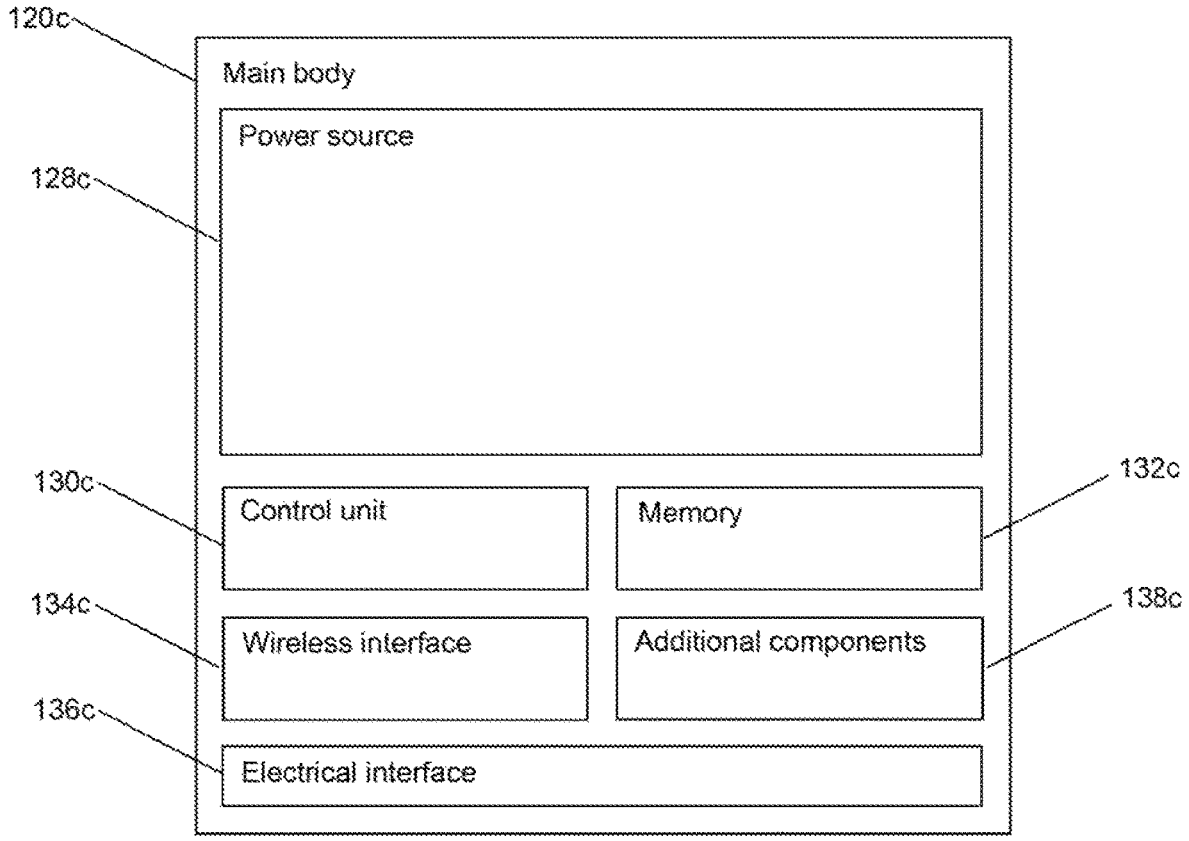
FIG. 15A is a schematic view of the main body of the smoking substitute device of FIG. 14A.

FIG. 15A is a schematic view of the main body 120*c* of the smoking substitute device 110*c*.

Figure 15B:
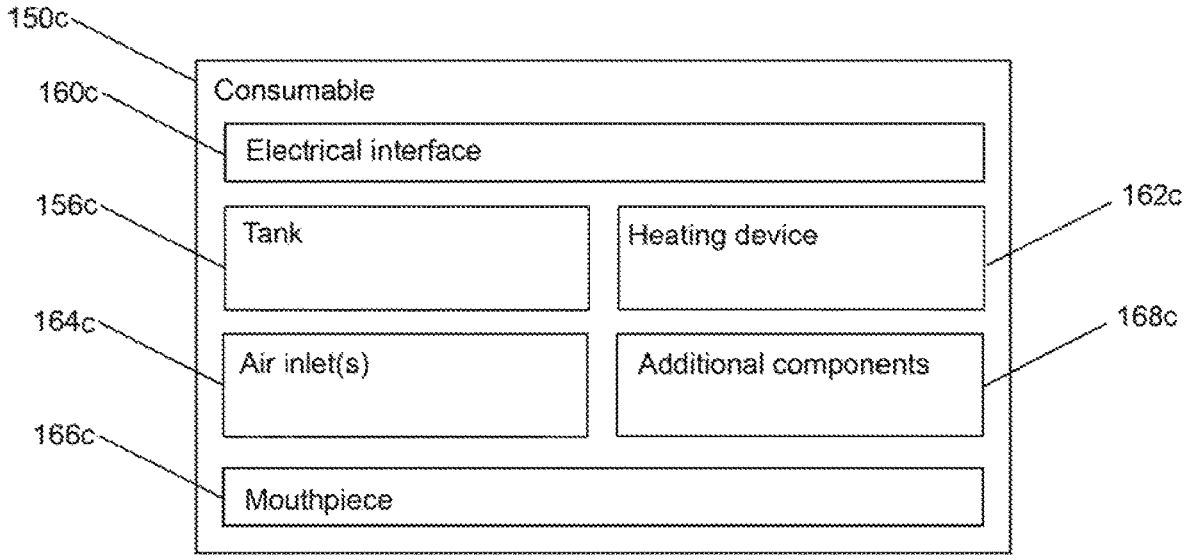
FIG. 15B is a schematic view of the consumable of the smoking substitute device of FIG. 14A.

FIG. 15B is a schematic view of the consumable 150*c* of the smoking substitute device 110*c*.

As shown in FIG. 15A, the main body 120*c* includes a power source 128*c*, a control unit 130*c*, a memory 132*c*, a wireless interface 134*c*, an electrical interface 136*c*, and, optionally, one or more additional components 138*c*.

The power source 128*c* is preferably a battery, more preferably a rechargeable battery.

The control unit 130*c* may include a microprocessor, for example.

The memory 132*c* is preferably includes non-volatile memory.

The wireless interface establishes communication over a wireless communication channel between the smoking substitute device and communication terminal of the external device. The wireless interface may utilities any suitable wireless protocol. Suitably, the wireless interface may operate over a short range network. For example, it may comprise a wireless personal area network (WPAN), e.g., using Bluetooth™, ZigBee, a WIFI personal hotspot or the like. The smoking substitute device may pair with the portable communication terminal over the wireless communication channel. The portable communication terminal may be a master device and the smoking substitute device may be a slave device. As such, in exemplary embodiments, the wireless interface 134*c* is preferably configured to communicate wirelessly with the mobile device 2*c*, e.g., via Bluetooth. To this end, the wireless interface 134*c* could include a Bluetooth™ antenna. Other wireless communication interfaces, e.g., WIFI, are also possible.

The electrical interface 136*c* of the main body 120*c* may include one or more electrical supply contacts. The electrical interface 136*c* may be located in, and preferably at the bottom of, the aperture in the top end 122*c* of the main body 120*c*. When the main body 120*c* is physically coupled to the consumable 150*c*, the electrical interface 136*c* may be configured to pass electrical power from the power source 128*c* to (e.g., a heating device of) the consumable 150*c* when the smoking substitute device 110*c* is activated, e.g., via the electrical interface 160*c* of the consumable 150*c* (discussed below). When the main body 120*c* is not physically coupled to the consumable 150*c*, the electrical interface may be configured to receive power from the charging station 6*c*.

The additional components 138*c* of the main body 120*c* may include the optional light 126*c* discussed above.

The additional components 138*c* of the main body 120*c* may, if the power source 128*c* is a rechargeable battery, include a charging port configured to receive power from the charging station 6*c*. This may be located at the bottom end 124*c* of the main body 120*c*. Alternatively, the electrical interface 136*c* discussed above is configured to act as a charging port configured to receive power from the charging station 6*c* such that a separate charging port is not required.

The additional components 138*c* of the main body 120*c* may, if the power source 128*c* is a rechargeable battery, include a battery charging control circuit, for controlling the charging of the rechargeable battery. However, a battery charging control circuit could equally be located in the charging station 6*c* (if present).

The additional components 138*c* of the main body 120*c* may include an airflow sensor for detecting airflow in the smoking substitute device 110*c*, e.g., caused by a user inhaling through a mouthpiece 166*c* (discussed below) of the smoking substitute device 110*c*. The smoking substitute device 110*c* may be configured to be activated when airflow is detected by the airflow sensor. This optional sensor could alternatively be included in the consumable 150*c* (though this is less preferred where the consumable 150*c* is intended to be disposed of after use, as in this example).

The additional components 138*c* of the main body 120*c* may include an actuator, e.g., a button. The smoking substitute device 110*c* may be configured to be activated when the actuator is actuated. This provides an alternative to the airflow sensor noted, as a mechanism for activating the smoking substitute device 110*c*.

The additional components 138*c* of the main body 120*c* may include a reading device configured to read information associated with the consumable from a machine readable data source included in (e.g., contained in the body of, or attached to) the consumable 150*c*.

In some examples, the reading device (if present) may be configured to read information from the machine readable data source non-wirelessly, e.g., using an electrical connection between the main body 120*c* and consumable 150*c*.

For example, the reading device (if present) may include a set of one or more electrical communication contacts configured to read information from the machine readable data source via an electrical connection established between the set of one or more electrical communication contacts and the machine readable data source. Conveniently, the set of one or more electrical communication contacts of the reading device may be configured to provide the electrical connection by engaging with a set of one or more electrical communication contacts of the consumable 150*c*, when the main body 120*c* and the consumable 150*c* are physically coupled together.

In some examples, the reading device (if present) may be configured to read information from the machine readable data source wirelessly, e.g., via electromagnetic waves or optically. Thus, for example, the machine readable data source included in the consumable 150*c* could be an RFID tag (in which case the reading device included in the main body 120*c* may be an RFID reader) or a visual data source such as a barcode (in which case the reading device included in the main body may be an optical reader, e.g., a barcode scanner). Various wireless technologies and protocols may be employed to allow the reading device to wirelessly read information from a machine readable data source included in or attached to the consumable 150*c*, e.g., NFC, Bluetooth, Wi-Fi, as would be appreciated by a skilled person.

The reading device (if present) may be configured to write information associated with the consumable to the machine readable data source (e.g., wirelessly or non-wirelessly, via one of the mechanisms discussed above) in addition to being configured to read information associated with the consumable from the machine readable data source. In this case, the reading device may be referred to as a reading/writing device.

As shown in FIG. 15B, the consumable 150*c* includes the tank 156*c*, an electrical interface 160*c*, a heating device 162*c*, one or more air inlets 164*c*, a mouthpiece 166*c*, and, optionally, one or more additional components 168*c*.

The electrical interface 160*c* of the consumable 150*c* may include one or more electrical supply contacts. The electrical interface 136*c* of the main body 120*c* and an electrical interface 160*c* of the consumable 150*c* are preferably configured to contact each other and therefore electrically couple the main body 120*c* to the consumable 150*c* when the main body 120*c* is physically coupled to the consumable 150*c*. In this way, electrical energy (e.g., in the form of an electrical current) is able to be supplied from the power source 128*c* in the main body 120*c* to the heating device 162*c* in the consumable 150*c*.

The heating device 162*c* is preferably configured to heat e-liquid contained in the tank 156*c*, e.g., using electrical energy supplied from the power source 128*c*. In one example, the heating device 162*c* may include a heating filament and a wick, wherein a first portion of the wick extends into the tank 156*c* in order to draw e-liquid out from the tank 156*c*, and wherein the heating filament coils around a second portion of the wick located outside the tank 156*c*. In this example, the heating filament is configured to heat up e-liquid drawn out of the tank 156*c* by the wick to produce an aerosol vapor.

The one or more air inlets 164*c* are preferably configured to allow air to be drawn into the smoking substitute device 110*c*, when a user inhales through the mouthpiece 166*c*.

The additional components 168*c* of the consumable 150*c* may include a machine readable data source, which may, e.g., be contained in the body of, or attached to the consumable 150*c*. The machine readable data source may store information associated with the consumable. The information associated with the consumable may include information concerning the content of the consumable (e.g., e-liquid type, batch number) and/or a unique identifier, for example.

The machine readable data source may be rewritable, e.g., a rewritable RFID chip, or read only, e.g., a visual data source such as a barcode. As indicated above, the additional components 138*c* of the main body 120*c* may include a reading device configured to read information associated with the consumable from the machine readable data source.

For example, the electrical interface 160*c* of the consumable 150*c* may include a set of one or more electrical communication contacts, which may allow a reading device of the main body to read information from a machine readable data source of the consumable, e.g., as discussed previously.

In use, a user activates the smoking substitute device 110*c*, e.g., through actuating an actuator included in the main body 120*c* or by inhaling through the mouthpiece 166*c* as described above. Upon activation, the control unit 130*c* may supply electrical energy from the power source 128*c* to the heating device 162*c* (via electrical interfaces 136*c*, 166*c*), which may cause the heating device 162*c* to heat e-liquid drawn from the tank 156*c* to produce a vapor which is inhaled by a user through the mouthpiece 166*c*.

Of course, a skilled reader would readily appreciate that the smoking substitute device 110*c* shown in FIGS. 14 and 15 shows just one example implementation of a smoking substitute device, and that other forms of smoking substitute device could be used as the smoking substitute device 10*c* of FIG. 13.

By way of example, a HNB smoking substitute device including a main body and a consumable could be used as the smoking substitute device 10*c* of FIG. 13, instead of the smoking substitute device 110*c*. One such HNB smoking substitute device is the IQOS™ smoking substitute device discussed above.

As another example, an open system vaping device which includes a main body, a refillable tank, and a mouthpiece could be used as the smoking substitute device 10*c* of FIG. 13, instead of the smoking substitute device 110*c*. One such open system vaping device is the blu PRO™ e-cigarette discussed above.

As another example, an entirely disposable (one use) smoking substitute device could be used as the smoking substitute device 10*c* of FIG. 13, instead of the smoking substitute device 110*c*.

Figure 16:
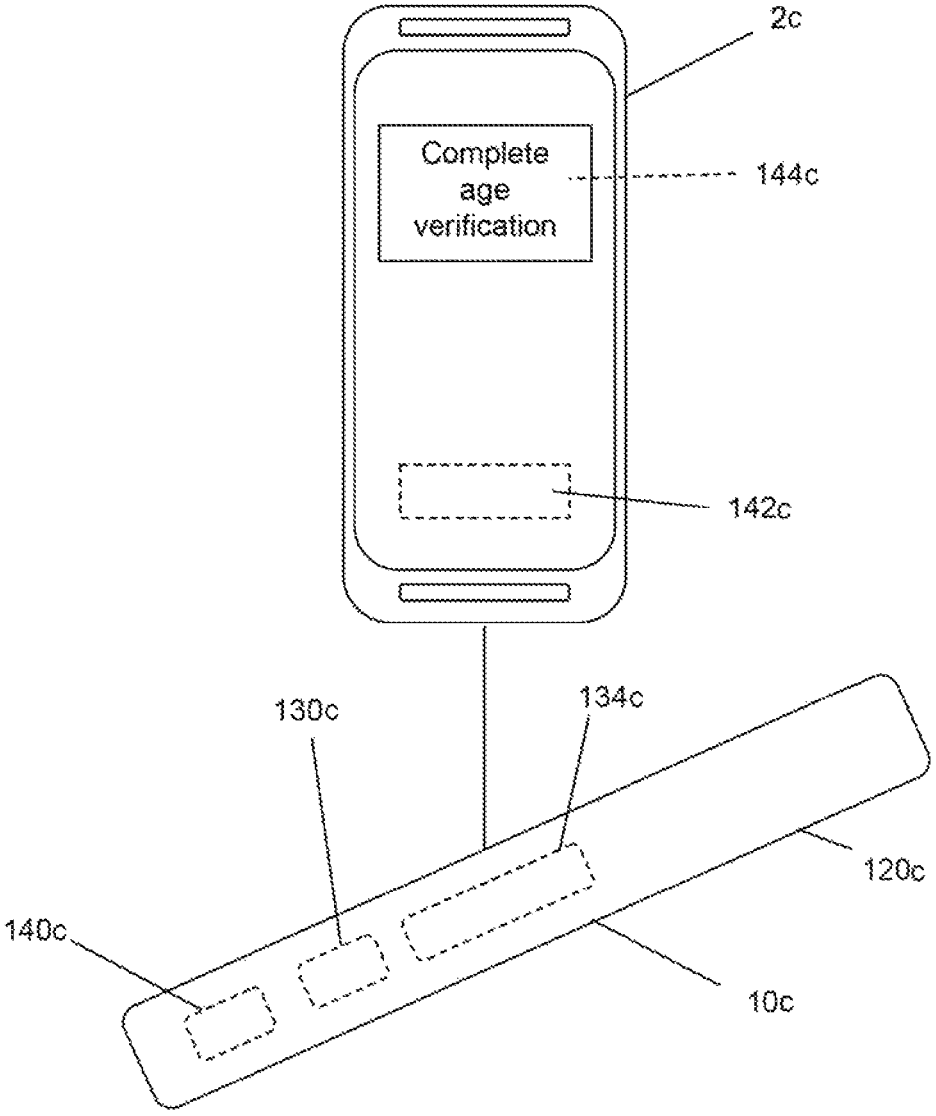
FIG. 16 is an example schematic view of a system for setting an operating mode based on location of a smoking substitute device and according to an exemplary embodiment of the third mode.

Referring to FIG. 16, an exemplary embodiment is shown wherein the system comprises an external device 2*c* and a smoking substitute device 10*c*. The devices 2*c*, 10*c* can be as explained above, but specific features relating to the switching between operating modes are herein further described.

The external device 2*c* is shown as suitably being a smart telephone operating an application. However, it will be appreciated that other devices such as tablet computers, smart watches or the like may be equally applicable. The external device 2*c* runs the application that can be used as a user interface between the user and the smoking substitute device. In order to establish communication between the external device and smoking substitute device, the smoking substitute device includes a communications interface and the external device is connected thereto. Whilst a wired connection would provide a suitable connection, it is envisaged that a more preferable connection would be a wireless connection as discussed above. Therefore, upon initial set up of the system, it will be appreciated that the application may be used to pair the external device with the smoking substitute device. For instance, the application may complete a Bluetooth pairing operation or another operation to establish the external device as a trusted device. With communication between the devices established, the external device can communicate with the smoking substitute device via the application and the smoking substitute device can communicate with the external device via the application by being controlled to transmit data via a communication interface component.

As shown in FIG. 16, the body 120*c* of the smoking substitute device 10*c* therefore preferably houses a wireless communication interface such as short distance wireless communication module 134*c*.

The body 120*c* also houses memory 132*c* (not shown in FIG. 16). The memory as described above is arranged to store firmware data that is used by a control unit 130*c* to perform the operational functions of the smoking substitute device as is known in the art. For instance, the control unit 130*c* uses the firmware to operate in a first mode or a second mode and to control the communication interface 134*c* to complete communication steps.

A power source, such as a battery 128*c* (not shown in FIG. 16) is also housed in the body 120*c*. The power source is configured to provide power to the various components of the smoking substitute device as is known in the art.

In the exemplary embodiments, the control unit is configured to select an operating mode based on a location of the smoking substitute device. Here, a locator 142*c* is used to determine the location of the smoking substitute device. For instance using a GPS system or the like as is known in the art. The locator forms part of a locator device having the function of determining which mode the control unit should operate in. That is, whether a function should be enabled or disabled. It will be appreciated that the function of the locator device may be completed by various components of the smoking substitute device or the external device. Thus, the smoking substitute device may comprise the locator. However, it is envisaged a more preferable embodiment is for the smoking substitute device to use the existing location function of the external device. For instance, the external device has a locator 142*c* that can determine the location of the external device. With the smoking substitute device connected over a short distance wireless link, the location of the external device can be used as an approximate location of the smoking substitute device. In particular, since in the example of the external device being a personal device such as a mobile phone, the user typically carries both on their person. Once the locator 142*c* establishes the location of the device, the location can either be sent over the wireless link for use by the control unit to complete a lookup function to determine an appropriate mode to operate in, or the external device can complete the lookup function to determine the appropriate mode and to subsequently send a mode command over the wireless link to command the control unit to operate in a specific mode. It is envisaged that completing the lookup function on the external device might be more preferable so that the lookup function can be more readily updated.

As explained, the locator device completes a lookup function wherein suitably a database is queried in order to determine an operating mode authorized or required by the location. That is, the first mode might be assigned to a first location and the second mode might be assigned to a second, different location. By querying the database with the determined location of the smoking substitute device, the locator can determine whether the smoking substitute device should operate in the first mode or the second mode. The lookup function might be controlled by the control unit of the smoking substitute device or by the external device. The first location and second location might be geographically separated as separate countries, or separate states, or specific areas within states. It will be appreciated that there may be a plurality of locations each assigned the first or second mode or a further mode to enable the smoking substitute device to be constrained to operate as required by the rules or regulations or requirements of the location.

In the exemplary embodiments, the smoking substitute device has a first function. Thus, the smoking substitute device includes a functional device for completing the first function. For instance, the function may be a function to generate an aerosol, or a function to determine whether a user is above an age limit, or a function to determine to operate with a type of consumable, or a function to record user data, or another function. In the first mode, one function is enabled and in the second mode, that function is disabled. It will be appreciated that there may be further modes where further functions are enabled and disabled and the modes may include combinations of functions, for instance an age limit restriction on a type of consumable.

By way of example, in one embodiment, the first function is an operation of the smoking substitute device to create an aerosol. In the first mode, the function is enabled such that the smoking substitute device operates. In the second mode, the function is disabled such that a user cannot operate the device to create an aerosol. Consequently, for example, if the first location allows an aerosol to be inhaled, but the second location does not, the manufacturer can configure the smoking substitute device to be automatically compliant with the operating conditions in both locations.

According to one example and as shown in FIG. 16, the first function is an operation of the smoking substitute device. Here, the smoking substitute device 10*c* suitably includes a functional device comprising an aerosol assembly component 140*c*. The aerosol assembly component typically includes the components necessary to produce an aerosol. For instance, the aerosol assembly component might include a heating device 162*c*. Suitably, the heating device might be a coil as herein described. In an additional embodiment, the heating device 162*c* is configured to be actuated by an additional component 168*c* such as a switch or an airflow sensor. Here, in use the smoking substitute device is configured to supply power to the heating device when the switch is activated or when the airflow sensor senses an inhale. In the exemplary embodiments, the control unit 130*c* controls the power source 128*c* to not supply power to the heating device 162*c* and/or the additional component 168*c*. Consequently, the aerosol assembly component is disabled because the heating device is not provided with power, either directly or through the additional component. Alternatively, the control unit is configured to ignore commands requesting the heating device's activation. With no power provided to the heating device, the smoking substitute device is disabled from being used because no aerosol is produced even if the user attempts to do so by activating the switch for instance or by inhaling.

In another embodiment, the smoking substitute device includes a consumable 150*c* as herein described. The consumable couples with a coupling portion, for instance a coupling portion of the smoking substitute device's body. Typically, the coupling portion includes an electrical interface 136*c* for electrically connecting the consumable to the components in the body 120*c*. For instance, as explained above, the electrical interface may be a pair of electrical contact pins. The power source 128*c* is configured to power the consumable through the electrical interface 136*c*. Here, the smoking substitute device can additionally or alternatively be disabled by controlling the power source to prevent power from being supplied to the electrical interface.

Thus, in an alternative embodiment, wherein the first function is to enable and disable a type of consumable, the smoking substitute device has a functional device that may comprise a reader device to read a detail of the consumable. For instance, to read a type of consumable that is connected. Here, the first function may be to enable and disable the compatibility of the smoking substitute device with a first type of consumable. For instance, the reader device reads the consumable and determines the consumable as a first type. In the first mode, the operation of the smoking substitute device to create and aerosol (as described above) is enabled. Whereas in the second mode, the operation is disabled for the first type of consumable. It will be appreciated that in a more preferable embodiment, the reader device identifies the consumable as either a first type of consumable or a second type of consumable and the smoking substitute device is operable with the first type of consumable in both modes but the operation with the second type of consumable is enabled and disabled in the first mode and the second mode respectively. Furthermore, there may be third and further types of consumable, and there may be third and subsequent modes of operation wherein each mode enables and disables operation for a different set of types of consumables.

In a further exemplary embodiment, the first function is an age verification process. Here, the application running on the external device may provide a functional device comprising a user input 144*c* to determine a user age. For instance, the user completes an age verification process and in the first mode, operation of the smoking substitute device is enabled. Whereas in the second mode, operation of the smoking substitute device is disabled if the user is not determined to be above a minimum operating age. It will be appreciated that the operation of the smoking substitute device may have a first minimum age of operation in both the first and second mode wherein the operation of the smoking substitute device is disabled in both modes unless it is determined that the user is above the first minimum age. Here, the age verification process includes a second minimum age limit, older than the first and in the first mode, operation is enabled if the user is determined to be at least above the first minimum age limit, and in the second mode, operation is disabled unless the user is verified as being older than both the first and second age limits. It will be appreciated that there may be third and subsequent minimum age limits and associated third and subsequent operating modes assigned to prevent use by users below that age limit. Thus, if locations have different age limits for operation or, for instance, operation with specific types of consumables, the manufacturer can configure the smoking substitute device to automatically comply with the rules, or regulations, or requirements as the smoking substitute is moved between locations.

Although not depicted in FIG. 16, the body 120*c* also houses memory 132*c*. The memory as described above is arranged to store firmware data that is used by a control unit 130*c* to perform the operational functions of the smoking substitute device as is known in the art. For instance, the control unit uses the firmware to control the communication unit to complete communication steps. The memory may also be configured to store user data. User data is typically stored as non-volatile memory and is generated during operation of the smoking substitute device. For instance, the user data may be logs of operational details such as the time at which an inhale began, the duration or pressure or flow rate of an inhale, battery characteristics such as charge status or connection status, temperature details, error events, or the like. Where a consumable is inserted, the user data may include details such as time and number of consumables inserted, coil temperature and resistance details, and where supported, details of the type or other data of the consumable. It will be appreciated that to record the one or more desired user data, further hardware of the smoking substitute device may be required and/or further additional components as described above or otherwise known in the art. Here, the first function may be a function of recording user data and the smoking substitute device therefore comprises a functional device comprising the function of monitoring and storing user data in the memory. Thus, in the first mode, storing user data is enabled, whereas in the second mode storing user data is disabled. It will be appreciated that the function could alternatively be storing specific types of user data or the like and there may be third and subsequent modes enabling and disabling the storage of different types of user data or the like.

Figure 17:
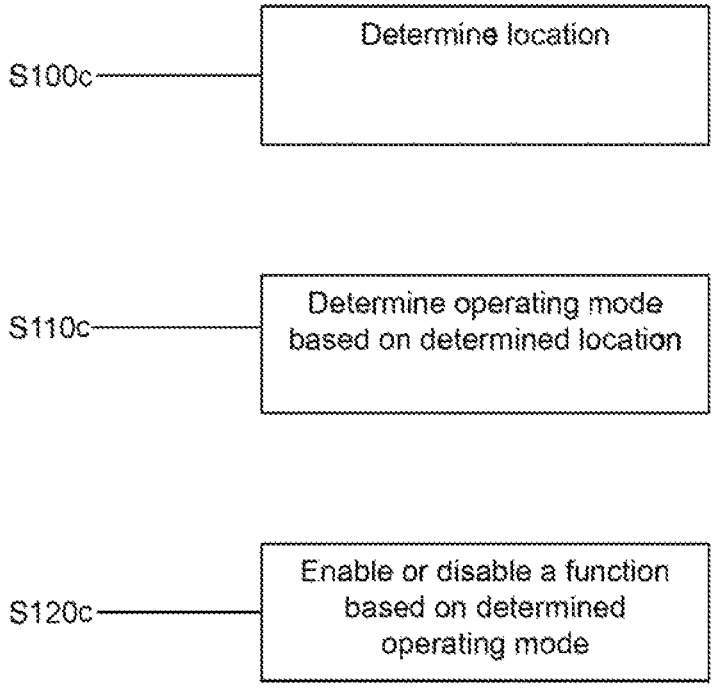
FIG. 17 is a flow chart of a method of the third mode to set an operating mode based on a location of a smoking substitute device and according to an exemplary embodiment.

According to the above exemplary embodiments and as shown in FIG. 17, a user manages the smoking substitute device by determining a location of the smoking substitute device at step S100 and using the location to determine an operating mode at step S110. For instance, the connected external device determines the location of the device and by approximation the smoking substitute device. A lookup function is then completed to determine whether a first mode or a second mode (or indeed a third or subsequent mode) is assigned to the location. The external device subsequently issues a mode command over the wireless link to indicate to the control unit to control the smoking substitute device in either the respective first mode or second mode. Here, and at step S130, the smoking substitute device is configured to enable and disable the first function respectively. Thus, a user may be constrained to use the smoking substitute device with a function automatically disabled in one location, but to use the same smoking substitute device in a different location with the function enables. Thus, a manufacture can supply a smoking substitute device that is configured to be operable differently in accordance to the rules or regulations of different locations without the need to provide different smoking substitute devices specifically adapted for use in different locations or to allow a user to operate a smoking substitute device against the rules or regulations of a second location whilst being able to enjoy the functionality in the first location While the disclosure has been described in conjunction with the exemplary embodiments described above, many equivalent modifications and variations will be apparent to those skilled in the art when given this disclosure. Accordingly, the exemplary embodiments of the disclosure set forth above are considered to be illustrative and not limiting. Various changes to the described embodiments may be made without departing from the spirit and scope of the disclosure.

For the avoidance of any doubt, any theoretical explanations provided herein are provided for the purposes of improving the understanding of a reader. The inventors do not wish to be bound by any of these theoretical explanations.

Any section headings used herein are for organizational purposes only and are not to be construed as limiting the subject matter described.

Throughout this specification, including the claims which follow, unless the context requires otherwise, the word "comprise" and "include", and variations such as "comprises", "comprising", and "including" will be understood to imply the inclusion of a stated integer or step or group of integers or steps but not the exclusion of any other integer or step or group of integers or steps.

It must be noted that, as used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by the use of the antecedent "about," it will be understood that the particular value forms another embodiment. The term "about" in relation to a numerical value is optional and means for example +/−10%.

Fourth Mode: A Smoking Substitute Device and Connectivity of a Smoking Substitute Device to an External Device.

Aspects and embodiments of the fourth mode of the present disclosure will now be discussed with reference to the accompanying figures. Further aspects and embodiments of the fourth mode will be apparent to those skilled in the art. All documents mentioned in this text are incorporated herein by reference.

Figure 18:
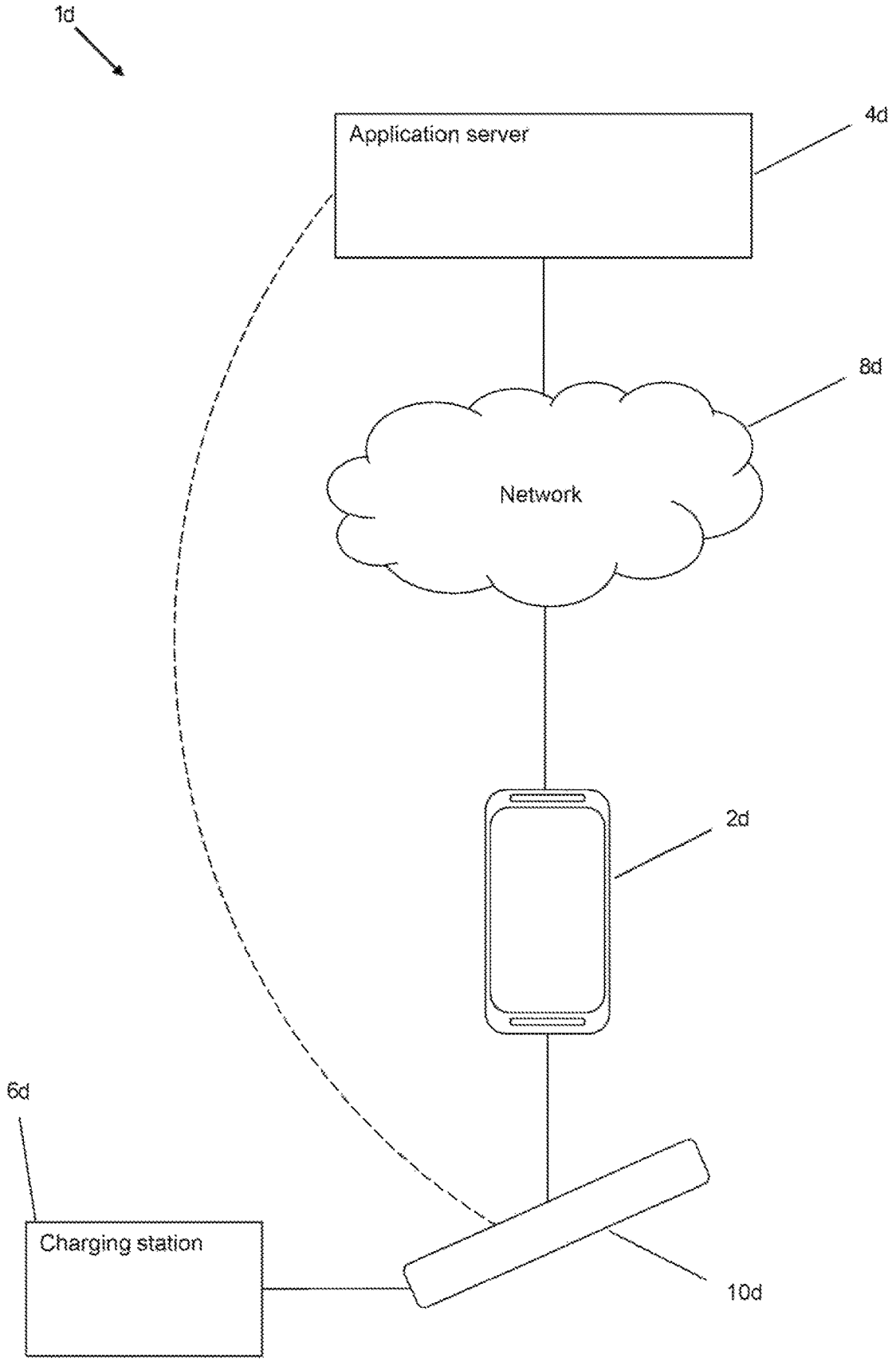
FIG. 18 shows an example system for managing a smoking substitute device of the fourth mode.

FIG. 18 shows an example system 1*d* for managing a smoking substitute device 10*d*.

The system 1*d* as shown in FIG. 18 includes a mobile device 2*d*, an application server 4*d*, an optional charging station 6*d*, as well as the smoking substitute device 10*d*.

The smoking substitute device 10*d* is configured to communicate wirelessly, e.g., via Bluetooth™, with an application (or "app") installed on the mobile device 2*d*, e.g., via a suitable wireless interface (not shown) on the mobile device 2*d*. The mobile device 2*d* may be a mobile phone, for example. The application on the mobile phone is configured to communicate with the application server 4*d*, via a network 8*d*. The application server 4*d* may utilise cloud storage, for example.

The network 8*d* may include a cellular network and/or the internet.

In other examples, the smoking substitute device 10*d* may be configured to communicate with the application server 4*d* via a connection that does not involve the mobile device 2*d*, e.g., via a narrowband internet of things ("NB-IoT") connection. In some examples, the mobile device 2*d* may be omitted from the system.

A skilled person would readily appreciate that the mobile device 2*d* may be configured to communicate via the network 8*d* according to various communication channels, preferably a wireless communication channel such as via a cellular network (e.g., according to a standard protocol, such as 3G or 4G) or via a WiFi network.

The app installed on the mobile device and the application server 4*d* may be configured to assist a user with their smoking substitute device 10*d*, based on information communicated between the smoking substitute device 10*d* and the app and/or information communicated between the app and the application server 4*d*.

The charging station 6*d* (if present) may be configured to charge (and optionally communicate with) the smoking substitute device 10*d*, via a charging port on the smoking substitute device 10*d*. The charging port on the smoking substitute device 10*d* may be a USB port, for example, which may allow the smoking substitute device to be charged by any USB-compatible device capable of delivering power to the smoking substitute device 10*d* via a suitable USB cable (in this case the USB-compatible device would be acting as the charging station 6*d*). Alternatively, the charging station could be a docking station specifically configured to dock with the smoking substitute device 10*d* and charge the smoking substitute device 10*d* via the charging port on the smoking substitute device 10*d*.

Figure 19A:
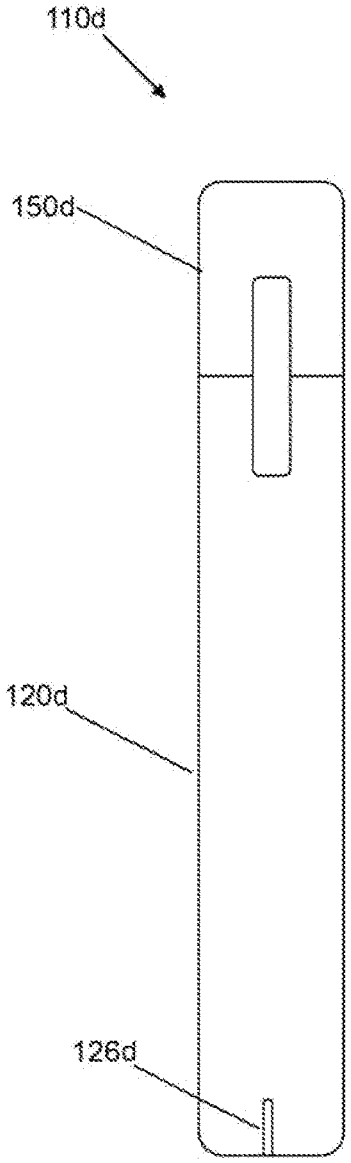
FIG. 19A shows an example smoking substitute device for use as the smoking substitute device in the system of FIG. 18.

FIG. 19A shows an example smoking substitute device 110*d* for use as the smoking substitute device 10*d* in the system 1*d* of FIG. 18.

In this example, the smoking substitute device 110*d* includes a main body 120*d* and a consumable 150*d*. The consumable 150*d* may alternatively be referred to as a "pod".

In this example, the smoking substitute device 110*d* is a closed system vaping device, wherein the consumable 150*d* includes a sealed tank 156*d* and is intended for one-use only.

FIG. 19A shows the smoking substitute device 110*d* with the main body 120*d* physically coupled to the consumable 150*d*.

Figure 19B:
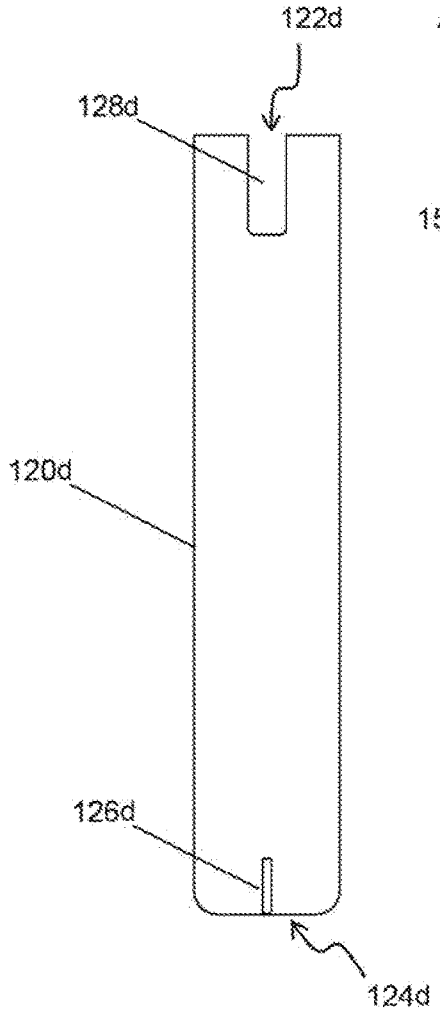
FIG. 19B shows the main body of the smoking substitute device of FIG. 19A without the consumable.

FIG. 19B shows the main body 120*d* of the smoking substitute device 110*d* without the consumable 150*d*.

Figure 19C:
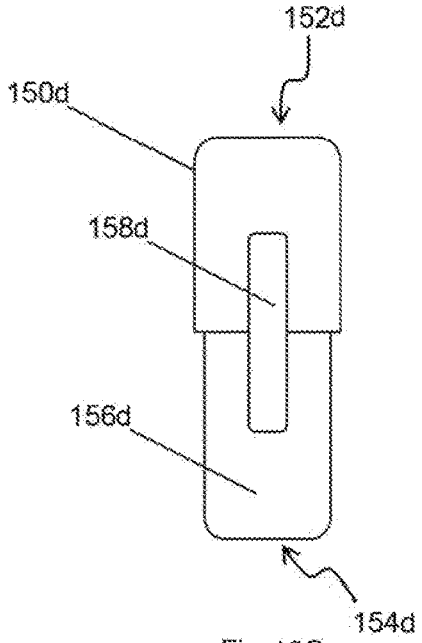
FIG. 19C shows the consumable of the smoking substitute device of FIG. 19A without the main body.

FIG. 19C shows the consumable 150*d* of the smoking substitute device 110*d* without the main body 120*d*.

The main body 120*d* and the consumable 150*d* are configured to be physically coupled together, in this example by pushing the consumable 150*d* into an aperture in a top end 122*d* of the main body 120*d*, e.g., with the consumable 150*d* being retained in the aperture via an interference fit. In other examples, the main body 120*d* and the consumable could be physically coupled together by screwing one onto the other, through a bayonet fitting, or through a snap engagement mechanism, for example. An optional light 126*d*, e.g., an LED located behind a small translucent cover, is located a bottom end 124*d* of the main body 120*d*. The light 126*d* may be configured to illuminate when the smoking substitute device 110*d* is activated.

The consumable 150*d* includes a mouthpiece (not shown) at a top end 152*d* of the consumable 150*d*, as well as one or more air inlets (not shown in FIG. 19) so that air can be drawn into the smoking substitute device 110*d* when a user inhales through the mouthpiece. At a bottom end 154*d* of the consumable 150*d*, there is located a tank 156*d* that contains e-liquid. The tank 156*d* may be a translucent body, for example.

The tank 156*d* preferably includes a window 158*d*, so that the amount of e-liquid in the tank 156*d* can be visually assessed. The main body 120*d* includes a slot 128*d* so that the window 158*d* of the consumable 150*d* can be seen whilst the rest of the tank 156*d* is obscured from view when the consumable 150*d* is inserted into the aperture in the top end 122*d* of the main body 120*d*.

In this present embodiment, the consumable 302*d* is a "single-use" consumable. That is, upon exhausting the e-liquid in the tank 156*d*, the intention is that the user disposes of the whole consumable 150*d*. In other embodiments, the e-liquid (i.e., aerosol former) may be the only part of the system that is truly "single-use". In such embodiments, the tank 156*d* may be refillable with e-liquid or the e-liquid may be stored in a non-consumable component of the system. For example, the e-liquid may be stored in a tank located in the device or stored in another component that is itself not single-use (e.g., a refillable tank).

The tank 156*d* may be referred to as a "clearomizer" if it includes a window 158*d*, or a "cartomizer" if it does not.

Figure 20A:
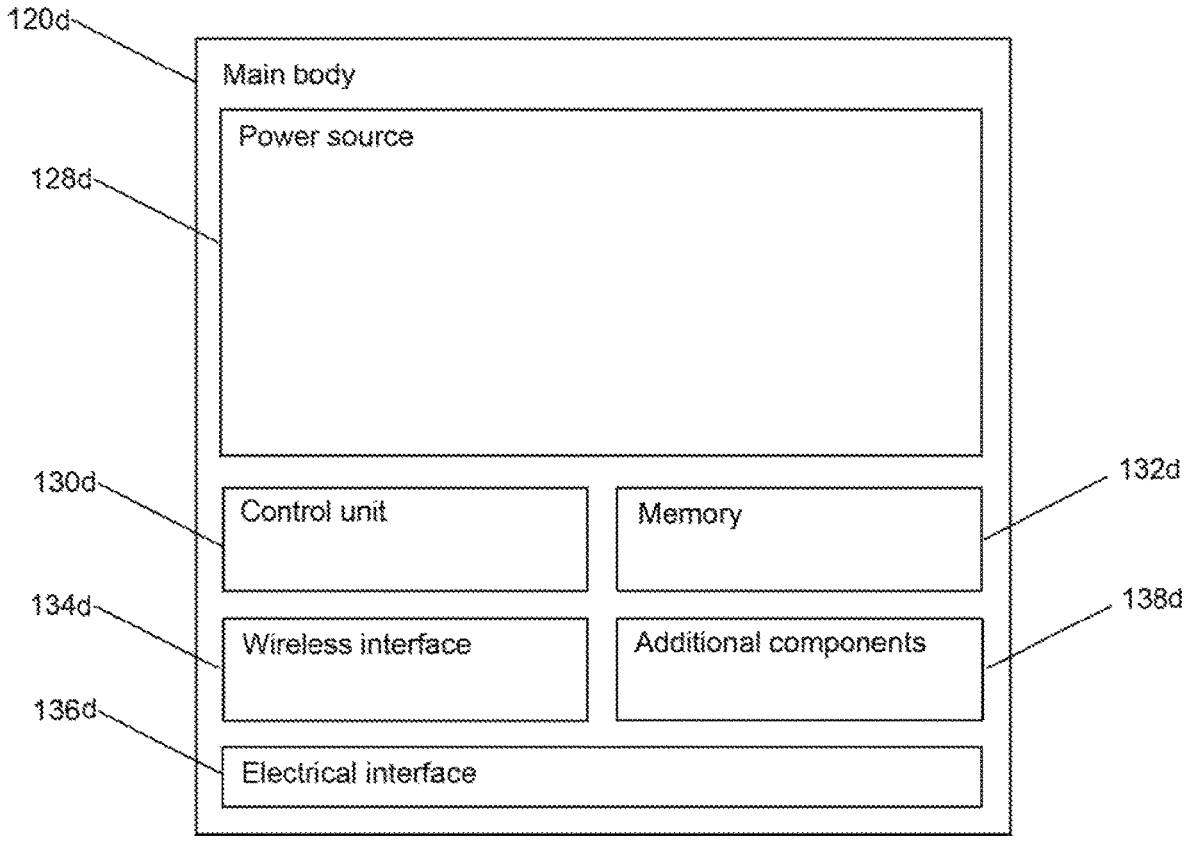
FIG. 20A is a schematic view of the main body of the smoking substitute device of FIG. 19A.

FIG. 20A is a schematic view of the main body 120*d* of the smoking substitute device 110*d*.

Figure 20B:
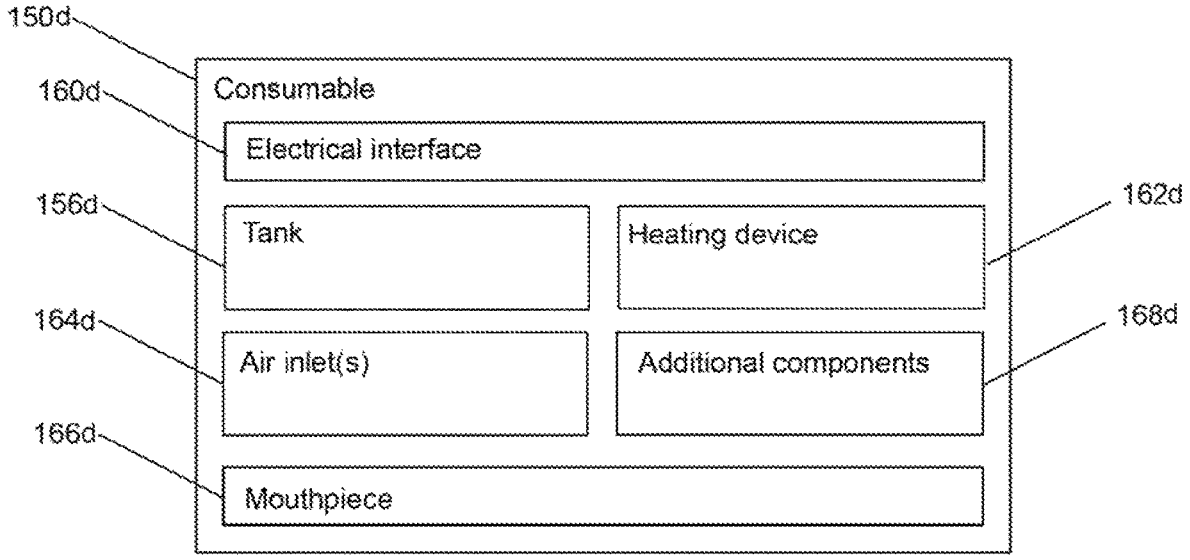
FIG. 20B is a schematic view of the consumable of the smoking substitute device of FIG. 19A.

FIG. 20B is a schematic view of the consumable 150*d* of the smoking substitute device 110*d*.

As shown in FIG. 20A, the main body 120*d* includes a power source 128*d*, a control unit 130*d*, a memory 132*d*, a wireless interface 134*d*, an electrical interface 136*d*, and, optionally, one or more additional components 138*d*.

The power source 128*d* is preferably a battery, more preferably a rechargeable battery.

The control unit 130*d* may include a microprocessor, for example.

The memory 132*d* is preferably includes non-volatile memory.

The wireless interface 134*d* is preferably configured to communicate wirelessly with the mobile device 2*d*, e.g., via Bluetooth™. To this end, the wireless interface 134*d* could include a Bluetooth™ antenna. Other wireless communication interfaces, e.g., WIFI, are also possible.

The electrical interface 136*d* of the main body 120*d* may include one or more electrical supply contacts. The electrical interface 136*d* may be located in, and preferably at the bottom of, the aperture in the top end 122*d* of the main body 120*d*. When the main body 120*d* is physically coupled to the consumable 150*d*, the electrical interface 136*d* may be configured to pass electrical power from the power source 128*d* to (e.g., a heating device of) the consumable 150*d* when the smoking substitute device 110*d* is activated, e.g., via the electrical interface 160*d* of the consumable 150*d* (discussed below). When the main body 120*d* is not physically coupled to the consumable 150*d*, the electrical interface may be configured to receive power from the charging station 6*d*.

The additional components 138*d* of the main body 120*d* may include the optional light 126*d* discussed above.

The additional components 138*d* of the main body 120*d* may, if the power source 128*d* is a rechargeable battery, include a charging port configured to receive power from the charging station 6*d*. This may be located at the bottom end 124*d* of the main body 120*d*. Alternatively, the electrical interface 136*d* discussed above is configured to act as a charging port configured to receive power from the charging station 6*d* such that a separate charging port is not required.

The additional components 138*d* of the main body 120*d* may, if the power source 128*d* is a rechargeable battery, include a battery charging control circuit, for controlling the charging of the rechargeable battery. However, a battery charging control circuit could equally be located in the charging station 6*d* (if present).

The additional components 138*d* of the main body 120*d* may include an airflow sensor for detecting airflow in the smoking substitute device 110*d*, e.g., caused by a user inhaling through a mouthpiece 166*d* (discussed below) of the smoking substitute device 110*d*. The smoking substitute device 110*d* may be configured to be activated when airflow is detected by the airflow sensor. This optional sensor could alternatively be included in the consumable 150*d* (though this is less preferred where the consumable 150*d* is intended to be disposed of after use, as in this example).

The additional components 138*d* of the main body 120*d* may include an actuator, e.g., a button. The smoking substitute device 110*d* may be configured to be activated when the actuator is actuated. This provides an alternative to the airflow sensor noted, as a mechanism for activating the smoking substitute device 110*d*.

The additional components 138*d* of the main body 120*d* may include a reading device configured to read information associated with the consumable from a machine readable data source included in (e.g., contained in the body of, or attached to) the consumable 150*d*.

In some examples, the reading device (if present) may be configured to read information from the machine readable data source non-wirelessly, e.g., using an electrical connection between the main body 120*d* and consumable 150*d*.

For example, the reading device (if present) may include a set of one or more electrical communication contacts configured to read information from the machine readable data source via an electrical connection established between the set of one or more electrical communication contacts and the machine readable data source. Conveniently, the set of one or more electrical communication contacts of the reading device may be configured to provide the electrical connection by engaging with a set of one or more electrical communication contacts of the consumable 150*d*, when the main body 120*d* and the consumable 150*d* are physically coupled together.

In some examples, the reading device (if present) may be configured to read information from the machine readable data source wirelessly, e.g., via electromagnetic waves or optically. Thus, for example, the machine readable data source included in the consumable 150*d* could be an RFID tag (in which case the reading device included in the main body 120*d* may be an RFID reader) or a visual data source such as a barcode (in which case the reading device included in the main body may be an optical reader, e.g., a barcode scanner). Various wireless technologies and protocols may be employed to allow the reading device to wirelessly read information from a machine readable data source included in or attached to the consumable 150*d*, e.g., NFC, Bluetooth™, Wi-Fi, as would be appreciated by a skilled person.

The reading device (if present) may be configured to write information associated with the consumable to the machine readable data source (e.g., wirelessly or non-wirelessly, via one of the mechanisms discussed above) in addition to being configured to read information associated with the consumable from the machine readable data source. In this case, the reading device may be referred to as a reading/writing device.

As shown in FIG. 20B, the consumable 150*d* includes the tank 156*d*, an electrical interface 160*d*, a heating device 162*d*, one or more air inlets 164*d*, a mouthpiece 166*d*, and, optionally, one or more additional components 168*d*.

The electrical interface 160*d* of the consumable 150*d* may include one or more electrical supply contacts. The electrical interface 136*d* of the main body 120*d* and an electrical interface 160*d* of the consumable 150*d* are preferably configured to contact each other and therefore electrically couple the main body 120*d* to the consumable 150*d* when the main body 120*d* is physically coupled to the consumable 150*d*. In this way, electrical energy (e.g., in the form of an electrical current) is able to be supplied from the power source 128*d* in the main body 120*d* to the heating device 162*d* in the consumable 150*d*.

The heating device 162*d* is preferably configured to heat e-liquid contained in the tank 156*d*, e.g., using electrical energy supplied from the power source 128*d*. In one example, the heating device 162*d* may include a heating filament and a wick, wherein a first portion of the wick extends into the tank 156*d* in order to draw e-liquid out from the tank 156*d*, and wherein the heating filament coils around a second portion of the wick located outside the tank 156*d*. In this example, the heating filament is configured to heat up e-liquid drawn out of the tank 156*d* by the wick to produce an aerosol vapor.

The one or more air inlets 164*d* are preferably configured to allow air to be drawn into the smoking substitute device 110*d*, when a user inhales through the mouthpiece 166*d*.

The additional components 168*d* of the consumable 150*d* may include a machine readable data source, which may, e.g., be contained in the body of, or attached to the consumable 150*d*. The machine readable data source may store information associated with the consumable. The information associated with the consumable may include information concerning the content of the consumable (e.g., e-liquid type, batch number) and/or a unique identifier, for example.

The machine readable data source may be rewritable, e.g., a rewritable RFID chip, or read only, e.g., a visual data source such as a barcode. As indicated above, the additional components 138*d* of the main body 120*d* may include a reading device configured to read information associated with the consumable from the machine readable data source.

For example, the electrical interface 160*d* of the consumable 150*d* may include a set of one or more electrical communication contacts, which may allow a reading device of the main body to read information from a machine readable data source of the consumable, e.g., as discussed previously.

In use, a user activates the smoking substitute device 110*d*, e.g., through actuating an actuator included in the main body 120*d* or by inhaling through the mouthpiece 166*d* as described above. Upon activation, the control unit 130*d* may supply electrical energy from the power source 128*d* to the heating device 162*d* (via electrical interfaces 136*d*, 166*d*), which may cause the heating device 162*d* to heat e-liquid drawn from the tank 156*d* to produce a vapor which is inhaled by a user through the mouthpiece 166*d*.

Of course, a skilled reader would readily appreciate that the smoking substitute device 110*d* shown in FIGS. 19 and 20 shows just one example implementation of a smoking substitute device, and that other forms of smoking substitute device could be used as the smoking substitute device 10*d* of FIG. 18.

By way of example, a HNB smoking substitute device including a main body and a consumable could be used as the smoking substitute device 10*d* of FIG. 18, instead of the smoking substitute device 110*d*. One such HNB smoking substitute device is the IQOS™ smoking substitute device discussed above.

As another example, an open system vaping device which includes a main body, a refillable tank, and a mouthpiece could be used as the smoking substitute device 10*d* of FIG. 18, instead of the smoking substitute device 110*d*. One such open system vaping device is the blu PRO™ e-cigarette discussed above.

As another example, an entirely disposable (one use) smoking substitute device could be used as the smoking substitute device 10*d* of FIG. 18, instead of the smoking substitute device 110*d*.

Figure 21:
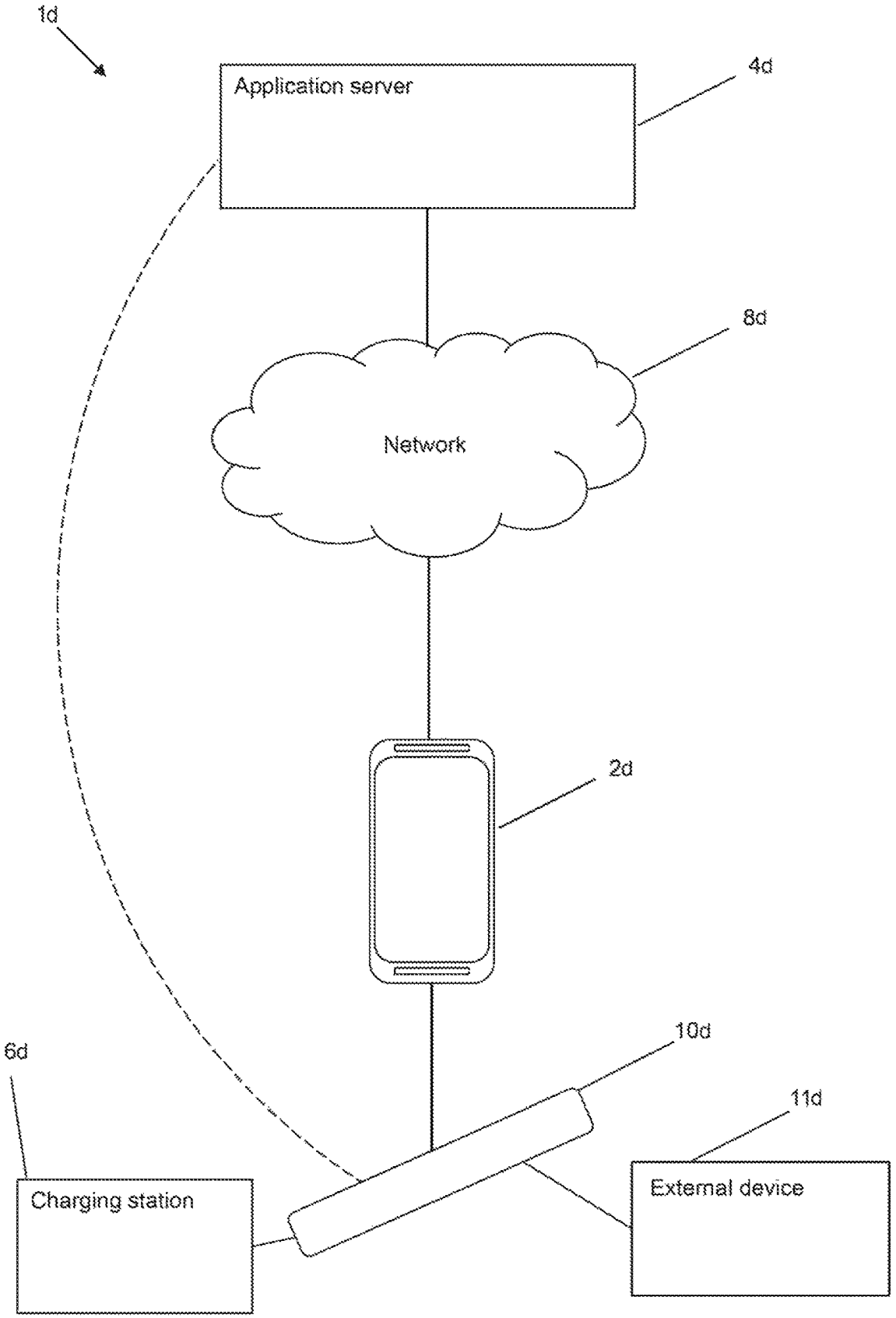
FIG. 21 shows an example system for managing a smoking substitute device of the fourth mode.

FIG. 21 shows how an external device may be connected to a smoking substitute device 10*d*. All of the features described above in relation to FIGS. 18 to 20 are equally applicable to the system 1*d* and smoking substitute device 10*d* of FIG. 21. The system 1*d* as shown in FIG. 21 includes an external device 11*d* in addition to the mobile device 2*d*, application server 4*d*, optional charging station 6*d*, and smoking substitute device 10*d*. In the system of FIG. 21, the application server and network and/or mobile device may be omitted from the system.

The external device 11*d* is electrically connectable to the substitute smoking device 10*d*. In this way, information can pass between the substitute smoking device 10*d* and the external device 11*d*. For example, information from the substitute smoking device 10*d* can be transmitted to the external device 11*d* via the electrical connection.

In order to enable the electrical connection between the substitute smoking device 10*d* and the external device 11*d*, a connection port may be provided on the substitute smoking device 10*d*. The connection port may include a transmitter/receiver including one or more electrical contacts. The electrical contact(s) may be accessible to the outside of the substitute smoking device. For example, the electrical contact(s) may be exposed to the outside of the substitute smoking device, or the electrical contact(s) may be positioned beneath a cap on the outside of the substitute smoking device, such that when the cap is removed or opened, the contact(s) are exposed to the outside of the substitute smoking device.

The electrical contacts may be an input pin and an output pin. The connection port may be a serial port, and may include a UART (Universal Asynchronous Receiver/Transmitter) interface, for example, a 2-wire UART interface. The UART interface may be provided on a printed circuit board (PCB) in the smoking substitute device.

Preferably, the connection port is provided on the main body of the substitute smoking device. Alternatively, the connection port may be provided on the consumable. The connection port may be one of the additional components 138*d* of the main body 120*d* of the substitute smoking device or one of the additional components 168*d* of the consumable 150*d*.

The external device may be physically connected to the connection port either directly or via a connection lead configured to electrically connect the connection port of the substitute smoking device to the external device.

The connection port may be connected to and controlled by the control unit 130*d*. The connection port may communicate with any combination of components from the list including: the control unit, the memory, the wireless interface, additional components and the electrical interface. The connection port may communicate with components of the consumable.

The external device 11*d* may be a computer, a mobile device or another type of electronic device.

The external device may be configured to provide age verification. In this case, when the external device is connected to the substitute smoking device, the external device can transmit a signal to the substitute smoking device to indicate that age verification has been successful. The external device may optionally be able to transmit a signal to the substitute smoking device indicating that age verification has not been successful.

The substitute smoking device may alter its functionality dependent on whether it receives an indication that age verification has been successful (an age verification success signal).

If the substitute smoking device does not receive an age verification success signal during a time window, the device may become locked. Locked may include that the heater is prevented from being activated. In this way, the e-liquid will not be heated and no vapor/aerosol will be produced by the device.

The time window may be a predetermined time since the device received an age verification success signal, and/or a predetermined time since the device was turned on, and/or a time over which a predetermined number of inhales is taken, and/or a time for a predetermined number of charge cycles to be initiated. When the device is turned on for the first time, the time window may be the shortest of (a) a predetermined time since the device was turned on, (b) a time over which a predetermined number of inhales is taken, and (c) a time for a predetermined number of charge cycles to be initiated.

When the device is locked and a user inhales through the mouthpiece, an indication may be given to the user that the device is locked and so the heater will not be activated. The indication may be a flashing light on the substitute smoking device. The light may be an LED and/or may be red. The indication may be three flashes of the light. The indication may additionally or alternatively include vibration of the device, for example three times. When both vibration and light indications are used, the indications may be simultaneous.

Alternatively, when the wireless interface includes a Bluetooth™ antenna so that the device is configured to communicate via Bluetooth™, the external device 11*d* may be configured to provide Bluetooth™ certification. In this case, the external device may send test commands to the substitute smoking device to activate various functions of the Bluetooth™ antenna and control circuit.

The features disclosed in the foregoing description, or in the following claims, or in the accompanying drawings, expressed in their specific forms or in terms of a means for performing the disclosed function, or a method or process for obtaining the disclosed results, as appropriate, may, separately, or in any combination of such features, be utilized for realizing the disclosure in diverse forms thereof.

While the disclosure has been described in conjunction with the exemplary embodiments of the fourth mode described above, many equivalent modifications and variations will be apparent to those skilled in the art when given this disclosure. Accordingly, the exemplary embodiments of the disclosure set forth above are considered to be illustrative and not limiting. Various changes to the described embodiments may be made without departing from the spirit and scope of the disclosure.

For the avoidance of any doubt, any theoretical explanations provided herein are provided for the purposes of improving the understanding of a reader. The inventors do not wish to be bound by any of these theoretical explanations.

Any section headings used herein are for organizational purposes only and are not to be construed as limiting the subject matter described.

Throughout this specification, including the claims which follow, unless the context requires otherwise, the word "comprise" and "include", and variations such as "comprises", "comprising", and "including" will be understood to imply the inclusion of a stated integer or step or group of integers or steps but not the exclusion of any other integer or step or group of integers or steps.

It must be noted that, as used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by the use of the antecedent "about," it will be understood that the particular value forms another embodiment. The term "about" in relation to a numerical value is optional and means for example +/−10%.

Fifth Mode: A Smoking Substitute Device and Management of the Smoking Substitute Device to Assist a User in Locating the Device.

Aspects and embodiments of the fifth mode of the present disclosure will now be discussed with reference to the accompanying figures. Further aspects and embodiments of the fifth mode will be apparent to those skilled in the art. All documents mentioned in this text are incorporated herein by reference.

Figure 22:
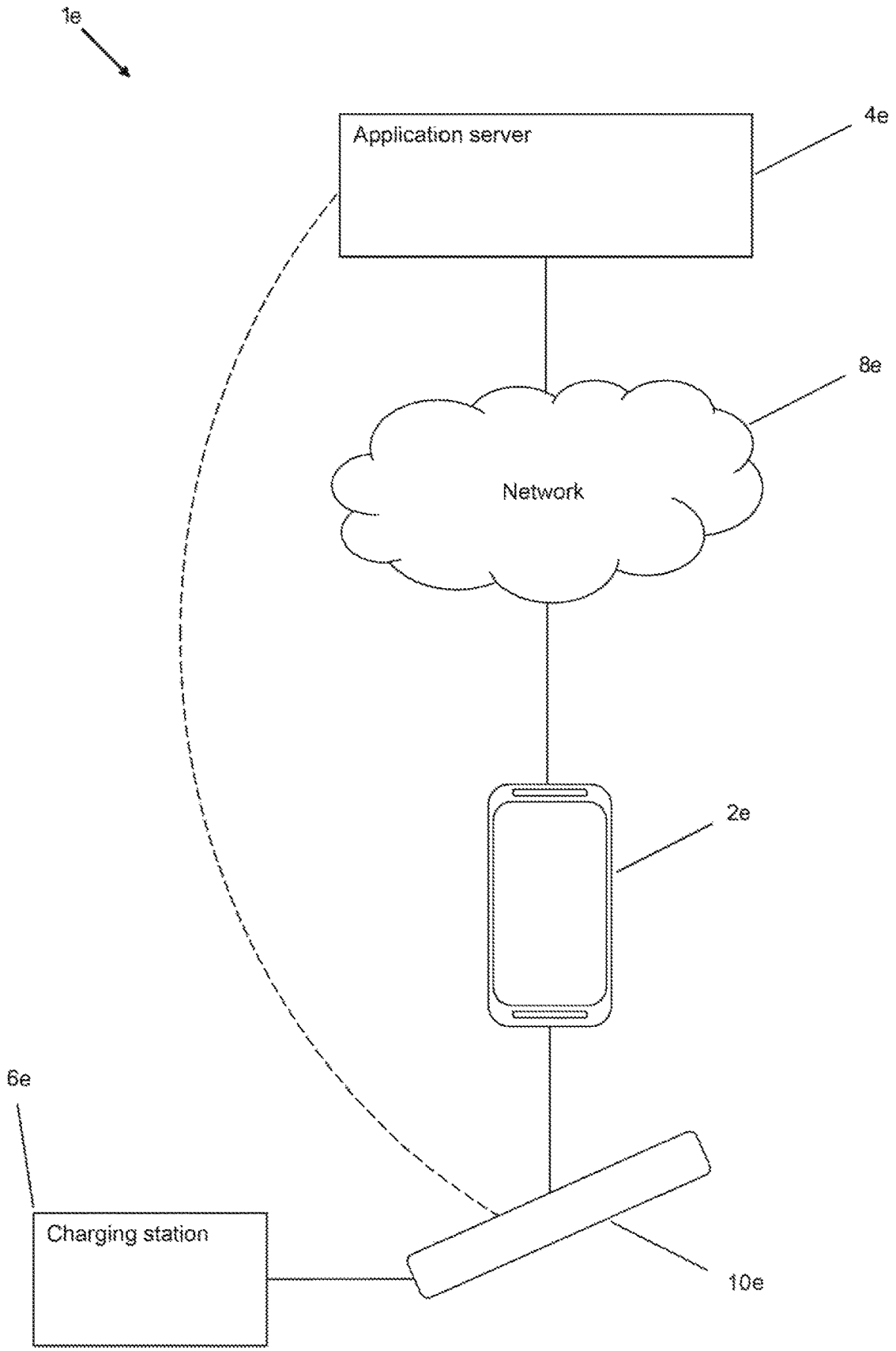
FIG. 22 shows an example system for managing a smoking substitute device of the fifth mode.

FIG. 22 shows an example system 1*e* for managing a smoking substitute device 10*e*.

The system 1*e* as shown in FIG. 22 includes a mobile device 2*e*, an application server 4*e*, an optional charging station 6*e*, as well as the smoking substitute device 10*e*.

The smoking substitute device 10*e* is configured to communicate wirelessly, e.g., via Bluetooth™, with an application (or "app") installed on the mobile device 2*e*, e.g., via a suitable wireless interface (not shown) on the mobile device 2*e*. The mobile device 2*e* may be a mobile phone, for example. The application on the mobile phone is configured to communicate with the application server 4*e*, via a network 8*e*. The application server 4*e* may utilise cloud storage, for example.

The network 8*e* may include a cellular network and/or the internet.

In other examples, the smoking substitute device 10*e* may be configured to communicate with the application server 4*e* via a connection that does not involve the mobile device 2*e*, e.g., via a narrowband internet of things ("NB-IoT") connection. In some examples, the mobile device 2*e* may be omitted from the system.

A skilled person would readily appreciate that the mobile device 2*e* may be configured to communicate via the network 8*e* according to various communication channels, preferably a wireless communication channel such as via a cellular network (e.g., according to a standard protocol, such as 3G or 4G) or via a WiFi network.

The app installed on the mobile device and the application server 4*e* may be configured to assist a user with their smoking substitute device 10*e*, based on information communicated between the smoking substitute device 10*e* and the app and/or information communicated between the app and the application server 4*e*. The app may run in the background to handle communication with the smoking substitute device.

The charging station 6*e* (if present) may be configured to charge (and optionally communicate with) the smoking substitute device 10*e*, via a charging port on the smoking substitute device 10*e*. The charging port on the smoking substitute device 10*e* may be a USB port, for example, which may allow the smoking substitute device to be charged by any USB-compatible device capable of delivering power to the smoking substitute device 10*e* via a suitable USB cable (in this case the USB-compatible device would be acting as the charging station 6*e*). Alternatively, the charging station could be a docking station specifically configured to dock with the smoking substitute device 10*e* and charge the smoking substitute device 10*e* via the charging port on the smoking substitute device 10*e*.

Figure 23A:
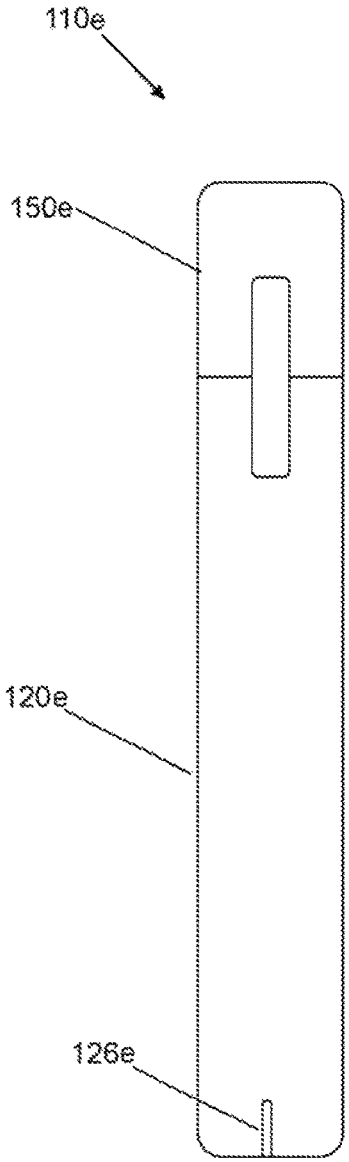
FIG. 23A shows an example smoking substitute device for use as the smoking substitute device in the system of FIG. 22.

FIG. 23A shows an example smoking substitute device 110*e* for use as the smoking substitute device 10*e* in the system 1*e* of FIG. 22.

In this example, the smoking substitute device 110*e* includes a main body 120*e* and a consumable 150*e*. The consumable 150*e* may alternatively be referred to as a "pod".

In this example, the smoking substitute device 110*e* is a closed system vaping device, wherein the consumable 150*e* includes a sealed tank 156*e* and is intended for one-use only.

FIG. 23A shows the smoking substitute device 110*e* with the main body 120*e* physically coupled to the consumable 150*e*.

Figure 23B:
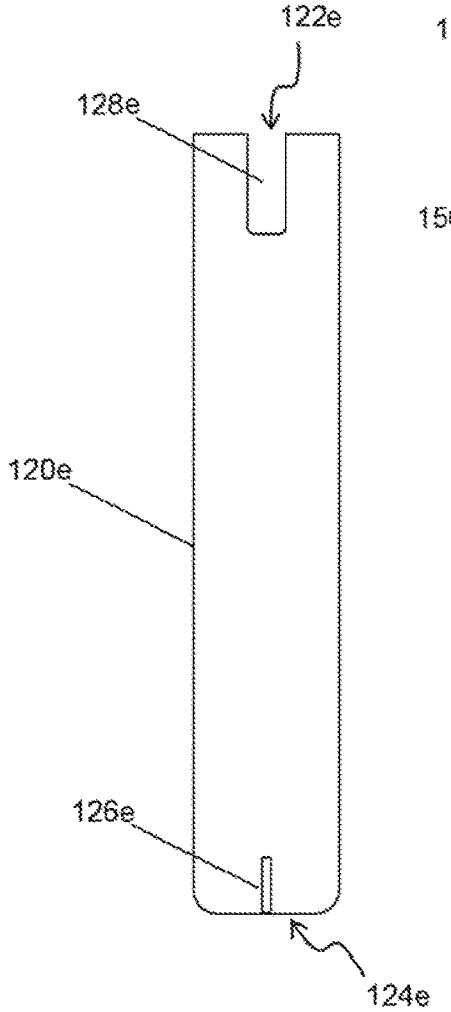
FIG. 23B shows the main body of the smoking substitute device of FIG. 23A without the consumable.

FIG. 23B shows the main body 120*e* of the smoking substitute device 110*e* without the consumable 150*e*.

Figure 23C:
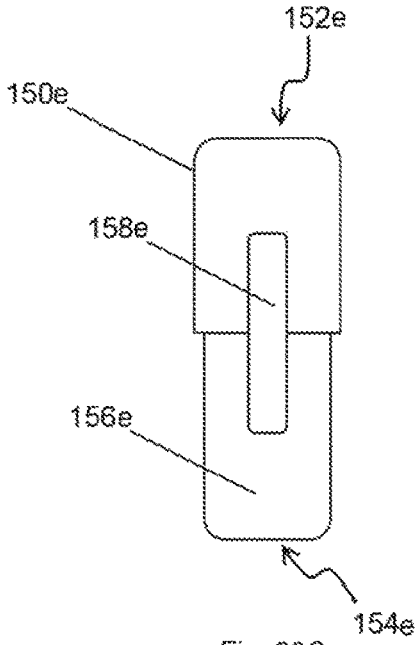
FIG. 23C shows the consumable of the smoking substitute device of FIG. 23A without the main body.

FIG. 23C shows the consumable 150*e* of the smoking substitute device 110*e* without the main body 120*e*.

The main body 120*e* and the consumable 150*e* are configured to be physically coupled together, in this example by pushing the consumable 150*e* into an aperture in a top end 122*e* of the main body 120*e*, e.g., with the consumable 150*e* being retained in the aperture via an interference fit. In other examples, the main body 120*e* and the consumable could be physically coupled together by screwing one onto the other, through a bayonet fitting, or through a snap engagement mechanism, for example. An optional light 126*e*, e.g., an LED located behind a small translucent cover, is located a bottom end 124*e* of the main body 120*e*. The light 126*e* may be configured to illuminate when the smoking substitute device 110*e* is activated.

The consumable 150*e* includes a mouthpiece (not shown) at a top end 152*e* of the consumable 150*e*, as well as one or more air inlets (not shown in FIG. 23) so that air can be drawn into the smoking substitute device 110*e* when a user inhales through the mouthpiece. At a bottom end 154*e* of the consumable 150*e*, there is located a tank 156*e* that contains e-liquid. The tank 156*e* may be a translucent body, for example.

The tank 156*e* preferably includes a window 158*e*, so that the amount of e-liquid in the tank 156*e* can be visually assessed. The main body 120*e* includes a slot 128*e* so that the window 158*e* of the consumable 150*e* can be seen whilst the rest of the tank 156*e* is obscured from view when the consumable 150*e* is inserted into the aperture in the top end 122*e* of the main body 120*e*.

In this present embodiment, the consumable 302*e* is a "single-use" consumable. That is, upon exhausting the e-liquid in the tank 156*e*, the intention is that the user disposes of the whole consumable 150*e*. In other embodiments, the e-liquid (i.e., aerosol former) may be the only part of the system that is truly "single-use". In such embodiments, the tank 156*e* may be refillable with e-liquid or the e-liquid may be stored in a non-consumable component of the system. For example, the e-liquid may be stored in a tank located in the device or stored in another component that is itself not single-use (e.g., a refillable tank).

The tank 156*e* may be referred to as a "clearomizer" if it includes a window 158*e*, or a "cartomizer" if it does not.

Figure 24A:
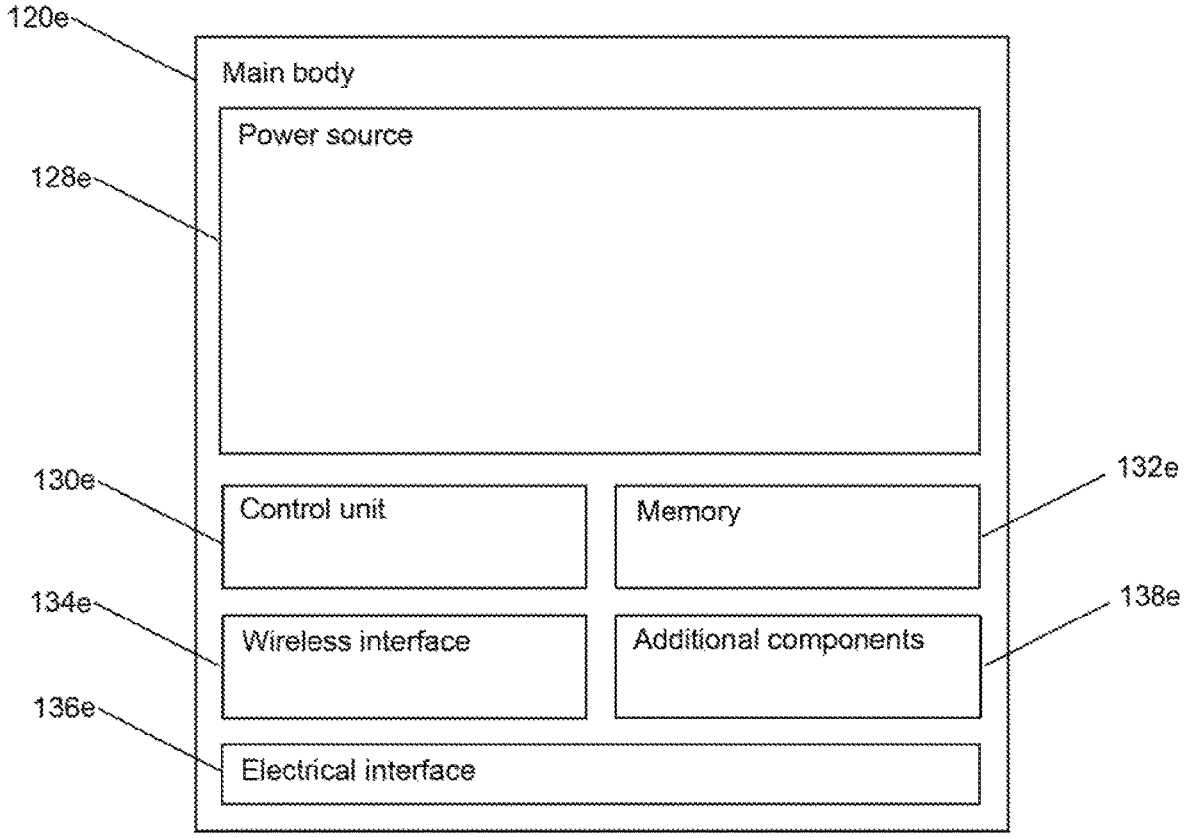
FIG. 24A is a schematic view of the main body of the smoking substitute device of FIG. 23A.

FIG. 24A is a schematic view of the main body 120*e* of the smoking substitute device 110*e*.

Figure 24B:
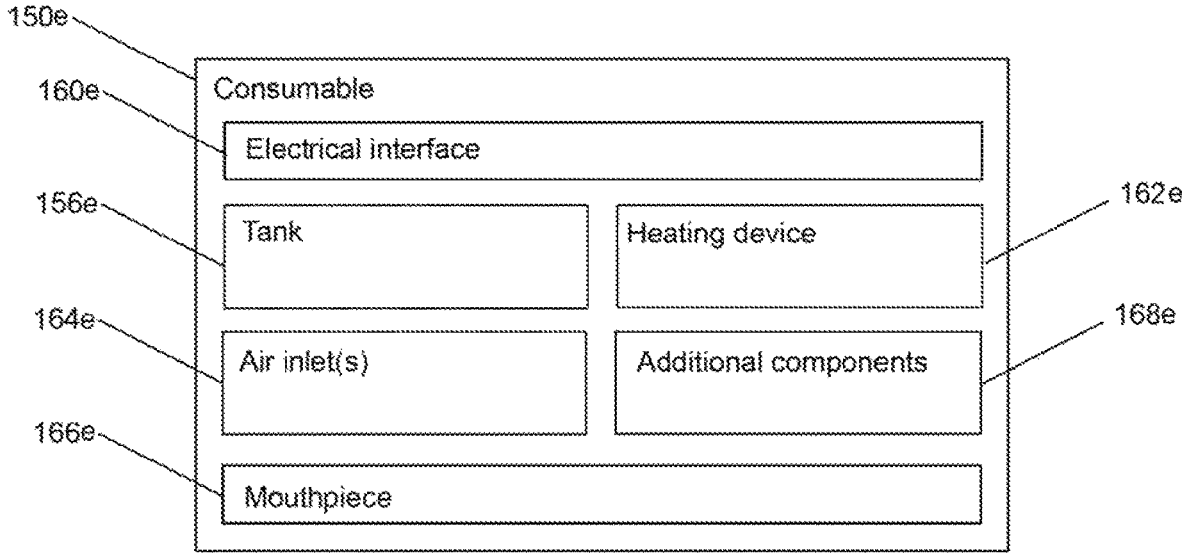
FIG. 24B is a schematic view of the consumable of the smoking substitute device of FIG. 23A.

FIG. 24B is a schematic view of the consumable 150*e* of the smoking substitute device 110*e*.

As shown in FIG. 24A, the main body 120*e* includes a power source 128*e*, a control unit 130*e*, a memory 132*e*, a wireless interface 134*e*, an electrical interface 136*e*, and, optionally, one or more additional components 138*e*.

The power source 128*e* is preferably a battery, more preferably a rechargeable battery.

The control unit 130*e* may include a microprocessor, for example.

The memory 132*e* preferably includes non-volatile memory.

The wireless interface establishes communication over a wireless communication channel between the smoking substitute device and communication terminal of the external device. The wireless interface may utilities any suitable wireless protocol. Suitably, the wireless interface may operate over a short range network. For example, it may comprise a wireless personal area network (WPAN), e.g., using Bluetooth™, ZigBee, a WIFI personal hotspot or the like. The smoking substitute device may pair with the portable communication terminal over the wireless communication channel. The portable communication terminal may be a master device and the smoking substitute device may be a slave device. As such, in exemplary embodiments, the wireless interface 134*e* is preferably configured to communicate wirelessly with the mobile device 2*e*, e.g., via Bluetooth. To this end, the wireless interface 134*e* could include a Bluetooth™ antenna. Other wireless communication interfaces, e.g., WIFI, are also possible.

The electrical interface 136*e* of the main body 120*e* may include one or more electrical supply contacts. The electrical interface 136*e* may be located in, and preferably at the bottom of, the aperture in the top end 122*e* of the main body 120*e*. When the main body 120*e* is physically coupled to the consumable 150*e*, the electrical interface 136*e* may be configured to pass electrical power from the power source 128*e* to (e.g., a heating device of) the consumable 150*e* when the smoking substitute device 110*e* is activated, e.g., via the electrical interface 160*e* of the consumable 150*e* (discussed below). When the main body 120*e* is not physically coupled to the consumable 150*e*, the electrical interface may be configured to receive power from the charging station 6*e*.

The additional components 138*e* of the main body 120*e* may include the optional light 126*e* discussed above.

The additional components 138*e* of the main body 120*e* may, if the power source 128*e* is a rechargeable battery, include a charging port configured to receive power from the charging station 6*e*. This may be located at the bottom end 124*e* of the main body 120*e*. Alternatively, the electrical interface 136*e* discussed above is configured to act as a charging port configured to receive power from the charging station 6*e* such that a separate charging port is not required.

The additional components 138*e* of the main body 120*e* may, if the power source 128*e* is a rechargeable battery, include a battery charging control circuit, for controlling the charging of the rechargeable battery. However, a battery charging control circuit could equally be located in the charging station 6*e* (if present).

The additional components 138*e* of the main body 120*e* may include an airflow sensor for detecting airflow in the smoking substitute device 110*e*, e.g., caused by a user inhaling through a mouthpiece 166*e* (discussed below) of the smoking substitute device 110*e*. The smoking substitute device 110*e* may be configured to be activated when airflow is detected by the airflow sensor. This optional sensor could alternatively be included in the consumable 150*e* (though this is less preferred where the consumable 150*e* is intended to be disposed of after use, as in this example).

The additional components 138*e* of the main body 120*e* may include an actuator, e.g., a button. The smoking substitute device 110*e* may be configured to be activated when the actuator is actuated. This provides an alternative to the airflow sensor noted, as a mechanism for activating the smoking substitute device 110*e*.

The additional components 138*e* of the main body 120*e* may include a motion sensor such as an accelerometer. The accelerometer may function as a motion sensor to receive inputs for controlling the device. An accelerometer is, as the skilled reader will know, an electromechanical device that measures acceleration forces, and provides a measure of "proper acceleration", which is the acceleration of a body or object, relative to free fall. The accelerometer comprised within the smoking substitute device, is configured to measure dynamic acceleration forces, and so can sense movement or vibrations. The accelerometer is configured to measure acceleration and its outputs may be used to determine position factors and/or orientation factors such as tilt, tilt angle, and incline, as well as being used to determine actions or events such as rotation, vibration and collision.

The accelerometer may be a piezoelectric accelerometer. However other types of accelerometer may be used in a smoking substitute device, such as a capacitance accelerometer. The accelerometer may comprise a three-axis model, to enable it to sense rotational tilt, as well as movement in a two-dimensional plane.

The accelerometer may be configured to detect movement and collisions, and to provide one or more voltage outputs to the control unit 130*e*, as a result of what it has detected. The accelerometer can, for example, detect the action of the smoking substitute device being tapped against (i.e., relatively gently colliding with) a surface. When the user taps the device, the accelerometer transmits a corresponding voltage signal to the control unit 130*e*. The control unit 130*e* can then control the memory 132*e* to store (at least temporarily) a measure of the voltage signal, along with an indicator of the time at which it was received. If the smoking substitute device is currently paired with, or bonded to, a mobile device, it may also submit a signal to the mobile device, via the wireless communication link that has been established between them, regarding the detection that the accelerometer has made. This can be very useful as the smoking substitute device may be preconfigured for a tap (or a plurality of taps) to form part of a sequence for the user to convey instructions to the device and/or to the connected mobile device or application.

The additional components 138*e* of the main body 120*e* may include a reading device configured to read information associated with the consumable from a machine readable data source included in (e.g., contained in the body of, or attached to) the consumable 150*e*.

In some examples, the reading device (if present) may be configured to read information from the machine readable data source non-wirelessly, e.g., using an electrical connection between the main body 120*e* and consumable 150*e*.

For example, the reading device (if present) may include a set of one or more electrical communication contacts configured to read information from the machine readable data source via an electrical connection established between the set of one or more electrical communication contacts and the machine readable data source. Conveniently, the set of one or more electrical communication contacts of the reading device may be configured to provide the electrical connection by engaging with a set of one or more electrical communication contacts of the consumable 150*e*, when the main body 120*e* and the consumable 150*e* are physically coupled together.

In some examples, the reading device (if present) may be configured to read information from the machine readable data source wirelessly, e.g., via electromagnetic waves or optically. Thus, for example, the machine readable data source included in the consumable 150*e* could be an RFID tag (in which case the reading device included in the main body 120*e* may be an RFID reader) or a visual data source such as a barcode (in which case the reading device included in the main body may be an optical reader, e.g., a barcode scanner). Various wireless technologies and protocols may be employed to allow the reading device to wirelessly read information from a machine readable data source included in or attached to the consumable 150*e*, e.g., NFC, Bluetooth, Wi-Fi, as would be appreciated by a skilled person.

The reading device (if present) may be configured to write information associated with the consumable to the machine readable data source (e.g., wirelessly or non-wirelessly, via one of the mechanisms discussed above) in addition to being configured to read information associated with the consumable from the machine readable data source. In this case, the reading device may be referred to as a reading/writing device.

As shown in FIG. 24B, the consumable 150*e* includes the tank 156*e*, an electrical interface 160*e*, a heating device 162*e*, one or more air inlets 164*e*, a mouthpiece 166*e*, and, optionally, one or more additional components 168*e*.

The electrical interface 160*e* of the consumable 150*e* may include one or more electrical supply contacts. The electrical interface 136*e* of the main body 120*e* and an electrical interface 160*e* of the consumable 150*e* are preferably configured to contact each other and therefore electrically couple the main body 120*e* to the consumable 150*e* when the main body 120*e* is physically coupled to the consumable 150*e*. In this way, electrical energy (e.g., in the form of an electrical current) is able to be supplied from the power source 128*e* in the main body 120*e* to the heating device 162*e* in the consumable 150*e*.

The heating device 162*e* is preferably configured to heat e-liquid contained in the tank 156*e*, e.g., using electrical energy supplied from the power source 128*e*. In one example, the heating device 162*e* may include a heating filament and a wick, wherein a first portion of the wick extends into the tank 156*e* in order to draw e-liquid out from the tank 156*e*, and wherein the heating filament coils around a second portion of the wick located outside the tank 156*e*. In this example, the heating filament is configured to heat up e-liquid drawn out of the tank 156*e* by the wick to produce an aerosol vapor.

The one or more air inlets 164*e* are preferably configured to allow air to be drawn into the smoking substitute device 110*e*, when a user inhales through the mouthpiece 166*e*.

The additional components 168*e* of the consumable 150*e* may include a machine readable data source, which may, e.g., be contained in the body of, or attached to the consumable 150*e*. The machine readable data source may store information associated with the consumable. The information associated with the consumable may include information concerning the content of the consumable (e.g., e-liquid type, batch number) and/or a unique identifier, for example.

The machine readable data source may be rewritable, e.g., a rewritable RFID chip, or read only, e.g., a visual data source such as a barcode. As indicated above, the additional components 138*e* of the main body 120*e* may include a reading device configured to read information associated with the consumable from the machine readable data source.

For example, the electrical interface 160*e* of the consumable 150*e* may include a set of one or more electrical communication contacts, which may allow a reading device of the main body to read information from a machine readable data source of the consumable, e.g., as discussed previously.

In use, a user activates the smoking substitute device 110*e*, e.g., through actuating an actuator included in the main body 120*e* or by inhaling through the mouthpiece 166*e* as described above. Upon activation, the control unit 130*e* may supply electrical energy from the power source 128*e* to the heating device 162*e* (via electrical interfaces 136*e*, 166*e*), which may cause the heating device 162*e* to heat e-liquid drawn from the tank 156*e* to produce a vapor which is inhaled by a user through the mouthpiece 166*e*.

Of course, a skilled reader would readily appreciate that the smoking substitute device 110*e* shown in FIGS. 23 and 24 shows just one example implementation of a smoking substitute device, and that other forms of smoking substitute device could be used as the smoking substitute device 10*e* of FIG. 22.

By way of example, a HNB smoking substitute device including a main body and a consumable could be used as the smoking substitute device 10*e* of FIG. 22, instead of the smoking substitute device 110*e*. One such HNB smoking substitute device is the IQOS™ smoking substitute device discussed above.

As another example, an open system vaping device which includes a main body, a refillable tank, and a mouthpiece could be used as the smoking substitute device 10*e* of FIG. 22, instead of the smoking substitute device 110*e*. One such open system vaping device is the blu PRO™ e-cigarette discussed above.

As another example, an entirely disposable (one use) smoking substitute device could be used as the smoking substitute device 10*e* of FIG. 22, instead of the smoking substitute device 110*e*.

Figure 25:
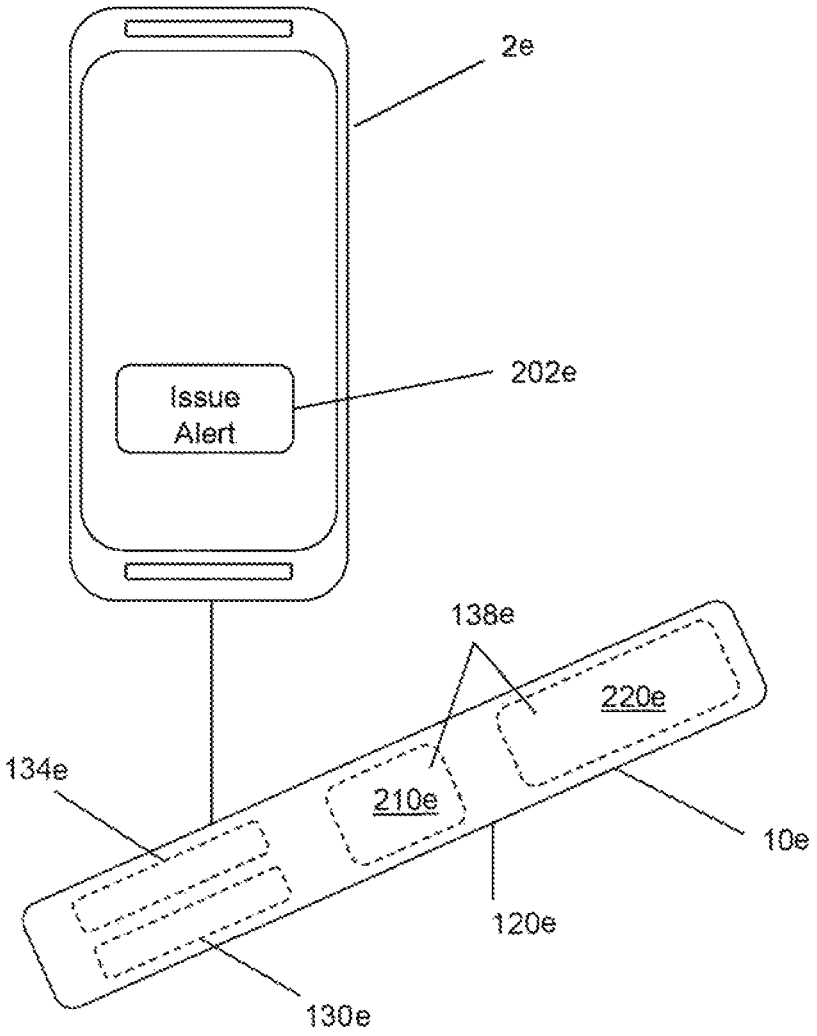
FIG. 25 is an example schematic view of a system for managing the automatic alert deactivation of a smoking substitute device according to an exemplary embodiment of the fifth mode.

Referring to FIG. 25, an exemplary embodiment is shown wherein the system comprises an external device 2*e* and a smoking substitute device 10*e*. The devices 2*e*, 10*e* can be as explained above, but specific features relating to the automatic deactivation of an alert are herein further described.

The external device is shown as suitably being a smart telephone operating an application. However, it will be appreciated that other devices such as tablet computers, smart watches or the like may be equally applicable. The external device 2*e* runs the application that can be used as a user interface between the user and the smoking substitute device. In order to establish communication between the external device and smoking substitute device, the smoking substitute device includes a communications interface and the external device is connected thereto. It is envisaged the connection will be a short distance wireless connection so that the user can be within distance of the alert in order to subsequently use the alert to guide them to the location of the smoking substitute device. Therefore, upon initial set up of the system, it will be appreciated that the application may be used to pair the external device with the smoking substitute device. For instance, the application may complete a Bluetooth pairing operation or another operation to establish the external device as a trusted device. With communication between the devices established, the external device can communicate with the smoking substitute device via the application and the smoking substitute device can communicate with the application by being controlled to transmit data via the communication interface. Thus, the user can manipulate the external device to send the alert command wirelessly to the smoking substitute device. As shown in FIG. 25 an input button 202*e* is suitably provide as part of the application's graphic user interface to enable a user to initiate the alert. Thus, the smoking substitute device receives an alert command and the control unit recognizes the receipt of the alert command as the first event trigger and activates the alert device.

The smoking substitute device's body 1 houses the wireless interface 134*e*, the control unit 130*e* and additional components 138*e*. In the exemplary embodiments, the additional components are a motion sensor 210*e* and an alert device 220*e*.

In one exemplary embodiment, the motion sensor 210*e* is an accelerometer as herein described. It will be appreciated that the motion sensor is therefore able to sense and convert movement of the smoking substitute device into signals. Here, electronic signals for instance form the motion sensor are analyzed and used by the control unit to determine whether the smoking substitute device has been moved to replicate a predetermined movement. If the control unit determines the motion sensor has detected a movement replicating a predetermined movement that corresponds to a second event trigger, the control unit 130*e* can deactivate the alert device 220*e*.

In one exemplary embodiment, the alert device 220*e* issues a visual alert when activated. Here, it will be appreciated that the alert device may be a light emitter such as a light 126*e* as herein described.

In an additional or alternative exemplary embodiment, the alert device 220*e* issues an audible alert when activated. Here the alert device 220*e* may comprise a speaker or a haptic generator. Speakers are known in the art and the control unit 130*e* may control the speaker to issue an audible alert to assist the user locating the smoking substitute device when nearby. For instance, the speaker could emit a periodic sound such as a buzz or beep or other noise until deactivated. Alternatively, the speaker may be controlled to issue a substantially constant sound such as music, wherein the music may be recognizable and attributed to the smoking substitute device.

In an additional or alternative exemplary embodiment, the alert device 200*e* is a haptic generator that causes a vibration force on the smoking substitute device when activated. Typically, when vibrated, the smoking substitute device emanates an audible alert that a user may recognize to assist in locating the device. In addition, if the device is in the user's clothing, the vibrations may transmit a haptic sensory alert to the user. The haptic generator may be a haptic motor and a weight mounted eccentrically on a shaft of the electric motor. The rotation of the eccentric weight produces the vibratory force.

It will be appreciated that in the exemplary embodiments, the body 120*e* may house a power source 128*e* and the control unit controls the activation and deactivation of the alert device by controlling the supply of power to the alert device from a power source 128*e*.

Figure 26:
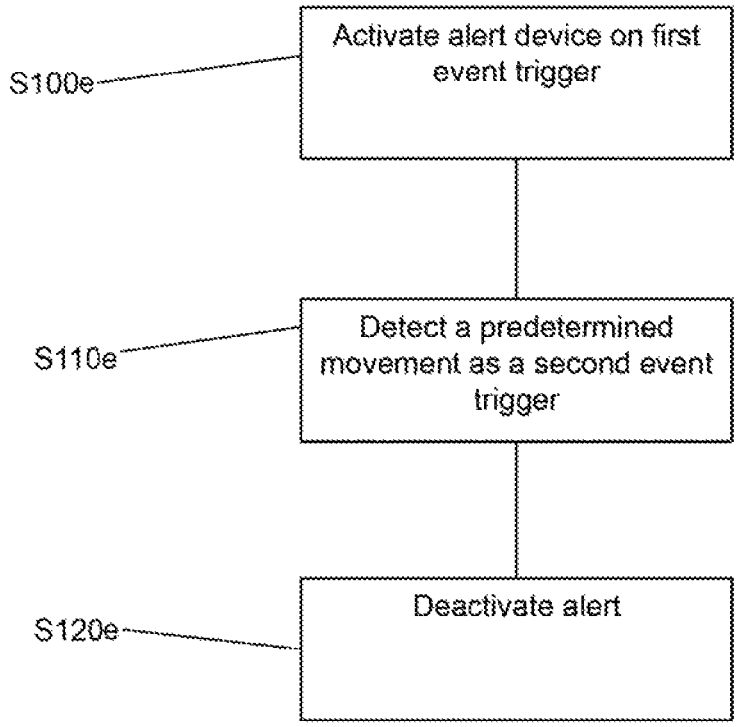
FIG. 26 is a flow chart of an automatic alert deactivation method according to an exemplary embodiment of the fifth mode.

In an exemplary method a smoking substitute device is managed so that an alert device is automatically deactivated upon the motion sensor detecting that a predetermined movement of the smoking substitute device has been replicated. As shown in FIG. 26, at step S100 the alert device 220*e* is activated upon the control unit 130*e* identifying a first event trigger. Suitably, the first event trigger is the receipt by the wireless interface of an alert command. Here, in an exemplary method of managing a system, the method includes the precursor step of a user inputting an alert command to cause the external device to transmit an alert command to the smoking substitute device connected thereto via a wireless communications link.

At step S110, the control unit is configured to detect a predetermined movement of the smoking substitute device has been replicated by monitoring and/or analyzing the output of a motion sensor. Thus, the step S110 may comprise using a motion sensor to detect a second event trigger, wherein the second event trigger is detection of a predetermined movement being replicated by the smoking substitute device.

Consequently, the method comprises at step S130 deactivating the alert subsequent to identifying the second event trigger.

According to exemplary embodiments, the method of managing the system may comprise the optional step of verifying that a smoking substitute device is connected via a wireless communication link. If there is a wireless connection link, the method may comprise subsequently transmitting the alert command to the smoking substitute device. Alternatively, if the wireless link is not connected, the method may comprise issuing an error command. The error command may be a message through the application's graphic user interface or otherwise. Alternatively, the verification may occur before an alert function is active and the alert function is not activated to allow the alert command to be transmitted unless the wireless link is verified as being established.

According to another exemplary embodiment, after deactivating the alert, the method may comprise the step of transmitting a found command from the smoking substitute device back to the external device.

The features disclosed in the foregoing description, or in the following claims, or in the accompanying drawings, expressed in their specific forms or in terms of a means for performing the disclosed function, or a method or process for obtaining the disclosed results, as appropriate, may, separately, or in any combination of such features, be utilized for realizing the disclosure in diverse forms thereof.

While the disclosure has been described in conjunction with the exemplary embodiments described above, many equivalent modifications and variations will be apparent to those skilled in the art when given this disclosure. Accordingly, the exemplary embodiments of the disclosure set forth above are considered to be illustrative and not limiting. Various changes to the described embodiments may be made without departing from the spirit and scope of the disclosure.

For the avoidance of any doubt, any theoretical explanations provided herein are provided for the purposes of improving the understanding of a reader. The inventors do not wish to be bound by any of these theoretical explanations.

Any section headings used herein are for organizational purposes only and are not to be construed as limiting the subject matter described.

Throughout this specification, including the claims which follow, unless the context requires otherwise, the word "comprise" and "include", and variations such as "comprises", "comprising", and "including" will be understood to imply the inclusion of a stated integer or step or group of integers or steps but not the exclusion of any other integer or step or group of integers or steps.

It must be noted that, as used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by the use of the antecedent "about," it will be understood that the particular value forms another embodiment. The term "about" in relation to a numerical value is optional and means for example +/−10%.

Sixth Mode: A Smoking Substitute Device and Management of the Smoking Substitute Device when Wirelessly Connected to an External Device.

Aspects and embodiments of the sixth mode of the present disclosure will now be discussed with reference to the accompanying figures. Further aspects and embodiments will be apparent to those skilled in the art. All documents mentioned in this text are incorporated herein by reference.

Figure 27:
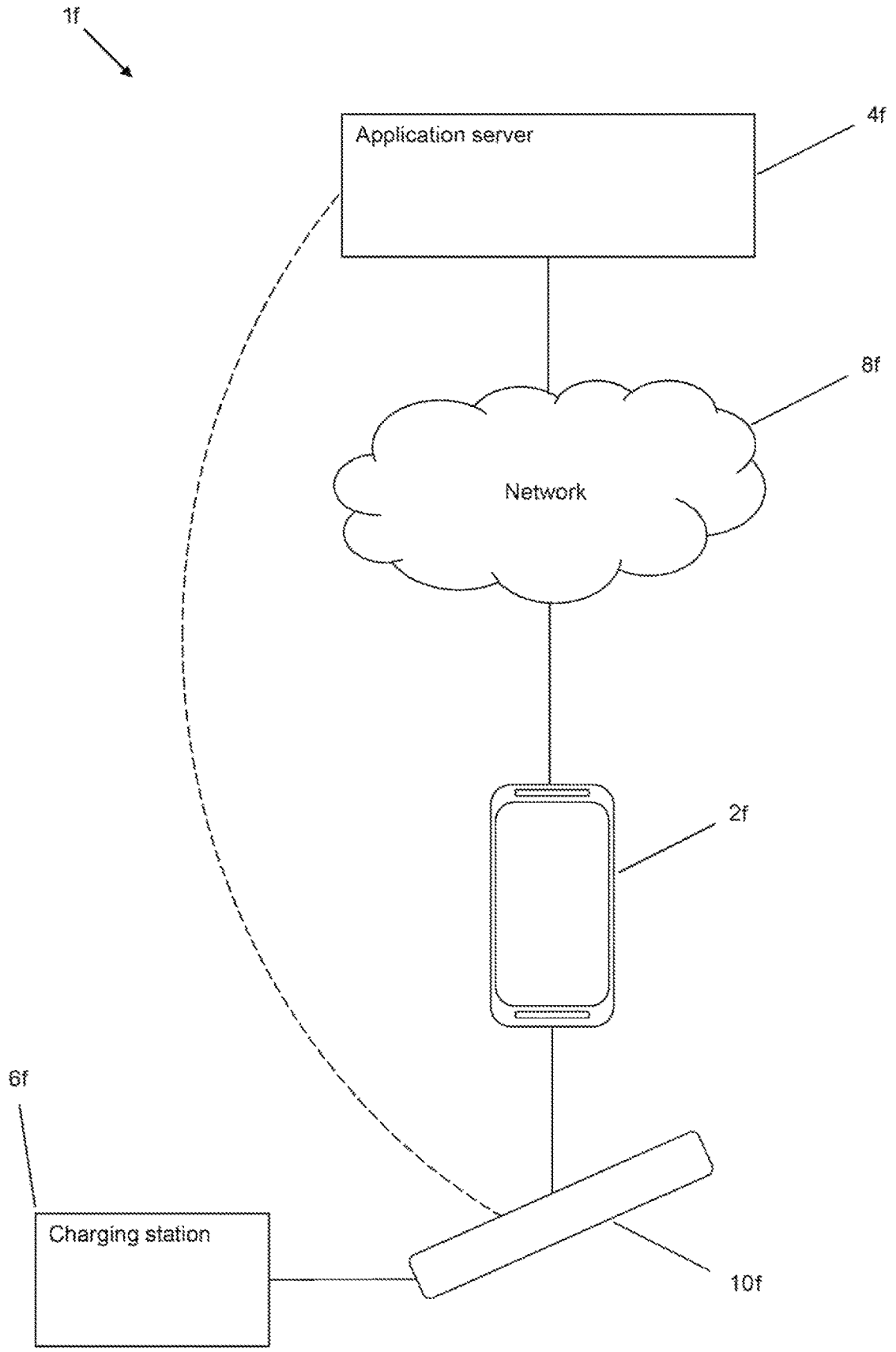
FIG. 27 shows an example system for managing a smoking substitute device of the sixth mode.

FIG. 27 shows an example system 1*f* for managing a smoking substitute device 10*f*.

The system 1*f* as shown in FIG. 27 includes a mobile device 2*f*, an application server 4*f*, an optional charging station 6*f*, as well as the smoking substitute device 10*f*.

The smoking substitute device 10*f* is configured to communicate wirelessly, e.g., via Bluetooth™, with an application (or "app") installed on the mobile device 2*f*, e.g., via a suitable wireless interface (not shown) on the mobile device 2*f*. The mobile device 2*f* may be a mobile phone, for example. The application on the mobile phone is configured to communicate with the application server 4*f*, via a network 8*f*. The application server 4*f* may utilize cloud storage, for example.

The network 8*f* may include a cellular network and/or the internet.

In other examples, the smoking substitute device 10*f* may be configured to communicate with the application server 4*f* via a connection that does not involve the mobile device 2*f*, e.g., via a narrowband internet of things ("NB-IoT") connection. In some examples, the mobile device 2*f* may be omitted from the system.

A skilled person would readily appreciate that the mobile device 2*f* may be configured to communicate via the network 8*f* according to various communication channels, preferably a wireless communication channel such as via a cellular network (e.g., according to a standard protocol, such as 3G or 4G) or via a WIFI network.

The app installed on the mobile device and the application server 4*f* may be configured to assist a user with their smoking substitute device 10*f*, based on information communicated between the smoking substitute device 10*f* and the app and/or information communicated between the app and the application server 4*f*. The app may run in the background to handle communication with the smoking substitute device.

The charging station 6*f* (if present) may be configured to charge (and optionally communicate with) the smoking substitute device 10*f*, via a charging port on the smoking substitute device 10*f*. The charging port on the smoking substitute device 10*f* may be a USB port, for example, which may allow the smoking substitute device to be charged by any USB-compatible device capable of delivering power to the smoking substitute device 10*f* via a suitable USB cable (in this case the USB-compatible device would be acting as the charging station 6*f*). Alternatively, the charging station could be a docking station specifically configured to dock with the smoking substitute device 10*f* and charge the smoking substitute device 10*f* via the charging port on the smoking substitute device 10*f*.

Figure 28A:
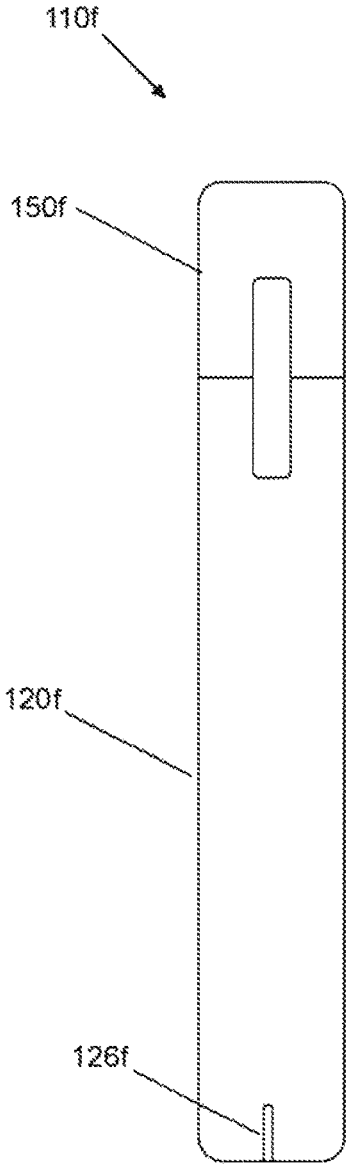
FIG. 28A shows an example smoking substitute device for use as the smoking substitute device in the system of FIG. 27.

FIG. 28A shows an example smoking substitute device 110*f* for use as the smoking substitute device 10*f* in the system 1*f* of FIG. 27.

In this example, the smoking substitute device 110*f* includes a main body 120*f* and a consumable 150*f*. The consumable 150*f* may alternatively be referred to as a "pod".

In this example, the smoking substitute device 110*f* is a closed system vaping device, wherein the consumable 150*f* includes a sealed tank 156*f* and is intended for one-use only.

FIG. 28A shows the smoking substitute device 110*f* with the main body 120*f* physically coupled to the consumable 150*f*.

Figure 28B:
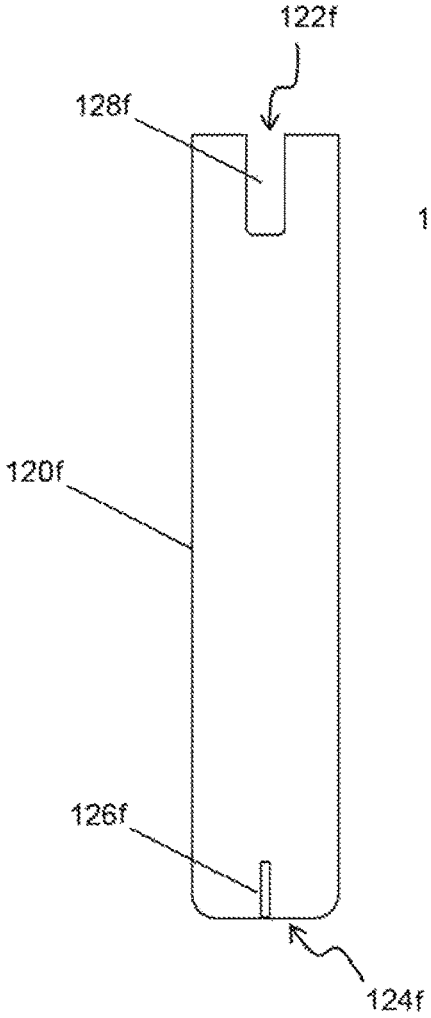
FIG. 28B shows the main body of the smoking substitute device of FIG. 28A without the consumable.

FIG. 28B shows the main body 120*f* of the smoking substitute device 110*f* without the consumable 150*f*.

Figure 28C:
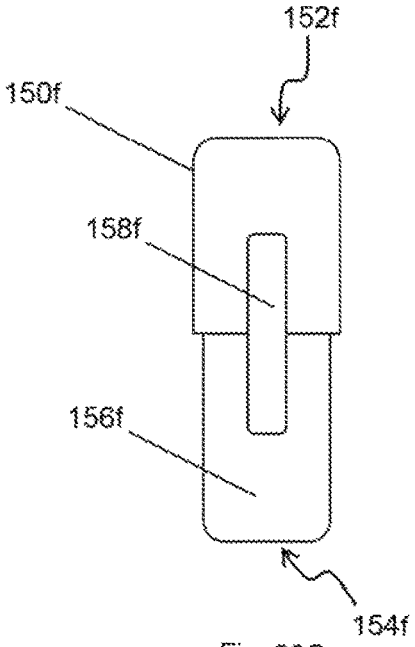
FIG. 28C shows the consumable of the smoking substitute device of FIG. 28A without the main body.

FIG. 28C shows the consumable 150*f* of the smoking substitute device 110*f* without the main body 120*f*.

The main body 120*f* and the consumable 150*f* are configured to be physically coupled together, in this example by pushing the consumable 150*f* into an aperture in a top end 122*f* of the main body 120*f*, e.g., with the consumable 150*f* being retained in the aperture via an interference fit. In other examples, the main body 120*f* and the consumable could be physically coupled together by screwing one onto the other, through a bayonet fitting, or through a snap engagement mechanism, for example. An optional light 126*f*, e.g., an LED located behind a small translucent cover, is located a bottom end 124*f* of the main body 120*f*. The light 126*f* may be configured to illuminate when the smoking substitute device 110*f* is activated.

The consumable 150*f* includes a mouthpiece (not shown) at a top end 152*f* of the consumable 150*f*, as well as one or more air inlets (not shown in FIG. 28) so that air can be drawn into the smoking substitute device 110*f* when a user inhales through the mouthpiece. At a bottom end 154*f* of the consumable 150*f*, there is located a tank 156*f* that contains e-liquid. The tank 156*f* may be a translucent body, for example.

The tank 156*f* preferably includes a window 158*f*, so that the amount of e-liquid in the tank 156*f* can be visually assessed. The main body 120*f* includes a slot 128*f* so that the window 158*f* of the consumable 150*f* can be seen whilst the rest of the tank 156*f* is obscured from view when the consumable 150*f* is inserted into the aperture in the top end 122*f* of the main body 120*f*.

In this present embodiment, the consumable 302*f* is a "single-use" consumable. That is, upon exhausting the e-liquid in the tank 156*f*, the intention is that the user disposes of the whole consumable 150*f*. In other embodiments, the e-liquid (i.e., aerosol former) may be the only part of the system that is truly "single-use". In such embodiments, the tank 156*f* may be refillable with e-liquid or the e-liquid may be stored in a non-consumable component of the system. For example, the e-liquid may be stored in a tank located in the device or stored in another component that is itself not single-use (e.g., a refillable tank).

The tank 156*f* may be referred to as a "clearomizer" if it includes a window 158*f*, or a "cartomizer" if it does not.

Figure 29A:
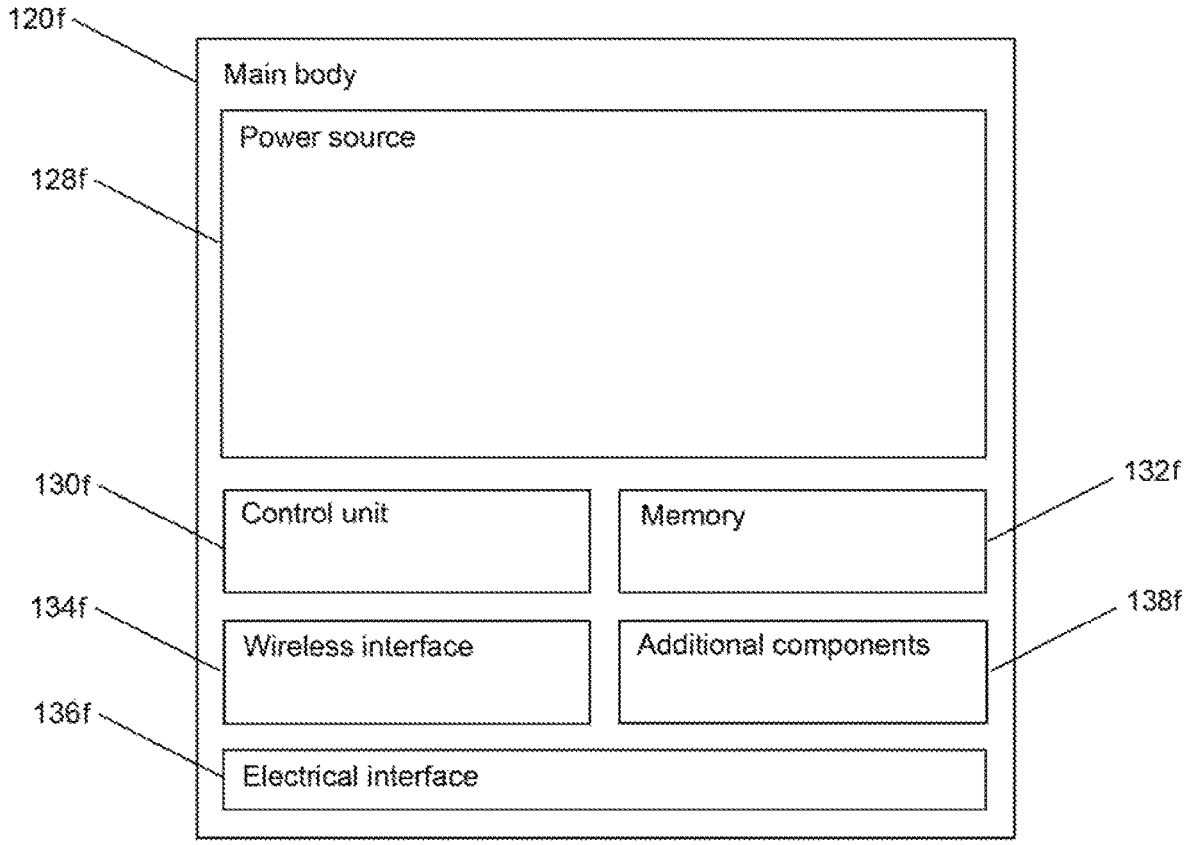
FIG. 29A is a schematic view of the main body of the smoking substitute device of FIG. 28A.

FIG. 29A is a schematic view of the main body 120*f* of the smoking substitute device 110*f*.

Figure 29B:
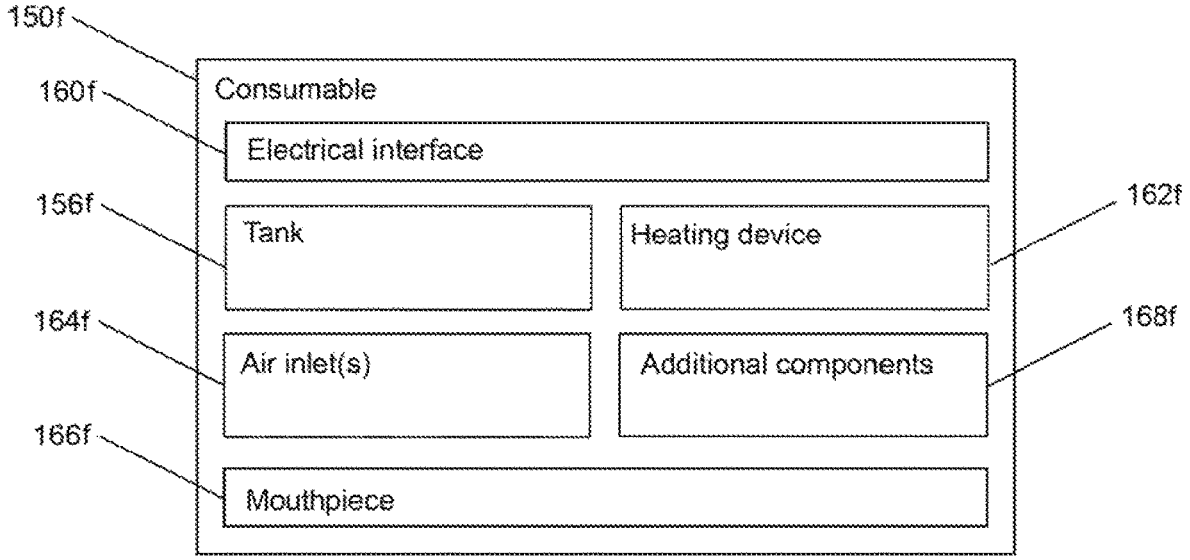
FIG. 29B is a schematic view of the consumable of the smoking substitute device of FIG. 28A.

FIG. 29B is a schematic view of the consumable 150*f* of the smoking substitute device 110*f*.

As shown in FIG. 29A, the main body 120*f* includes a power source 128*f*, a control unit 130*f*, a memory 132*f*, a wireless interface 134*f*, an electrical interface 136*f*, and, optionally, one or more additional components 138*f*.

The power source 128*f* is preferably a battery, more preferably a rechargeable battery.

The control unit 130*f* may include a microprocessor, for example.

The memory 132*f* is preferably includes non-volatile memory.

The wireless interface establishes communication over a wireless communication channel between the smoking substitute device and communication terminal of the external device. The wireless interface may utilities any suitable wireless protocol. Suitably, the wireless interface may operate over a short range network. For example, it may comprise a wireless personal area network (WPAN), e.g., using Bluetooth™, ZigBee, a WIFI personal hotspot or the like. The smoking substitute device may pair with the portable communication terminal over the wireless communication channel. The portable communication terminal may be a master device and the smoking substitute device may be a slave device. As such, in exemplary embodiments, the wireless interface 134*f* is preferably configured to communicate wirelessly with the mobile device 2*f*, e.g., via Bluetooth. To this end, the wireless interface 134*f* could include a Bluetooth™ antenna. Other wireless communication interfaces, e.g., WIFI, are also possible.

The electrical interface 136*f* of the main body 120*f* may include one or more electrical supply contacts. The electrical interface 136*f* may be located in, and preferably at the bottom of, the aperture in the top end 122*f* of the main body 120*f*. When the main body 120*f* is physically coupled to the consumable 150*f*, the electrical interface 136*f* may be configured to pass electrical power from the power source 128*f* to (e.g., a heating device of) the consumable 150*f* when the smoking substitute device 110*f* is activated, e.g., via the electrical interface 160*f* of the consumable 150*f* (discussed below). When the main body 120*f* is not physically coupled to the consumable 150*f*, the electrical interface may be configured to receive power from the charging station 6*f*.

The additional components 138*f* of the main body 120*f* may include the optional light 126*f* discussed above.

The additional components 138*f* of the main body 120*f* may, if the power source 128*f* is a rechargeable battery, include a charging port configured to receive power from the charging station 6*f*. This may be located at the bottom end 124*f* of the main body 120*f*. Alternatively, the electrical interface 136*f* discussed above is configured to act as a charging port configured to receive power from the charging station 6*f* such that a separate charging port is not required.

The additional components 138*f* of the main body 120*f* may, if the power source 128*f* is a rechargeable battery, include a battery charging control circuit, for controlling the charging of the rechargeable battery. However, a battery charging control circuit could equally be located in the charging station 6*f* (if present).

The additional components 138*f* of the main body 120*f* may include an airflow sensor for detecting airflow in the smoking substitute device 110*f*, e.g., caused by a user inhaling through a mouthpiece 166*f* (discussed below) of the smoking substitute device 110*f*. The smoking substitute device 110*f* may be configured to be activated when airflow is detected by the airflow sensor. This optional sensor could alternatively be included in the consumable 150*f* (though this is less preferred where the consumable 150*f* is intended to be disposed of after use, as in this example).

The additional components 138*f* of the main body 120*f* may include an actuator, e.g., a button. The smoking substitute device 110*f* may be configured to be activated when the actuator is actuated. This provides an alternative to the airflow sensor noted, as a mechanism for activating the smoking substitute device 110*f*.

The additional components 138*f* of the main body 120*f* may include a reading device configured to read information associated with the consumable from a machine readable data source included in (e.g., contained in the body of, or attached to) the consumable 150*f*.

In some examples, the reading device (if present) may be configured to read information from the machine readable data source non-wirelessly, e.g., using an electrical connection between the main body 120*f* and consumable 150*f*.

For example, the reading device (if present) may include a set of one or more electrical communication contacts configured to read information from the machine readable data source via an electrical connection established between the set of one or more electrical communication contacts and the machine readable data source. Conveniently, the set of one or more electrical communication contacts of the reading device may be configured to provide the electrical connection by engaging with a set of one or more electrical communication contacts of the consumable 150*f*, when the main body 120*f* and the consumable 150*f* are physically coupled together.

In some examples, the reading device (if present) may be configured to read information from the machine readable data source wirelessly, e.g., via electromagnetic waves or optically. Thus, for example, the machine readable data source included in the consumable 150*f* could be an RFID tag (in which case the reading device included in the main body 120*f* may be an RFID reader) or a visual data source such as a barcode (in which case the reading device included in the main body may be an optical reader, e.g., a barcode scanner). Various wireless technologies and protocols may be employed to allow the reading device to wirelessly read information from a machine readable data source included in or attached to the consumable 150*f*, e.g., NFC, Bluetooth, Wi-Fi, as would be appreciated by a skilled person.

The reading device (if present) may be configured to write information associated with the consumable to the machine readable data source (e.g., wirelessly or non-wirelessly, via one of the mechanisms discussed above) in addition to being configured to read information associated with the consumable from the machine readable data source. In this case, the reading device may be referred to as a reading/writing device.

As shown in FIG. 29B, the consumable 150*f* includes the tank 156*f*, an electrical interface 160*f*, a heating device 162*f*, one or more air inlets 164*f*, a mouthpiece 166*f*, and, optionally, one or more additional components 168*f*.

The electrical interface 160*f* of the consumable 150*f* may include one or more electrical supply contacts. The electrical interface 136*f* of the main body 120*f* and an electrical interface 160*f* of the consumable 150*f* are preferably configured to contact each other and therefore electrically couple the main body 120*f* to the consumable 150*f* when the main body 120*f* is physically coupled to the consumable 150*f*. In this way, electrical energy (e.g., in the form of an electrical current) is able to be supplied from the power source 128*f* in the main body 120*f* to the heating device 162*f* in the consumable 150*f*.

The heating device 162*f* is preferably configured to heat e-liquid contained in the tank 156*f*, e.g., using electrical energy supplied from the power source 128*f*. In one example, the heating device 162*f* may include a heating filament and a wick, wherein a first portion of the wick extends into the tank 156*f* in order to draw e-liquid out from the tank 156*f*, and wherein the heating filament coils around a second portion of the wick located outside the tank 156*f*.

In this example, the heating filament is configured to heat up e-liquid drawn out of the tank 156*f* by the wick to produce an aerosol vapor.

The one or more air inlets 164*f* are preferably configured to allow air to be drawn into the smoking substitute device 110*f*, when a user inhales through the mouthpiece 166*f*.

The additional components 168*f* of the consumable 150*f* may include a machine readable data source, which may, e.g., be contained in the body of, or attached to the consumable 150*f*. The machine readable data source may store information associated with the consumable. The information associated with the consumable may include information concerning the content of the consumable (e.g., e-liquid type, batch number) and/or a unique identifier, for example.

The machine readable data source may be rewritable, e.g., a rewritable RFID chip, or read only, e.g., a visual data source such as a barcode. As indicated above, the additional components 138*f* of the main body 120*f* may include a reading device configured to read information associated with the consumable from the machine readable data source.

For example, the electrical interface 160*f* of the consumable 150*f* may include a set of one or more electrical communication contacts, which may allow a reading device of the main body to read information from a machine readable data source of the consumable, e.g., as discussed previously.

In use, a user activates the smoking substitute device 110*f*, e.g., through actuating an actuator included in the main body 120*f* or by inhaling through the mouthpiece 166*f* as described above. Upon activation, the control unit 130*f* may supply electrical energy from the power source 128*f* to the heating device 162*f* (via electrical interfaces 136*f*, 166*f*), which may cause the heating device 162*f* to heat e-liquid drawn from the tank 156*f* to produce a vapor which is inhaled by a user through the mouthpiece 166*f*.

Of course, a skilled reader would readily appreciate that the smoking substitute device 110*f* shown in FIGS. 28 and 29 shows just one example implementation of a smoking substitute device, and that other forms of smoking substitute device could be used as the smoking substitute device 10*f* of FIG. 27.

By way of example, a HNB smoking substitute device including a main body and a consumable could be used as the smoking substitute device 10*f* of FIG. 27, instead of the smoking substitute device 110*f*. One such HNB smoking substitute device is the IQOS™ smoking substitute device discussed above.

As another example, an open system vaping device which includes a main body, a refillable tank, and a mouthpiece could be used as the smoking substitute device 10*f* of FIG. 27, instead of the smoking substitute device 110*f*. One such open system vaping device is the blu PRO™ e-cigarette discussed above.

As another example, an entirely disposable (one use) smoking substitute device could be used as the smoking substitute device 10*f* of FIG. 27, instead of the smoking substitute device 110*f*.

Figure 30:
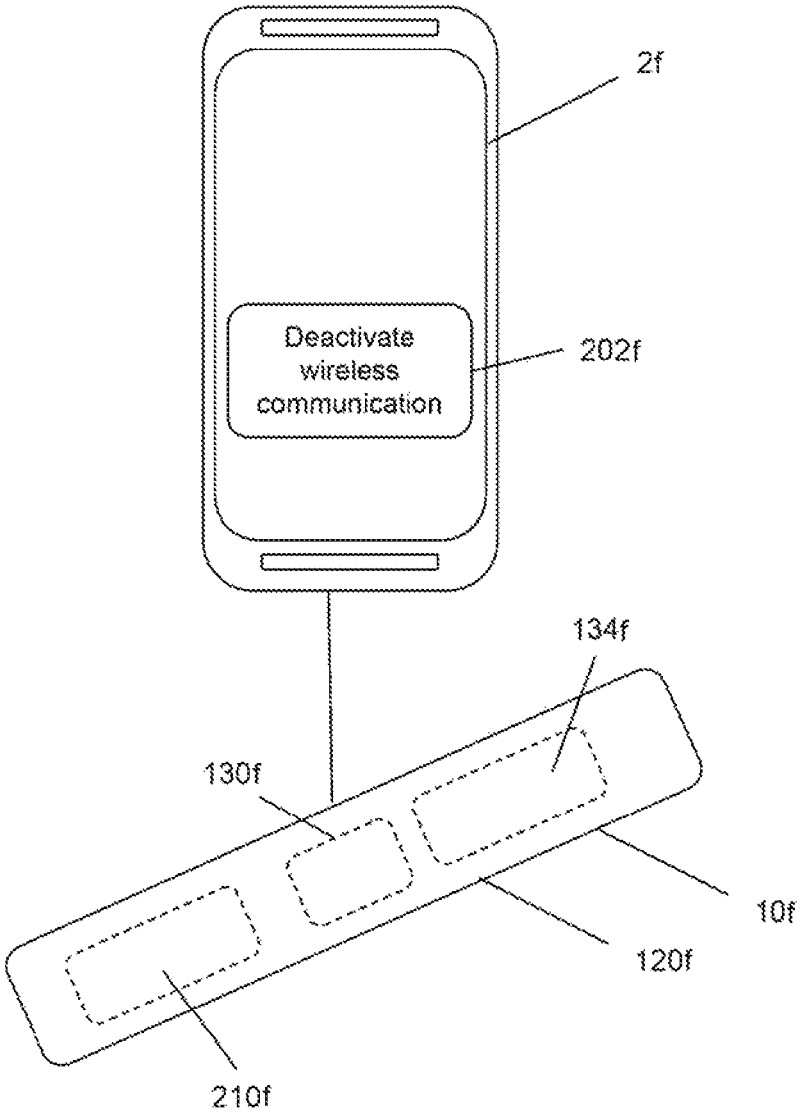
FIG. 30 is an example schematic view of a system of the sixth mode for automatically reactivating a wireless communication interface upon a puff operation.

Referring to FIG. 30, an exemplary embodiment is shown wherein the system comprises an external device 2*f* and a smoking substitute device 10*f*. The devices 2*f*, 10*f* can be as explained above, but specific features relating to the automatic reactivation of a wireless communication are herein further described.

The external device 10*f* is shown as suitably being a smart telephone operating an application. However, it will be appreciated that other devices such as tablet computers, smart watches or the like may be equally applicable. The external device 2*f* runs the application that can be used as a user interface between the user and the smoking substitute device. In order to establish communication between the external device and smoking substitute device, the smoking substitute device includes a wireless communications interface 134*f* and the external device is able to be connected thereto. Therefore, upon initial set up of the system, it will be appreciated that the application may be used to pair the external device with the smoking substitute device. For instance, the application may complete a Bluetooth pairing operation or another operation to establish the external device as a trusted device. With communication between the devices established, the external device can communicate with the smoking substitute device via the application, and the smoking substitute device can communicate with the application by being controlled to transmit data via the communication interface. Thus, the user can manipulate the external device to send a deactivate communication command wirelessly to the smoking substitute device. As shown in FIG. 30 an input button 202*f* is suitably provided as part of the application's graphic user interface to enable a user to initiate the command. Thus, the smoking substitute device receives a deactivate communication command and the control unit recognizes the receipt of the deactivate communication command and switches the wireless communication interface to deactivated mode in response thereto. When deactivated and in a deactivated mode, the wireless communication interface is configured to not transmit data over a communication link. That is, the wireless communication link is deactivated so that the smoking substitute device is blocked or controlled to not transmit wireless signals as may be required or desired, for instance to operate in a flight-safe mode when transported on an airplane.

Typically, the smoking substitute device's body 120 houses the wireless interface 134*f*, the control unit 130*f* and a puff sensor 210*f*. Here, the puff sensor senses a puff operation and automatically reactivates the wireless communication interface by switching the wireless communication interface to an active mode such that wireless transmissions are re-established/transmissions are able to be sent.

In one exemplary embodiment, the puff sensor is an airflow sensor as described above. Here, the airflow sensor detects a change in airflow and determines the user has manipulated the smoking substitute device to initiate a puff operation by inhaling through the smoking substitute device. As an alternative or addition, the puff sensor 210*f* may also include an actuator for initiating a heating device. Here the actuation of the actuator, for instance the pressing of a switch by a user, is determined to be the user input initiating a puff operation. As will be appreciated, as well as initiating the smoking substitute device to produce an aerosol, the action of initiating the puff operation also triggers the control unit to switch the disabled wireless communication interface to the active mode.

Figure 31:
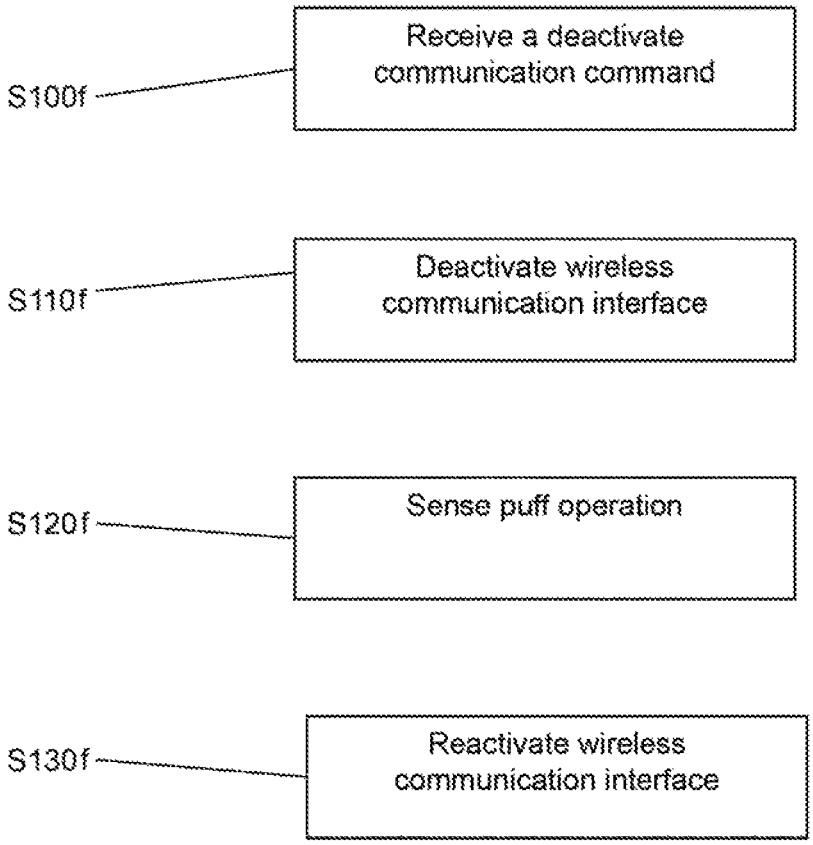
FIG. 31 is a flow chart of a method of the sixth mode of automatically reactivating a wireless communication module on sensing a puff operation.

The user is able to manage the smoking device by inputting a command into the external device, for instance by entering a deactivate communication command through the application operating on the connected external device. Additionally, or alternatively, the user may input the deactivate communication command directly into the smoking substitute device, for instance by manipulating the smoking substitute device in a predetermined action. As shown if FIG. 31, at step S100 the smoking substitute device receives a deactivate communication command. As described, the deactivate communication command may be a command received at the wireless communication interface or may be a user manipulation of the smoking substitute device. At step S110, the control unit identifies the deactivate communication command and deactivates the wireless communication interface so that the wireless communication interface operates in a deactivated mode such that it is controlled to not emit wireless transmissions. At step S120, the puff sensor senses a user input initiating a puff operation. For instance, by sensing a user has inhaled through the smoking substitute device and/or that a user has activated a heating unit. At step S130, the wireless communication interface is automatically reactivated upon identifying the puff operation.

In the exemplary embodiments, the smoking substitute device may include additional components such as a light, and/or a speaker, and/or a haptic generator for generating vibrations, wherein the smoking substitute device is configured to initiate an alert through the one or more additional components when entering the active mode and/or when entering the deactivated mode.

The features disclosed in the foregoing description, or in the following claims, or in the accompanying drawings, expressed in their specific forms or in terms of a means for performing the disclosed function, or a method or process for obtaining the disclosed results, as appropriate, may, separately, or in any combination of such features, be utilized for realizing the disclosure in diverse forms thereof.

While the disclosure has been described in conjunction with the exemplary embodiments described above, many equivalent modifications and variations will be apparent to those skilled in the art when given this disclosure. Accordingly, the exemplary embodiments of the disclosure set forth above are considered to be illustrative and not limiting. Various changes to the described embodiments may be made without departing from the spirit and scope of the disclosure.

For the avoidance of any doubt, any theoretical explanations provided herein are provided for the purposes of improving the understanding of a reader. The inventors do not wish to be bound by any of these theoretical explanations.

Any section headings used herein are for organizational purposes only and are not to be construed as limiting the subject matter described.

Throughout this specification, including the claims which follow, unless the context requires otherwise, the word "comprise" and "include", and variations such as "comprises", "comprising", and "including" will be understood to imply the inclusion of a stated integer or step or group of integers or steps but not the exclusion of any other integer or step or group of integers or steps.

It must be noted that, as used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by the use of the antecedent "about," it will be understood that the particular value forms another embodiment. The term "about" in relation to a numerical value is optional and means for example +/−10%.

Seventh Mode: A Smoking Substitute Device and Providing Notifications on a Smoking Substitute Device and a Connected Mobile Device.

Aspects and embodiments of the seventh mode of the present disclosure will now be discussed with reference to the accompanying figures. Further aspects and embodiments of the seventh mode will be apparent to those skilled in the art. All documents mentioned in this text are incorporated herein by reference.

Figure 32:
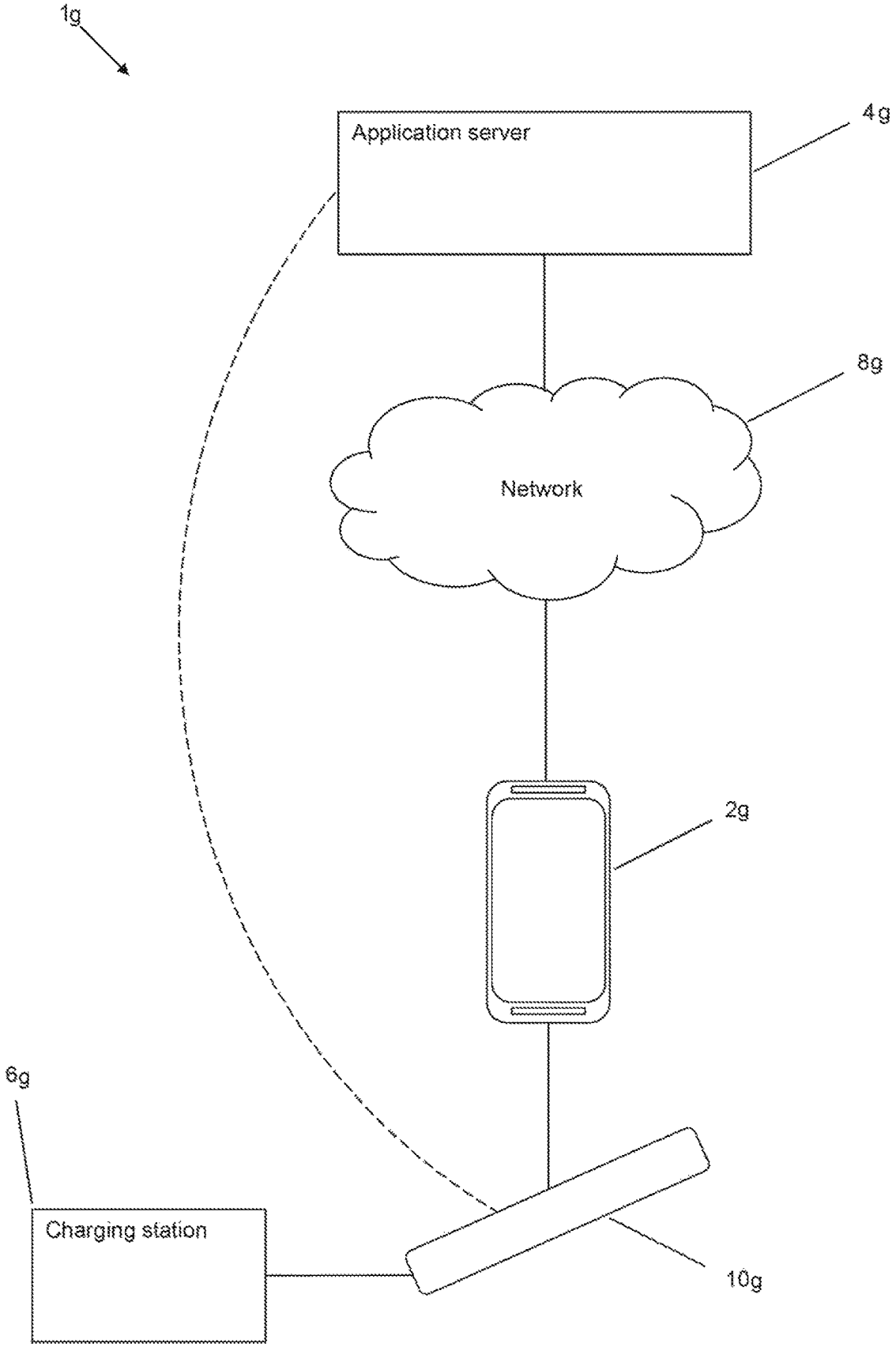
FIG. 32 shows an example system for managing a smoking substitute device of the seventh mode.

FIG. 32 shows an example system 1*g* for managing a smoking substitute device 10*g*.

The system 1*g* as shown in FIG. 32 includes a mobile device 2*g*, an application server 4*g*, an optional charging station 6*g*, as well as the smoking substitute device 10*g*.

The smoking substitute device 10*g* is configured to communicate wirelessly, e.g., via Bluetooth™, with an application (or "app") installed on the mobile device 2*g*, e.g., via a suitable wireless interface (not shown) on the mobile device 2*g*. The mobile device 2*g* may be a mobile phone, for example. The application on the mobile phone is configured to communicate with the application server 4*g*, via a network 8*g*. The application server 4*g* may utilize cloud storage, for example.

The network 8*g* may include a cellular network and/or the internet.

In other examples, the smoking substitute device 10*g* may be configured to communicate with the application server 4*g* via a connection that does not involve the mobile device 2*g*, e.g., via a narrowband internet of things ("NB-IoT") connection. In some examples, the mobile device 2*g* may be omitted from the system.

A skilled person would readily appreciate that the mobile device 2*g* may be configured to communicate via the network 8*g* according to various communication channels, preferably a wireless communication channel such as via a cellular network (e.g., according to a standard protocol, such as 3G or 4G) or via a WIFI network.

The app installed on the mobile device and the application server 4*g* may be configured to assist a user with their smoking substitute device 10*g*, based on information communicated between the smoking substitute device 10*g* and the app and/or information communicated between the app and the application server 4*g*.

The charging station 6*g* (if present) may be configured to charge (and optionally communicate with) the smoking substitute device 10*g*, via a charging port on the smoking substitute device 10*g*. The charging port on the smoking substitute device 10*g* may be a USB port, for example, which may allow the smoking substitute device to be charged by any USB-compatible device capable of delivering power to the smoking substitute device 10*g* via a suitable USB cable (in this case the USB-compatible device would be acting as the charging station 6*g*). Alternatively, the charging station could be a docking station specifically configured to dock with the smoking substitute device 10*g* and charge the smoking substitute device 10*g* via the charging port on the smoking substitute device 10*g*.

Figure 33A:
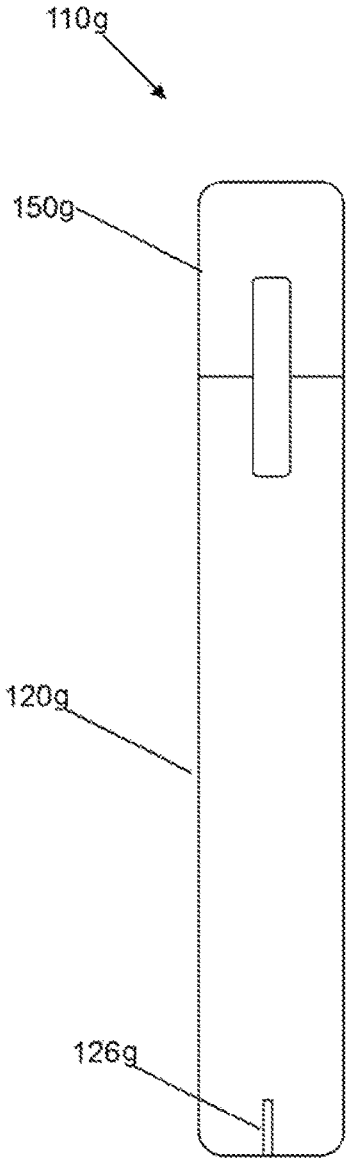
FIG. 33A shows an example smoking substitute device for use as the smoking substitute device in the system of FIG. 32.

FIG. 33A shows an example smoking substitute device 110*g* for use as the smoking substitute device 10*g* in the system 1*g* of FIG. 32.

In this example, the smoking substitute device 110*g* includes a main body 120*g* and a consumable 150*g*. The consumable 150*g* may alternatively be referred to as a "pod".

In this example, the smoking substitute device 110*g* is a closed system vaping device, wherein the consumable 150*g* includes a sealed tank 156*g* and is intended for one-use only.

FIG. 33A shows the smoking substitute device 110*g* with the main body 120*g* physically coupled to the consumable 150*g*.

Figure 33B:
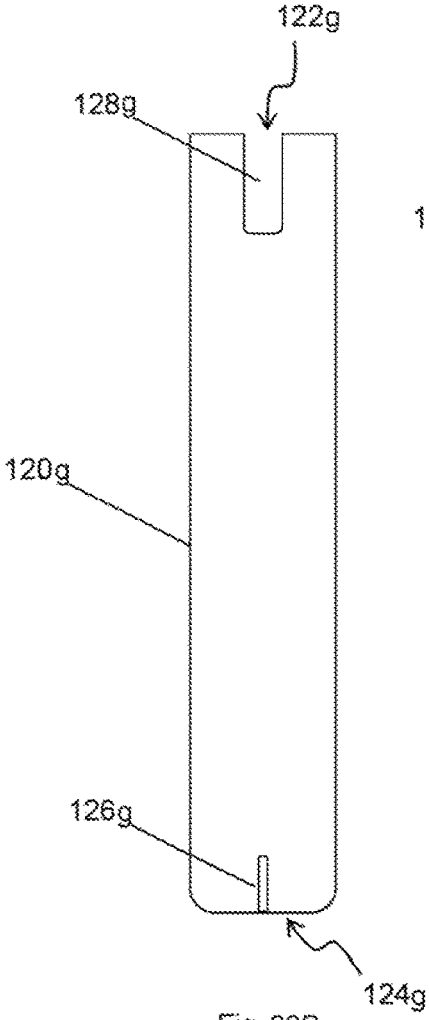
FIG. 33B shows the main body of the smoking substitute device of FIG. 33A without the consumable.

FIG. 33B shows the main body 120*g* of the smoking substitute device 110*g* without the consumable 150*g*.

Figure 33C:
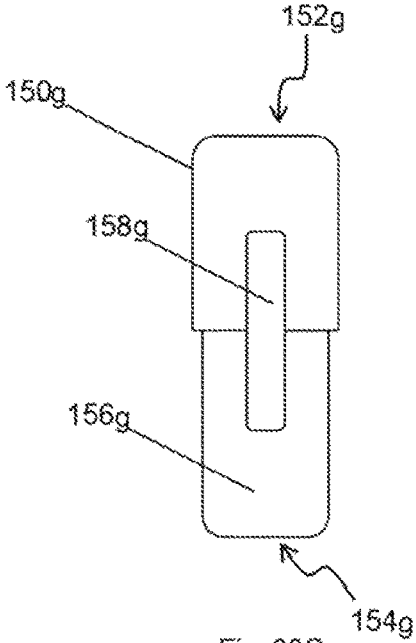
FIG. 33C shows the consumable of the smoking substitute device of FIG. 33A without the main body.

FIG. 33C shows the consumable 150*g* of the smoking substitute device 110*g* without the main body 120*g*.

The main body 120*g* and the consumable 150*g* are configured to be physically coupled together, in this example by pushing the consumable 150*g* into an aperture in a top end 122*g* of the main body 120*g*, e.g., with the consumable 150*g* being retained in the aperture via an interference fit. In other examples, the main body 120*g* and the consumable could be physically coupled together by screwing one onto the other, through a bayonet fitting, or through a snap engagement mechanism, for example. An optional light 126*g*, e.g., an LED located behind a small translucent cover, is located a bottom end 124*g* of the main body 120*g*. The light 126*g* may be configured to illuminate when the smoking substitute device 110*g* is activated.

The consumable 150*g* includes a mouthpiece (not shown) at a top end 152*g* of the consumable 150*g*, as well as one or more air inlets (not shown in FIG. 33) so that air can be drawn into the smoking substitute device 110*g* when a user inhales through the mouthpiece. At a bottom end 154*g* of the consumable 150*g*, there is located a tank 156*g* that contains e-liquid. The tank 156*g* may be a translucent body, for example.

The tank 156*g* preferably includes a window 158*g*, so that the amount of e-liquid in the tank 156*g* can be visually assessed. The main body 120*g* includes a slot 128*g* so that the window 158*g* of the consumable 150*g* can be seen whilst the rest of the tank 156*g* is obscured from view when the consumable 150*g* is inserted into the aperture in the top end 122*g* of the main body 120*g*.

In this present embodiment, the consumable 302*g* is a "single-use" consumable. That is, upon exhausting the e-liquid in the tank 156*g*, the intention is that the user disposes of the whole consumable 150*g*. In other embodiments, the e-liquid (i.e., aerosol former) may be the only part of the system that is truly "single-use". In such embodiments, the tank 156*g* may be refillable with e-liquid or the e-liquid may be stored in a non-consumable component of the system. For example, the e-liquid may be stored in a tank located in the device or stored in another component that is itself not single-use (e.g., a refillable tank).

The tank 156*g* may be referred to as a "clearomizer" if it includes a window 158*g*, or a "cartomizer" if it does not.

Figure 34A:
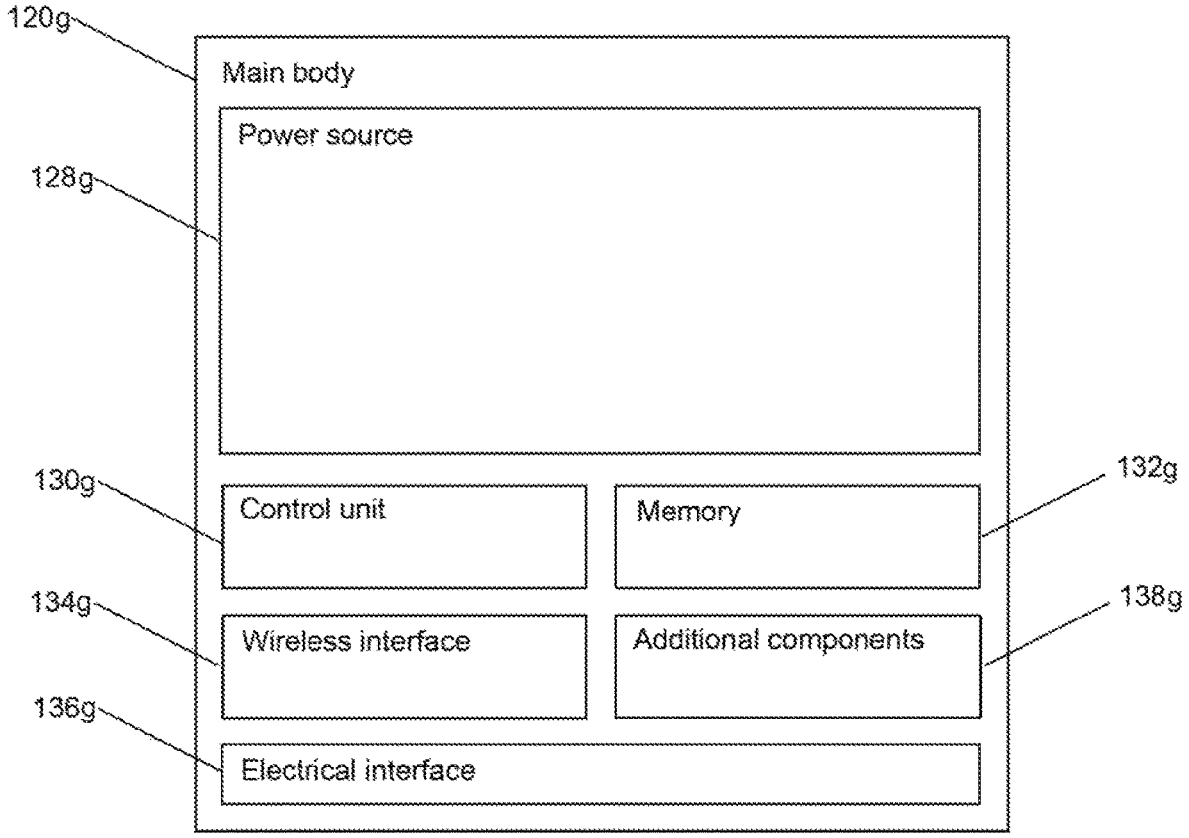
FIG. 34A is a schematic view of the main body of the smoking substitute device of FIG. 33A.

FIG. 34A is a schematic view of the main body 120*g* of the smoking substitute device 110*g*.

Figure 34B:
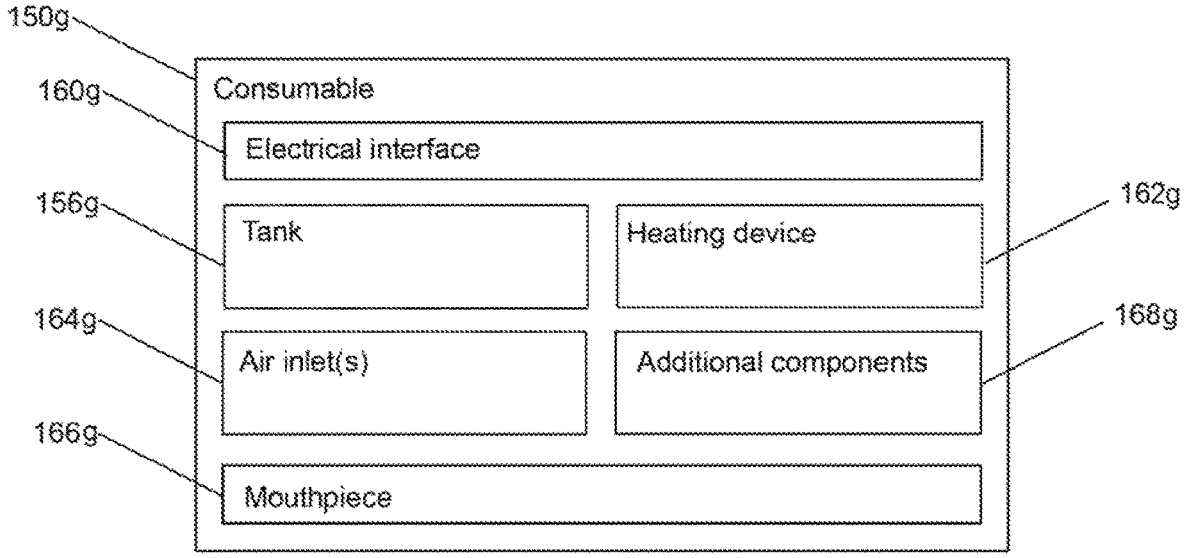
FIG. 34B is a schematic view of the consumable of the smoking substitute device of FIG. 33A.

FIG. 34B is a schematic view of the consumable 150*g* of the smoking substitute device 110*g*.

As shown in FIG. 34A, the main body 120*g* includes a power source 128*g*, a control unit 130*g*, a memory 132*g*, a wireless interface 134*g*, an electrical interface 136*g*, and, optionally, one or more additional components 138*g*.

The power source 128*g* is preferably a battery, more preferably a rechargeable battery.

The control unit 130*g* may include a microprocessor, for example.

The memory 132*g* is preferably includes non-volatile memory.

The wireless interface 134*g* is preferably configured to communicate wirelessly with the mobile device 2*g*, e.g., via Bluetooth. To this end, the wireless interface 134*g* could include a Bluetooth™ antenna. Other wireless communication interfaces, e.g., WIFI, are also possible.

The electrical interface 136*g* of the main body 120*g* may include one or more electrical supply contacts. The electrical interface 136*g* may be located in, and preferably at the bottom of, the aperture in the top end 122*g* of the main body 120*g*. When the main body 120*g* is physically coupled to the consumable 150*g*, the electrical interface 136*g* may be configured to pass electrical power from the power source 128*g* to (e.g., a heating device of) the consumable 150*g* when the smoking substitute device 110*g* is activated, e.g., via the electrical interface 160*g* of the consumable 150*g* (discussed below). When the main body 120*g* is not physically coupled to the consumable 150*g*, the electrical interface may be configured to receive power from the charging station 6*g*.

The additional components 138*g* of the main body 120*g* may include the optional light 126*g* discussed above. The light 126*g* may be an LED located behind a small translucent cover located a bottom end 124*g* of the main body 120*g* as shown in the Figures, or the light may take another form. For example, the light may be located beneath a translucent portion of the housing of the main body, so that no separate translucent cover is required. The light may be configured so that different visual effects may be presented. For example, different colors may be presented, the light may flash, and/or the light may have several sections that can be activated separately (e.g., sequentially) to cause a visual effect.

The additional components 138*g* of the main body 120*g* may, if the power source 128*g* is a rechargeable battery, include a charging port configured to receive power from the charging station 6*g*. This may be located at the bottom end 124*g* of the main body 120*g*. Alternatively, the electrical interface 136*g* discussed above is configured to act as a charging port configured to receive power from the charging station 6*g* such that a separate charging port is not required.

The additional components 138*g* of the main body 120*g* may, if the power source 128*g* is a rechargeable battery, include a battery charging control circuit, for controlling the charging of the rechargeable battery. However, a battery charging control circuit could equally be located in the charging station 6*g* (if present).

The additional components 138*g* of the main body 120*g* may include an airflow sensor for detecting airflow in the smoking substitute device 110*g*, e.g., caused by a user inhaling through a mouthpiece 166*g* (discussed below) of the smoking substitute device 110*g*. The smoking substitute device 110*g* may be configured to be activated when airflow is detected by the airflow sensor. This optional sensor could alternatively be included in the consumable 150*g* (though this is less preferred where the consumable 150*g* is intended to be disposed of after use, as in this example).

The additional components 138*g* of the main body 120*g* may include an actuator, e.g., a button. The smoking substitute device 110*g* may be configured to be activated when the actuator is actuated. This provides an alternative to the airflow sensor noted, as a mechanism for activating the smoking substitute device 110*g*.

The additional components 138*g* of the main body 120*g* may include a reading device configured to read information associated with the consumable from a machine readable data source included in (e.g., contained in the body of, or attached to) the consumable 150*g*.

In some examples, the reading device (if present) may be configured to read information from the machine readable data source non-wirelessly, e.g., using an electrical connection between the main body 120*g* and consumable 150*g*.

For example, the reading device (if present) may include a set of one or more electrical communication contacts configured to read information from the machine readable data source via an electrical connection established between the set of one or more electrical communication contacts and the machine readable data source. Conveniently, the set of one or more electrical communication contacts of the reading device may be configured to provide the electrical connection by engaging with a set of one or more electrical communication contacts of the consumable 150*g*, when the main body 120*g* and the consumable 150*g* are physically coupled together.

In some examples, the reading device (if present) may be configured to read information from the machine readable data source wirelessly, e.g., via electromagnetic waves or optically. Thus, for example, the machine readable data source included in the consumable 150*g* could be an RFID tag (in which case the reading device included in the main body 120*g* may be an RFID reader) or a visual data source such as a barcode (in which case the reading device included in the main body may be an optical reader, e.g., a barcode scanner). Various wireless technologies and protocols may be employed to allow the reading device to wirelessly read information from a machine readable data source included in or attached to the consumable 150*g*, e.g., NFC, Bluetooth, Wi-Fi, as would be appreciated by a skilled person.

The reading device (if present) may be configured to write information associated with the consumable to the machine readable data source (e.g., wirelessly or non-wirelessly, via one of the mechanisms discussed above) in addition to being configured to read information associated with the consumable from the machine readable data source. In this case, the reading device may be referred to as a reading/writing device.

As shown in FIG. 34B, the consumable 150*g* includes the tank 156*g*, an electrical interface 160*g*, a heating device 162*g*, one or more air inlets 164*g*, a mouthpiece 166*g*, and, optionally, one or more additional components 168*g*.

The electrical interface 160*g* of the consumable 150*g* may include one or more electrical supply contacts. The electrical interface 136*g* of the main body 120*g* and an electrical interface 160*g* of the consumable 150*g* are preferably configured to contact each other and therefore electrically couple the main body 120*g* to the consumable 150*g* when the main body 120*g* is physically coupled to the consumable 150*g*. In this way, electrical energy (e.g., in the form of an electrical current) is able to be supplied from the power source 128*g* in the main body 120*g* to the heating device 162*g* in the consumable 150*g*.

The heating device 162*g* is preferably configured to heat e-liquid contained in the tank 156*g*, e.g., using electrical energy supplied from the power source 128*g*. In one example, the heating device 162*g* may include a heating filament and a wick, wherein a first portion of the wick extends into the tank 156*g* in order to draw e-liquid out from the tank 156*g*, and wherein the heating filament coils around a second portion of the wick located outside the tank 156*g*. In this example, the heating filament is configured to heat up e-liquid drawn out of the tank 156*g* by the wick to produce an aerosol vapor.

The one or more air inlets 164*g* are preferably configured to allow air to be drawn into the smoking substitute device 110*g*, when a user inhales through the mouthpiece 166*g*.

The additional components 168*g* of the consumable 150*g* may include a machine readable data source, which may, e.g., be contained in the body of, or attached to the consumable 150*g*. The machine readable data source may store information associated with the consumable. The information associated with the consumable may include information concerning the content of the consumable (e.g., e-liquid type, batch number) and/or a unique identifier, for example.

The machine readable data source may be rewritable, e.g., a rewritable RFID chip, or read only, e.g., a visual data source such as a barcode. As indicated above, the additional components 138*g* of the main body 120*g* may include a reading device configured to read information associated with the consumable from the machine readable data source.

For example, the electrical interface 160*g* of the consumable 150*g* may include a set of one or more electrical communication contacts, which may allow a reading device of the main body to read information from a machine readable data source of the consumable, e.g., as discussed previously.

In use, a user activates the smoking substitute device 110*g*, e.g., through actuating an actuator included in the main body 120*g* or by inhaling through the mouthpiece 166*g* as described above. Upon activation, the control unit 130*g* may supply electrical energy from the power source 128*g* to the heating device 162*g* (via electrical interfaces 136*g*, 166*g*), which may cause the heating device 162*g* to heat e-liquid drawn from the tank 156*g* to produce a vapor which is inhaled by a user through the mouthpiece 166*g*.

Of course, a skilled reader would readily appreciate that the smoking substitute device 110*g* shown in FIGS. 33 and 34 shows just one example implementation of a smoking substitute device, and that other forms of smoking substitute device could be used as the smoking substitute device 10*g* of FIG. 32.

By way of example, a HNB smoking substitute device including a main body and a consumable could be used as the smoking substitute device 10*g* of FIG. 32, instead of the smoking substitute device 110*g*. One such HNB smoking substitute device is the IQOS™ smoking substitute device discussed above.

As another example, an open system vaping device which includes a main body, a refillable tank, and a mouthpiece could be used as the smoking substitute device 10*g* of FIG. 32, instead of the smoking substitute device 110*g*. One such open system vaping device is the blu PRO™ e-cigarette discussed above.

As another example, an entirely disposable (one use) smoking substitute device could be used as the smoking substitute device 10*g* of FIG. 32, instead of the smoking substitute device 110*g*.

Figure 35:
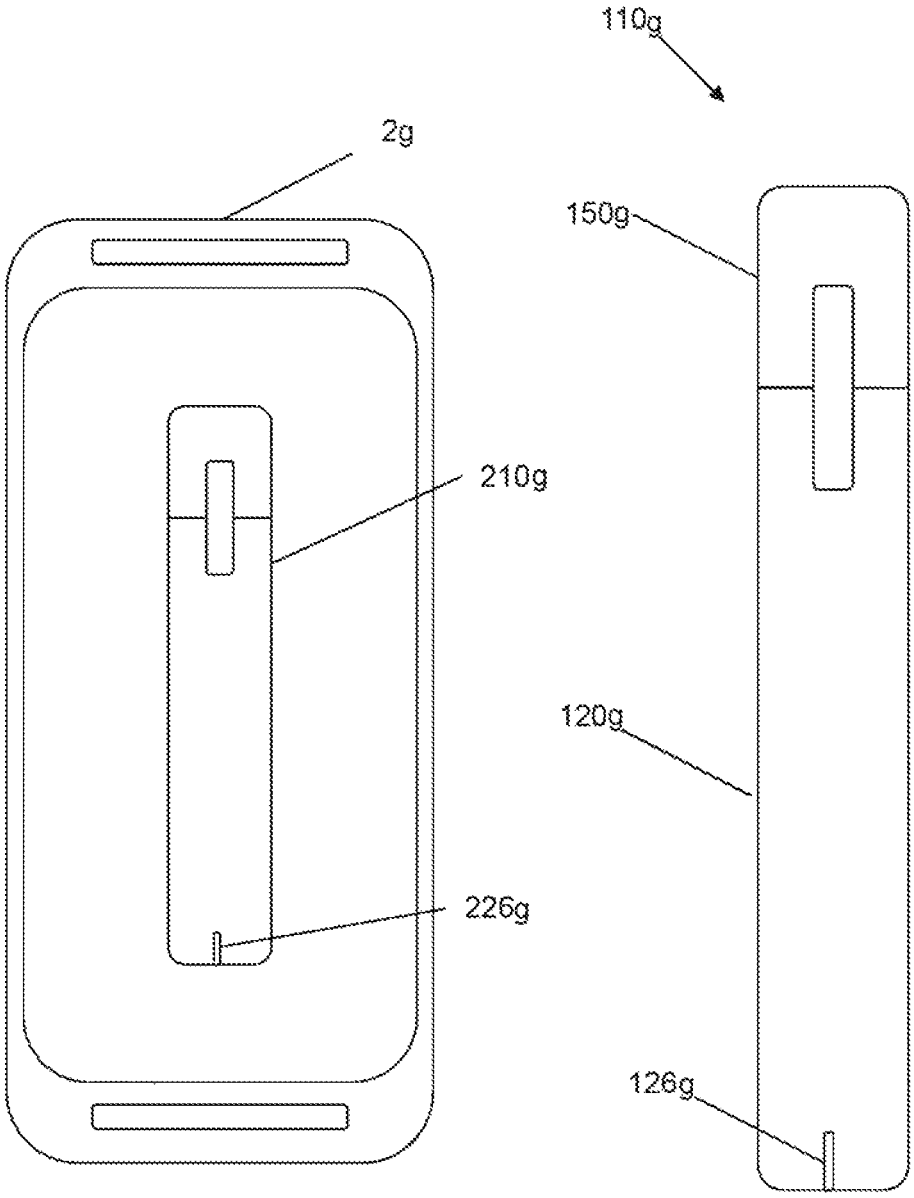
FIG. 35 shows a schematic view (not to scale) of the smoking substitute device of FIG. 33 and the mobile device shown in FIG. 32.

FIG. 35 shows a schematic view of smoking substitute device 110*g* and mobile device 2*g*. Mobile device 2*g* may have an app installed to assist in communicating with the smoking substitute device 110*g* and/or displaying information relating to the smoking substitute device 110*g* to the user. In one example, the app may display an image 210*g* representing the smoking substitute device 110*g* on the screen of the mobile device 2*g* as shown in FIG. 35.

The smoking substitute device 110*g* may provide a notification to the user of a property or status of the smoking substitute device 110*g*. For example, a notification may be provided when the battery is running low or when the smoking substitute device 110*g* is connected with the mobile device 2*g*.

The notification may be haptic (for example, the device may vibrate) or visual (for example, the light 126*g* may be activated).

When the smoking substitute device 110*g* is connected with the mobile device, and the image 210*g* representing the smoking substitute device 110*g* is displayed on the mobile device, the image may display a second notification corresponding to the first notification on the smoking substitute device simultaneously.

For example, when the first notification is provided by light 126*g* on the smoking substitute device 110*g*, the image 210*g* representing the smoking substitute device 110*g* may change to mirror the first notification by showing the virtual light 226*g* as activated in the same manner as the light 126*g* on the smoking substitute device 110*g*, thereby providing the second notification.

When the first notification on the smoking substitute device 110*g* is a haptic notification, the image 210*g* may simultaneously indicate that the device is vibrating, for example by showing an icon or by moving the image 210*g* in a manner similar to a vibrating device, thereby providing the second notification. Additionally, or alternatively, the mobile device may provide a corresponding haptic notification simultaneously to the first notification on the smoking substitute device. For example, when the first notification is a vibration having a certain pattern, the second notification may be a vibration of the mobile device having the same pattern.

Figure 36A:
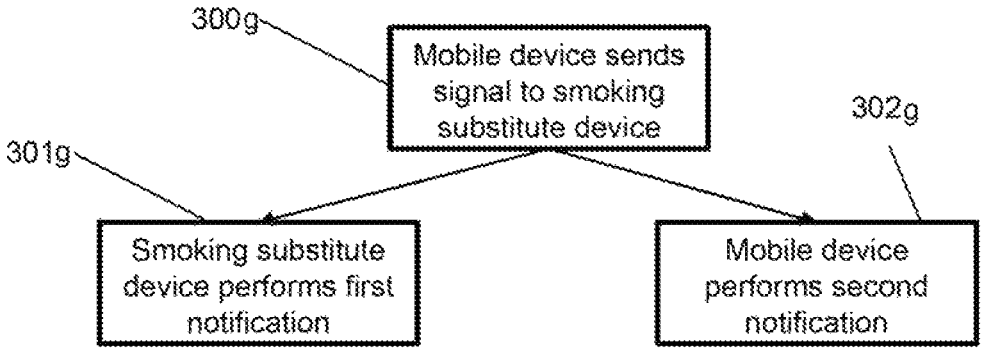
FIG. 36A shows an example of a process of the seventh mode for ensuring notifications from a mobile device and a smoking substitute device are simultaneous.

FIGS. 36A-3C show three examples of processes that may be used in order that the notifications are simultaneous. The skilled person will be aware that there may be other ways in which the first and second notifications may be provided simultaneously.

In FIG. 36A, at step 300*g*, the mobile device sends a signal to the smoking substitute device and then performs the second notification at step 302*g*. When the smoking substitute device 110*g* receives the signal, the smoking substitute device performs the first notification at step 301*g*. Thus, the notifications are performed simultaneously at steps 301*g* and 302*g*.

Figure 36B:
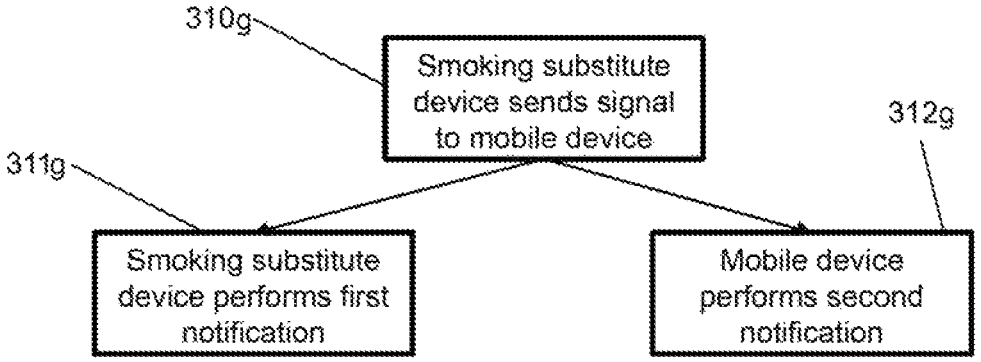
FIG. 36B shows another example of a process of the seventh mode for ensuring notifications from a mobile device and a smoking substitute device are simultaneous.

In FIG. 36B, at step 301*g*, the smoking substitute device sends a signal to the mobile device and then performs the first notification at step 311*g*. When the mobile device receives the signal, the mobile device performs the second notification at step 312*g*. Thus, the notifications are performed simultaneously at steps 311*g* and 312*g*.

The signals may also have other purposes. For example, a signal from the smoking substitute device to the mobile device which indicates a connection has been achieved may also be a signal indicative of the smoking substitute device performing a first notification and may cause the mobile device to perform a corresponding second notification. The same is true of a signal from the mobile device to the smoking substitute device indicating a connection has been achieved.

Figure 36C:
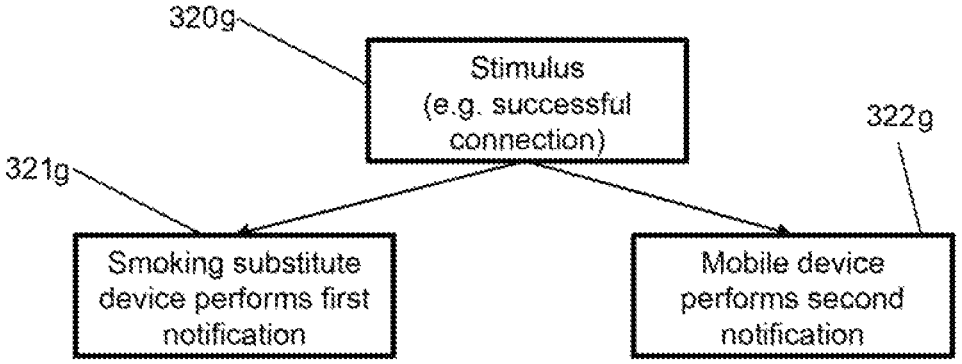
FIG. 36C shows another example of a process of the seventh mode for ensuring notifications from a mobile device and a smoking substitute device are simultaneous.

In FIG. 36C, a stimulus (step 320*g*), such as a connection being formed causes both the smoking substitute device to perform the first notification (step 321*g*) and the mobile device to perform the second notification (step 322*g*). Thus, no signal from one device to the other is needed and the notifications are performed simultaneously at steps 321*g* and 322*g*.

The features disclosed in the foregoing description, or in the following claims, or in the accompanying drawings, expressed in their specific forms or in terms of a means for performing the disclosed function, or a method or process for obtaining the disclosed results, as appropriate, may, separately, or in any combination of such features, be utilized for realizing the disclosure in diverse forms thereof.

While the disclosure has been described in conjunction with the exemplary embodiments described above, many equivalent modifications and variations will be apparent to those skilled in the art when given this disclosure. Accordingly, the exemplary embodiments of the disclosure set forth above are considered to be illustrative and not limiting. Various changes to the described embodiments may be made without departing from the spirit and scope of the disclosure.

For the avoidance of any doubt, any theoretical explanations provided herein are provided for the purposes of improving the understanding of a reader. The inventors do not wish to be bound by any of these theoretical explanations.

Any section headings used herein are for organizational purposes only and are not to be construed as limiting the subject matter described.

Throughout this specification, including the claims which follow, unless the context requires otherwise, the word "comprise" and "include", and variations such as "comprises", "comprising", and "including" will be understood to imply the inclusion of a stated integer or step or group of integers or steps but not the exclusion of any other integer or step or group of integers or steps.

It must be noted that, as used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by the use of the antecedent "about," it will be understood that the particular value forms another embodiment. The term "about" in relation to a numerical value is optional and means for example +/−10%.

Eighth Mode: A Smoking Substitute Device and a Method of Communicating Usage of a Smoking Substitute Device to a User.

Aspects and embodiments of the eighth mode of the present disclosure will now be discussed with reference to the accompanying figures. Further aspects and embodiments of the eighth mode will be apparent to those skilled in the art. All documents mentioned in this text are incorporated herein by reference.

Figure 37:
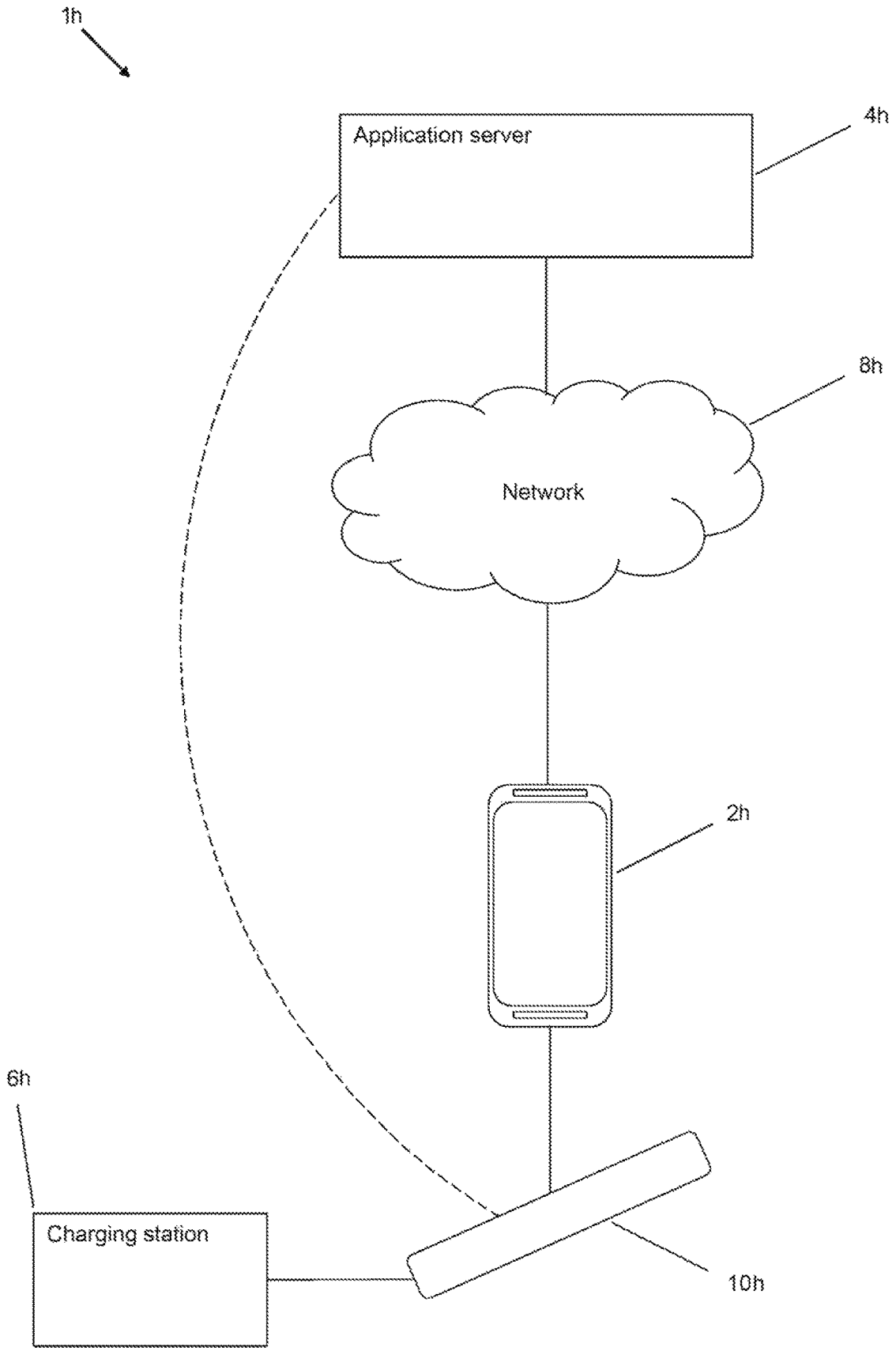
FIG. 37 shows an example system for managing a smoking substitute device of the eighth mode.

FIG. 37 shows an example system 1*h* for managing a smoking substitute device 10*h*.

The system 1*h* as shown in FIG. 37 includes a mobile device 2*h*, an application server 4*h*, an optional charging station 6*h*, as well as the smoking substitute device 10*h*.

The smoking substitute device 10*h* is configured to communicate wirelessly, e.g., via Bluetooth™, with an application (or "app") installed on the mobile device 2*h*, e.g., via a suitable wireless interface (not shown) on the mobile device 2*h*. The mobile device 2*h* may be a mobile phone, for example. The application on the mobile phone is configured to communicate with the application server 4*h*, via a network 8*h*. The application server 4*h* may utilize cloud storage, for example.

The network 8*h* may include a cellular network and/or the internet.

In other examples, the smoking substitute device 10*h* may be configured to communicate with the application server 4*h* via a connection that does not involve the mobile device 2*h*, e.g., via a narrowband internet of things ("NB-IoT") connection. In some examples, the mobile device 2*h* may be omitted from the system.

A skilled person would readily appreciate that the mobile device 2*h* may be configured to communicate via the network 8*h* according to various communication channels, preferably a wireless communication channel such as via a cellular network (e.g., according to a standard protocol, such as 3G or 4G) or via a WIFI network.

The app installed on the mobile device and the application server 4*h* may be configured to assist a user with their smoking substitute device 10*h*, based on information communicated between the smoking substitute device 10*h* and the app and/or information communicated between the app and the application server 4*h*.

The charging station 6*h* (if present) may be configured to charge (and optionally communicate with) the smoking substitute device 10*h*, via a charging port on the smoking substitute device 10*h*. The charging port on the smoking substitute device 10*h* may be a USB port, for example, which may allow the smoking substitute device to be charged by any USB-compatible device capable of delivering power to the smoking substitute device 10*h* via a suitable USB cable (in this case the USB-compatible device would be acting as the charging station 6*h*). Alternatively, the charging station could be a docking station specifically configured to dock with the smoking substitute device 10*h* and charge the smoking substitute device 10*h* via the charging port on the smoking substitute device 10*h*.

Figure 38A:
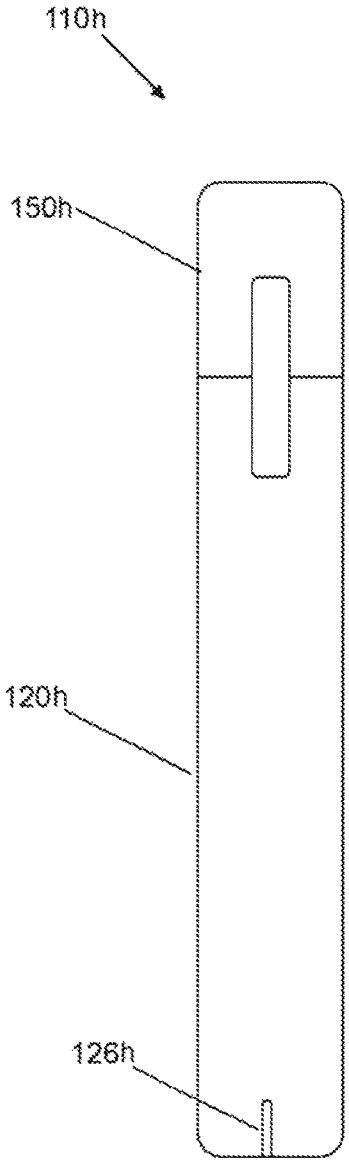
FIG. 38A shows an example smoking substitute device for use as the smoking substitute device in the system of FIG. 37.

FIG. 38A shows an example smoking substitute device 110*h* for use as the smoking substitute device 10*h* in the system 1*h* of FIG. 37.

In this example, the smoking substitute device 110*h* includes a main body 120*h* and a consumable 150*h*. The consumable 150*h* may alternatively be referred to as a "pod".

In this example, the smoking substitute device 110*h* is a closed system vaping device, wherein the consumable 150*h* includes a sealed tank 156*h* and is intended for one-use only.

FIG. 38A shows the smoking substitute device 110*h* with the main body 120*h* physically coupled to the consumable 150*h*.

Figure 38B:
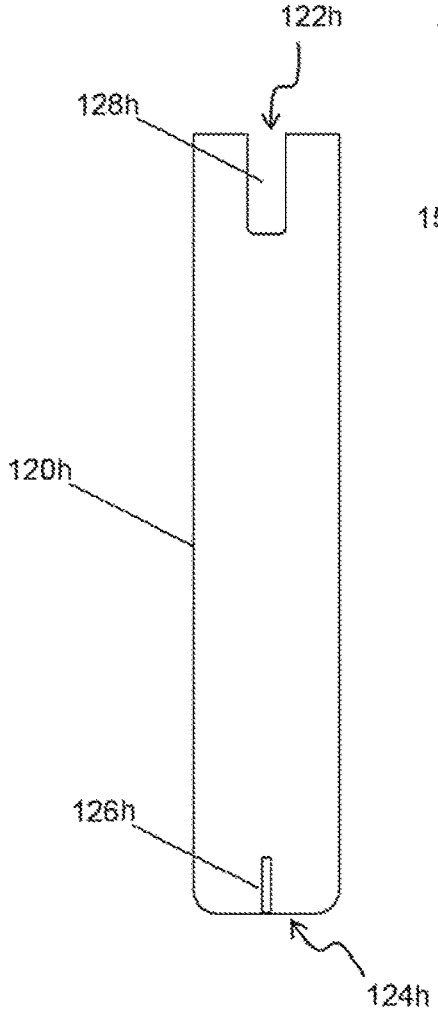
FIG. 38B shows the main body of the smoking substitute device of FIG. 38A without the consumable.

FIG. 38B shows the main body 120*h* of the smoking substitute device 110*h* without the consumable 150*h*.

Figure 38C:
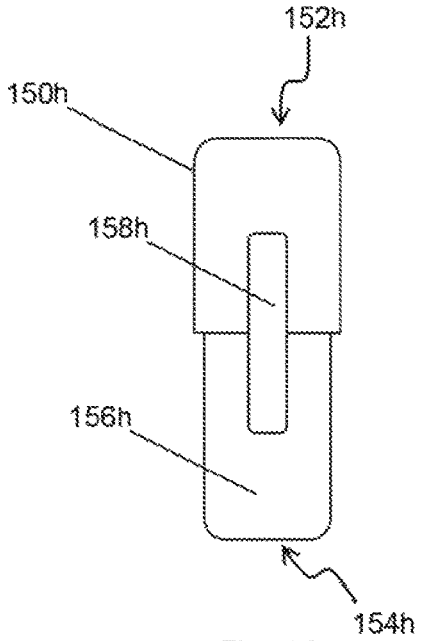
FIG. 38C shows the consumable of the smoking substitute device of FIG. 38A without the main body.

FIG. 38C shows the consumable 150*h* of the smoking substitute device 110*h* without the main body 120*h*.

The main body 120*h* and the consumable 150*h* are configured to be physically coupled together, in this example by pushing the consumable 150*h* into an aperture in a top end 122*h* of the main body 120*h*, e.g., with the consumable 150*h* being retained in the aperture via an interference fit. In other examples, the main body 120*h* and the consumable could be physically coupled together by screwing one onto the other, through a bayonet fitting, or through a snap engagement mechanism, for example. An optional light 126*h*, e.g., an LED located behind a small translucent cover, is located a bottom end 124*h* of the main body 120*h*. The light 126*h* may be configured to illuminate when the smoking substitute device 110*h* is activated.

The consumable 150*h* includes a mouthpiece (not shown) at a top end 152*h* of the consumable 150*h*, as well as one or more air inlets (not shown in FIG. 38) so that air can be drawn into the smoking substitute device 110*h* when a user inhales through the mouthpiece. At a bottom end 154*h* of the consumable 150*h*, there is located a tank 156*h* that contains e-liquid. The tank 156*h* may be a translucent body, for example.

The tank 156*h* preferably includes a window 158*h*, so that the amount of e-liquid in the tank 156*h* can be visually assessed. The main body 120*h* includes a slot 128*h* so that the window 158*h* of the consumable 150*h* can be seen whilst the rest of the tank 156*h* is obscured from view when the consumable 150*h* is inserted into the aperture in the top end 122*h* of the main body 120*h*.

In this present embodiment, the consumable 302*h* is a "single-use" consumable. That is, upon exhausting the e-liquid in the tank 156*h*, the intention is that the user disposes of the whole consumable 150*h*. In other embodiments, the e-liquid (i.e., aerosol former) may be the only part of the system that is truly "single-use". In such embodiments, the tank 156*h* may be refillable with e-liquid or the e-liquid may be stored in a non-consumable component of the system. For example, the e-liquid may be stored in a tank located in the device or stored in another component that is itself not single-use (e.g., a refillable tank).

The tank 156*h* may be referred to as a "clearomizer" if it includes a window 158*h*, or a "cartomizer" if it does not.

The illumination element 126*h*, or light 126*h*, is an example of a signaling element, in particular a visual signaling element that may provide a visual signal to a user. The illumination element 126*h* may generally glow to signal a non-use time period to a user, or glow in a certain pattern, intensity, brightness or color, dependent on an elapsed non-use time period of the smoking substitute device. The non-use time period may be determined by the smoking substitute device 10*h*, 110*h* itself, or may be determined by a mobile device 2*h* associated with the smoking substitute device 10*h*, 110*h*. Different signaling elements are conceivable, like an acoustic signaling element or a haptic signaling element, both of which are not depicted in FIGS. 38A-C. Further, the mobile device 2*h* may, alternatively or additionally, provide the signal to the user.

Figure 39A:
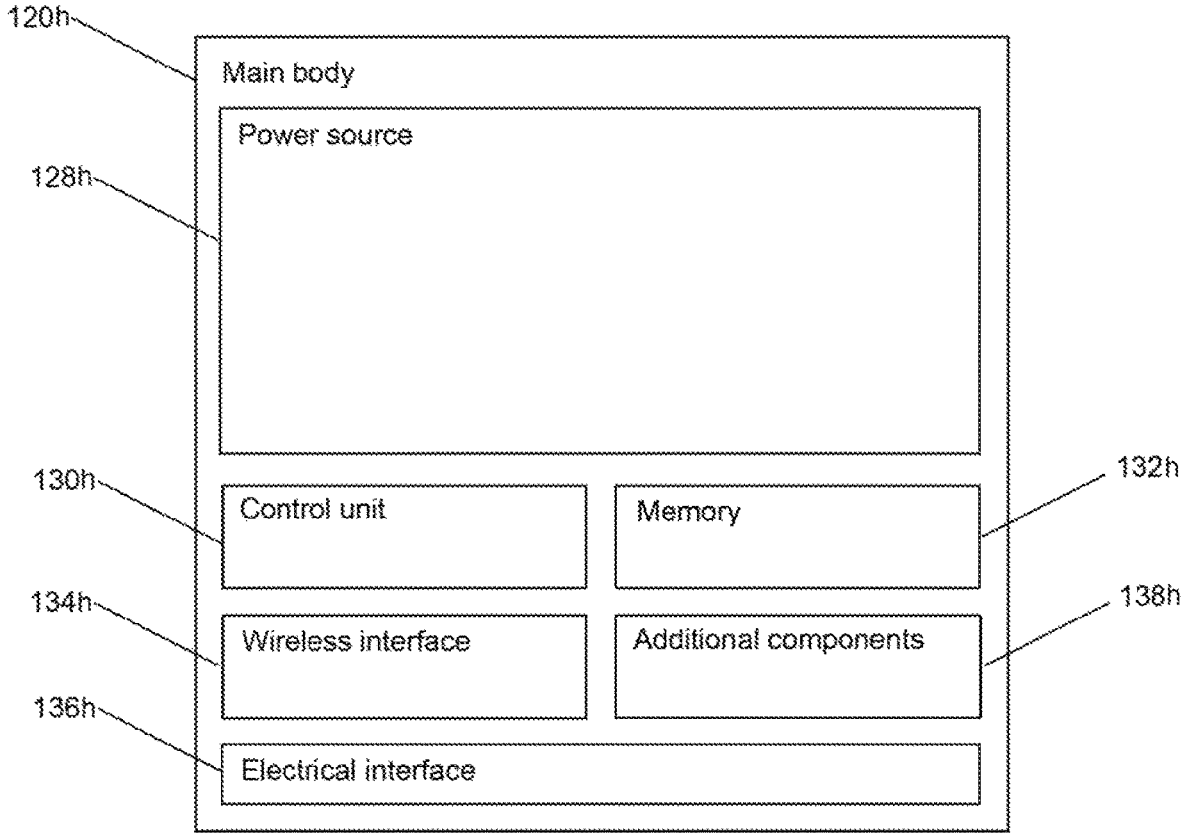
FIG. 39A is a schematic view of the main body of the smoking substitute device of FIG. 38A.

FIG. 39A is a schematic view of the main body 120*h* of the smoking substitute device 110*h*.

Figure 39B:
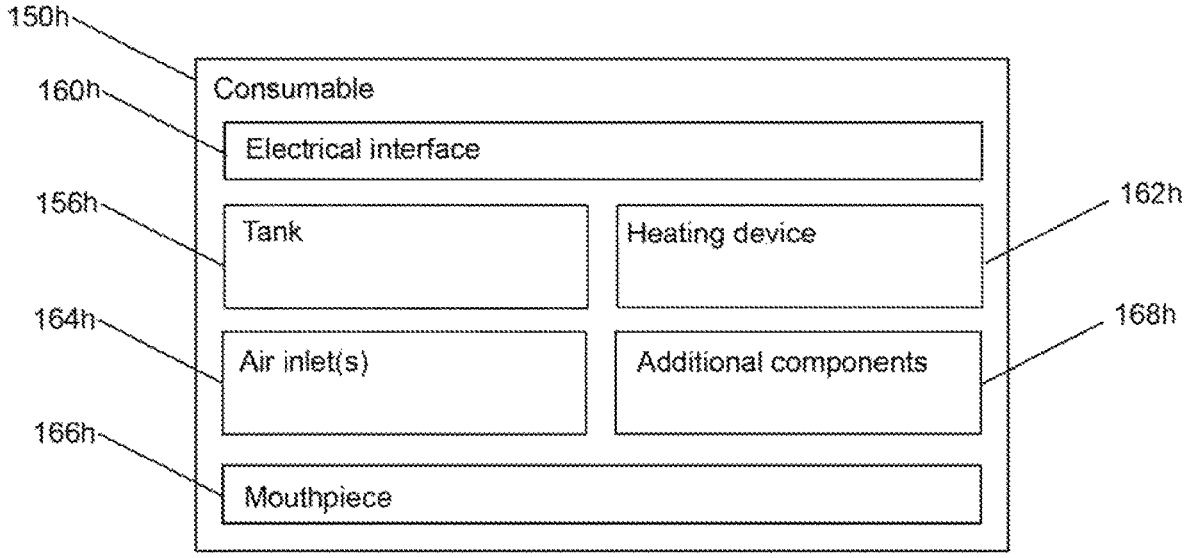
FIG. 39B is a schematic view of the consumable of the smoking substitute device of FIG. 38A.

FIG. 39B is a schematic view of the consumable 150*h* of the smoking substitute device 110*h*.

As shown in FIG. 39A, the main body 120*h* includes a power source 128*h*, a control unit 130*h*, a memory 132*h*, a wireless interface 134*h*, an electrical interface 136*h*, and, optionally, one or more additional components 138*h*.

The power source 128*h* is preferably a battery, more preferably a rechargeable battery.

The control unit 130*h* may include a microprocessor, for example.

The memory 132*h* is preferably includes non-volatile memory.

The wireless interface 134*h* is preferably configured to communicate wirelessly with the mobile device 2*h*, e.g., via Bluetooth. To this end, the wireless interface 134*h* could include a Bluetooth™ antenna. Other wireless communication interfaces, e.g., WIFI, are also possible.

The electrical interface 136*h* of the main body 120*h* may include one or more electrical supply contacts. The electrical interface 136*h* may be located in, and preferably at the bottom of, the aperture in the top end 122*h* of the main body 120*h*. When the main body 120*h* is physically coupled to the consumable 150*h*, the electrical interface 136*h* may be configured to pass electrical power from the power source 128*h* to (e.g., a heating device of) the consumable 150*h* when the smoking substitute device 110*h* is activated, e.g., via the electrical interface 160*h* of the consumable 150*h* (discussed below). When the main body 120*h* is not physically coupled to the consumable 150*h*, the electrical interface may be configured to receive power from the charging station 6*h*.

The additional components 138*h* of the main body 120*h* may include the optional light 126*h* discussed above.

The additional components 138*h* of the main body 120*h* may, if the power source 128*h* is a rechargeable battery, include a charging port configured to receive power from the charging station 6*h*. This may be located at the bottom end 124*h* of the main body 120*h*. Alternatively, the electrical interface 136*h* discussed above is configured to act as a charging port configured to receive power from the charging station 6*h* such that a separate charging port is not required.

The additional components 138*h* of the main body 120*h* may, if the power source 128*h* is a rechargeable battery, include a battery charging control circuit, for controlling the charging of the rechargeable battery. However, a battery charging control circuit could equally be located in the charging station 6*h* (if present).

The additional components 138*h* of the main body 120*h* may include an airflow sensor for detecting airflow in the smoking substitute device 110*h*, e.g., caused by a user inhaling through a mouthpiece 166*h* (discussed below) of the smoking substitute device 110*h*. The smoking substitute device 110*h* may be configured to be activated when airflow is detected by the airflow sensor. This optional sensor could alternatively be included in the consumable 150*h* (though this is less preferred where the consumable 150*h* is intended to be disposed of after use, as in this example).

The additional components 138*h* of the main body 120*h* may include an actuator, e.g., a button. The smoking substitute device 110*h* may be configured to be activated when the actuator is actuated. This provides an alternative to the airflow sensor noted, as a mechanism for activating the smoking substitute device 110*h*.

The additional components 138*h* of the main body 120*h* may include a reading device configured to read information associated with the consumable from a machine readable data source included in (e.g., contained in the body of, or attached to) the consumable 150*h*.

In some examples, the reading device (if present) may be configured to read information from the machine readable data source non-wirelessly, e.g., using an electrical connection between the main body 120*h* and consumable 150*h*.

For example, the reading device (if present) may include a set of one or more electrical communication contacts configured to read information from the machine readable data source via an electrical connection established between the set of one or more electrical communication contacts and the machine readable data source. Conveniently, the set of one or more electrical communication contacts of the reading device may be configured to provide the electrical connection by engaging with a set of one or more electrical communication contacts of the consumable 150*h*, when the main body 120*h* and the consumable 150*h* are physically coupled together.

In some examples, the reading device (if present) may be configured to read information from the machine readable data source wirelessly, e.g., via electromagnetic waves or optically. Thus, for example, the machine readable data source included in the consumable 150*h* could be an RFID tag (in which case the reading device included in the main body 120*h* may be an RFID reader) or a visual data source such as a barcode (in which case the reading device included in the main body may be an optical reader, e.g., a barcode scanner). Various wireless technologies and protocols may be employed to allow the reading device to wirelessly read information from a machine readable data source included in or attached to the consumable 150*h*, e.g., NFC, Bluetooth, Wi-Fi, as would be appreciated by a skilled person.

The reading device (if present) may be configured to write information associated with the consumable to the machine readable data source (e.g., wirelessly or non-wirelessly, via one of the mechanisms discussed above) in addition to being configured to read information associated with the consumable from the machine readable data source. In this case, the reading device may be referred to as a reading/writing device.

As shown in FIG. 39B, the consumable 150*h* includes the tank 156*h*, an electrical interface 160*h*, a heating device 162*h*, one or more air inlets 164*h*, a mouthpiece 166*h*, and, optionally, one or more additional components 168*h*.

The electrical interface 160*h* of the consumable 150*h* may include one or more electrical supply contacts. The electrical interface 136*h* of the main body 120*h* and an electrical interface 160*h* of the consumable 150*h* are preferably configured to contact each other and therefore electrically couple the main body 120*h* to the consumable 150*h* when the main body 120*h* is physically coupled to the consumable 150*h*. In this way, electrical energy (e.g., in the form of an electrical current) is able to be supplied from the power source 128*h* in the main body 120*h* to the heating device 162*h* in the consumable 150*h*.

The heating device 162*h* is preferably configured to heat e-liquid contained in the tank 156*h*, e.g., using electrical energy supplied from the power source 128*h*. In one example, the heating device 162*h* may include a heating filament and a wick, wherein a first portion of the wick extends into the tank 156*h* in order to draw e-liquid out from the tank 156*h*, and wherein the heating filament coils around a second portion of the wick located outside the tank 156*h*. In this example, the heating filament is configured to heat up e-liquid drawn out of the tank 156*h* by the wick to produce an aerosol vapor.

The one or more air inlets 164*h* are preferably configured to allow air to be drawn into the smoking substitute device 110*h*, when a user inhales through the mouthpiece 166*h*.

The additional components 168*h* of the consumable 150*h* may include a machine readable data source, which may, e.g., be contained in the body of, or attached to the consumable 150*h*. The machine readable data source may store information associated with the consumable. The information associated with the consumable may include information concerning the content of the consumable (e.g., e-liquid type, batch number) and/or a unique identifier, for example.

The machine readable data source may be rewritable, e.g., a rewritable RFID chip, or read only, e.g., a visual data source such as a barcode. As indicated above, the additional components 138*h* of the main body 120*h* may include a reading device configured to read information associated with the consumable from the machine readable data source.

For example, the electrical interface 160*h* of the consumable 150*h* may include a set of one or more electrical communication contacts, which may allow a reading device of the main body to read information from a machine readable data source of the consumable, e.g., as discussed previously.

In use, a user activates the smoking substitute device 110*h*, e.g., through actuating an actuator included in the main body 120*h* or by inhaling through the mouthpiece 166*h* as described above. Upon activation, the control unit 130*h* may supply electrical energy from the power source 128*h* to the heating device 162*h* (via electrical interfaces 136*h*, 166*h*), which may cause the heating device 162*h* to heat e-liquid drawn from the tank 156*h* to produce a vapor which is inhaled by a user through the mouthpiece 166*h*.

Of course, a skilled reader would readily appreciate that the smoking substitute device 110*h* shown in FIGS. 38 and 39 shows just one example implementation of a smoking substitute device, and that other forms of smoking substitute device could be used as the smoking substitute device 10*h* of FIG. 37.

By way of example, a HNB smoking substitute device including a main body and a consumable could be used as the smoking substitute device 10*h* of FIG. 37, instead of the smoking substitute device 110*h*. One such HNB smoking substitute device is the IQOS™ smoking substitute device discussed above.

As another example, an open system vaping device which includes a main body, a refillable tank, and a mouthpiece could be used as the smoking substitute device 10*h* of FIG. 37, instead of the smoking substitute device 110*h*. One such open system vaping device is the blu PRO™ e-cigarette discussed above.

As another example, an entirely disposable (one use) smoking substitute device could be used as the smoking substitute device 10*h* of FIG. 37, instead of the smoking substitute device 110*h*.

Figure 40:
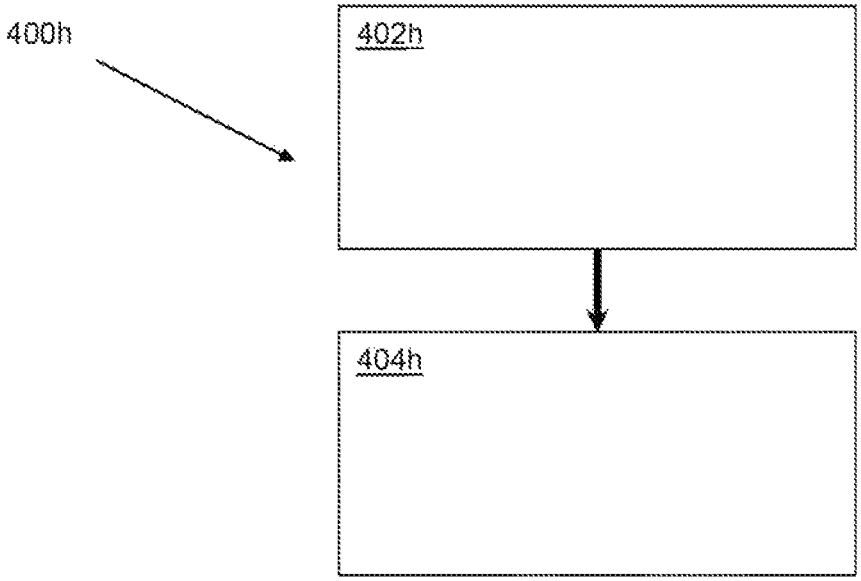
FIG. 40 is a flowchart diagram of a method of the eighth mode of communicating usage of a smoking substitute device to a user.

FIG. 40 is a flowchart diagram of a method of communicating usage of a smoking substitute device to a user. The method (400*h*) of communicating usage of a smoking substitute device to a user, comprises detecting (402*h*) usage of the smoking substitute device by the user, and providing (404*h*) a signal after a defined non-use time period of the smoking substitute device to the user.

The features disclosed in the foregoing description, or in the following claims, or in the accompanying drawings, expressed in their specific forms or in terms of a means for performing the disclosed function, or a method or process for obtaining the disclosed results, as appropriate, may, separately, or in any combination of such features, be utilized for realizing the disclosure in diverse forms thereof.

While the disclosure has been described in conjunction with the exemplary embodiments described above, many equivalent modifications and variations will be apparent to those skilled in the art when given this disclosure. Accordingly, the exemplary embodiments of the disclosure set forth above are considered to be illustrative and not limiting. Various changes to the described embodiments may be made without departing from the spirit and scope of the disclosure.

For the avoidance of any doubt, any theoretical explanations provided herein are provided for the purposes of improving the understanding of a reader. The inventors do not wish to be bound by any of these theoretical explanations.

Any section headings used herein are for organizational purposes only and are not to be construed as limiting the subject matter described.

Throughout this specification, including the claims which follow, unless the context requires otherwise, the word "comprise" and "include", and variations such as "comprises", "comprising", and "including" will be understood to imply the inclusion of a stated integer or step or group of integers or steps but not the exclusion of any other integer or step or group of integers or steps.

It must be noted that, as used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by the use of the antecedent "about," it will be understood that the particular value forms another embodiment. The term "about" in relation to a numerical value is optional and means for example +/−10%.

Nineth Mode: A Smoking Substitute Device, a Smoking Substitute System and a Method of Syncing at Least Two Smoking Substitute Devices.

Aspects and embodiments of the ninth mode of the present disclosure will now be discussed with reference to the accompanying figures. Further aspects and embodiments of the ninth mode will be apparent to those skilled in the art. All documents mentioned in this text are incorporated herein by reference.

Figure 41:
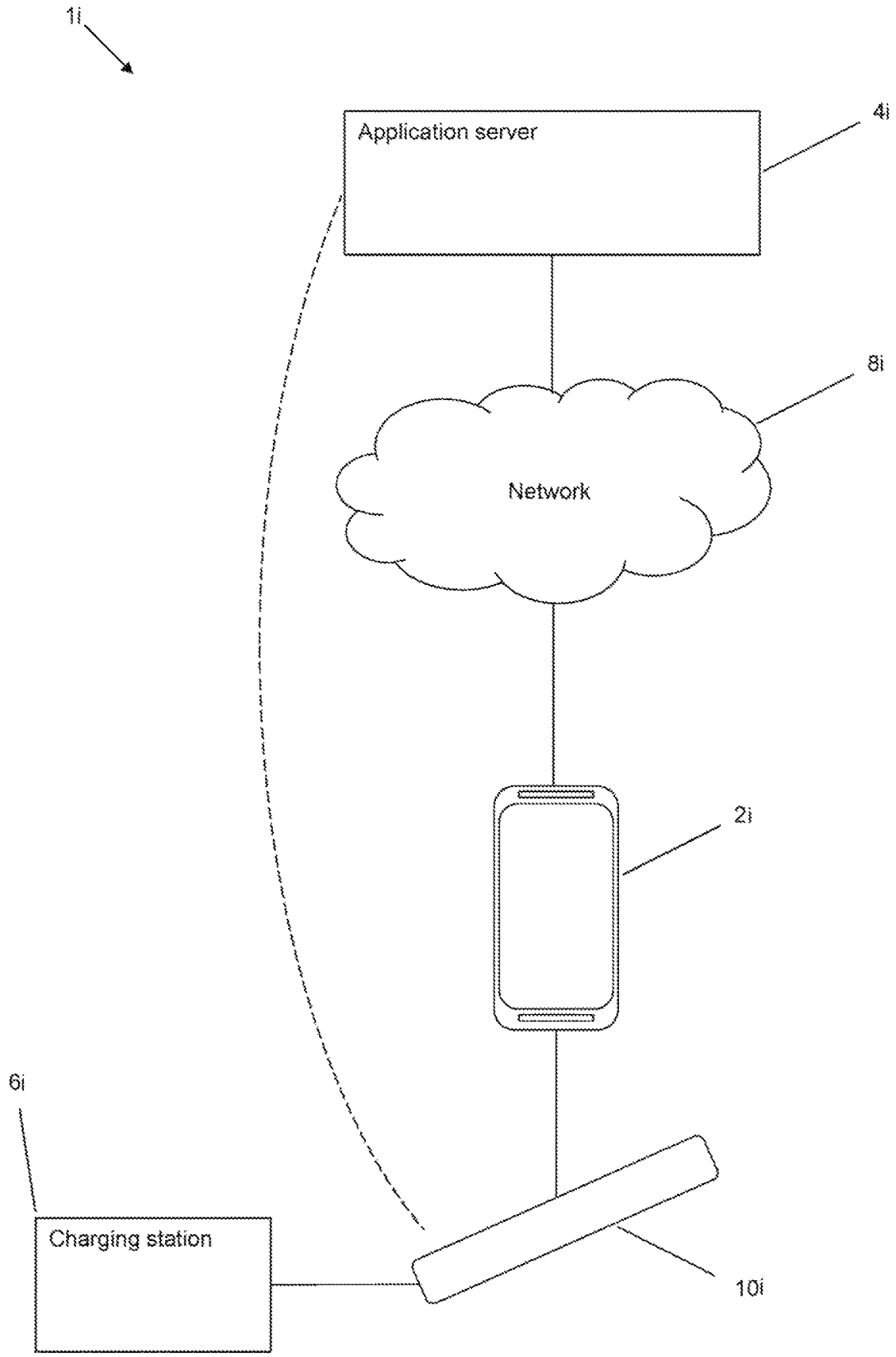
FIG. 41 shows an example system for managing a smoking substitute device of the ninth mode.

FIG. 41 shows an example system 1*i* for managing a smoking substitute device 10*i*.

The system 1*i* as shown in FIG. 41 includes a mobile device 2*i*, an application server 4*i*, an optional charging station 6*i*, as well as the smoking substitute device 10*i*.

The smoking substitute device 10*i* is configured to communicate wirelessly, e.g., via Bluetooth™, with an application (or "app") installed on the mobile device 2*i*, e.g., via a suitable wireless interface (not shown) on the mobile device 2*i*. The mobile device 2*i* may be a mobile phone, for example. The application on the mobile phone is configured to communicate with the application server 4*i*, via a network 8*i*. The application server 4*i* may utilize cloud storage, for example.

The network 8*i* may include a cellular network and/or the internet.

In other examples, the smoking substitute device 10*i* may be configured to communicate with the application server 4*i* via a connection that does not involve the mobile device 2*i*, e.g., via a narrowband internet of things ("NB-IoT") connection. In some examples, the mobile device 2*i* may be omitted from the system.

A skilled person would readily appreciate that the mobile device 2*i* may be configured to communicate via the network 8*i* according to various communication channels, preferably a wireless communication channel such as via a cellular network (e.g., according to a standard protocol, such as 3G or 4G) or via a WIFI network.

The app installed on the mobile device and the application server 4*i* may be configured to assist a user with their smoking substitute device 10*i*, based on information communicated between the smoking substitute device 10*i* and the app and/or information communicated between the app and the application server 4*i*.

The charging station 6*i* (if present) may be configured to charge (and optionally communicate with) the smoking substitute device 10*i*, via a charging port on the smoking substitute device 10*i*. The charging port on the smoking substitute device 10*i* may be a USB port, for example, which may allow the smoking substitute device to be charged by any USB-compatible device capable of delivering power to the smoking substitute device 10*i* via a suitable USB cable (in this case the USB-compatible device would be acting as the charging station 6*i*). Alternatively, the charging station could be a docking station specifically configured to dock with the smoking substitute device 10*i* and charge the smoking substitute device 10*i* via the charging port on the smoking substitute device 10*i*.

Figure 42A:
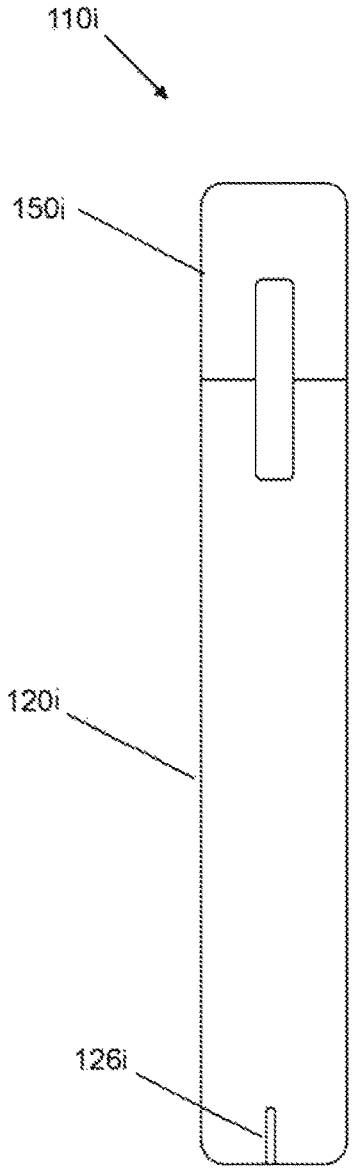
FIG. 42A shows an example smoking substitute device for use as the smoking substitute device in the system of FIG. 41.

FIG. 42A shows an example smoking substitute device 110*i* for use as the smoking substitute device 10*i* in the system 1*i* of FIG. 41.

In this example, the smoking substitute device 110*i* includes a main body 120*i* and a consumable 150*i*. The consumable 150*i* may alternatively be referred to as a "pod".

In this example, the smoking substitute device 110*i* is a closed system vaping device, wherein the consumable 150*i* includes a sealed tank 156*i* and is intended for one-use only.

FIG. 42A shows the smoking substitute device 110*i* with the main body 120*i* physically coupled to the consumable 150*i*.

Figure 42B:
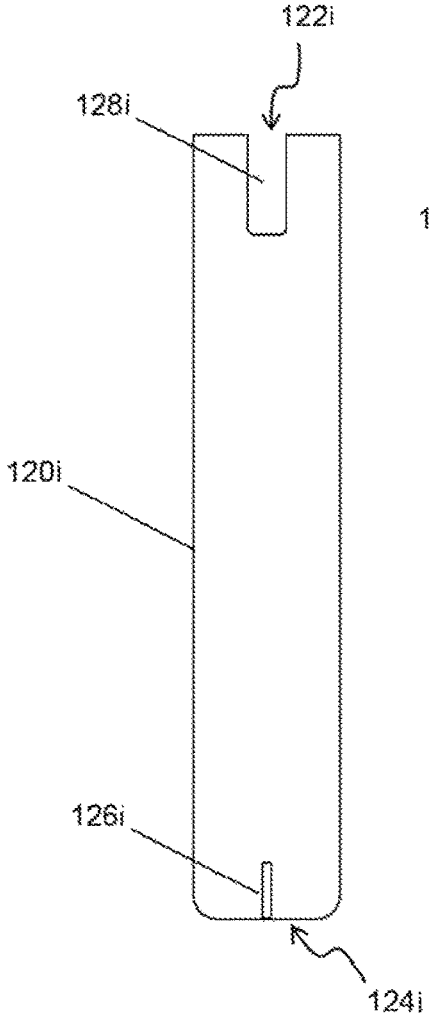
FIG. 42B shows the main body of the smoking substitute device of FIG. 42A without the consumable.

FIG. 42B shows the main body 120*i* of the smoking substitute device 110*i* without the consumable 150*i*.

Figure 42C:
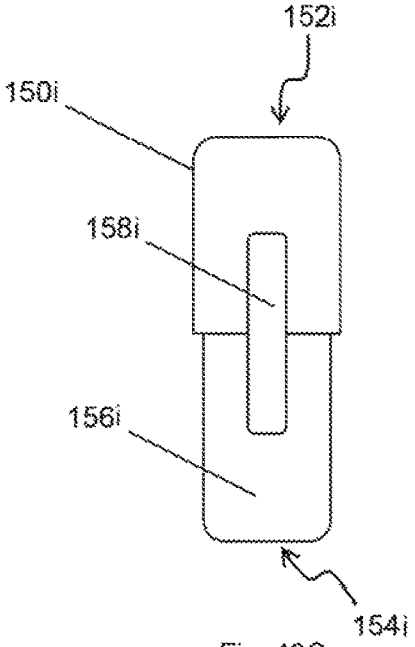
FIG. 42C shows the consumable of the smoking substitute device of FIG. 42A without the main body.

FIG. 42C shows the consumable 150*i* of the smoking substitute device 110*i* without the main body 120*i*.

The main body 120*i* and the consumable 150*i* are configured to be physically coupled together, in this example by pushing the consumable 150*i* into an aperture in a top end 122*i* of the main body 120*i*, e.g., with the consumable 150*i* being retained in the aperture via an interference fit. In other examples, the main body 120*i* and the consumable could be physically coupled together by screwing one onto the other, through a bayonet fitting, or through a snap engagement mechanism, for example. An optional light or illumination element 126*i*, e.g., an LED located behind a small translucent cover, is located a bottom end 124*i* of the main body 120*i*. The light 126*i* may be configured to illuminate when the smoking substitute device 110*i* is activated.

The consumable 150*i* includes a mouthpiece (not shown) at a top end 152*i* of the consumable 150*i*, as well as one or more air inlets (not shown in FIG. 42) so that air can be drawn into the smoking substitute device 110*i* when a user inhales through the mouthpiece. At a bottom end 154*i* of the consumable 150*i*, there is located a tank 156*i* that contains e-liquid. The tank 156*i* may be a translucent body, for example.

The tank 156*i* preferably includes a window 158*i*, so that the amount of e-liquid in the tank 156*i* can be visually assessed. The main body 120*i* includes a slot 128*i* so that the window 158*i* of the consumable 150*i* can be seen whilst the rest of the tank 156*i* is obscured from view when the consumable 150*i* is inserted into the aperture in the top end 122*i* of the main body 120*i*.

In this present embodiment, the consumable 302*i* is a "single-use" consumable. That is, upon exhausting the e-liquid in the tank 156*i*, the intention is that the user disposes of the whole consumable 150*i*. In other embodiments, the e-liquid (i.e., aerosol former) may be the only part of the system that is truly "single-use". In such embodiments, the tank 156*i* may be refillable with e-liquid or the e-liquid may be stored in a non-consumable component of the system. For example, the e-liquid may be stored in a tank located in the device or stored in another component that is itself not single-use (e.g., a refillable tank).

The tank 156*i* may be referred to as a "clearomizer" if it includes a window 158*i*, or a "cartomizer" if it does not.

Figure 43A:
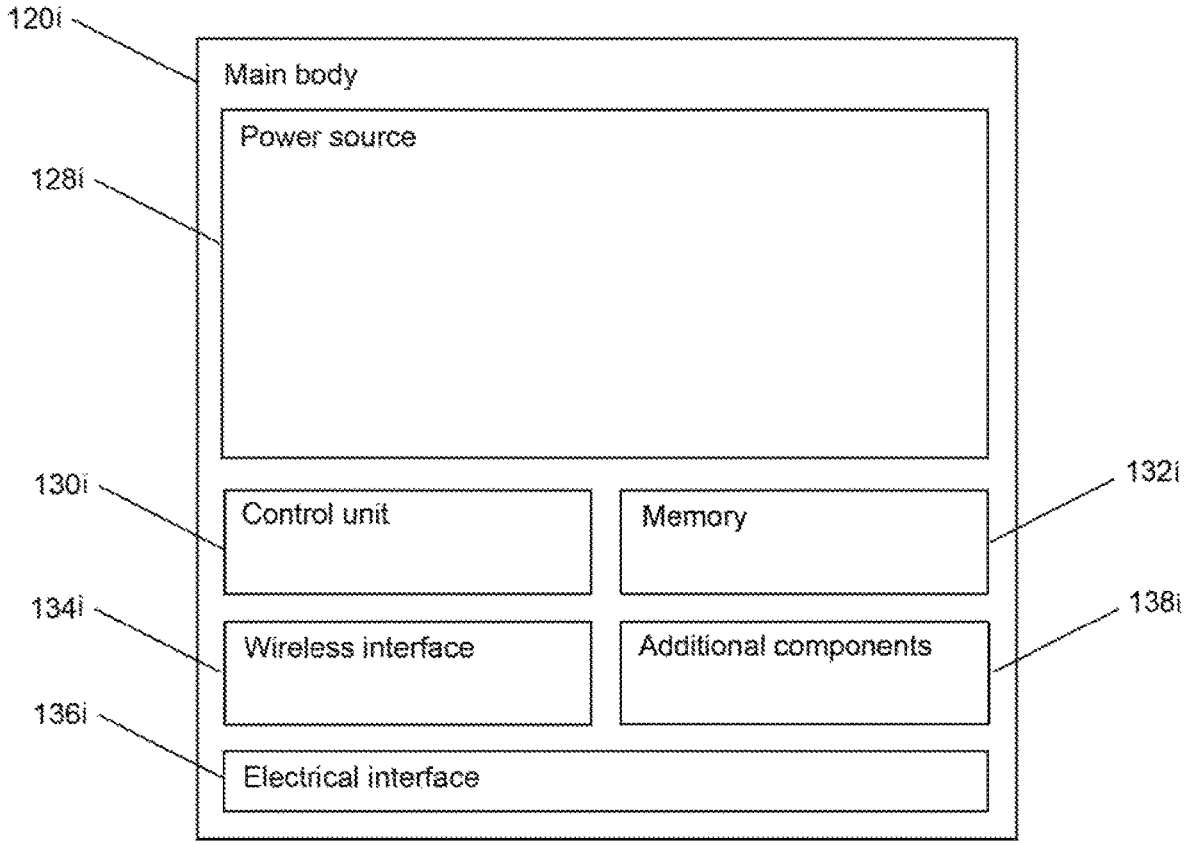
FIG. 43A is a schematic view of the main body of the smoking substitute device of FIG. 42A.

FIG. 43A is a schematic view of the main body 120*i* of the smoking substitute device 110*i*.

Figure 43B:
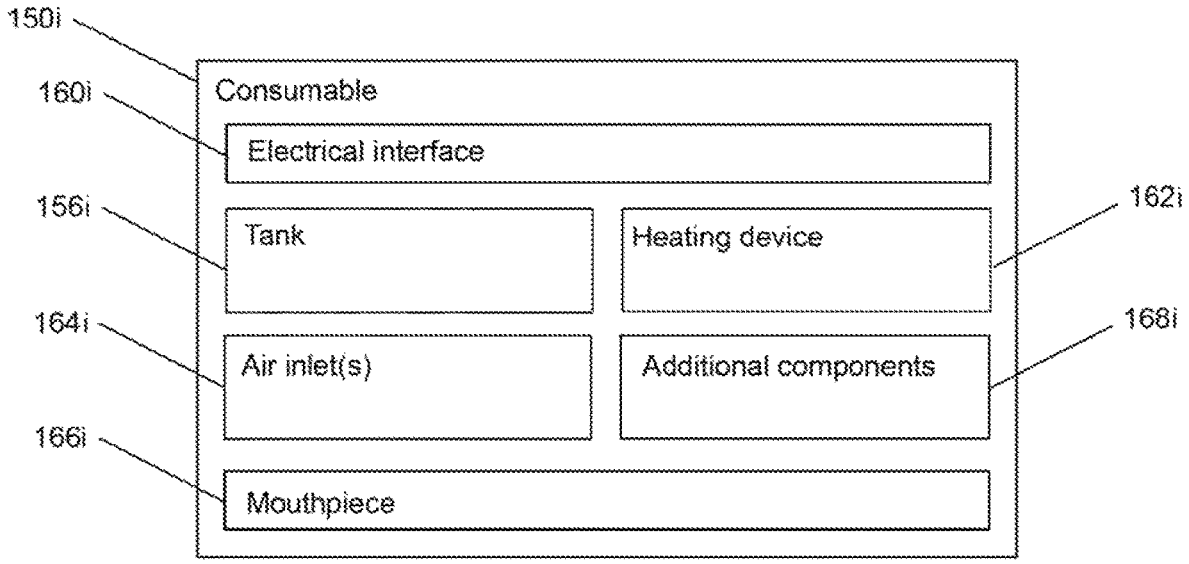
FIG. 43B is a schematic view of the consumable of the smoking substitute device of FIG. 42A.

FIG. 43B is a schematic view of the consumable 150*i* of the smoking substitute device 110*i*.

As shown in FIG. 43A, the main body 120*i* includes a power source 128*i*, a control unit 130*i*, a memory 132*i*, a wireless interface 134*i*, an electrical interface 136*i*, and, optionally, one or more additional components 138*i*.

The power source 128*i* is preferably a battery, more preferably a rechargeable battery.

The control unit 130*i* may include a microprocessor, for example.

The memory 132*i* is preferably includes non-volatile memory.

The wireless interface 134*i* is preferably configured to communicate wirelessly with the mobile device 2*i*, e.g., via Bluetooth. To this end, the wireless interface 134*i* could include a Bluetooth™ antenna. Other wireless communication interfaces, e.g., WIFI, are also possible.

The electrical interface 136*i* of the main body 120*i* may include one or more electrical supply contacts. The electrical interface 136*i* may be located in, and preferably at the bottom of, the aperture in the top end 122*i* of the main body 120*i*. When the main body 120*i* is physically coupled to the consumable 150*i*, the electrical interface 136*i* may be configured to pass electrical power from the power source 128*i* to (e.g., a heating device of) the consumable 150*i* when the smoking substitute device 110*i* is activated, e.g., via the electrical interface 160*i* of the consumable 150*i* (discussed below). When the main body 120*i* is not physically coupled to the consumable 150*i*, the electrical interface may be configured to receive power from the charging station 6*i*.

The additional components 138*i* of the main body 120*i* may include the optional light 126*i* discussed above.

The additional components 138*i* of the main body 120*i* may, if the power source 128*i* is a rechargeable battery, include a charging port configured to receive power from the charging station 6*i*. This may be located at the bottom end 124*i* of the main body 120*i*. Alternatively, the electrical interface 136*i* discussed above is configured to act as a charging port configured to receive power from the charging station 6*i* such that a separate charging port is not required.

The additional components 138*i* of the main body 120*i* may, if the power source 128*i* is a rechargeable battery, include a battery charging control circuit, for controlling the charging of the rechargeable battery. However, a battery charging control circuit could equally be located in the charging station 6*i* (if present).

The additional components 138*i* of the main body 120*i* may include an airflow sensor for detecting airflow in the smoking substitute device 110*i*, e.g., caused by a user inhaling through a mouthpiece 166*i* (discussed below) of the smoking substitute device 110*i*. The smoking substitute device 110*i* may be configured to be activated when airflow is detected by the airflow sensor. This optional sensor could alternatively be included in the consumable 150*i* (though this is less preferred where the consumable 150*i* is intended to be disposed of after use, as in this example).

The additional components 138*i* of the main body 120*i* may include an actuator, e.g., a button. The smoking substitute device 110*i* may be configured to be activated when the actuator is actuated. This provides an alternative to the airflow sensor noted, as a mechanism for activating the smoking substitute device 110*i*.

The additional components 138*i* of the main body 120*i* may include a reading device configured to read information associated with the consumable from a machine readable data source included in (e.g., contained in the body of, or attached to) the consumable 150*i*.

In some examples, the reading device (if present) may be configured to read information from the machine readable data source non-wirelessly, e.g., using an electrical connection between the main body 120*i* and consumable 150*i*.

For example, the reading device (if present) may include a set of one or more electrical communication contacts configured to read information from the machine readable data source via an electrical connection established between the set of one or more electrical communication contacts and the machine readable data source. Conveniently, the set of one or more electrical communication contacts of the reading device may be configured to provide the electrical connection by engaging with a set of one or more electrical communication contacts of the consumable 150*i*, when the main body 120*i* and the consumable 150*i* are physically coupled together.

In some examples, the reading device (if present) may be configured to read information from the machine readable data source wirelessly, e.g., via electromagnetic waves or optically. Thus, for example, the machine readable data source included in the consumable 150*i* could be an RFID tag (in which case the reading device included in the main body 120*i* may be an RFID reader) or a visual data source such as a barcode (in which case the reading device included in the main body may be an optical reader, e.g., a barcode scanner). Various wireless technologies and protocols may be employed to allow the reading device to wirelessly read information from a machine readable data source included in or attached to the consumable 150*i*, e.g., NFC, Bluetooth, Wi-Fi, as would be appreciated by a skilled person.

The reading device (if present) may be configured to write information associated with the consumable to the machine readable data source (e.g., wirelessly or non-wirelessly, via one of the mechanisms discussed above) in addition to being configured to read information associated with the consumable from the machine readable data source. In this case, the reading device may be referred to as a reading/writing device.

As shown in FIG. 43B, the consumable 150*i* includes the tank 156*i*, an electrical interface 160*i*, a heating device 162*i*, one or more air inlets 164*i*, a mouthpiece 166*i*, and, optionally, one or more additional components 168*i*.

The electrical interface 160*i* of the consumable 150*i* may include one or more electrical supply contacts. The electrical interface 136*i* of the main body 120*i* and an electrical interface 160*i* of the consumable 150*i* are preferably configured to contact each other and therefore electrically couple the main body 120*i* to the consumable 150*i* when the main body 120*i* is physically coupled to the consumable 150*i*. In this way, electrical energy (e.g., in the form of an electrical current) is able to be supplied from the power source 128*i* in the main body 120*i* to the heating device 162*i* in the consumable 150*i*.

The heating device 162*i* is preferably configured to heat e-liquid contained in the tank 156*i*, e.g., using electrical energy supplied from the power source 128*i*. In one example, the heating device 162*i* may include a heating filament and a wick, wherein a first portion of the wick extends into the tank 156*i* in order to draw e-liquid out from the tank 156*i*, and wherein the heating filament coils around a second portion of the wick located outside the tank 156*i*. In this example, the heating filament is configured to heat up e-liquid drawn out of the tank 156*i* by the wick to produce an aerosol vapor.

The one or more air inlets 164*i* are preferably configured to allow air to be drawn into the smoking substitute device 110*i*, when a user inhales through the mouthpiece 166*i*.

The additional components 168*i* of the consumable 150*i* may include a machine readable data source, which may, e.g., be contained in the body of, or attached to the consumable 150*i*. The machine readable data source may store information associated with the consumable. The information associated with the consumable may include information concerning the content of the consumable (e.g., e-liquid type, batch number) and/or a unique identifier, for example.

The machine readable data source may be rewritable, e.g., a rewritable RFID chip, or read only, e.g., a visual data source such as a barcode. As indicated above, the additional components 138*i* of the main body 120*i* may include a reading device configured to read information associated with the consumable from the machine readable data source.

For example, the electrical interface 160*i* of the consumable 150*i* may include a set of one or more electrical communication contacts, which may allow a reading device of the main body to read information from a machine readable data source of the consumable, e.g., as discussed previously.

In use, a user activates the smoking substitute device 110*i*, e.g., through actuating an actuator included in the main body 120*i* or by inhaling through the mouthpiece 166*i* as described above. Upon activation, the control unit 130*i* may supply electrical energy from the power source 128*i* to the heating device 162*i* (via electrical interfaces 136*i*, 166*i*), which may cause the heating device 162*i* to heat e-liquid drawn from the tank 156*i* to produce a vapor which is inhaled by a user through the mouthpiece 166*i*.

Of course, a skilled reader would readily appreciate that the smoking substitute device 110*i* shown in FIGS. 42 and 43 shows just one example implementation of a smoking substitute device, and that other forms of smoking substitute device could be used as the smoking substitute device 10*i* of FIG. 41.

By way of example, a HNB smoking substitute device including a main body and a consumable could be used as the smoking substitute device 10*i* of FIG. 41, instead of the smoking substitute device 110*i*. One such HNB smoking substitute device is the IQOS™ smoking substitute device discussed above.

As another example, an open system vaping device which includes a main body, a refillable tank, and a mouthpiece could be used as the smoking substitute device 10*i* of FIG. 41, instead of the smoking substitute device 110*i*. One such open system vaping device is the blu PRO™ e-cigarette discussed above.

As another example, an entirely disposable (one use) smoking substitute device could be used as the smoking substitute device 10*i* of FIG. 41, instead of the smoking substitute device 110*i*.

Figure 44:
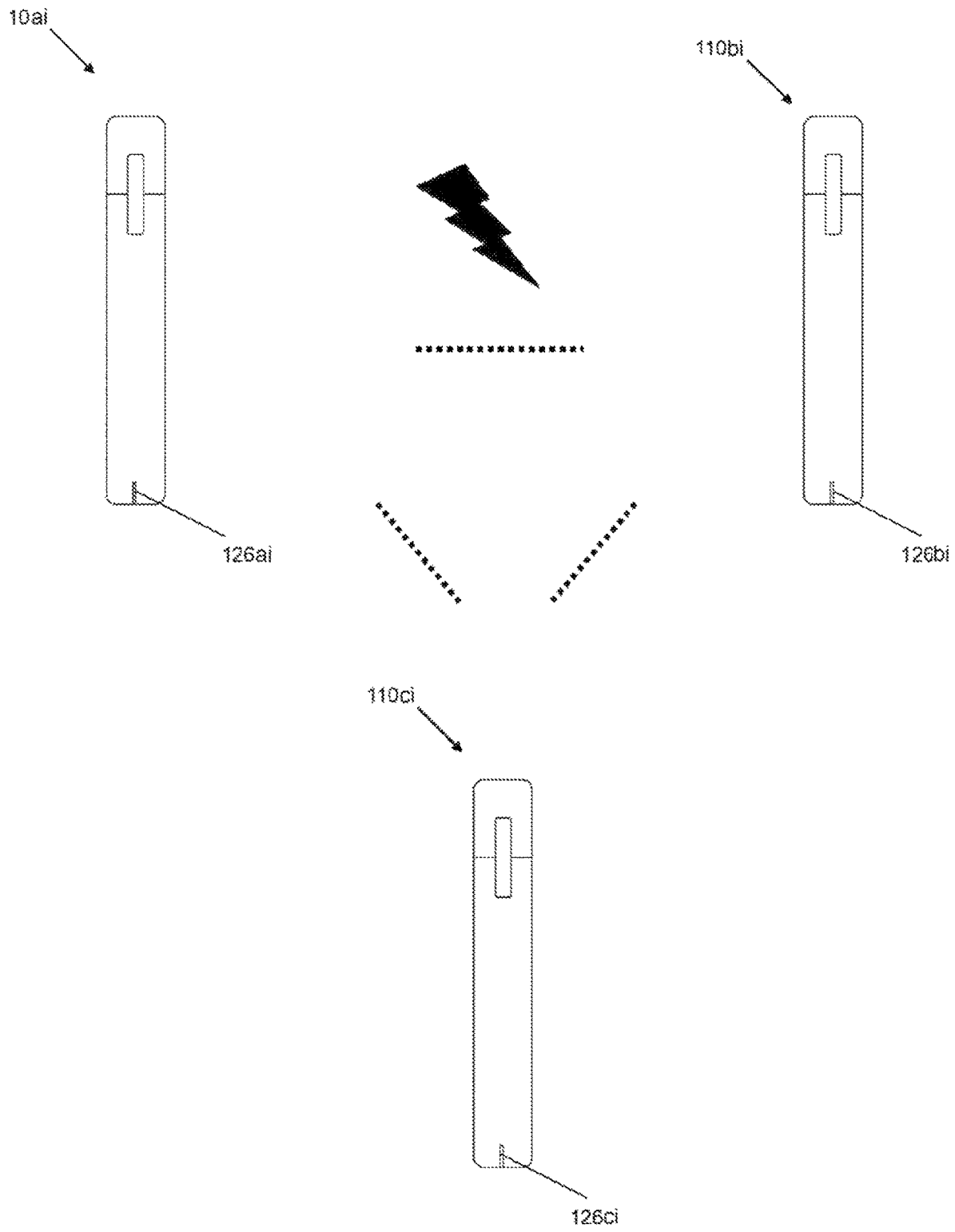
FIG. 44 shows an exemplary scenario of three smoking substitute devices of the ninth mode about to be brought in each other's vicinity

FIG. 44 shows an exemplary scenario of three smoking substitute devices about to be brought in each other's vicinity.

In FIG. 44, three smoking substitute devices 110*ai, bi, ci* are depicted, each operated by a user, not depicted. Each smoking substitute device 110*ai, bi, ci* has an illumination element 126*ai, bi, ci*, as an example of a dedicated function of each smoking substitute device 110*ai, bi, ci*, e.g., for providing a visual signal like a light or a glow or the like to a user. In FIG. 44, the three smoking substitute devices 110*ai, bi, ci* are still spaced apart so that each smoking substitute device 110*ai, bi, ci* neither detects the presence of another smoking substitute device 110*ai, bi, ci* nor are the smoking substitute devices 110*ai, bi, ci* in communication with one another. This lack of detected presence or lack of communication between the smoking substitute devices 110*ai, bi, ci* is depicted by the black lighting and the three dashed lines in FIG. 44. Consequently, the smoking substitute devices 110*ai, bi, ci* are not synced, in particular a light or glow emanating from the illumination element 126*ai, bi, ci*, assuming a current use of the smoking substitute devices 110*ai, bi, ci* may not be in sync.

Figure 45:
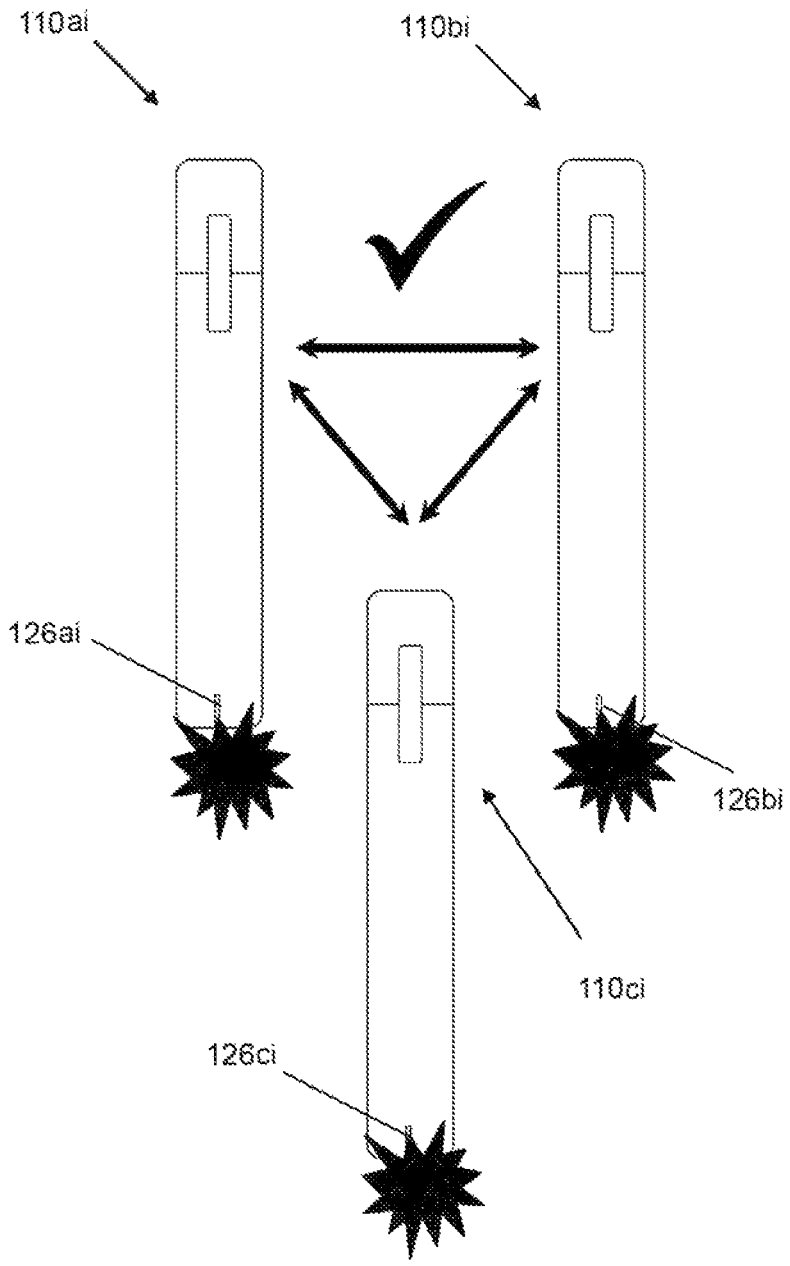
FIG. 45 shows an exemplary scenario of three smoking substitute devices of the ninth mode brought in each other's vicinity.

FIG. 45 shows an exemplary scenario of three smoking substitute devices brought in each other's vicinity. In FIG. 45, the three smoking substitute devices 110*ai, bi, ci* have now knowledge about each other's presence or are now in communicative connection, or at least have brought close enough so to detect the presence of each other, symbolized by the black check sign and the solid arrow lines between the smoking substitute device 110*ai, bi, ci*. This detection or communication may as well be realized by a processing unit connected thereto, like a processor, a control unit, a mobile device 2*i*, a smartphone or an application server 4*i*, not depicted in FIG. 45, associated with the respective smoking substitute device 110*ai, bi, ci*.

As an example of a dedicated function to be synchronized may be taken from FIG. 45 in that the illumination elements 126*ai, bi, ci* are lighting or glowing in a synchronized manner, as depicted by the black light flashes. The synchronization may be that the smoking substitute devices 110*ai,*

*bi, ci* are glowing in a similar or identical color, and/or that an intensity and/or frequency of glow may be synchronized. Other dedicated functions as described in accordance with the present disclosure may be realized alternatively or additionally.

Figure 46:
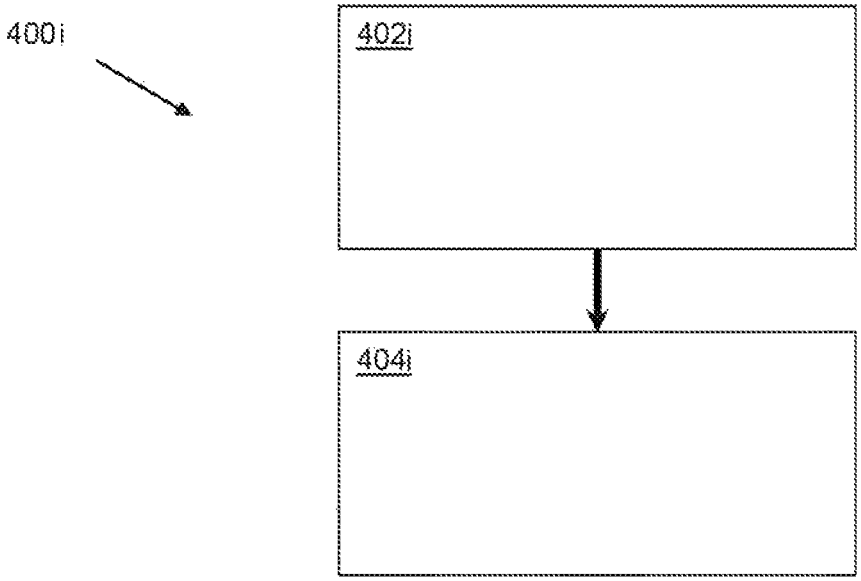
FIG. 46 shows an exemplary method of syncing at least two smoking substitute devices of the ninth mode.

FIG. 46 shows an exemplary method of syncing at least two smoking substitute devices. The method 400*i* comprises detecting 402*i*, by a processing unit 130*i*, 2*i*, 4*i* in communicative connection with a smoking substitute device, a presence of at least one further smoking substitute device, and syncing 404*i* a dedicated function of each smoking substitute device, when the presence of the at least one further smoking substitute device is detected.

The features disclosed in the foregoing description, or in the following claims, or in the accompanying drawings, expressed in their specific forms or in terms of a means for performing the disclosed function, or a method or process for obtaining the disclosed results, as appropriate, may, separately, or in any combination of such features, be utilized for realizing the disclosure in diverse forms thereof.

While the disclosure has been described in conjunction with the exemplary embodiments described above, many equivalent modifications and variations will be apparent to those skilled in the art when given this disclosure. Accordingly, the exemplary embodiments of the disclosure set forth above are considered to be illustrative and not limiting. Various changes to the described embodiments may be made without departing from the spirit and scope of the disclosure.

For the avoidance of any doubt, any theoretical explanations provided herein are provided for the purposes of improving the understanding of a reader. The inventors do not wish to be bound by any of these theoretical explanations.

Any section headings used herein are for organizational purposes only and are not to be construed as limiting the subject matter described.

Throughout this specification, including the claims which follow, unless the context requires otherwise, the word "comprise" and "include", and variations such as "comprises", "comprising", and "including" will be understood to imply the inclusion of a stated integer or step or group of integers or steps but not the exclusion of any other integer or step or group of integers or steps.

It must be noted that, as used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by the use of the antecedent "about," it will be understood that the particular value forms another embodiment. The term "about" in relation to a numerical value is optional and means for example +/−10%.

Tenth Mode: A Smoking Substitute Device, System and Method of Communicating.

Aspects and embodiments of the tenth mode of the present disclosure will now be discussed with reference to the accompanying figures. Further aspects and embodiments will be apparent to those skilled in the art. All documents mentioned in this text are incorporated herein by reference.

Figure 47:
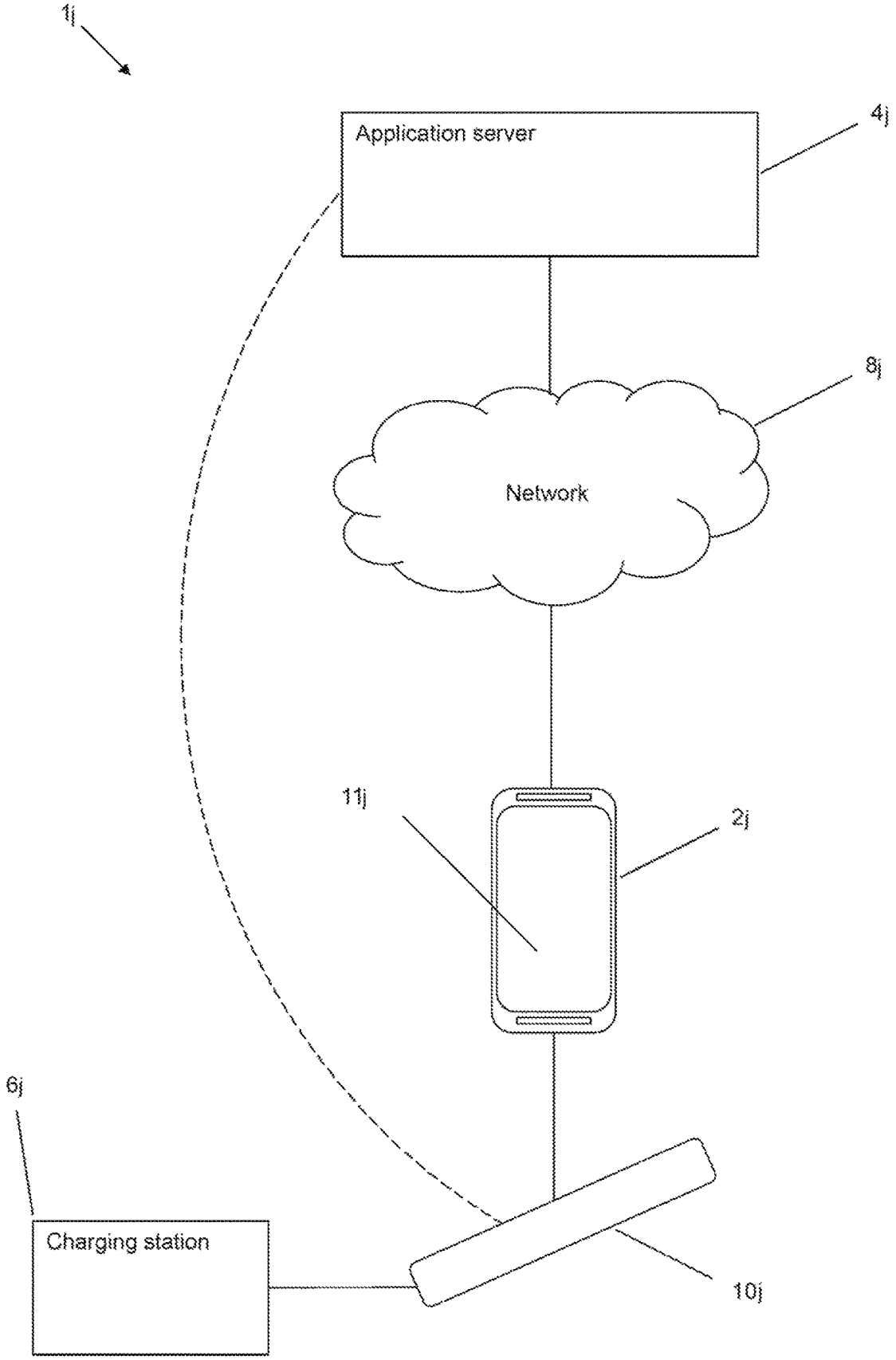
FIG. 47 shows an example system for managing a smoking substitute device of the tenth mode.

FIG. 47 shows an example system 1*j* for managing a smoking substitute device 10*j*.

The system 1*j* as shown in FIG. 47 includes a mobile device 2*j*, an application server 4*j*, an optional charging station 6*j*, as well as the smoking substitute device 10*j*.

The smoking substitute device 10*j* is configured to communicate wirelessly, e.g., via Bluetooth™, with an application (or "app") installed on the mobile device 2*j*, e.g., via a suitable wireless interface (not shown) on the mobile device 2*j*. The mobile device 2*j* may be a mobile phone, for example. The application on the mobile phone is configured to communicate with the application server 4*j*, via a network 8*j*. The application server 4*j* may utilize cloud storage, for example.

The network 8*j* may include a cellular network and/or the internet.

In other examples, the smoking substitute device 10*j* may be configured to communicate with the application server 4*j* via a connection that does not involve the mobile device 2*j*, e.g., via a narrowband internet of things ("NB-IoT") connection. In some examples, the mobile device 2*j* may be omitted from the system.

A skilled person would readily appreciate that the mobile device 2*j* may be configured to communicate via the network 8*j* according to various communication channels, preferably a wireless communication channel such as via a cellular network (e.g., according to a standard protocol, such as 3G or 4G) or via a WIFI network.

The app installed on the mobile device and the application server 4*j* may be configured to assist a user with their smoking substitute device 10*j*, based on information communicated between the smoking substitute device 10*j* and the app and/or information communicated between the app and the application server 4*j*.

The charging station 6*j* (if present) may be configured to charge (and optionally communicate with) the smoking substitute device 10*j*, via a charging port on the smoking substitute device 10*j*. The charging port on the smoking substitute device 10*j* may be a USB port, for example, which may allow the smoking substitute device to be charged by any USB-compatible device capable of delivering power to the smoking substitute device 10*j* via a suitable USB cable (in this case the USB-compatible device would be acting as the charging station 6*j*). Alternatively, the charging station could be a docking station specifically configured to dock with the smoking substitute device 10*j* and charge the smoking substitute device 10*j* via the charging port on the smoking substitute device 10*j*.

FIG. 47 also shows the communication setup according to an embodiment of the present disclosure. The smoking substitute device 10*j* is communicatively connected to mobile device 2*j*, as depicted by the line between the two devices. Mobile device 2*j* in turn is further communicatively connected to the application server 4*j*, via a network 8*j*, as depicted by the two lines between the mobile device 2*j*, the network 8*j* and the application server 4*j*. Thereby, a connection between the smoking substitute device 10*j* and the application server 4*j* may be established, as depicted by the dashed, bent line drawn between the smoking substitute device 10*j* and the application server 4*j*.

Data originating from the smoking substitute device 10*j* to the mobile device may comprise first data (encrypted data) or second data (non-encrypted data or differently encrypted data), or both. Second data may be used by the mobile device 2*j*, e.g., may be displayed on screen 11*j* of the mobile device, in particular may be displayed substantially immediately, further in particular at least may be displayed without requiring further substantive processing. In addition to the second data, the mobile device 2*j* may receive first data, in particular data encrypted by the smoking substitute device 10*j*. Such first data/encrypted data may then be forwarded to the application server 4*j*, for decryption and/or storage, and in particular for further processing, e.g., analysis. The processed or analyzed data may subsequently be stored on the application server 4*j* and/or may be transmitted back to the mobile device 2*j* for display on the screen 11*j*.

The data transmitted from the smoking substitute device 10*j* and received by the mobile device 2*j* may be both first data (encrypted data) and second data (non-encrypted or differently encrypted data). The second data may constitute at least a part or all of the first data. In other words, it may be conceivable that the smoking substitute device sends at least partly similar or identical data, in encrypted form and in non-encrypted/differently encrypted form, to the mobile device 2*j*. The mobile device 2*j* may thus use the non-encrypted/differently encrypted data stream itself, while transmitting the encrypted data stream to the application server 4*j* via network 8*j*. Thus, data redundancy may be provided. The similar or identical data, in encrypted form and in non-encrypted/differently encrypted form, may not necessarily be sent at the same time, but can be sent with a defined time difference, e.g., non-encrypted/differently encrypted data is sent by the smoking substitute device 10*j* to the mobile device 2*j* at a first time, while the data is collected and only subsequently, at a further point in time, e.g., when sufficient data has been collected, is encrypted and sent as encrypted data to the mobile device 2*j* for transmitting on to the application server 4*j*.

Figure 48A:
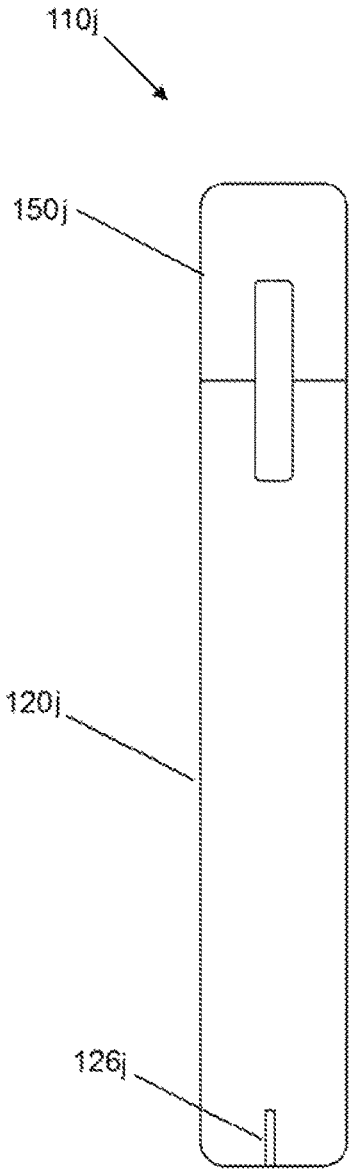
FIG. 48A shows an example smoking substitute device for use as the smoking substitute device in the system of FIG. 47.

FIG. 48A shows an example smoking substitute device 110*j* for use as the smoking substitute device 10*j* in the system 1*j* of FIG. 47.

In this example, the smoking substitute device 110*j* includes a main body 120*j* and a consumable 150*j*. The consumable 150*j* may alternatively be referred to as a "pod".

In this example, the smoking substitute device 110*j* is a closed system vaping device, wherein the consumable 150*j* includes a sealed tank 156*j* and is intended for one-use only.

FIG. 48A shows the smoking substitute device 110*j* with the main body 120*j* physically coupled to the consumable 150*j*.

FIG. 48A shows the main body 120*j* of the smoking substitute device 110*j* without the consumable 150*j*.

Figure 48B:
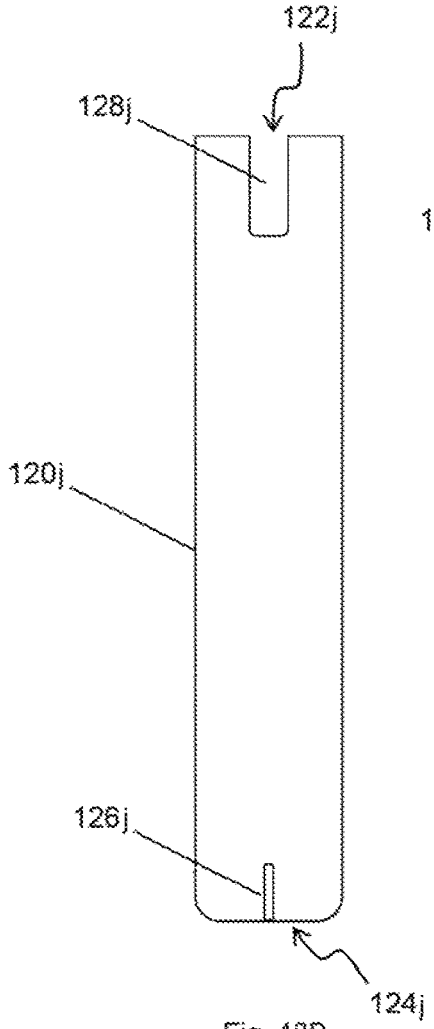
FIG. 48B shows the main body of the smoking substitute device of FIG. 48A without the consumable.
Figure 48C:
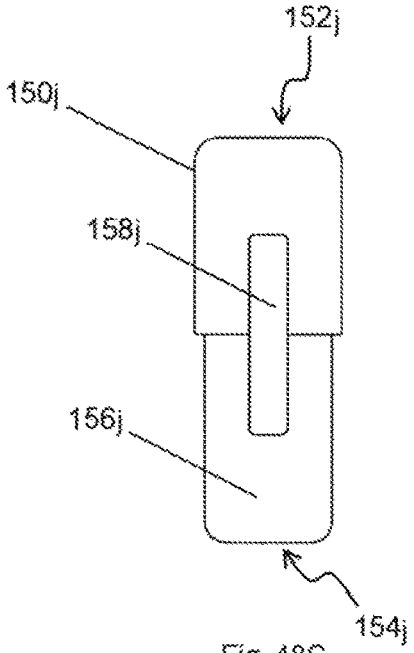
FIG. 48C shows the consumable of the smoking substitute device of FIG. 48A without the main body.

FIG. 48C shows the consumable 150*j* of the smoking substitute device 110*j* without the main body 120*j*.

The main body 120*j* and the consumable 150*j* are configured to be physically coupled together, in this example by pushing the consumable 150*j* into an aperture in a top end 122*j* of the main body 120*j*, e.g., with the consumable 150*j* being retained in the aperture via an interference fit. In other examples, the main body 120*j* and the consumable could be physically coupled together by screwing one onto the other, through a bayonet fitting, or through a snap engagement mechanism, for example. An optional light 126*j*, e.g., an LED located behind a small translucent cover, is located a bottom end 124*j* of the main body 120*j*. The light 126*j* may be configured to illuminate when the smoking substitute device 110*j* is activated.

The consumable 150*j* includes a mouthpiece (not shown) at a top end 152*j* of the consumable 150*j*, as well as one or more air inlets (not shown in FIG. 48) so that air can be drawn into the smoking substitute device 110*j* when a user inhales through the mouthpiece. At a bottom end 154*j* of the consumable 150*j*, there is located a tank 156*j* that contains e-liquid. The tank 156*j* may be a translucent body, for example.

The tank 156*j* preferably includes a window 158*j*, so that the amount of e-liquid in the tank 156*j* can be visually assessed. The main body 120*j* includes a slot 128*j* so that the window 158*j* of the consumable 150*j* can be seen whilst the rest of the tank 156*j* is obscured from view when the consumable 150*j* is inserted into the aperture in the top end 122*j* of the main body 120*j*.

In this present embodiment, the consumable 302*j* is a "single-use" consumable. That is, upon exhausting the e-liquid in the tank 156*j*, the intention is that the user disposes of the whole consumable 150*j*. In other embodiments, the e-liquid (i.e., aerosol former) may be the only part of the system that is truly "single-use". In such embodiments, the tank 156*j* may be refillable with e-liquid or the e-liquid may be stored in a non-consumable component of the system. For example, the e-liquid may be stored in a tank located in the device or stored in another component that is itself not single-use (e.g., a refillable tank).

The tank 156*j* may be referred to as a "clearomizer" if it includes a window 158*j*, or a "cartomizer" if it does not.

Figure 49A:
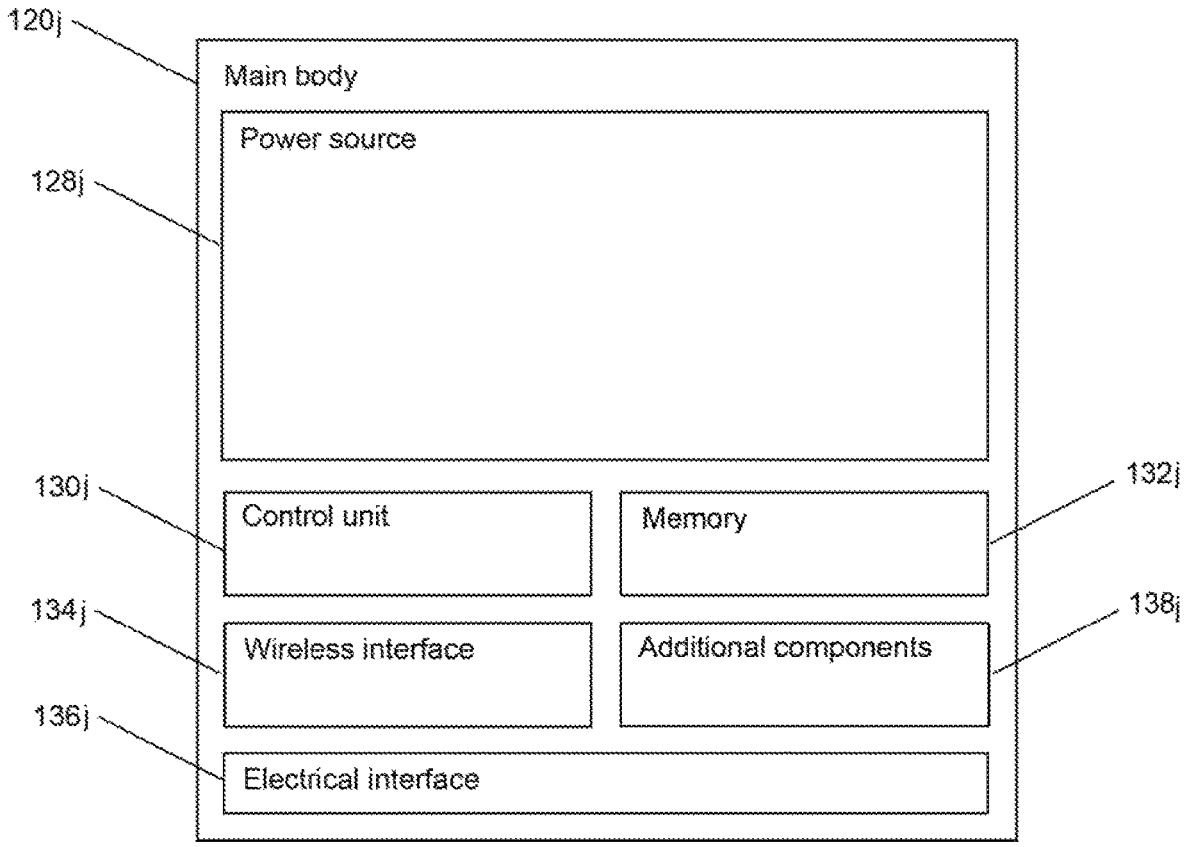
FIG. 49A is a schematic view of the main body of the smoking substitute device of FIG. 48A.

FIG. 49A is a schematic view of the main body 120*j* of the smoking substitute device 110*j*.

Figure 49B:
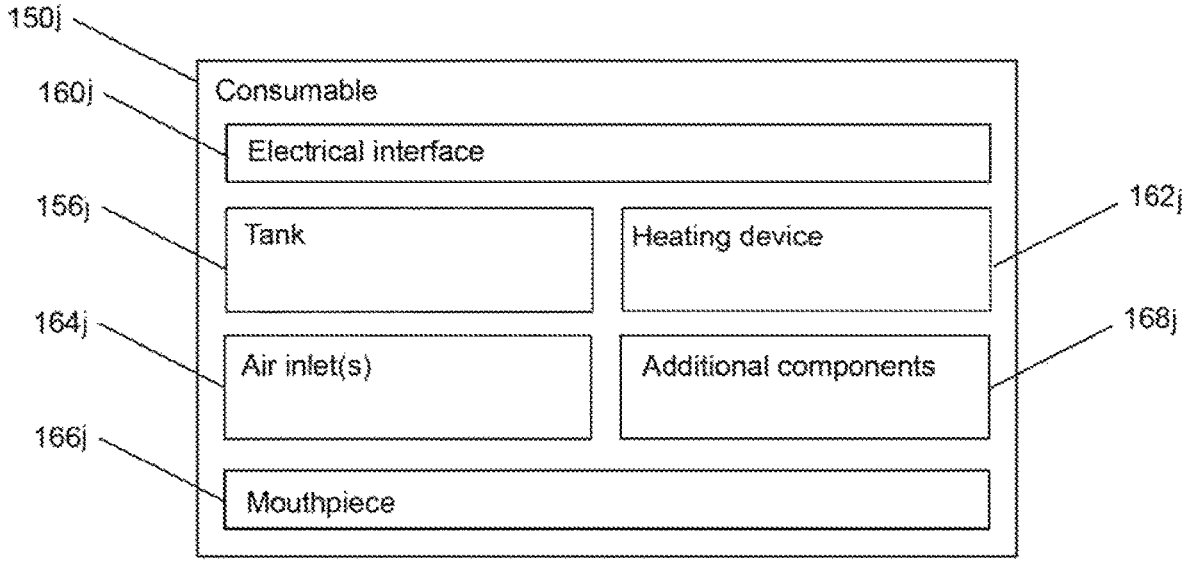
FIG. 49B is a schematic view of the consumable of the smoking substitute device of FIG. 48A.

FIG. 49B is a schematic view of the consumable 150*j* of the smoking substitute device 110*j*.

As shown in FIG. 49A, the main body 120*j* includes a power source 128*j*, a control unit 130*j*, a memory 132*j*, a wireless interface 134*j*, an electrical interface 136*j*, and, optionally, one or more additional components 138*j*.

The power source 128*j* is preferably a battery, more preferably a rechargeable battery.

The control unit 130*j* may include a microprocessor, for example.

The memory 132*j* is preferably includes non-volatile memory.

The wireless interface 134*j* is preferably configured to communicate wirelessly with the mobile device 2*j*, e.g., via Bluetooth. To this end, the wireless interface 134*j* could include a Bluetooth™ antenna. Other wireless communication interfaces, e.g., WIFI, are also possible.

The electrical interface 136*j* of the main body 120*j* may include one or more electrical supply contacts. The electrical interface 136*j* may be located in, and preferably at the bottom of, the aperture in the top end 122*j* of the main body 120*j*. When the main body 120*j* is physically coupled to the consumable 150*j*, the electrical interface 136*j* may be configured to pass electrical power from the power source 128*j* to (e.g., a heating device of) the consumable 150*j* when the smoking substitute device 110*j* is activated, e.g., via the electrical interface 160*j* of the consumable 150*j* (discussed below). When the main body 120*j* is not physically coupled to the consumable 150*j*, the electrical interface may be configured to receive power from the charging station 6*j*.

The additional components 138*j* of the main body 120*j* may include the optional light 126*j* discussed above.

The additional components 138*j* of the main body 120*j* may, if the power source 128*j* is a rechargeable battery, include a charging port configured to receive power from the charging station 6*j*. This may be located at the bottom end 124*j* of the main body 120*j*. Alternatively, the electrical interface 136*j* discussed above is configured to act as a charging port configured to receive power from the charging station 6*j* such that a separate charging port is not required.

The additional components 138*j* of the main body 120*j* may, if the power source 128*j* is a rechargeable battery, include a battery charging control circuit, for controlling the charging of the rechargeable battery. However, a battery charging control circuit could equally be located in the charging station 6*j* (if present).

The additional components 138*j* of the main body 120*j* may include an airflow sensor for detecting airflow in the smoking substitute device 110*j*, e.g., caused by a user inhaling through a mouthpiece 166*j* (discussed below) of the smoking substitute device 110*j*. The smoking substitute device 110*j* may be configured to be activated when airflow is detected by the airflow sensor. This optional sensor could alternatively be included in the consumable 150*j* (though this is less preferred where the consumable 150*j* is intended to be disposed of after use, as in this example).

The additional components 138*j* of the main body 120*j* may include an actuator, e.g., a button. The smoking substitute device 110*j* may be configured to be activated when the actuator is actuated. This provides an alternative to the airflow sensor noted, as a mechanism for activating the smoking substitute device 110*j*.

The additional components 138*j* of the main body 120*j* may include a reading device configured to read information associated with the consumable from a machine readable data source included in (e.g., contained in the body of, or attached to) the consumable 150*j*.

In some examples, the reading device (if present) may be configured to read information from the machine readable data source non-wirelessly, e.g., using an electrical connection between the main body 120*j* and consumable 150*j*.

For example, the reading device (if present) may include a set of one or more electrical communication contacts configured to read information from the machine readable data source via an electrical connection established between the set of one or more electrical communication contacts and the machine readable data source. Conveniently, the set of one or more electrical communication contacts of the reading device may be configured to provide the electrical connection by engaging with a set of one or more electrical communication contacts of the consumable 150*j*, when the main body 120*j* and the consumable 150*j* are physically coupled together.

In some examples, the reading device (if present) may be configured to read information from the machine readable data source wirelessly, e.g., via electromagnetic waves or optically. Thus, for example, the machine readable data source included in the consumable 150*j* could be an RFID tag (in which case the reading device included in the main body 120*j* may be an RFID reader) or a visual data source such as a barcode (in which case the reading device included in the main body may be an optical reader, e.g., a barcode scanner). Various wireless technologies and protocols may be employed to allow the reading device to wirelessly read information from a machine readable data source included in or attached to the consumable 150*j*, e.g., NFC, Bluetooth, Wi-Fi, as would be appreciated by a skilled person.

The reading device (if present) may be configured to write information associated with the consumable to the machine readable data source (e.g., wirelessly or non-wirelessly, via one of the mechanisms discussed above) in addition to being configured to read information associated with the consumable from the machine readable data source. In this case, the reading device may be referred to as a reading/writing device.

As shown in FIG. 49B, the consumable 150*j* includes the tank 156*j*, an electrical interface 160*j*, a heating device 162*j*, one or more air inlets 164*j*, a mouthpiece 166*j*, and, optionally, one or more additional components 168*j*.

The electrical interface 160*j* of the consumable 150*j* may include one or more electrical supply contacts. The electrical interface 136*j* of the main body 120*j* and an electrical interface 160*j* of the consumable 150*j* are preferably configured to contact each other and therefore electrically couple the main body 120*j* to the consumable 150*j* when the main body 120*j* is physically coupled to the consumable 150*j*. In this way, electrical energy (e.g., in the form of an electrical current) is able to be supplied from the power source 128*j* in the main body 120*j* to the heating device 162*j* in the consumable 150*j*.

The heating device 162*j* is preferably configured to heat e-liquid contained in the tank 156*j*, e.g., using electrical energy supplied from the power source 128*j*. In one example, the heating device 162*j* may include a heating filament and a wick, wherein a first portion of the wick extends into the tank 156*j* in order to draw e-liquid out from the tank 156*j*, and wherein the heating filament coils around a second portion of the wick located outside the tank 156*j*. In this example, the heating filament is configured to heat up e-liquid drawn out of the tank 156*j* by the wick to produce an aerosol vapor.

The one or more air inlets 164*j* are preferably configured to allow air to be drawn into the smoking substitute device 110*j*, when a user inhales through the mouthpiece 166*j*.

The additional components 168*j* of the consumable 150*j* may include a machine readable data source, which may, e.g., be contained in the body of, or attached to the consumable 150*j*. The machine readable data source may store information associated with the consumable. The information associated with the consumable may include information concerning the content of the consumable (e.g., e-liquid type, batch number) and/or a unique identifier, for example.

The machine readable data source may be rewritable, e.g., a rewritable RFID chip, or read only, e.g., a visual data source such as a barcode. As indicated above, the additional components 138*j* of the main body 120*j* may include a reading device configured to read information associated with the consumable from the machine readable data source.

For example, the electrical interface 160*j* of the consumable 150*j* may include a set of one or more electrical communication contacts, which may allow a reading device of the main body to read information from a machine readable data source of the consumable, e.g., as discussed previously.

In use, a user activates the smoking substitute device 110*j*, e.g., through actuating an actuator included in the main body 120*j* or by inhaling through the mouthpiece 166*j* as described above. Upon activation, the control unit 130*j* may supply electrical energy from the power source 128*j* to the heating device 162*j* (via electrical interfaces 136*j*, 166*j*), which may cause the heating device 162*j* to heat e-liquid drawn from the tank 156*j* to produce a vapor which is inhaled by a user through the mouthpiece 166*j*.

Of course, a skilled reader would readily appreciate that the smoking substitute device 110*j* shown in FIGS. 48 and 49 shows just one example implementation of a smoking substitute device, and that other forms of smoking substitute device could be used as the smoking substitute device 10*j* of FIG. 47.

By way of example, a HNB smoking substitute device including a main body and a consumable could be used as the smoking substitute device 10*j* of FIG. 47, instead of the smoking substitute device 110*j*. One such HNB smoking substitute device is the IQOS™ smoking substitute device discussed above.

As another example, an open system vaping device which includes a main body, a refillable tank, and a mouthpiece could be used as the smoking substitute device 10*j* of FIG. 47, instead of the smoking substitute device 110*j*. One such open system vaping device is the blu PRO™ e-cigarette discussed above.

As another example, an entirely disposable (one use) smoking substitute device could be used as the smoking substitute device 10*j* of FIG. 47, instead of the smoking substitute device 110*j*.

Figure 50:
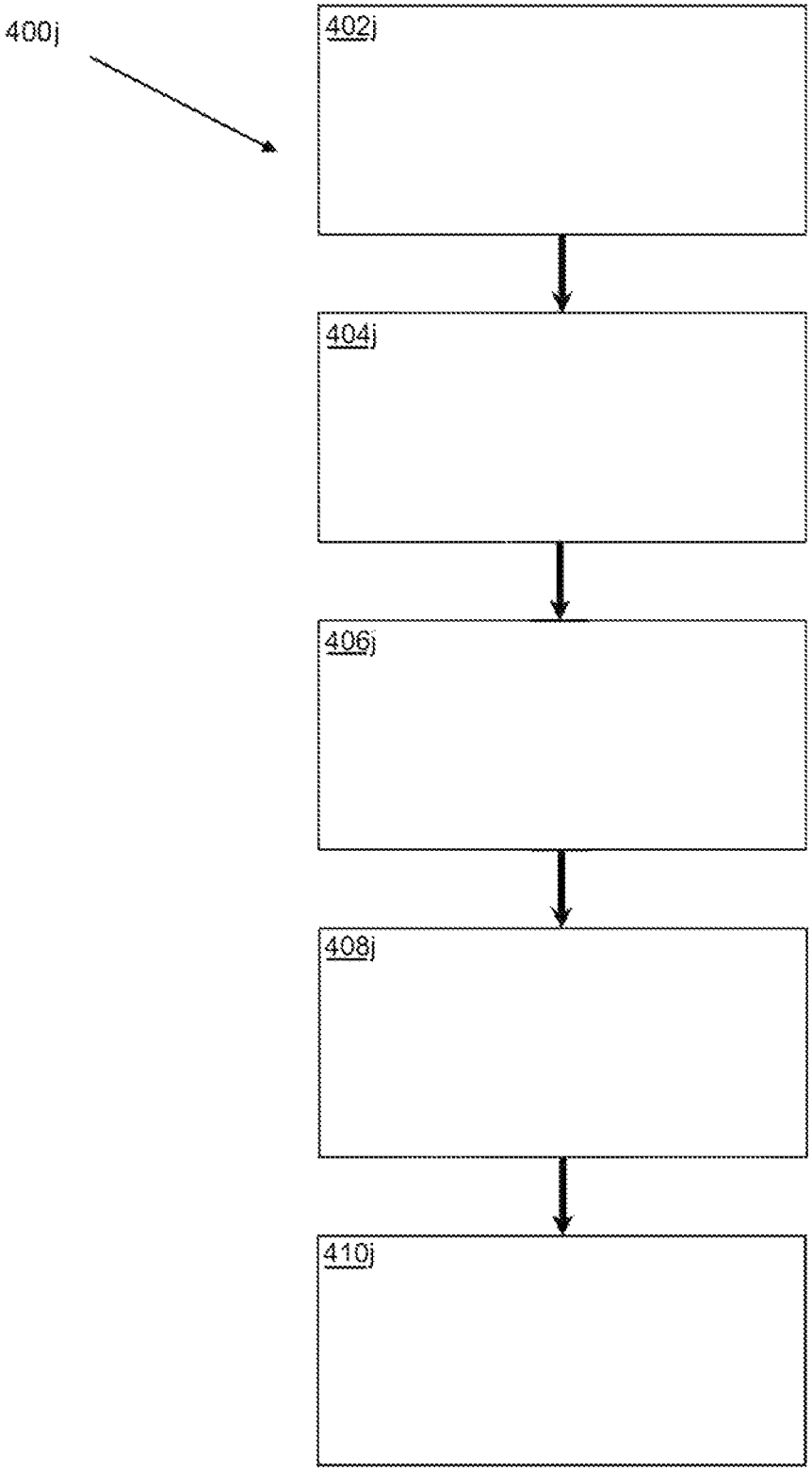
FIG. 50 is a flowchart diagram of a method of communicating of a smoking substitute device of the tenth mode and a mobile device.

Now referring to FIG. 50, where a flowchart diagram of a method of communicating of a smoking substitute device and a mobile device is depicted.

Depicted is a method 400*j* of communicating of a smoking substitute device 10*j*, 110*j* and a mobile device 2*j*, wherein the smoking substitute device is adapted to be connectable to the mobile device for communicating with the mobile device, comprising transmitting 402*j* first data, being of a first data type, from the smoking substitute device to the mobile device and transmitting 404 second data, being of a second data type different from the first data type, to the mobile device, wherein one of the first data and second data is encrypted data, and wherein the other one of the first data and second data is non-encrypted data. The method may further comprise communicating 406*j* with the application server via a network 8*j*, transmitting 408*j* at least part of the encrypted data to the application server and for processing by the application server, and transmitting 410*j* at least part of the processed data to the mobile device.

The features disclosed in the foregoing description, or in the following claims, or in the accompanying drawings, expressed in their specific forms or in terms of a means for performing the disclosed function, or a method or process for obtaining the disclosed results, as appropriate, may, separately, or in any combination of such features, be utilized for realizing the disclosure in diverse forms thereof.

While the disclosure has been described in conjunction with the exemplary embodiments described above, many equivalent modifications and variations will be apparent to those skilled in the art when given this disclosure. Accordingly, the exemplary embodiments of the disclosure set forth above are considered to be illustrative and not limiting. Various changes to the described embodiments may be made without departing from the spirit and scope of the disclosure.

For the avoidance of any doubt, any theoretical explanations provided herein are provided for the purposes of improving the understanding of a reader. The inventors do not wish to be bound by any of these theoretical explanations.

Any section headings used herein are for organizational purposes only and are not to be construed as limiting the subject matter described.

Throughout this specification, including the claims which follow, unless the context requires otherwise, the word "comprise" and "include", and variations such as "comprises", "comprising", and "including" will be understood to imply the inclusion of a stated integer or step or group of integers or steps but not the exclusion of any other integer or step or group of integers or steps.

It must be noted that, as used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by the use of the antecedent "about," it will be understood that the particular value forms another embodiment. The term "about" in relation to a numerical value is optional and means for example +/−10%.

ILLUSTRATIVE EMBODIMENTS

First Mode: A Smoking Substitute Device and Management of User Generated Data when the Smoking Substitute Device is Connected to an External Device.

The following statements, which form part of the description, provide general expressions of the disclosure herein:

A1. A smoking substitute device comprising a memory, a communication interface, a control unit and at least one additional component; wherein
- the memory is configured to store firmware data that is used by the control unit to operate the smoking substitute device;
- the memory is further configured to store user data that is generated during operation of the smoking substitute device;
- the control unit is operable to cause the communication interface to transmit user data stored in the memory to an external device;
- the control unit is configured to delete user data stored in the memory upon identification of a reset operation, wherein the reset operation is a predetermined manipulation of said additional component or receipt by the communication interface of a reset command from the external device.

A2. The smoking substitute device of statement A1, wherein the communication interface is a wireless interface and the control unit is configured to store details of the external device as a connected external device as user data in the memory.

A3. The smoking substitute device of any of statement A1, wherein an additional component is an actuator that is manipulated by a user pressing the actuator.

A4. The smoking substitute device of statement A1, wherein an additional component is a motion sensor that is activated by movement of the smoking substitute device.

A5. The smoking substitute device of statement A1, wherein the body houses a further additional component and the further additional component is an airflow sensor for detecting airflow through the body, wherein the control unit monitors the airflow sensor to determine an inhale event, wherein each inhale event is logged as user data to count a number of inhale events.

A6. The smoking substitute device of statement A1, wherein the smoking substitute device comprises a further additional component and the further additional component is an airflow sensor for detecting airflow through the body, wherein the control unit monitors the airflow sensor to determine an inhale event, wherein the duration of each inhale event is recorded as user data to record the inhale duration.

A7. The smoking substitute device of statement A1, wherein the smoking substitute device comprises a power source and control circuitry for controlling charging of the power source, and the control unit monitors the control circuitry to log or record as user data charge duration and/or charge status and/or voltage of the power source.

A8. The smoking substitute device of statement A1, wherein the control unit logs as user data an error count and/or a reset operation count.

A9. The smoking substitute device of statement A1, wherein the smoking substitute device comprises body including a coupling portion arranged to receive a consumable and the control unit logs as user data a count of inserted consumables and/or records as user data details read from each inserted consumable.

A10. The smoking substitute device of statement A1, wherein the control unit is configured to identify user data as either user specific data or global device data and to record both in the memory as user data and wherein the control unit is configured to delete the user specific data upon identification of a reset operation.

A11. The smoking substitute device of statement A10, wherein global device data is a count of user data over a time period equal to the lifetime operation of the smoking substitute device.

A12. The smoking substitute device of statement A10 or A11, wherein user specific data is a count of user data over a time period of operation of the smoking substitute device since a first operation or, if a reset operation has been completed, since the reset operation.

A13. A method of managing a smoking substitute device, the method comprising the steps of;

storing user data generated during operation of the smoking substitute device in a memory, causing a communication interface to transmit user data stored in the memory to an external device, deleting user data from the memory upon identification of a reset operation input, wherein the step of deleting user data includes at least one of identifying a user manipulation of an additional component as replicating a predetermined user manipulation of the additional component or receiving at the communication interface a reset command.

A14. The method of statement A15, wherein the method includes identifying user data as either user specific data or global device data before storing the data in the memory as user data and deleting the user specific data from the memory upon identifying the reset operation input.

A15. A computer implemented method for controlling a smoking substitute device to execute the method of statement A13 or a computer-readable medium containing computer-readable instructions which, when executed by a processor, cause the processor to perform the method of statement A13.

Second Mode: A Smoking Substitute Device and Management of Firmware Updates when the Smoking Substitute Device is Connected to an External Device.

The following statements, which form part of the description, provide general expressions of the disclosure herein:

B1. A smoking substitute device comprising:

a memory component storing firmware that is used to control operations of the smoking substitute device;

a communication interface component to receive data from an external device;

a control unit component that executes the firmware to control the memory and communication interface; and an aerosol assembly component to produce an aerosol; wherein the communication interface is configured to receive a disable command from the external device and upon receiving the disable command the control unit disables operation of the aerosol assembly component; and the communication interface is configured to subsequently receive data comprising an updated firmware and the control is configured to continue to disable operation of the aerosol assembly component until the data comprising an updated firmware is stored in the memory.

B2. The smoking substitute device of statement B1, wherein the aerosol assembly component includes a heating unit and the control unit disables the aerosol assembly component by preventing power from being provided to the heating unit.

B3. The smoking substitute device of statement B1, wherein the aerosol assembly component includes a heating unit and an additional component to activate the heating unit and the control unit disables the aerosol assembly component by preventing power from being provided to the additional component.

B4. The smoking substitute device of statement B3, wherein the additional component is a switch.

B5. The smoking substitute device of statement B3, wherein the additional component is an airflow sensor.

B6. The smoking substitute device of statement B1, wherein the aerosol assembly component includes a consumable that couples with a coupling portion that includes an electrical interface for electrically connecting the consumable, wherein the control unit disables the aerosol assembly component by preventing power from being provided to the electrical interface.

B7. The smoking substitute device of statement B1, wherein the communication interface is a wireless interface.

B8. A system including a smoking substitute device of statement B1 and an external device, wherein the external device receives data comprising an updated firmware from a remote server and upon receiving the updated firmware, the external device transmits a disable command to the connected smoking substitute device and subsequently transmits the data comprising an updated firmware to the substitute smoking device.

B9. A method of managing a smoking substitute device, the method comprising the steps of:

receiving a disable command;

disabling operation of an aerosol assembly component upon receiving the disable command;

receiving data corresponding to an updated firmware and storing the data in memory of the smoking substitute device; and re-enabling operation of the aerosol assembly component after the data corresponding to the updated firmware is stored in the memory.

B10. A method of managing a system comprising a smoking substitute device and an external device, wherein the method comprises the steps of:

receiving from a remote server an updated firmware;

after receiving the updated firmware transmitting a disable command to the smoking substitute device; and after transmitting the disable command, transmitting data corresponding to the updated firmware to the smoking substitute device.

B11. The method of statement B10, wherein the method comprises the step of verifying the updated firmware is compatible with the smoking substitute device prior to transmitting the disable command.

B12. The method of statement B10, wherein the method comprises the step of seeking a user input command prior to transmitting the updated firmware.

B13. The method of statement B10 wherein the method includes a step of identifying the updated firmware as non-critical and transmitting the disable command only if the updated firmware is identified as critical.

B14. A computer implemented method for controlling a smoking substitute device to execute the method of statement B9 or statement B10 or a computer-readable medium containing computer-readable instructions which, when executed by a processor, cause the processor to perform the method of statement B9 or statement B10.

Third Mode: A Smoking Substitute Device and Management of Firmware Updates when the Smoking Substitute Device is Connected to an External Device.

The following statements, which form part of the description, provide general expressions of the disclosure herein:

C1. A smoking substitute device operable in a first mode and a second mode, wherein; in the first mode the smoking substitute device is operable with a first function enabled; and in the second mode the smoking substitute device is operable with the first function disabled; the smoking substitute device including:

a control unit to enable and disable said first function when switching operation between the first mode and the second mode respectively; and a locator device to determine a location of the smoking substitute device; wherein the control unit is configured to operate in the first mode when the locator determines the smoking substitute device is located in a first region and to operate in the second mode when the locator determines the smoking substitute device is located in a second, different region C2. The smoking substitute device of statement C1, wherein;

the smoking substitute device includes an aerosol assembly for producing an aerosol;

the first function comprises an operating function of the aerosol assembly;

in the first mode, the operating function of the aerosol assembly is enabled so that when a user initiates a puff operation, the aerosol assembly produces an aerosol; and in the second mode, the operating function of the aerosol assembly is disabled so that when a user initiates a puff operation, the aerosol assembly is prevented from producing an aerosol.

C3. The smoking substitute device of statement C2, wherein the smoking substitute device includes;

a body having a coupling portion arranged to receive a first type of consumable and a second type of consumable;

a reading device configured to read the consumable and determine whether a consumable coupled to the coupling portion is a first type or a second type; and the operating function of the aerosol assembly is an operating function when it is determined that a second type of consumable is coupled to the coupling portion such that in the first mode, the aerosol assembly is enabled when a second type of consumable is connected and a user initiates a puff operation and in the second mode the aerosol assembly is disabled when a second type of consumable is connected and a user initiates a puff operation.

C4. The smoking substitute device of statement C2, wherein;

the control unit is configured to determine an age verification process of the user and to determine whether a user is above a first age or above a second age that is older than the first age;

the operating function of the aerosol assembly is not enabled in either mode if the control unit determines the user is not above the first age;

the operating function of the aerosol assembly is enabled in the first mode if the control unit determines the user is above the first age;

the operating function of the aerosol assembly is disabled in the second mode if the control unit determines the user is not also above the second age.

C5. The smoking substitute device of statement C2, wherein the aerosol assembly includes a heating unit and the control unit disables the aerosol assembly by preventing power from being provided to the heating unit.

C6. The smoking substitute device of statement C2, wherein the aerosol assembly component includes a heating unit and an additional component to activate the heating unit and the control unit disables the aerosol assembly component by preventing power from being provided to the additional component.

C7. The smoking substitute device of statement C6, wherein the additional component is a switch.

C8. The smoking substitute device of statement C6, wherein the additional component is an airflow sensor.

C9. The smoking substitute device of statement C3, wherein the coupling portion includes an electrical interface for electrically connecting the consumable, wherein the control unit disables the aerosol assembly by preventing power from being provided to the electrical interface.

C10. The smoking substitute device of statement C1, wherein the smoking substitute device includes a memory and the memory is configured to store user data that is generated during operation of the smoking substitute device, and the first function is the storing of user data such that in the first mode user data is stored in the memory and in the second mode user data is not stored in the memory.

C11. The smoking substitute device of statement C1 wherein the smoking substitute device is operable in further modes and in each further mode a further function or combination of functions are enabled and disabled between modes.

C12. A system including the smoking substitute device of statement C1 and an external device, wherein the smoking substitute device includes a wireless communication interface for connecting to the external device and the locator device comprises determining the location of the smoking substitute device as the location of the external device.

C13. A method of managing a smoking substitute device comprising the steps of:

determining a location of the smoking substitute device;

determining whether a first operating mode or a second operating mode is associated with the location; and controlling the smoking substitute device to operate in the first mode or the second mode based on the determined operating mode wherein in the first mode a first function is enabled and in the second mode the first function is disabled.

C14. A method of managing a system comprising a smoking substitute device and an external device comprising the steps of statement C13, wherein the step of determining a location of the smoking substitute device comprises using a locator of the external device to determine the location of the external device and to use the location of the external device as the location of the smoking substitute device.

C15. A computer implemented method for controlling a smoking substitute device to execute the method of statement C13 or statement C14 or a computer-readable medium containing computer-readable instructions which, when executed by a processor, cause the processor to perform the method of statement C13 or statement C14.

Fourth Mode: A Smoking Substitute Device and Connectivity of a Smoking Substitute Device to an External Device.

The following statements, which form part of the description, provide general expressions of the disclosure herein:

D1. A smoking substitute device comprising:
a wireless interface,
a charging port, and
a connection port for electrical connection to an external device.

D2. A smoking substitute device according to statement D1, wherein the connection port is a serial port.

D3. A smoking substitute device according to any preceding statement, wherein the connection port is a UART interface.

D4. A smoking substitute device according to any preceding statement, wherein the connection port comprises one or more electrical contacts accessible outside of the smoking substitute device.

D5. A smoking substitute device according to statement D4, wherein the electrical contact(s) are exposed outside of the smoking substitute device.

D6. A smoking substitute device according to statement D4, wherein the electrical contact(s) are positioned beneath a removable cap, such that when the cap is removed, the electrical contact(s) are exposed outside of the smoking substitute device.

D7. A smoking substitute device according to any preceding statement, wherein the smoking substitute device is configured to receive age verification data via the connection port and switch between a locked and unlocked status based on the data received.

D8. A smoking substitute device according to statement D7 wherein locking the device comprises preventing a heater in the device from activating.

D9. A smoking substitute device according to statement D7 or D8, wherein when an age verification success signal has not been received via the connection port for the duration of a time window, the smoking substitute device is configured to lock the device.

D10. A smoking substitute device according to statement D9, wherein the time window is a predetermined time since the device received an age verification success signal, or a predetermined time since the device was turned on, or a time over which a predetermined number of inhales is taken, or a time fora predetermined number of charge cycles to be initiated.

D11. A smoking substitute device according to statement D9 or D10, wherein, when the device is turned on for the first time, the time window is the shortest of (a) a predetermined time since the device was turned on, (b) a time over which a predetermined number of inhales is taken, and (c) a time for a predetermined number of charge cycles to be initiated.

D12. A smoking substitute device according to any preceding statement, wherein the wireless interface comprises a Bluetooth™ antenna and the smoking substitute device is configured to receive Bluetooth™ test commands via the connection port and to control the Bluetooth™ antenna based on the Bluetooth™ test commands.

D13. A system for managing a smoking substitute device comprising the smoking substitute device of any preceding statement and an external device connectable to the connection port of the smoking substitute device.

D14. A system according to statement D13, wherein the external device is an age verification device.

D15. A system according to statement D13, wherein the external device is a Bluetooth™ certification device.

Fifth Mode: A Smoking Substitute Device and Management of the Smoking Substitute Device to Assist a User in Locating the Device.

The following statements, which form part of the description, provide general expressions of the disclosure herein:

E1. A smoking substitute device comprising:
a wireless communication interface for wirelessly communicating with an external device;
an alert device for issuing an alert;
a motion sensor for sensing motion of the smoking substitute device and
a control unit for controlling the alert device to be activated between a first event trigger and a second event trigger; wherein
the control unit is configured to determine the first event trigger as the wireless communication interface receiving an issue alert command from the external device; and
the control unit is configured to determine the second event trigger as the motion sensor detecting movement of the smoking substitute device corresponding to a predetermined movement.

E2. The smoking substitute device of statement E1, wherein the motion sensor is an accelerometer.

E3. The smoking substitute device of statement E1, wherein the alert device activates continuously between the first event trigger and the second event trigger.

E4. The smoking substitute device of statement E1, wherein the alert device activates periodically between the first event trigger and the second event trigger.

E5. The smoking substitute device of statement E1, wherein the alert device is a speaker.

E6. The smoking substitute device of statement E1, wherein the alert device is a light emitter.

E7. The smoking substitute device of Statement E1, wherein the alert device is a haptic vibrator.

E8. The smoking substitute device of Statement E1, wherein the predetermined movement replicates a lifting or picking up of the smoking substitute device.

E9. The smoking substitute device of statement E1, wherein the wireless communication interface establishes a short distance wireless link.

E10. The smoking substitute device of statement E1, wherein the control unit is configured to send a found command to the external device upon detection of the second trigger event.

E11. A system comprising the smoking substitute device of statement E1 and an external device, wherein the external device is configured to establish a wireless communication link with the smoking substitute device and to transmit an alert command to the smoking substitute device.

E12. The system of statement E11 wherein the external device is configured to verify whether the wireless communication link is established and if a link is not established to issue an error message.

E13. A method of managing a smoking substitute device comprising the steps of;

activating an alert unit to issue an alert upon a control unit identifying a first event trigger;

detecting a predetermined movement of the smoking substitute device as a second event trigger; and deactivating the alert unit automatically upon detection of the second event trigger.

E14. The method of statement E13, wherein the method includes the step of a user lifting the smoking substitute device subsequent to the step of activating an alert, wherein the control unit is configured to recognize the lifting motion as the second event trigger.

E15. A computer implemented method for controlling a smoking substitute device to execute the method of statement E13 or a computer-readable medium containing computer-readable instructions which, when executed by a processor, cause the processor to perform the method of statement E13.

Sixth Mode: A Smoking Substitute Device and Management of the Smoking Substitute Device when Wirelessly Connected to an External Device.

The following statements, which form part of the description, provide general expressions of the disclosure herein:

F1. A smoking substitute device comprising a wireless communication interface, a control unit, and a puff sensor arrangement; wherein the wireless communication interface is configured to form a wireless connection with an external device for transmitting and receiving data between the devices;

the control unit is configured to switch the wireless communication interface between an active mode and a deactivated mode;

the puff sensor is arranged to sense a puff operation of the smoking substitute device; and the control unit switches the wireless communication interface to the deactivated mode on detecting a deactivate communication action and automatically switches the wireless communication interface to the active mode when the puff sensor senses a puff operation.

F2. The smoking substitute device of statement F1, wherein the wireless communication interface is configured to receive a deactivate communication command and the control unit is configured to detect the receipt of the deactivate communication command as the deactivate communication action to switch the wireless communication interface to the deactivated mode.

F3. The smoking substitute device of statement F1, wherein the smoking substitute device is configured to sense a user manipulation and the control unit is configured to detect the user manipulation as a predetermined manipulation corresponding to the deactivate communication action as an input to switch the wireless communication interface to the deactivated mode.

F4. The smoking substitute device of statement F1, wherein the puff sensor comprises an airflow sensor and the control unit is configured to determine a change in airflow as a puff operation.

F5. The smoking substitute device of statement F1, wherein the puff sensor comprises an actuator for activating a heating unit and the control unit is configured to determine activation of the actuator as a puff operation.

F6. The smoking substitute device according to statement F1, wherein the control unit is configured to also switch the wireless communication interface to the active mode upon receiving a reactivate command at the wireless communication interface.

F7. The smoking substitute device according to statement F1, wherein the smoking substitute device includes an additional component for generating a visual or audible or haptic signal to the user and the control unit is configured to control the additional component to generate said signal when switching the wireless communication interface to the active mode.

F8. The smoking substitute device according to statement F1, wherein the smoking substitute device includes an additional component for generating a visual or audible or haptic signal to the user and the control unit is configured to control the additional component to generate said signal when switching the wireless communication interface to the deactivated mode.

F9. A system including the smoking substitute device of statement F1 and an external device, wherein the external device provides a user input to allow a user to input a command to control the smoking substitute device to enter a wireless communication deactivated mode.

F10. The system of statement F9, wherein the external device provides a second user input to allow a user to input an additional command to control the smoking substitute device to enter a wireless communication active mode F11. A method of managing a smoking substitute device comprising the steps of:

detecting a deactivate communication action and controlling the smoking substitute device to enter a deactivated mode wherein a wireless communication interface of the smoking substitute device is prevented from transmitting wireless signals;

sensing a puff operation; and automatically switching the wireless communication interface to an active mode.

F12. The method of statement F11, wherein the step of detecting the deactivate communication action comprises receiving a deactivate command at the wireless communication interface.

F13. The method of statement F11, wherein the step of r detecting the deactivate communication action comprises a user operation to manipulate the smoking substitute device in a predetermined action.

F14. A method of managing a system comprising prior to completing the method of statement F11, causing an external device to transmit a deactivate communication command to the smoking substitute device.

F15. A computer implemented method for controlling a smoking substitute device to execute the method of statement F13 or a computer-readable medium containing computer-readable instructions which, when executed by a processor, cause the processor to perform the method of statement F13

Seventh Mode: A Smoking Substitute Device and Providing Notifications on a Smoking Substitute Device and a Connected Mobile Device.

The following statements, which form part of the description, provide general expressions of the disclosure herein:

G1. A system comprising a smoking substitute device and a mobile device, the smoking substitute device being connected to a mobile device, and the system being configured to perform a first notification on the smoking substitute device and simultaneously perform a second notification on the mobile device, wherein the second notification corresponds the first notification.

G2. A system according to statement G1 wherein the system is configured to perform the first and second notifications when a connecting process between the smoking substitute device and the mobile device has completed successfully.

G3. A system according to any preceding statement, wherein the first notification comprises a visual notification.

G4. A system according to statement G3, wherein the first notification comprises activation of a light on the smoking substitute device.

G5. A system according to statement G4, wherein activation of the light comprises flashing the light in a pattern.

G6. A system according to any preceding statement wherein the second notification is a visual notification.

G7. A system according to statement G6, wherein the mobile device is configured to display an image representing the smoking substitute device and the second notification comprises a representation of the first notification on the image.

G8. A system according to statement G7 and any of statements G4 or G5, wherein a representation of the light on the image shows the same color and/or the same pattern as the light on the smoking substitute device to perform the second notification.

G9. A system according to any preceding statement wherein the first notification comprises a haptic notification.

G10. A system according to statement G9 wherein the second notification comprises a visual notification indicative of vibration, and/or the second notification comprises a haptic notification on the mobile device.

G11. A method of managing a smoking substitute device, the smoking substitute device being connected to a mobile device, the method comprising: providing a first notification on the smoking substitute device and simultaneously providing a second notification corresponding to the first notification on the mobile device.

G12. A method according to statement G11, wherein the first and second notifications are performed when a connecting process between the smoking substitute device and the mobile device has completed successfully.

G13. A method according to any of statements G11 or G12, wherein the first notification comprises a visual notification.

G14. A method according to statement G13, wherein the mobile device is configured to display an image representing the smoking substitute device and the second notification comprises a representation of the first notification on the image.

G15. A smoking substitute device, the smoking substitute device being configured to, when connected with a mobile device, either:

(i) perform a first notification and send a signal to the mobile device configured to cause a corresponding second notification to occur on the mobile device simultaneously to the first notification, or (ii) receive a signal from the mobile device indicative of the mobile device performing the second notification and perform the corresponding first notification simultaneously to the second notification.

Eighth Mode: A Smoking Substitute Device and a Method of Communicating Usage of a Smoking Substitute Device to a User.

The following statements, which form part of the description, provide general expressions of the disclosure herein:

H1. A smoking substitute device, comprising a sensor element adapted to detect usage of the smoking substitute device by the user, and at least one signaling element adapted to provide a signal to a user, wherein the signaling element is adapted to provide the signal to the user after a defined non-use time period of the smoking substitute device.

H2. The smoking substitute device according to the preceding statement, wherein the signaling element is at least one of a visual signaling element, a haptic signaling element and an acoustic signaling element.

H3. The smoking substitute device according to at least one of the preceding statements, wherein the signaling element is an illumination element adapted to provide a visual signal to the user.

H4. The smoking substitute device according to at least one of the preceding statements, wherein the sensor element is an element out of the group consisting of an accelerator sensor element, a puff sensor element, a consumable detection sensor element, and an input sensor element, in particular a user input sensor element.

H5. The smoking substitute device according to at least one of the preceding statements, wherein the signal is provided to the user dependent on the defined non-use time period and a current time.

H6. The smoking substitute device according to the preceding statement, wherein the provided signal is dependent on the current time and/or the length of the non-use time period.

H7. The smoking substitute device according to at least one of the preceding statements, wherein a mobile device is communicatively connectable to the smoking substitute device to detect usage of the smoking substitute device and/or to control the smoking substitute device to provide the signal to the user, and/or to provide a signal to the user.

H8. A smoking substitute system, comprising a smoking substitute device according to at least one of the preceding statements, and a mobile device.

H9. A method of communicating usage of a smoking substitute device to a user, comprising detecting usage of the smoking substitute device by the user, and providing a signal after a defined non-use time period of the smoking substitute device to the user.

H10. The method according to the preceding statement, wherein the detecting the usage comprises detecting an accelerator, a puff, a consumable status change and a user input.

H11. The method according to at least one of the preceding statements, wherein providing the signal to the user is providing a visual signal.

H12. The method according to at least one of the preceding statements, wherein providing the signal to the user is dependent on the defined non-use time period and a current time.

H13. The method according to the preceding statement, wherein providing the signal is dependent on the current time and/or the length of the non-use time period.

Nineth Mode: A Smoking Substitute Device, a Smoking Substitute System and a Method of Syncing at Least Two Smoking Substitute Devices.

The following statements, which form part of the description, provide general expressions of the disclosure herein:

I1. A smoking substitute system, comprising
a smoking substitute device, and
a processing unit in communicative connection with the smoking substitute device and adapted to detect a presence of at least one further smoking substitute device,
wherein, when the presence of the at least one further smoking substitute device is detected, a dedicated function of each smoking substitute device is syncable.

I2. The smoking substitute system according to the preceding statement, wherein detecting a presence comprises communicating with the least one further smoking substitute device.

I3. The smoking substitute system according to at least one of the preceding statements, wherein the presence of the at least one further smoking substitute device is detected either directly or via at least one further processing unit in communicative connection with the at least one further smoking substitute device.

I4. The smoking substitute system according to the preceding statement, wherein the dedicated function is at least one function out of the group consisting of a visual function, an illumination function, an audible function, an acoustic function, a haptic function, a puff function, a puff intensity function, a puff duration function, an activation function, a lock function and a deactivation function.

I5. The smoking substitute system according to at least one of the preceding statements, further comprising
at least one illumination element,
wherein the illumination element of the smoking substitute device is synced with a respective illumination element of the at least one further smoking substitute device when the presence of the least one further smoking substitute device has been detected.

I6. The smoking substitute system according to the preceding statement, wherein the illumination element of the smoking substitute device and the illumination element of the at least one further smoking substitute device are synced such that the illumination elements illuminate is a similar color and/or pulse with a similar frequency, in particular have synced minima and maxima of pulsation.

I7. The smoking substitute system according to at least one of the preceding statements, wherein the presence of the at least one further smoking substitute device is detected substantially without a user interaction.

I8. The smoking substitute system according to at least one of the preceding statements, wherein the presence of the at least one further smoking substitute device is detected by receiving a beacon signal sent from the at least one further smoking substitute device and/or the processing unit of the at least one further smoking substitute device, in particular by receiving a Bluetooth beacon or Bluetooth low energy beacon.

I9. The smoking substitute system according to the preceding statement, wherein when a beacon signal is received, the receiving smoking substitute device and/or the processing unit is sending a synced beacon signal, so that further smoking substitute devices are syncable by receiving the sent synced beacon, in particular wherein the beacon is adaptable for transmitting at least one synchronization parameter.

I10. The smoking substitute system according to the preceding statement, wherein the at least one synchronization parameter comprises information about a function to be synchronized and/or information about the configuration of the synchronization.

I11. The smoking substitute system according to at least one of the preceding statements, wherein the presence of the at least one further smoking substitute device is detected by determining a current location of the smoking substitute device relative to a current location of the at least one further the smoking substitute device or by receiving information about an absolute position of the at least one further smoking substitute device.

I12. The smoking substitute system according to at least one of the preceding statements, wherein the processing unit is one of a control unit of a smoking substitute device; a mobile device in communicative connection with a smoking substitute device; and an application server in communicative connection with a smoking substitute device and/or a mobile device in communicative connection with a smoking substitute device.

I13. A method of syncing at least two smoking substitute devices, comprising
detecting, by a processing unit in communicative connection with a smoking substitute device, a presence of at least one further smoking substitute device, and
syncing a dedicated function of each smoking substitute device, when the presence of the at least one further smoking substitute device is detected.

I14. The method of the preceding statement, wherein the presence of the at least one further smoking substitute device is detected either directly or via at least one further processing unit in communicative connection with the at least one further smoking substitute device.

I15. The method according to at least one of the preceding statements,
wherein the presence of the at least one further smoking substitute device is detected by receiving a beacon signal sent from the at least one further smoking substitute device and/or the processing unit of the at least one further smoking substitute device, in particular by receiving a Bluetooth beacon or Bluetooth low energy beacon, and/or
wherein the presence of the at least one further smoking substitute device is detected by determining a current location of the smoking substitute device relative to a current location of the at least one further the smoking substitute device or by receiving information about an absolute position of the at least one further smoking substitute device.

Tenth Mode: A Smoking Substitute Device, System and Method of Communicating.

The following statements, which form part of the description, provide general expressions of the disclosure herein:

J1. A smoking substitute device, comprising
a wireless interface,
wherein the wireless interface is adapted to be connectable to a mobile device for communicating with the mobile device;
wherein the smoking substitute device is adapted to transmit first data to the mobile device;

wherein the smoking substitute device is adapted to transmit second data to the mobile device;

wherein the first data comprises encrypted data; and wherein the second data comprises at least one of non-encrypted data, and encrypted data that is encrypted differently than the first data.

J2. The smoking substitute device according to the preceding statement, wherein the first data is non-real time data; and wherein the second data is real time data.

J3. The smoking substitute device according to at least one of the preceding statements, wherein the mobile device is adapted to be connectable to an application server for communicating with the application server via a network; wherein at least part of the first data is transmitted to the application server and is processed by the application server; in particular wherein at least part of the processed data is transmitted to the mobile device.

J4. The smoking substitute device according to the preceding statement, wherein the smoking substitute device is adapted to communicate with the application server via the mobile device, in particular adapted to directly communicate with the application server via the mobile device.

J5. The smoking substitute device according to at least one of the preceding statements, wherein the first data is of a first data type; and wherein the second data is at least partly of a second data type different from the first data type.

J6. The smoking substitute device according to at least one of the preceding statements, wherein the first data and the second data is of a data type of the group consisting of status data, usage data, consumption data, error data, puff count data, nicotine consumption data, pod count data, fill level data of a consumable, power source level data, lock status data, consumable supply data, sensor data, device identification data and user identification data.

J7. The smoking substitute device according to at least one of the preceding statements, wherein at least part of the second data is processed by the mobile device, in particular at least one of status data, usage data, consumption data, error data, puff count data, pod count data, fill level data of a consumable, power source level data and lock status data, further in particular power source level data and puff count data.

J8. The smoking substitute device according to at least one of the preceding statements, wherein processing data by the mobile device comprises decryption of encrypted data by the mobile device, and/or wherein processing data by the application server comprises decryption of encrypted data by the application server.

J9. A smoking substitute system, comprising a smoking substitute device according to at least one of the preceding statements, and a mobile device in communicative connection with the smoking substitute device, and in particular an application server in communicative connection with the mobile device via a network.

J10. The smoking substitute system according to the preceding statement, wherein the mobile device is adapted to be connectable to an application server for communicating with the application server via a network; wherein at least part of the first data is transmitted to the application server and is processed by the application server; and wherein at least part of the second data is processed by the mobile device.

J11. The smoking substitute system according to at least one of the preceding statements, wherein processing data by the mobile device comprises decryption of encrypted data by the mobile device, and/or wherein processing data by the application server comprises decryption of encrypted data by the application server.

J12. The smoking substitute system according to at least one of the preceding statements, wherein the first data is decryptable by the application server, and/or wherein the second data is decryptable by the mobile device.

J13. A method of communicating of a smoking substitute device and a mobile device, wherein the smoking substitute device is adapted to be connectable to the mobile device for communicating with the mobile device, comprising transmitting first data from the smoking substitute device to the mobile device; and transmitting second data to the mobile device;

wherein the first data comprises encrypted data; and wherein the second data comprises at least one of non-encrypted data, and data that is encrypted differently to the first data.

J14. The method according to the preceding statement, comprising communicating with the application server via a network;

transmitting at least part of the first data to the application server for processing by the application server; in particular transmitting at least part of the processed data to the mobile device.

J15. The method according to at least one of the preceding statements, wherein the first data is decrypted by the application server, and/or wherein the second data is decrypted by the mobile device.

What is claimed is:

1. A smoking substitute device comprising a memory, a communication interface, a control unit and at least one additional component; wherein the memory is configured to store firmware data that is used by the control unit to operate the smoking substitute device;

the control unit is configured to identify user data that is generated during operation of the smoking substitute device as either user specific data or global device data;

the memory is further configured to store both the user specific data and the global device data that is generated during operation of the smoking substitute device;

the control unit is operable to cause the communication interface to transmit user data stored in the memory to an external device;

the control unit is configured to delete only the user specific data stored in the memory upon identification of a reset operation, wherein the reset operation is a predetermined manipulation of said additional component or receipt by the communication interface of a reset command from the external device.

2. The smoking substitute device of claim 1, wherein the communication interface is a wireless interface and the control unit is configured to store details of the external device as a connected external device as user data in the memory.

3. The smoking substitute device of claim 1, wherein an additional component is an actuator that is manipulated by a user pressing the actuator.

4. The smoking substitute device of claim 1, wherein an additional component is a motion sensor that is activated by movement of the smoking substitute device.

5. The smoking substitute device of claim 1, wherein the body houses a further additional component and the further additional component is an airflow sensor for detecting airflow through the body, wherein the control unit monitors the airflow sensor to determine an inhale event, wherein each inhale event is logged as user data to count a number of inhale events.

6. The smoking substitute device of claim 1, wherein the smoking substitute device comprises a further additional component and the further additional component is an airflow sensor for detecting airflow through the body, wherein the control unit monitors the airflow sensor to determine an inhale event, wherein the duration of each inhale event is recorded as user data to record the inhale duration.

7. The smoking substitute device of claim 1, wherein the smoking substitute device comprises a power source and control circuitry for controlling charging of the power source, and the control unit monitors the control circuitry to log or record as user data charge duration and/or charge status and/or voltage of the power source.

8. The smoking substitute device of claim 1, wherein the control unit logs as user data an error count and/or a reset operation count.

9. The smoking substitute device of claim 1, wherein the smoking substitute device comprises body including a coupling portion arranged to receive a consumable and the control unit logs as user data a count of inserted consumables and/or records as user data details read from each inserted consumable.

10. The smoking substitute device of claim 1, wherein global device data is a count of user data over a time period equal to the lifetime operation of the smoking substitute device.

11. The smoking substitute device of claim 1, wherein user specific data is a count of user data over a time period of operation of the smoking substitute device since a first operation or, if a reset operation has been completed, since the reset operation.

12. A method of managing a smoking substitute device, the method comprising the steps of;

identifying user data generated during operation of the smoking substitute device as being either user specific or global device data;

storing both the user specific data and the global device data generated during operation of the smoking substitute device in a memory, causing a communication interface to transmit user data stored in the memory to an external device, deleting only the user specific data from the memory upon identification of a reset operation input, wherein the step of deleting user data includes at least one of identifying a user manipulation of an additional component as replicating a predetermined user manipulation of the additional component or receiving at the communication interface a reset command.

13. A non-transitory computer-readable medium containing computer-readable instructions which, when executed by a processor, cause the processor to perform a method of managing a smoking substitute device, the method comprising the steps of;

identifying user data generated during operation of the smoking substitute device as being either user specific or global device data;

storing both the user specific data and the global device data generated during operation of the smoking substitute device in a memory, causing a communication interface to transmit user data stored in the memory to an external device, deleting only the user specific data from the memory upon identification of a reset operation input, wherein the step of deleting user data includes at least one of identifying a user manipulation of an additional component as replicating a predetermined user manipulation of the additional component or receiving at the communication interface a reset command.

* * * * *